US005752880A

United States Patent [19]

Gabai et al.

[11] Patent Number: 5,752,880

[45] Date of Patent: May 19, 1998

[54] INTERACTIVE DOLL

[75] Inventors: Oz Gabai; Jacob Gabai; Moshe Cohen, all of Tel Aviv, Israel

[73] Assignee: Creator Ltd., Herzlia, Israel

[21] Appl. No.: 561,316

[22] Filed: Nov. 20, 1995

[51] Int. Cl.[6] ..... A63F 9/22; G09B 5/06; A63H 3/28

[52] U.S. Cl. ..... 463/1; 463/35; 463/39; 434/308; 446/301; 446/298

[58] Field of Search ..... 463/1, 9, 30–31, 463/35–36, 39, 40; 446/775, 297, 298, 397, 401, 405, 301, 300; 434/307 R, 308; 364/410

[56] References Cited

U.S. PATENT DOCUMENTS

| | | | |
|---|---|---|---|
| 4,334,221 | 6/1982 | Rosenhagen et al. | 463/39 |
| 4,729,563 | 3/1988 | Yokoi | 446/175 |
| 4,786,967 | 11/1988 | Smith, III et al. | 358/143 |
| 4,799,171 | 1/1989 | Cummings | 446/175 |
| 4,846,693 | 7/1989 | Baer | 434/308 |
| 4,875,096 | 10/1989 | Baer et al. | 358/143 |
| 4,913,676 | 4/1990 | Koguchi et al. . | |
| 4,930,019 | 5/1990 | Chu | 434/307 R |
| 5,029,214 | 7/1991 | Hollander | 446/175 |
| 5,279,514 | 1/1994 | Lacombe et al. | 446/297 |
| 5,636,994 | 6/1997 | Tong | 434/308 |

OTHER PUBLICATIONS

BYTE Publication, Feb. 1981, article "A Computer Controlled Tank", by Steve Ciarcia, pp. 44–48, 50, 52, 54–55, 58, 60, 62 and 64.

*Primary Examiner*—Jessica Harrison
*Assistant Examiner*—Mark A. Sager
*Attorney, Agent, or Firm*—Ladas & Parry

[57] ABSTRACT

Apparatus for a wireless computer controlled toy system is disclosed, the apparatus including a computer system operative to transmit a first transmission via a first wireless transmitter and at least one toy including a first wireless receiver, the toy receiving the first transmission via the first wireless receiver and operative to carry out at least one action based on said first transmission. A method for controlling the toy system is also disclosed.

37 Claims, 59 Drawing Sheets

INTERACTIVE DOLL

FIELD OF THE INVENTION

The present invention relates to toys in general, and particularly to toys used in conjunction with a computer system.

BACKGROUND OF THE INVENTION

Toys which are remotely controlled by wireless communication and which are not used in conjunction with a computer system are well known in the art. Typically, such toys include vehicles whose motion is controlled by a human user via a remote control device.

U.S. Pat. No. 4,712,184 to Haugerud describes a computer controlled educational toy, the construction of which teaches the user computer terminology and programming and robotic technology. Haugerud describes computer control of a toy via a wired connection, wherein the user of the computer typically writes a simple program to control movement of a robot.

U.S. Pat. No. 4,840,602 to Rose describes a talking doll responsive to an external signal, in which the doll has a vocabulary stored in digital data in a memory which may be accessed to cause a speech synthesizer in the doll to simulate speech.

U.S. Pat. No. 5,021,878 to Lang describes an animated character system with real-time control.

U.S. Pat. No. 5,142,803 to Lang describes an animated character system with real-time control.

U.S. Pat. No. 5,191,615 to Aldava et al. describes an interrelational audio kinetic entertainment system in which movable and audible toys and other animated devices spaced apart from a television screen are provided with program synchronized audio and control data to interact with the program viewer in relationship to the television program.

U.S. Pat. No. 5,195,920 to Collier describes a radio controlled toy vehicle which generates realistic sound effects on board the vehicle. Communications with a remote computer allows an operator to modify and add new sound effects.

U.S. Pat. No. 5,270,480 to Hikawa describes a toy acting in response to a MIDI signal, wherein an instrument-playing toy performs simulated instrument playing movements.

U.S. Pat. No. 5,289,273 to Lang describes a system for remotely controlling an animated character. The system uses radio signals to transfer audio, video and other control signals to the animated character to provide speech, hearing vision and movement in real-time.

U.S. Pat. No. 5,388,493 describes a system for a housing for a vertical dual keyboard MIDI wireless controller for accordionists. The system may be used with either a conventional MIDI cable connection or by a wireless MIDI transmission system.

German Patent DE 3009-040 to Neuhierl describes a device for adding the capability to transmit sound from a remote control to a controlled model vehicle. The sound is generated by means of a microphone or a tape recorder and transmitted to the controlled model vehicle by means of radio communications. The model vehicle is equipped with a speaker that emits the received sounds.

SUMMARY OF THE INVENTION

The present invention seeks to provide an improved toy system for use in conjunction with a computer system.

There is thus provided in accordance with a preferred embodiment of the present invention a wireless computer controlled toy system including a computer system operative to transmit a first transmission via a first wireless transmitter and at least one toy including a first wireless receiver, the toy receiving the first transmission via the first wireless receiver and operative to carry out at least one action based on the first transmission.

The computer system may include a computer game. The toy may include a plurality of toys, and the at least one action may include a plurality of actions.

The first transmission may include a digital signal. The first transmission includes an analog signal and the analog signal may include sound.

Additionally in accordance with a preferred embodiment of the present invention the computer system includes a computer having a MIDI port and wherein the computer may be operative to transmit the digital signal by way of the MIDI port.

Additionally in accordance with a preferred embodiment of the present invention the sound includes music, a prerecorded sound and/or speech. The speech may include recorded speech and synthesized speech.

Further in accordance with a preferred embodiment of the present invention the at least one toy has a plurality of states including at least a sleep state and an awake state, and the first transmission includes a state transition command, and the at least one action includes transitioning between the sleep state and the awake state.

A sleep state may typically include a state in which the toy consumes a reduced amount of energy and/or in which the toy is largely inactive, while an awake state is typically a state of normal operation.

Still further in accordance with a preferred embodiment of the present invention the first transmission includes a control command chosen from a plurality of available control commands based, at least in part, on a result of operation of the computer game.

Additionally in accordance with a preferred embodiment of the present invention the computer system includes a plurality of computers.

Additionally in accordance with a preferred embodiment of the present invention the first transmission includes computer identification data and the second transmission includes computer identification data.

Additionally in accordance with a preferred embodiment of the present invention the at least one toy is operative to transmit a second transmission via a second wireless transmitter and the computer system is operative to receive the second transmission via a second wireless receiver.

Moreover in accordance with a preferred embodiment of the present invention the system includes at least one input device and the second transmission includes a status of the at least one input device.

Additionally in accordance with a preferred embodiment of the invention the at least one toy includes at least a first toy and a second toy, and wherein the first toy is operative to transmit a toy-to-toy transmission to the second toy via the second wireless transmitter, and wherein the second toy is operative to carry out at least one action based on the toy-to-toy transmission.

Further in accordance with a preferred embodiment of the present invention operation of the computer system is controlled, at least in part, by the second transmission.

Moreover in accordance with a preferred embodiment of the present invention the computer system includes a computer game, and wherein operation of the game is controlled, at least in part, by the second transmission.

The second transmission may include a digital signal and/or an analog signal.

Still further in accordance with a preferred embodiment of the present invention the computer system has a plurality of states including at least a sleep state and an awake state, and the second transmission include a state transition command, and the computer is operative, upon receiving the second transmission, to transition between the sleep state and the awake state.

Still further in accordance with a preferred embodiment of the present invention at least one toy includes sound input apparatus, and the second transmission includes a sound signal which represents a sound input via the sound input apparatus.

Additionally in accordance with a preferred embodiment of the present invention the computer system is also operative to perform at least one of the following actions: manipulate the sound signal; and play the sound signal.

Additionally in accordance with a preferred embodiment of the present invention the sound includes speech, and the computer system is operative to perform a speech recognition operation on the speech.

Further in accordance with a preferred embodiment of the present invention the second transmission includes toy identification data, and the computer system is operative to identify the at least one toy based, at least in part, on the toy identification data.

Still further in accordance with a preferred embodiment of the present invention the first transmission includes toy identification data. The computer system may adapt a mode of operation thereof based, at least in part, on the toy identification data.

Still further in accordance with a preferred embodiment of the present invention the at least one action may include movement of the toy, movement of a part of the toy and/or an output of a sound. The sound may be transmitted using a MIDI protocol.

There is also provided in accordance with another preferred embodiment of the present invention a game system including a computer system operative to control a computer game and having a display operative to display at least one display object, and at least one toy in wireless communication with the computer system, the computer game including a plurality of game objects, and the plurality of game objects includes the at least one display object and the at least one toy.

Further in accordance with a preferred embodiment of the present invention the at least one toy is operative to transmit toy identification data to the computer system, and the computer system is operative to adapt a mode of operation of the computer game based, at least in part, on the toy identification data.

The computer system may include a plurality of computers.

Additionally in accordance with a preferred embodiment of the present invention the first transmission includes computer identification data and the second transmission includes computer identification data.

There is also provided in accordance with a preferred embodiment of the present invention a data transmission apparatus including first wireless apparatus including musical instrument data interface (MIDI) apparatus operative to receive and transmit MIDI data between a first wireless and a first MIDI device and second wireless apparatus including MIDI apparatus operative to receive and transmit MIDI data between a second wireless and a second MIDI device, the first wireless apparatus is operative to transmit MIDI data including data received from the first MIDI device to the second wireless apparatus, and to transmit MIDI data including data received from the second wireless apparatus to the first MIDI device, and the second wireless apparatus is operative to transmit MIDI data including data received from the second MIDI device to the first wireless apparatus, and to transmit MIDI data including data received from the first wireless apparatus to the second MIDI device.

Further in accordance with a preferred embodiment of the present invention the second wireless apparatus includes a plurality of wirelesses each respectively associated with one of the plurality of MIDI devices, and each of the second plurality of wirelesses is operative to transmit MIDI data including data received from the associated MIDI device to the first wireless apparatus, and to transmit MIDI data including data received from the first wireless apparatus to the associated MIDI device.

The first MIDI device may include a computer, while the second MIDI device may include a toy.

Additionally in accordance with a preferred embodiment of the present invention the first wireless apparatus also includes analog interface apparatus operative to receive and transmit analog signals between the first wireless and a first analog device, and the second wireless apparatus also includes analog interface apparatus operative to receive and transmit analog signals between the second wireless and a second analog device, and the first wireless apparatus is also operative to transmit analog signals including signals received from the first analog device to the second wireless apparatus, and to transmit analog signal including signals received from the second wireless apparatus to the first analog device, and the second wireless apparatus is also operative to transmit analog signals including signals received from the second analog device to the first wireless apparatus, and to transmit analog signals including data received from the first wireless apparatus to the second analog device.

There is also provided in accordance with another preferred embodiment of the present invention a method for generating control instructions for a computer controlled toy system, the method includes selecting a toy, selecting at least one command from among a plurality of commands associated with the toy, and generating control instructions for the toy including the at least one command.

Further in accordance with a preferred embodiment of the present invention the step of selecting at least one command includes choosing a command, and specifying at least one control parameter associated with the chosen command.

Still further in accordance with a preferred embodiment of the present invention the at least one control parameter includes at least one condition depending on a result of a previous command.

Additionally in accordance with a preferred embodiment of the present invention at least one of the steps of selecting a toy and the step of selecting at least one command includes utilizing a graphical user interface.

Still further in accordance with a preferred embodiment of the present invention the previous command includes a previous command associated with a second toy.

Additionally in accordance with a preferred embodiment of the present invention the at least one control parameter includes an execution condition controlling execution of the command.

The execution condition may include a time at which to perform the command and/or a time at which to cease performing the command. The execution condition may also include a status of the toy.

Additionally in accordance with a preferred embodiment of the present invention the at least one control parameter includes a command modifier modifying execution of the command.

Still further in accordance with a preferred embodiment of the present invention the at least one control parameter includes a condition dependent on a future event.

Additionally in accordance with a preferred embodiment of the present invention the at least one command includes a command to cancel a previous command.

There is also provided for in accordance with a preferred embodiment of the present invention a signal transmission apparatus for use in conjunction with a computer, the apparatus including wireless transmission apparatus; and signal processing apparatus including at least one of the following analog/digital sound conversion apparatus operative to convert analog sound signals to digital sound signals, to convert digital sound signals to analog sound signals, and to transmit the signals between the computer and a sound device using the wireless transmission apparatus; a peripheral control interface operative to transmit control signals between the computer and a peripheral device using the wireless transmission apparatus; and a MIDI interface operative to transmit MIDI signals between the computer and a MIDI device using the wireless transmission apparatus.

There is also provided in accordance with another preferred embodiment of the present invention a computer system including a computer, and a sound card operatively attached to the computer and having a MIDI connector and at least one analog connecter, wherein the computer is operative to transmit digital signals by means of the MIDI connector and to transmit analog signals by means of the at least one analog connector.

Further in accordance with a preferred embodiment of the present invention the computer is also operative to receive digital signals by means of the MIDI connector and to receive analog signals by means of the at least one analog connector.

In this application the term "radio" includes all forms of "wireless" communication.

BRIEF DESCRIPTION OF THE DRAWINGS

The present invention will be understood and appreciated from the following detailed description, taken in conjunction with the drawings in which.

Figure 8A:
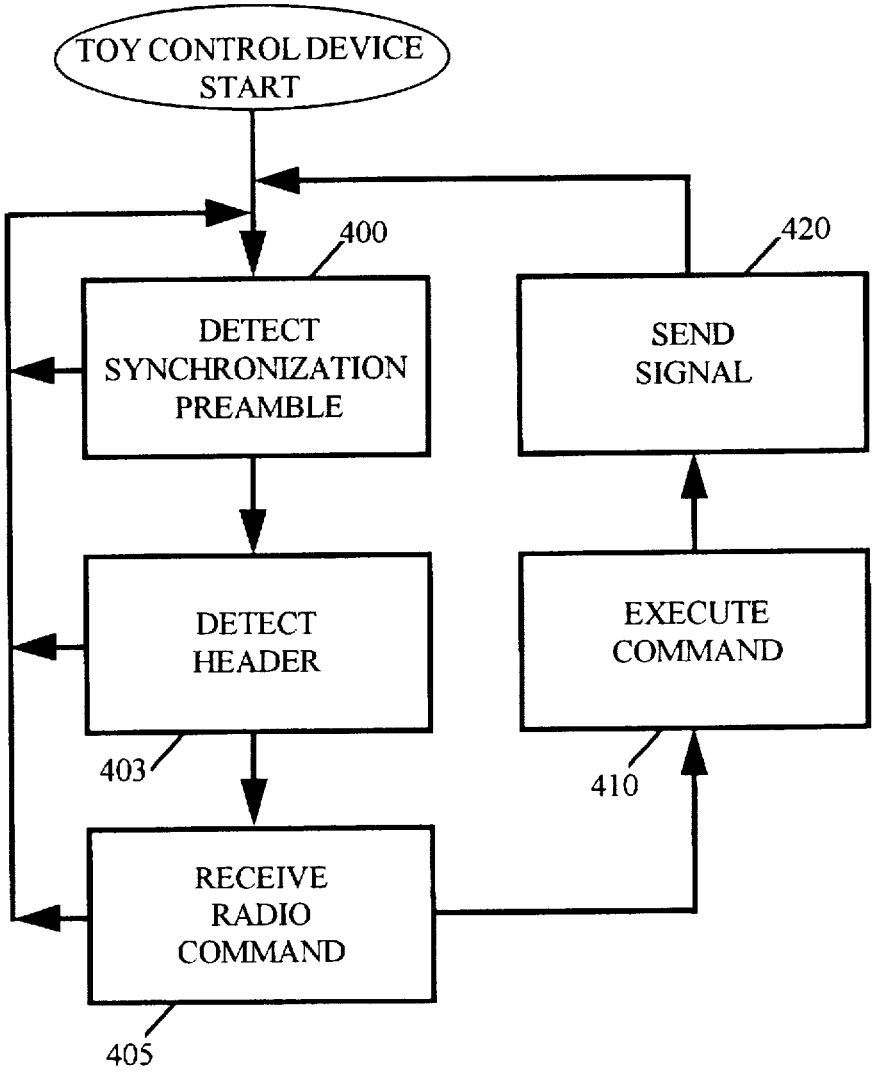
FIG. 8A is a simplified flowchart illustration of a preferred method for receiving radio signals, executing commands comprised therein, and sending radio signals, within the toy control device 130 of FIG. 1A.
Figure 8B:
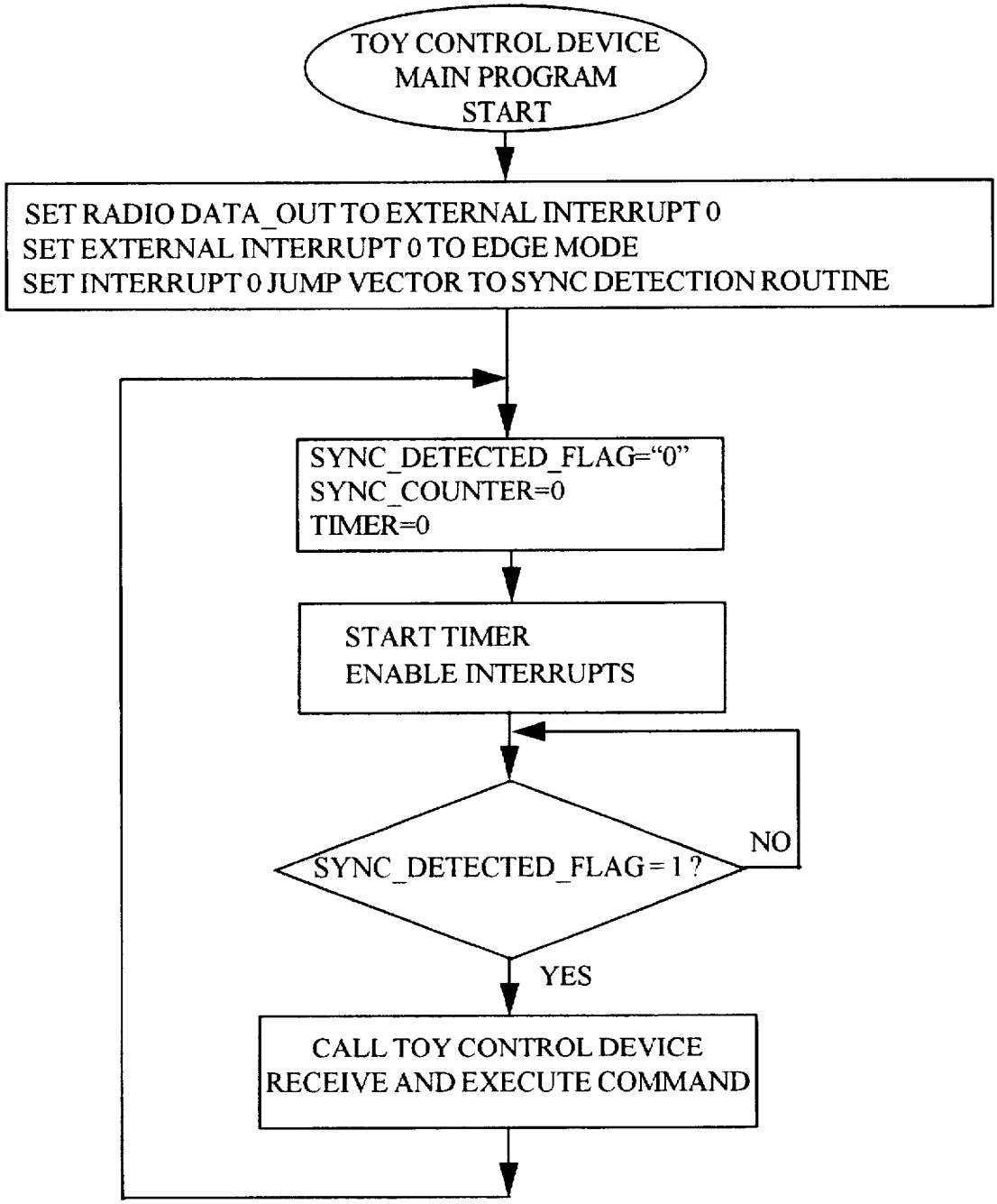
FIGS. 8B–8T, taken together, comprise a simplified flowchart illustration of a preferred implementation of the method of FIG. 8A.
Figure 8C:
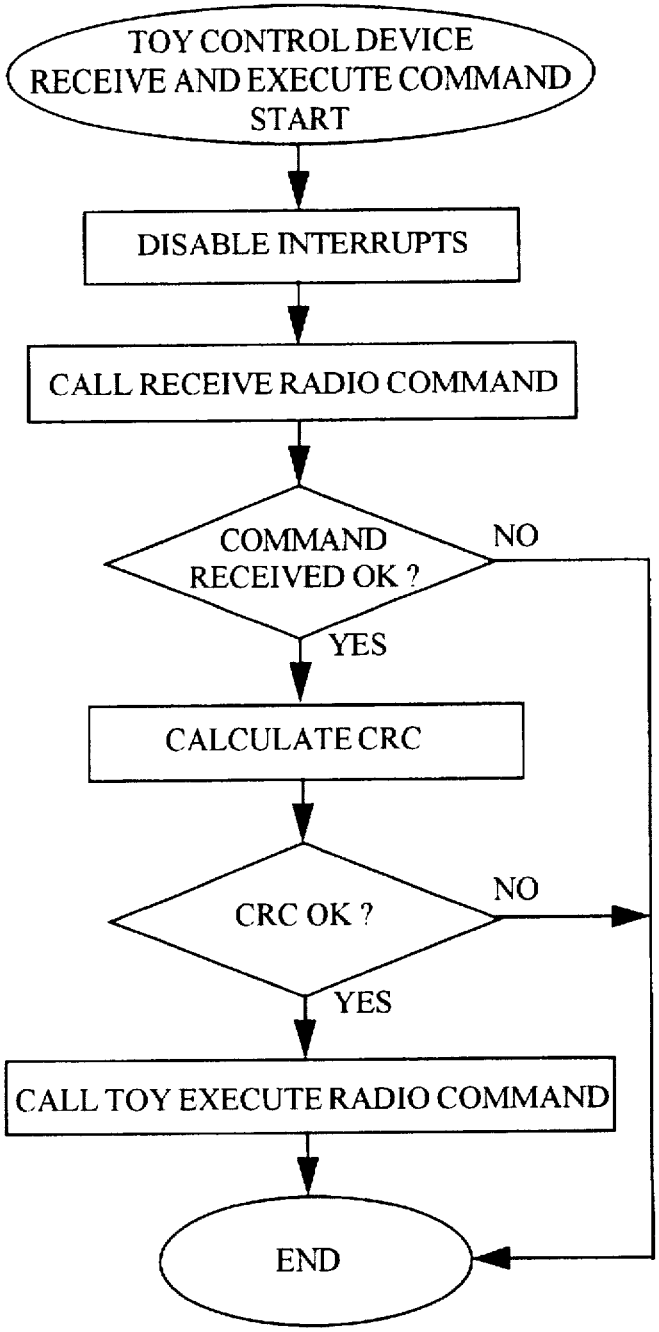
Figure 8D:
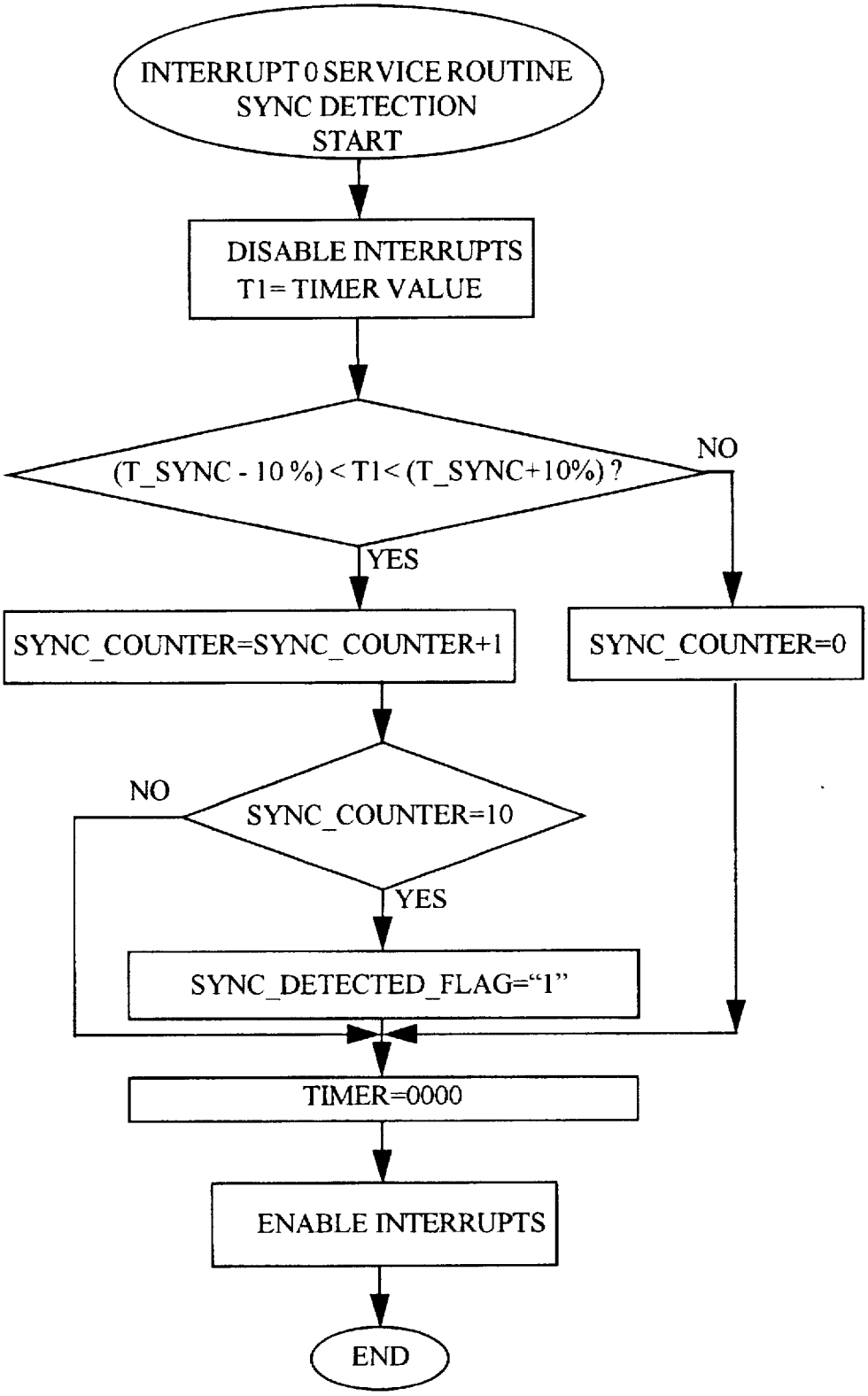
Figure 8E:
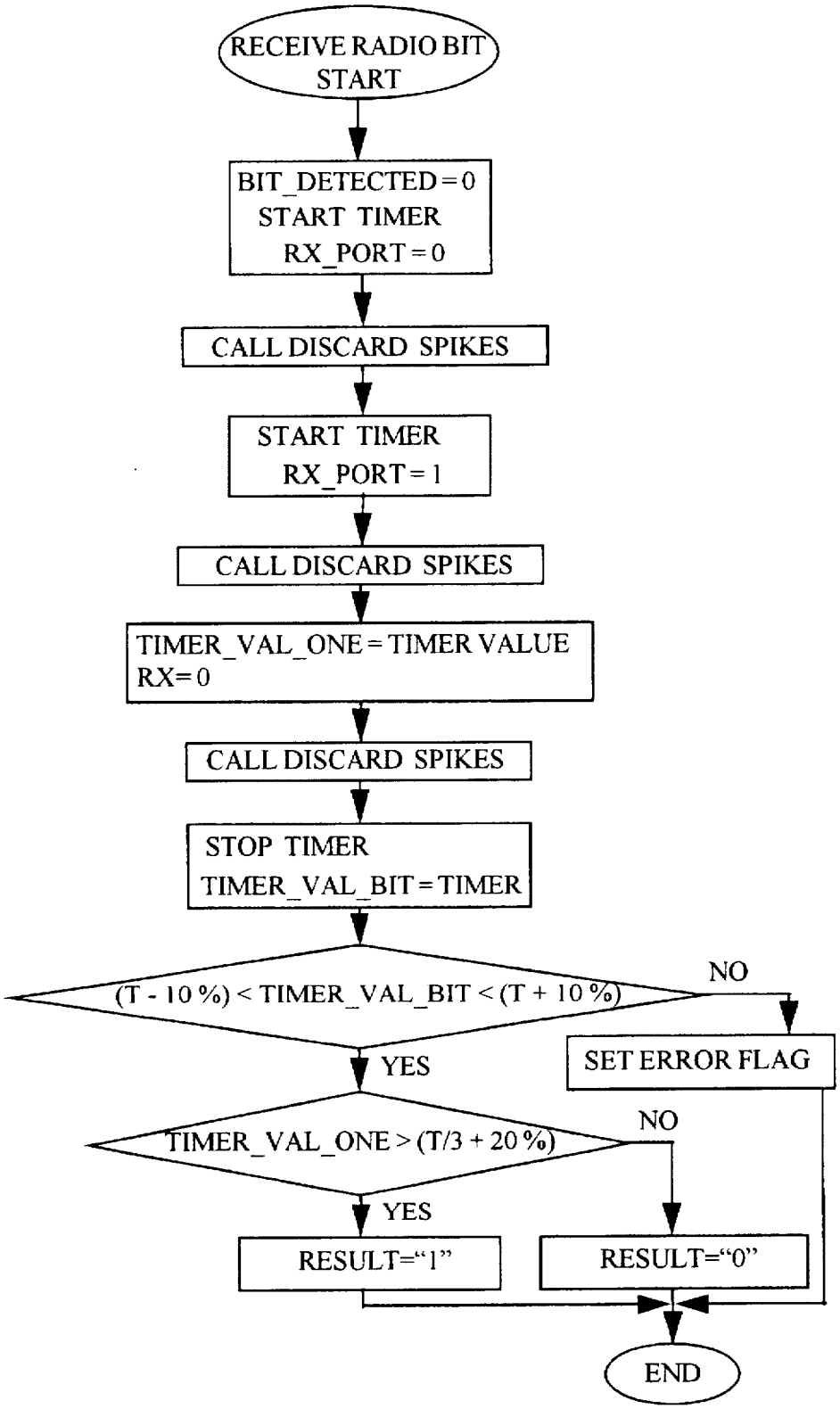
Figure 8F:
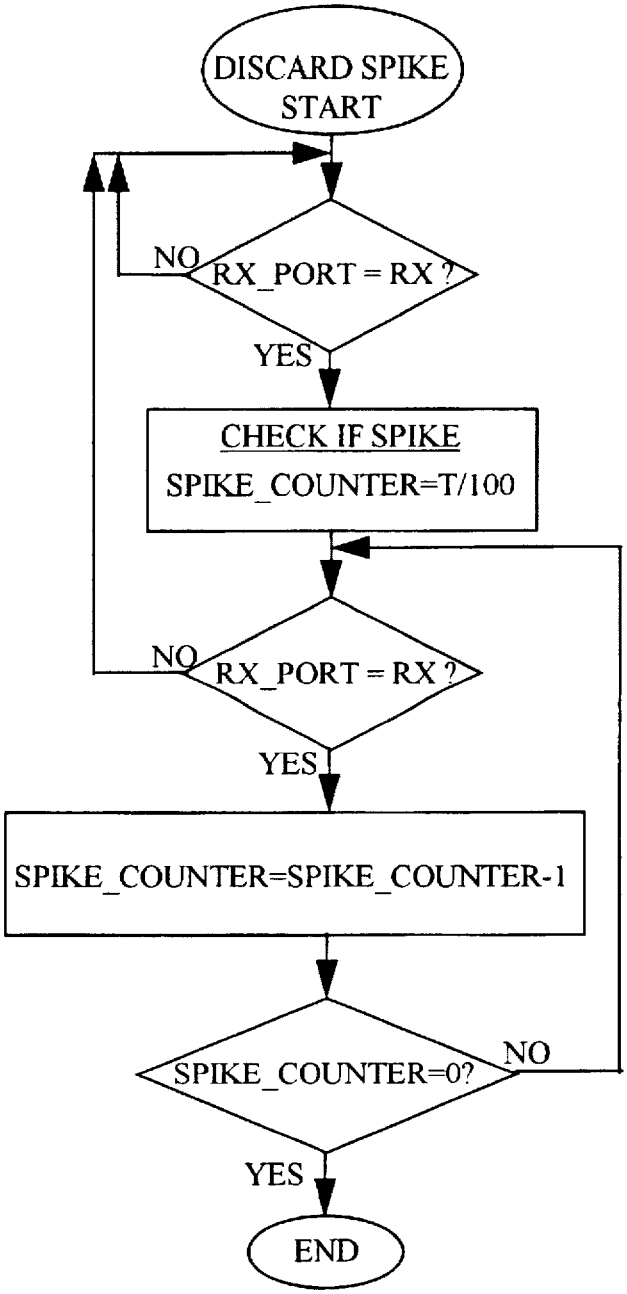
Figure 8G:
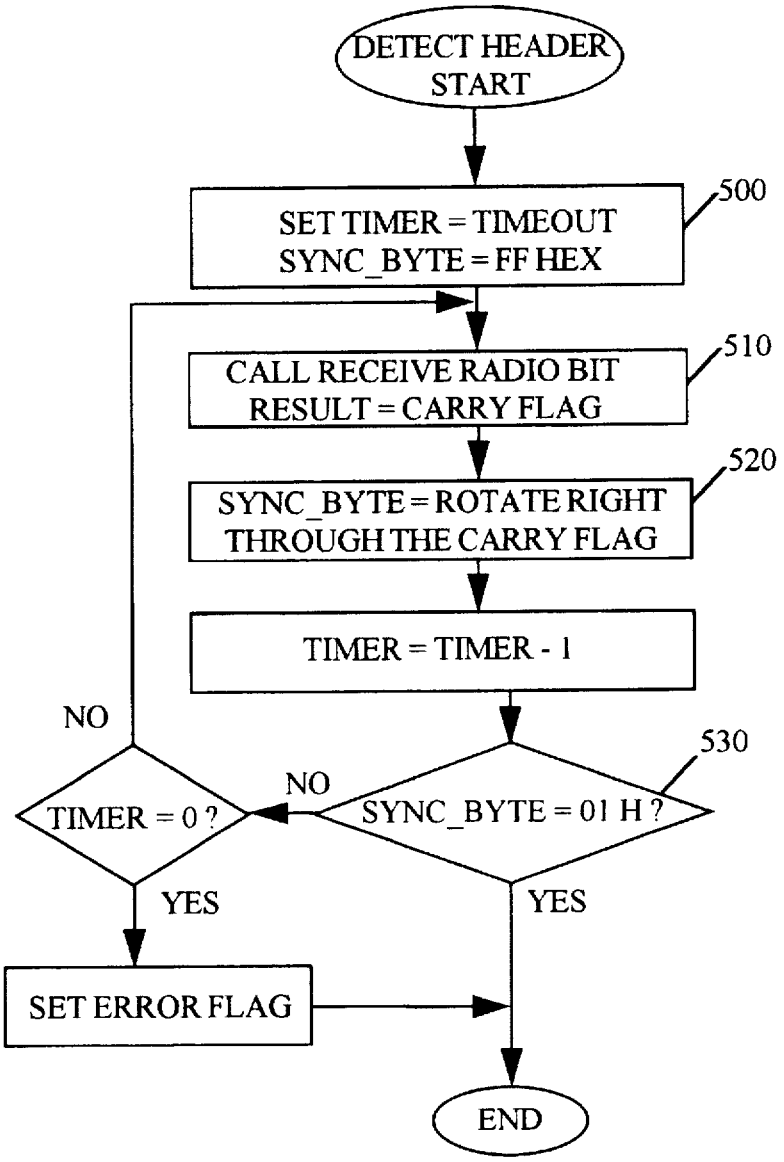
Figure 8H:
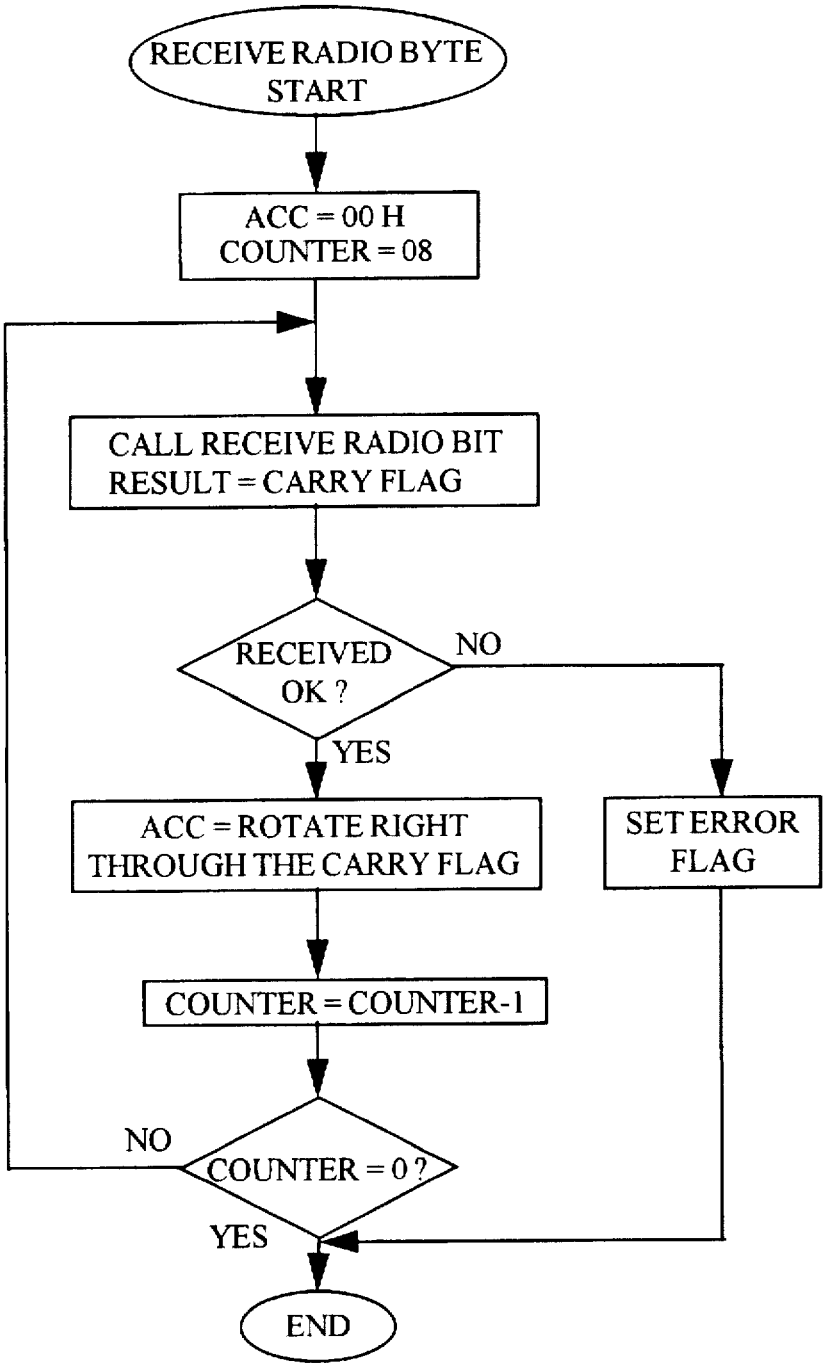
Figure 8I:
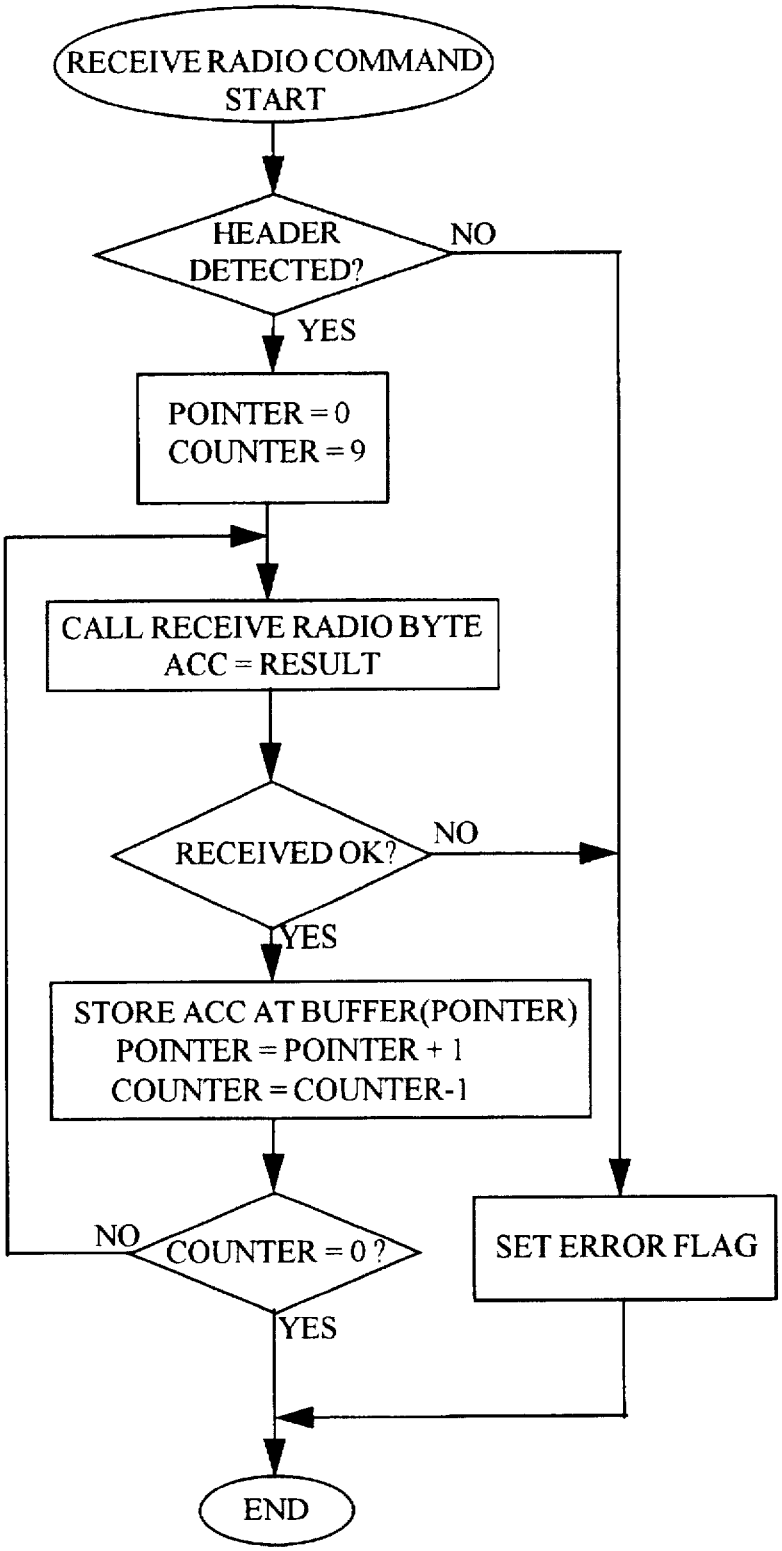
Figure 8J:
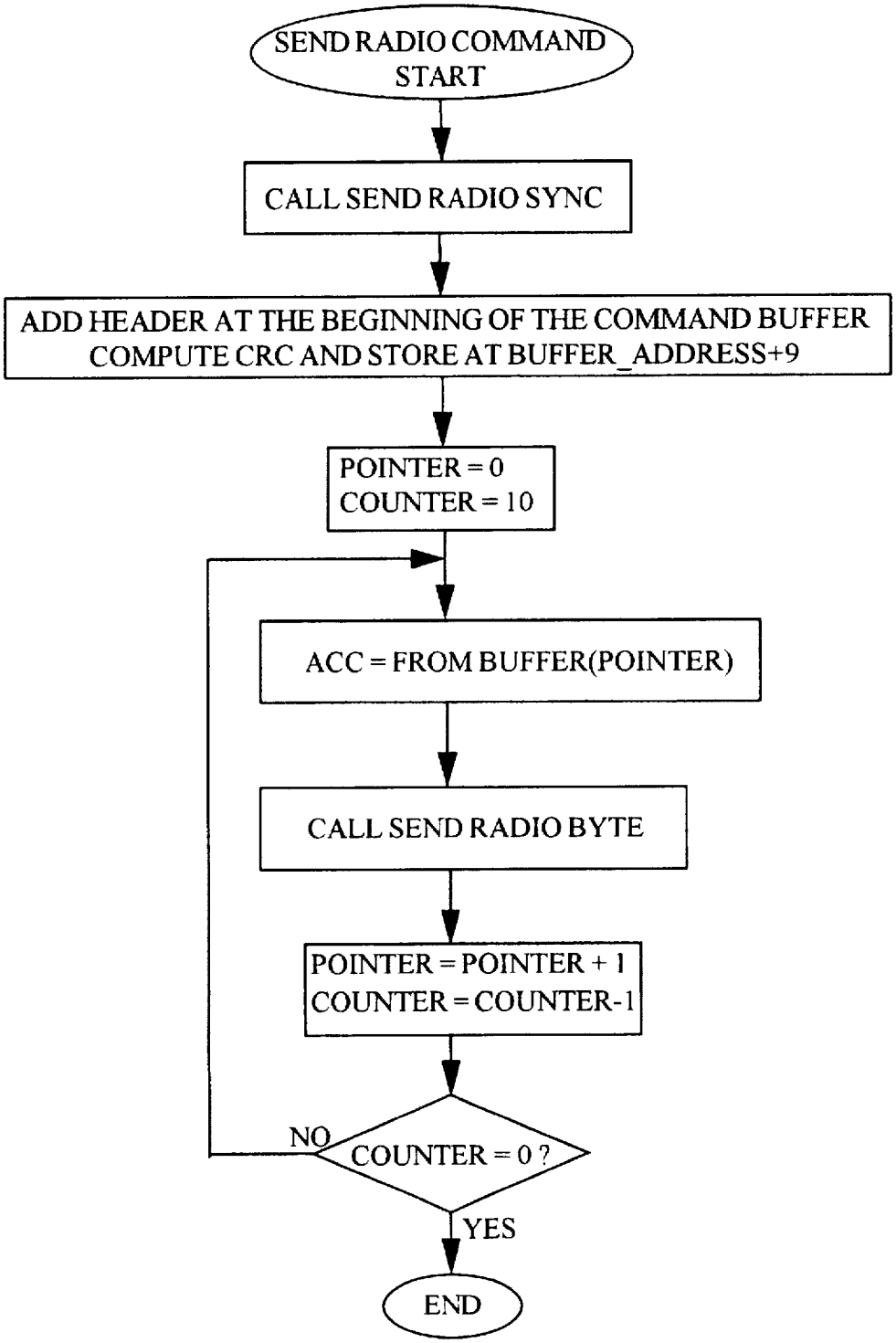
Figure 8K:
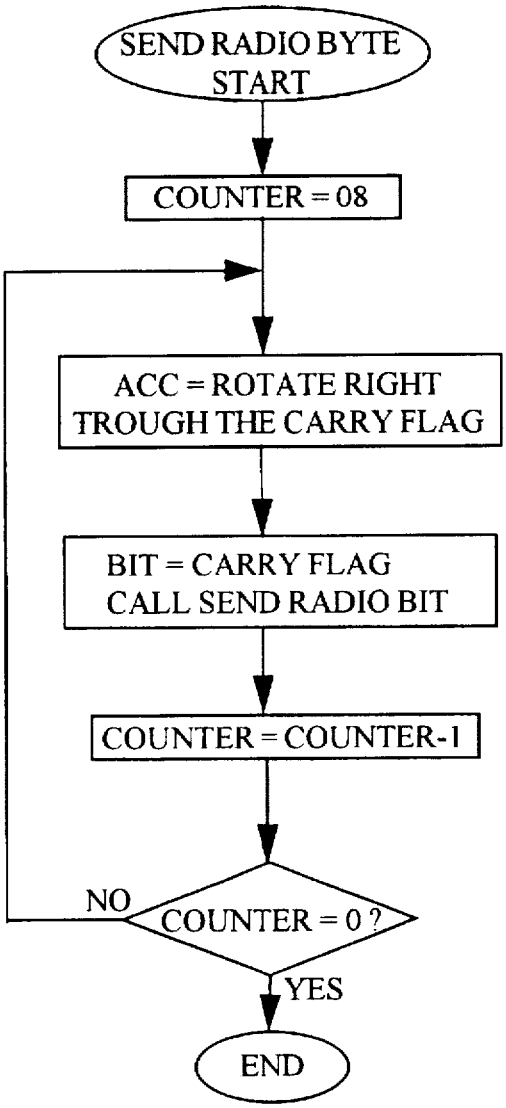
Figure 8L:
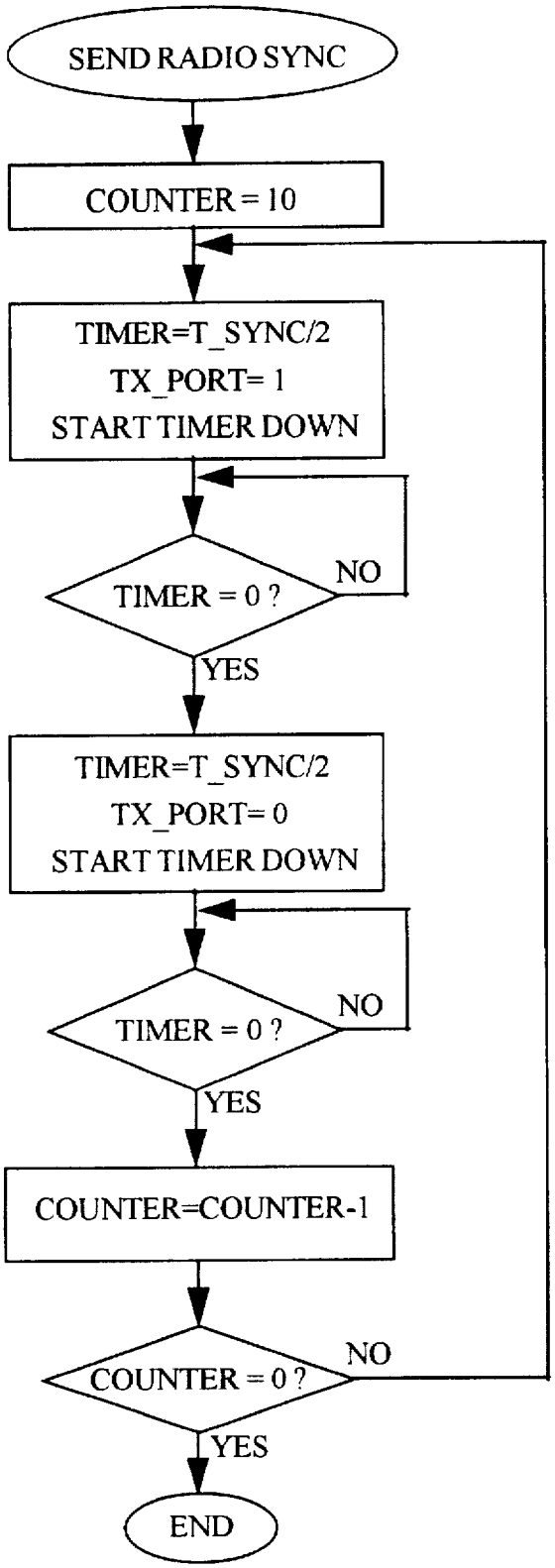
Figure 8M:
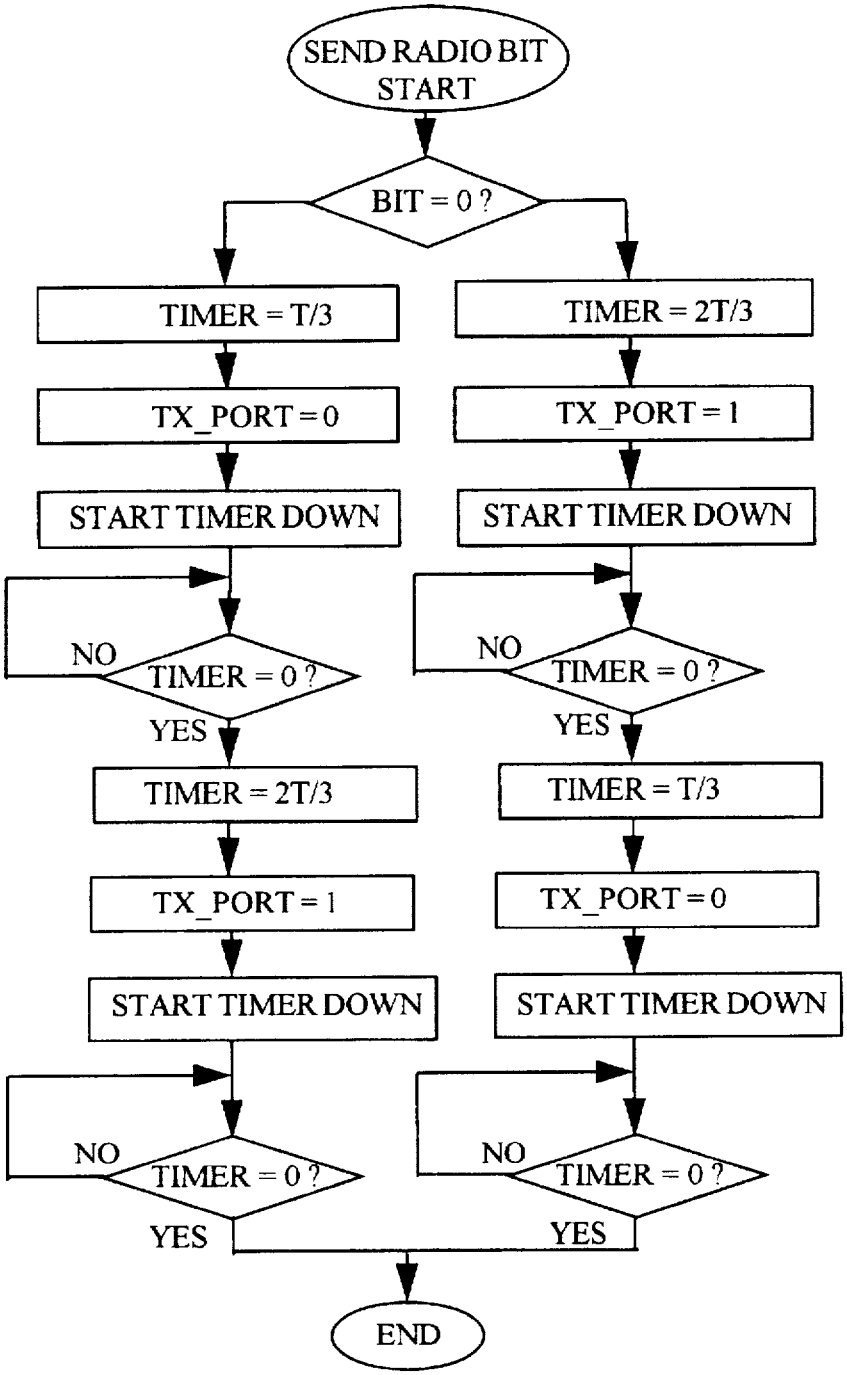
Figure 8N:
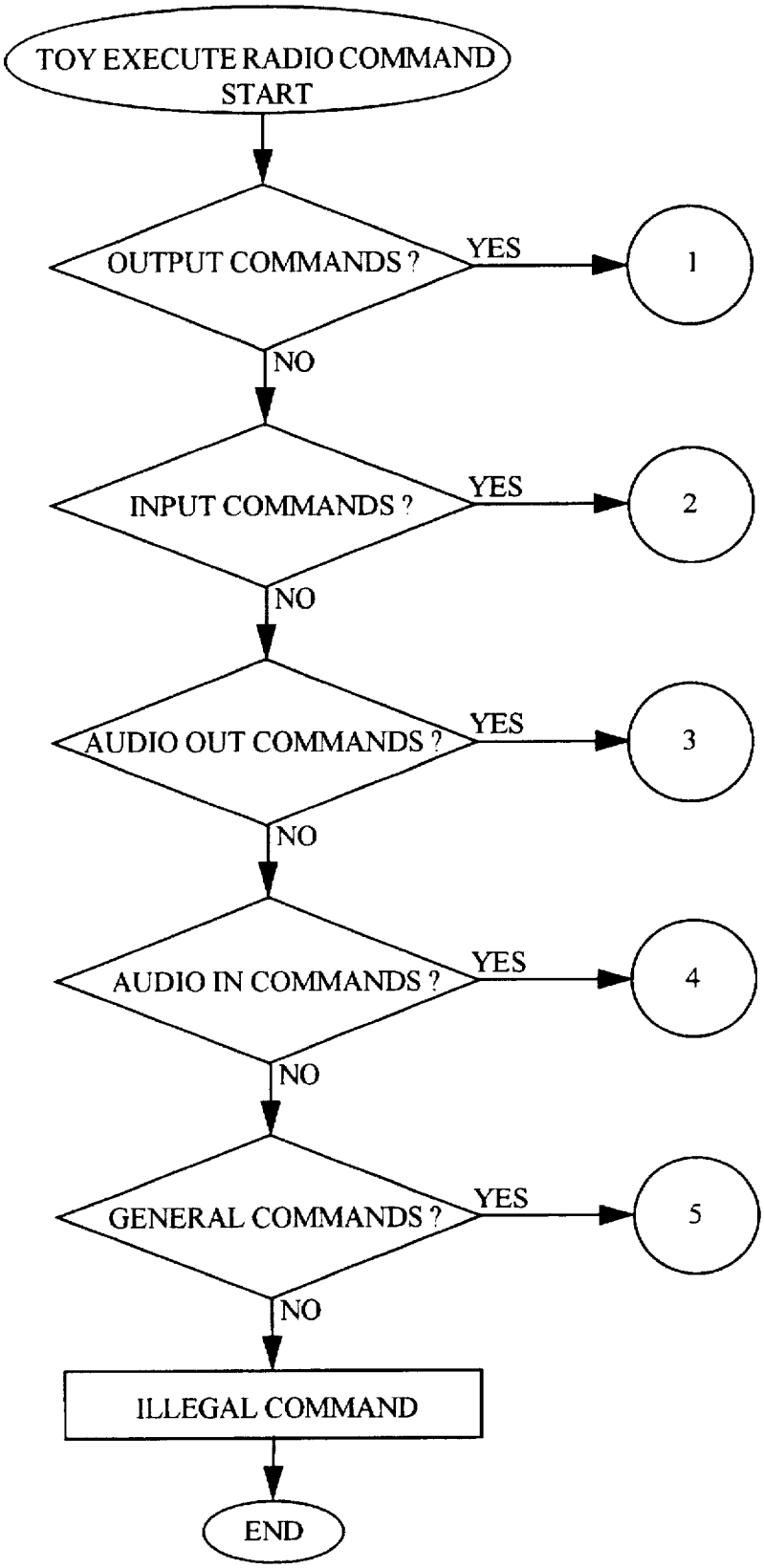
Figure 8O:
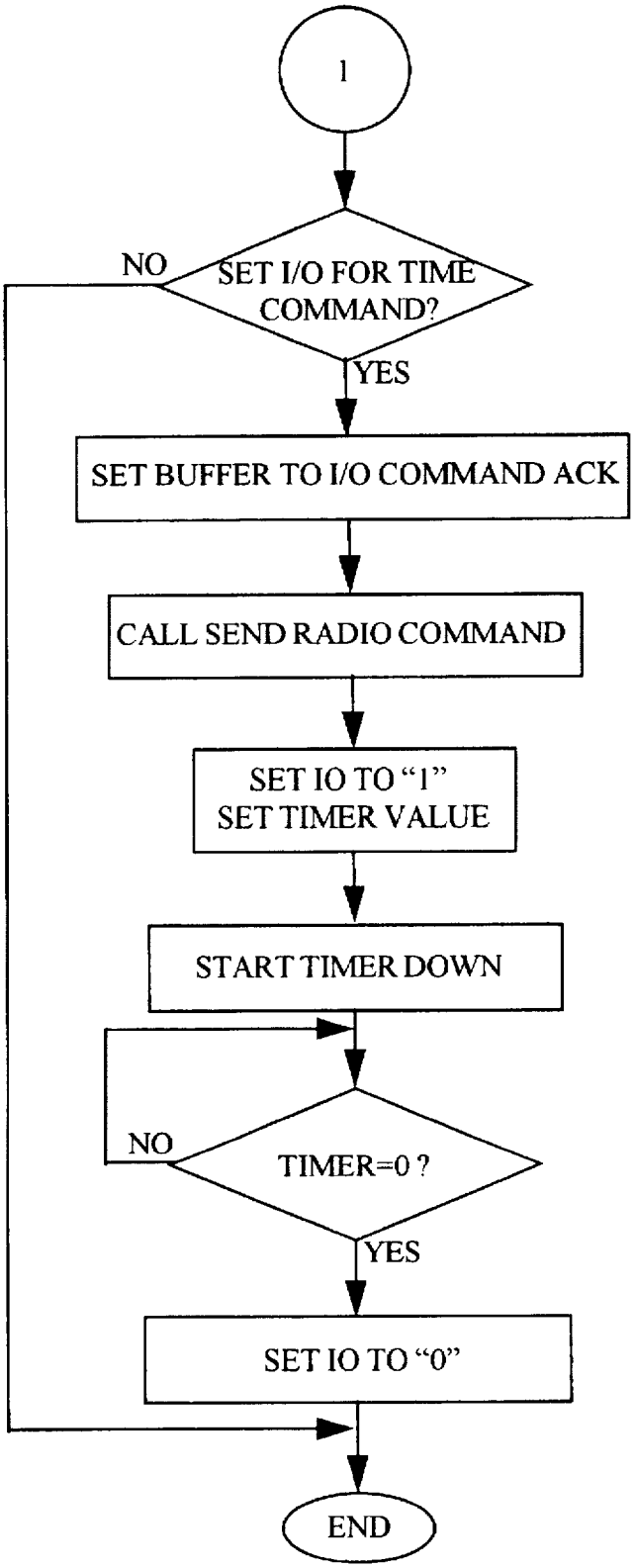
Figure 8P:
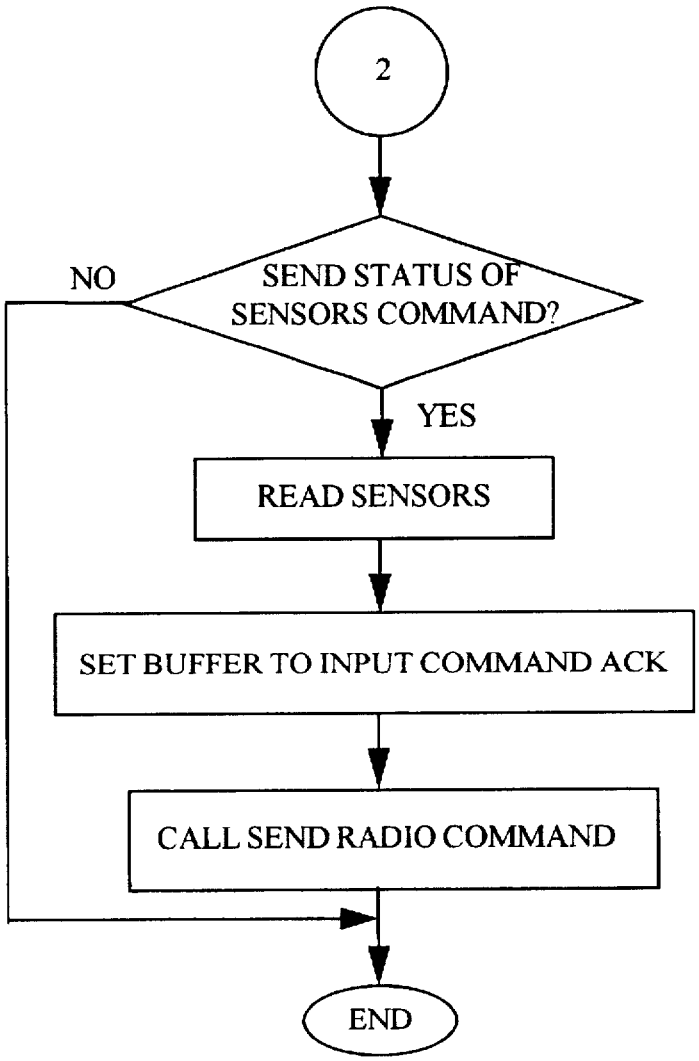
Figure 8Q:
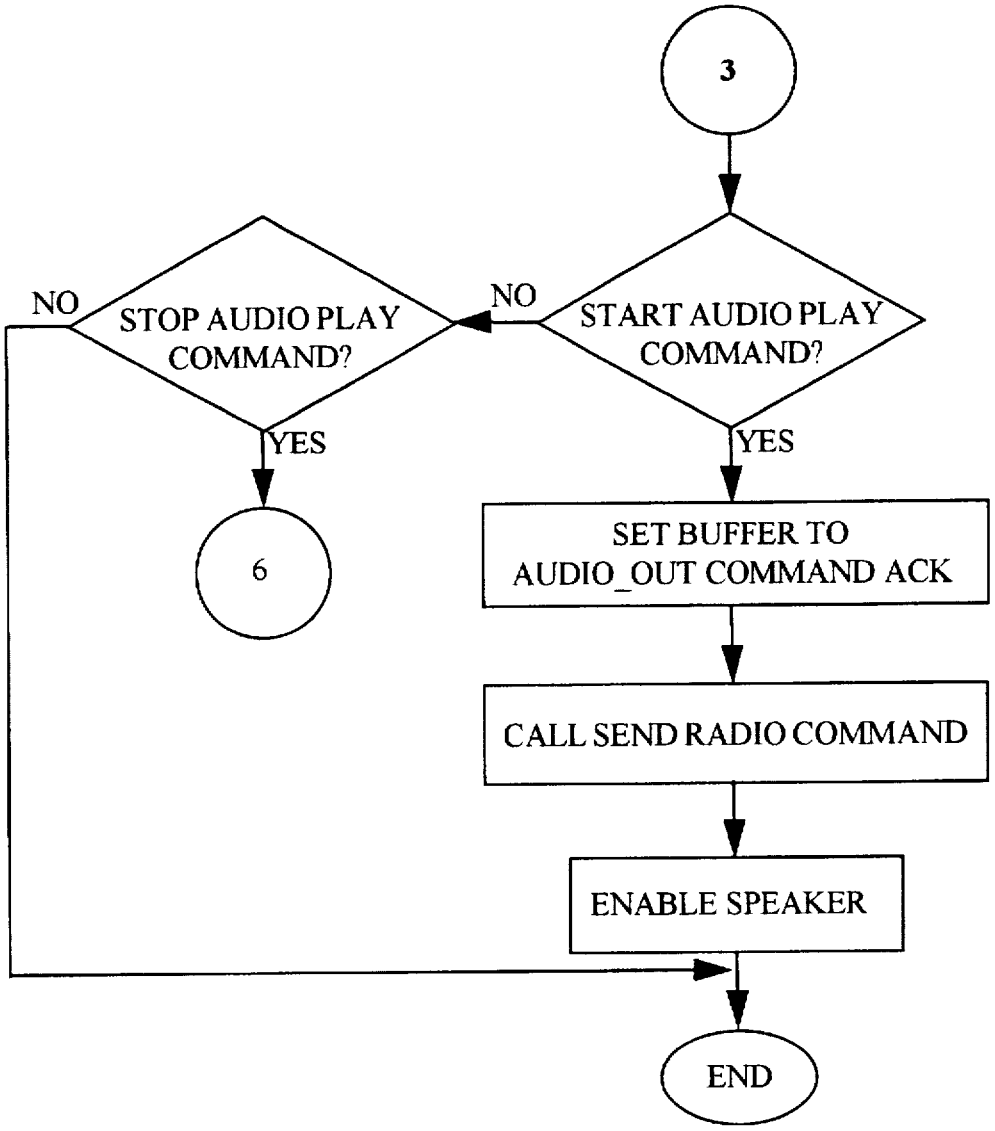
Figure 8R:
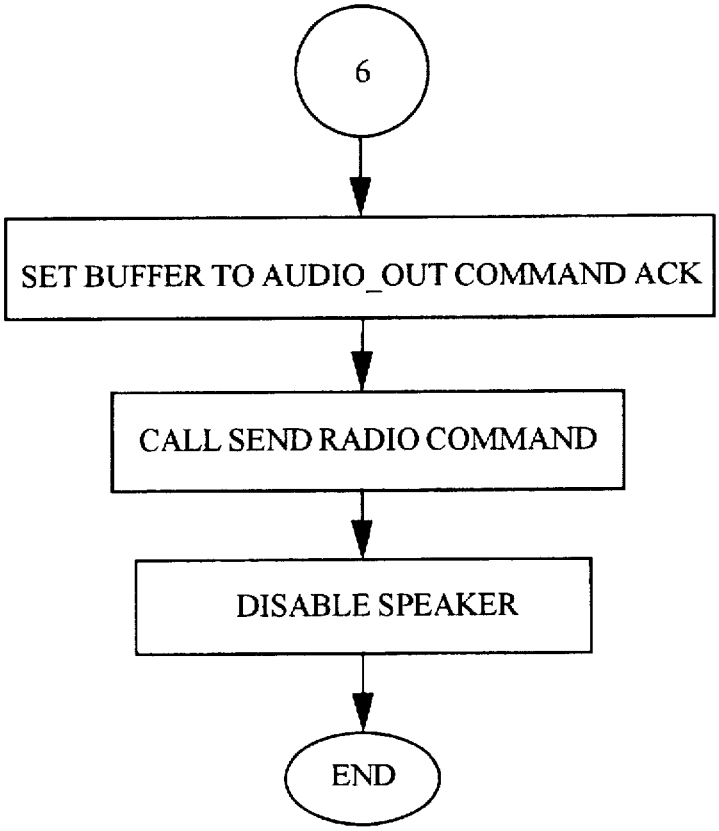
Figure 8S:
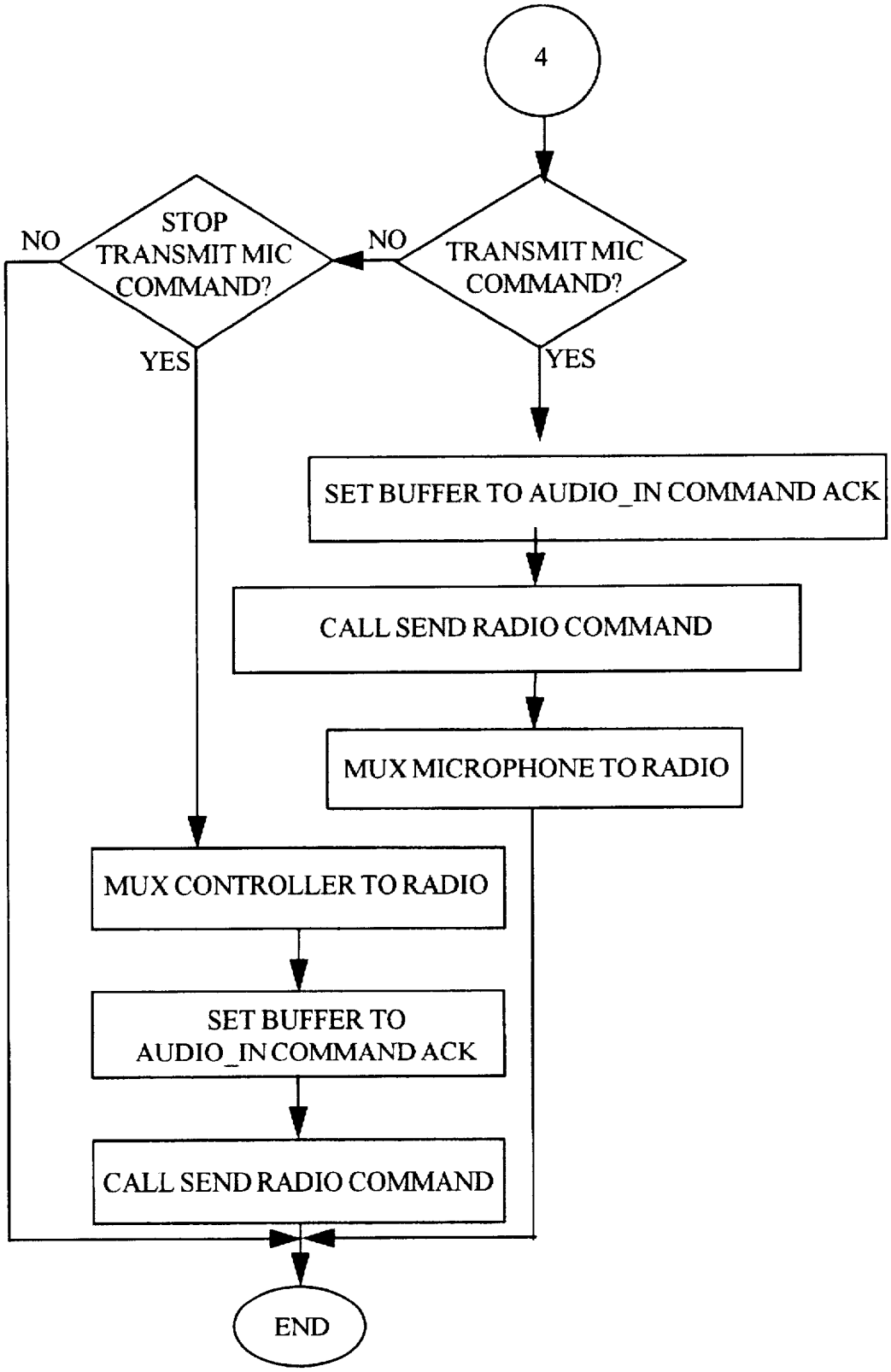
Figure 8T:
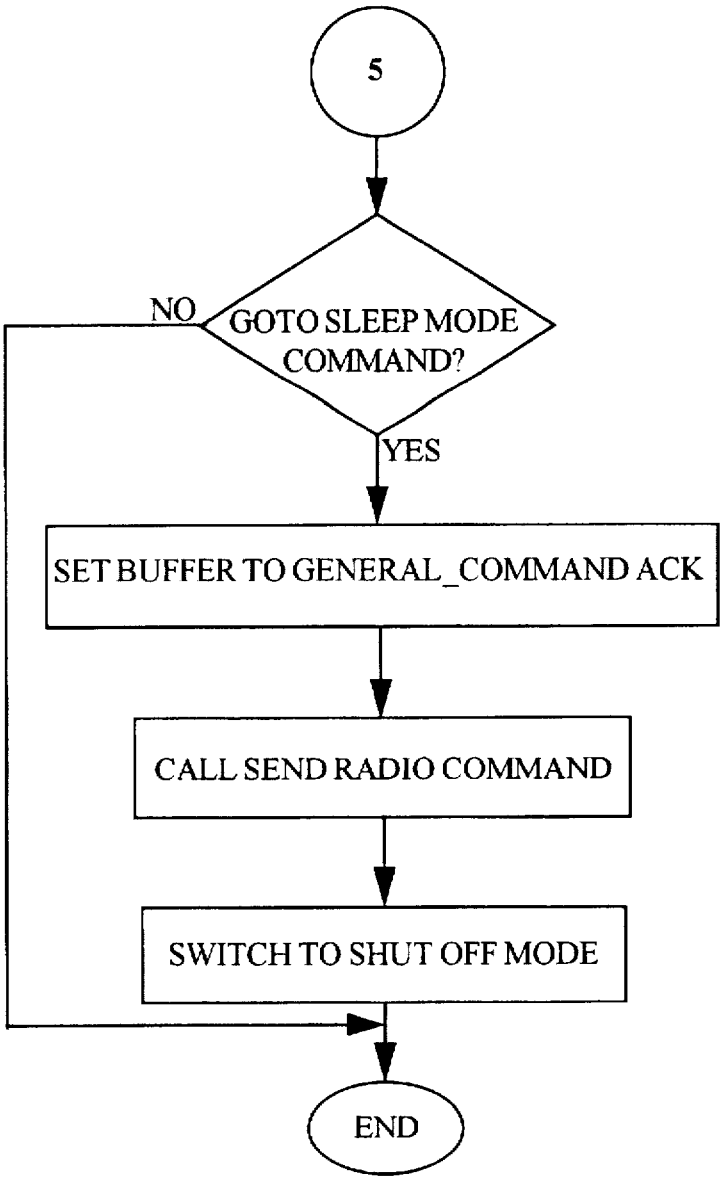
Figure 9A:
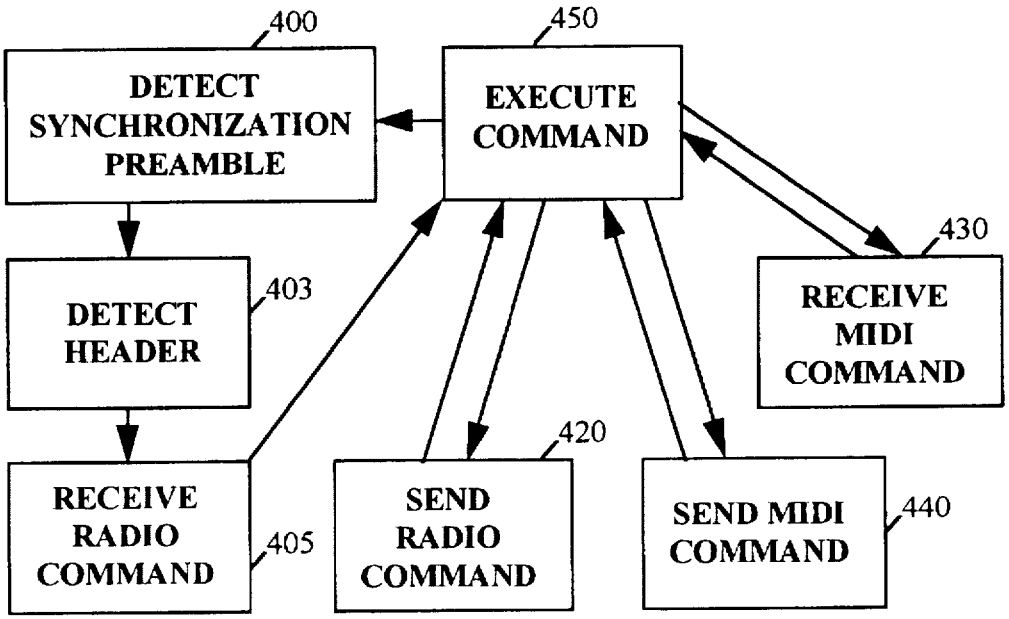
FIG. 9A is a simplified flowchart illustration of a preferred method for receiving MIDI signals, receiving radio signals, executing commands comprised therein, sending radio signals, and sending MIDI signals, within the computer radio interface 110 of FIG. 1A.
Figure 9B:
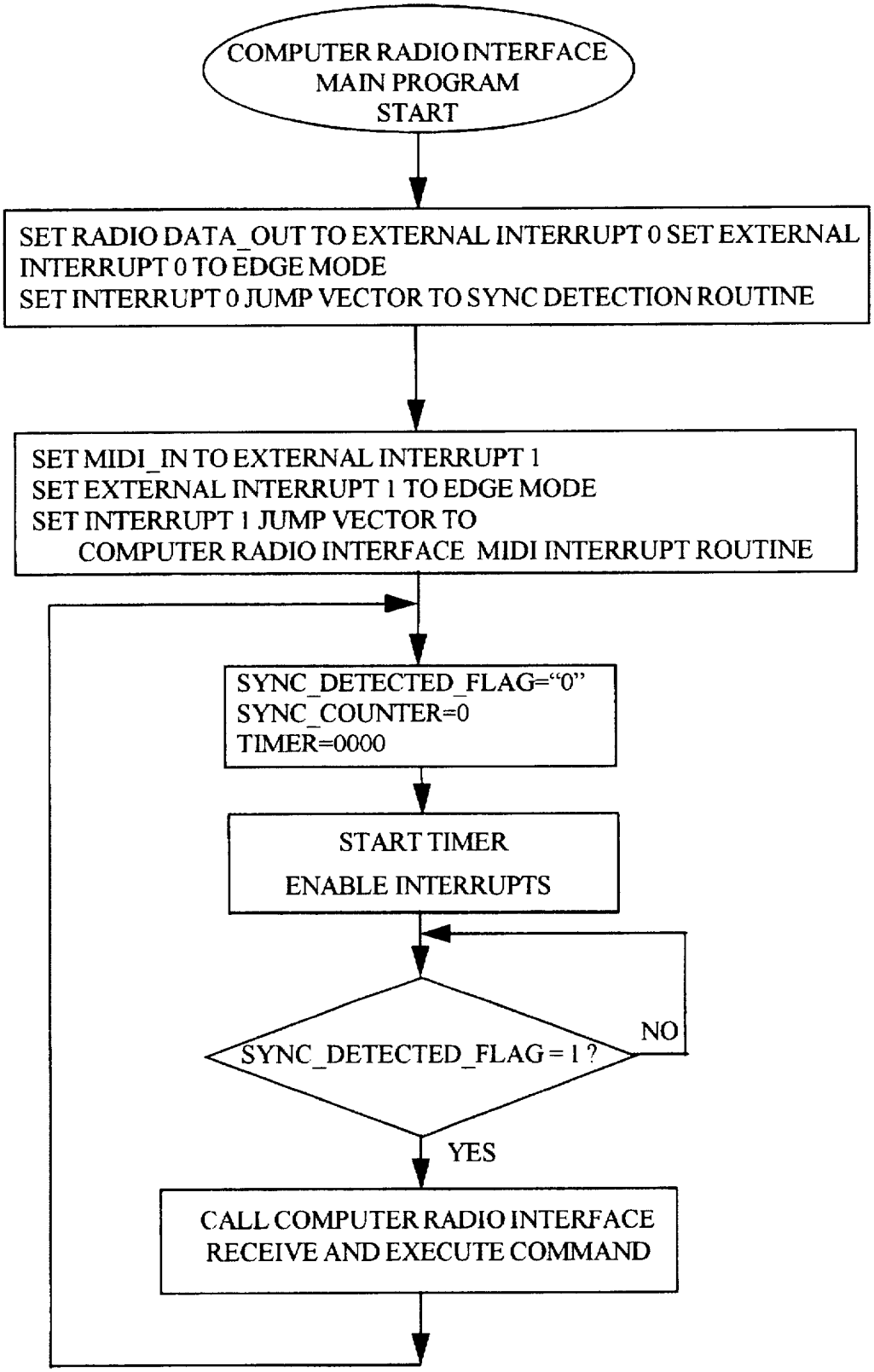
FIGS. 9B–9N, taken together with FIGS. 8D–8M, comprise a simplified flowchart illustration of a preferred implementation of the method of FIG. 9A.
Figure 9C:
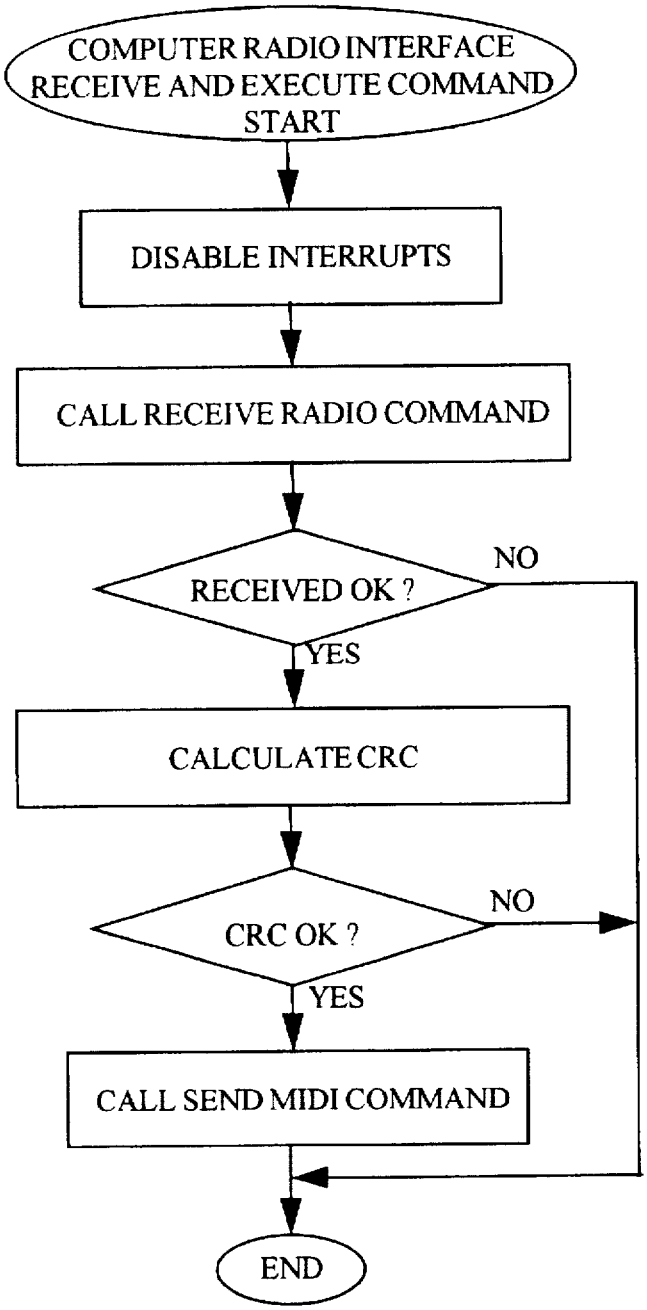
Figure 9D:
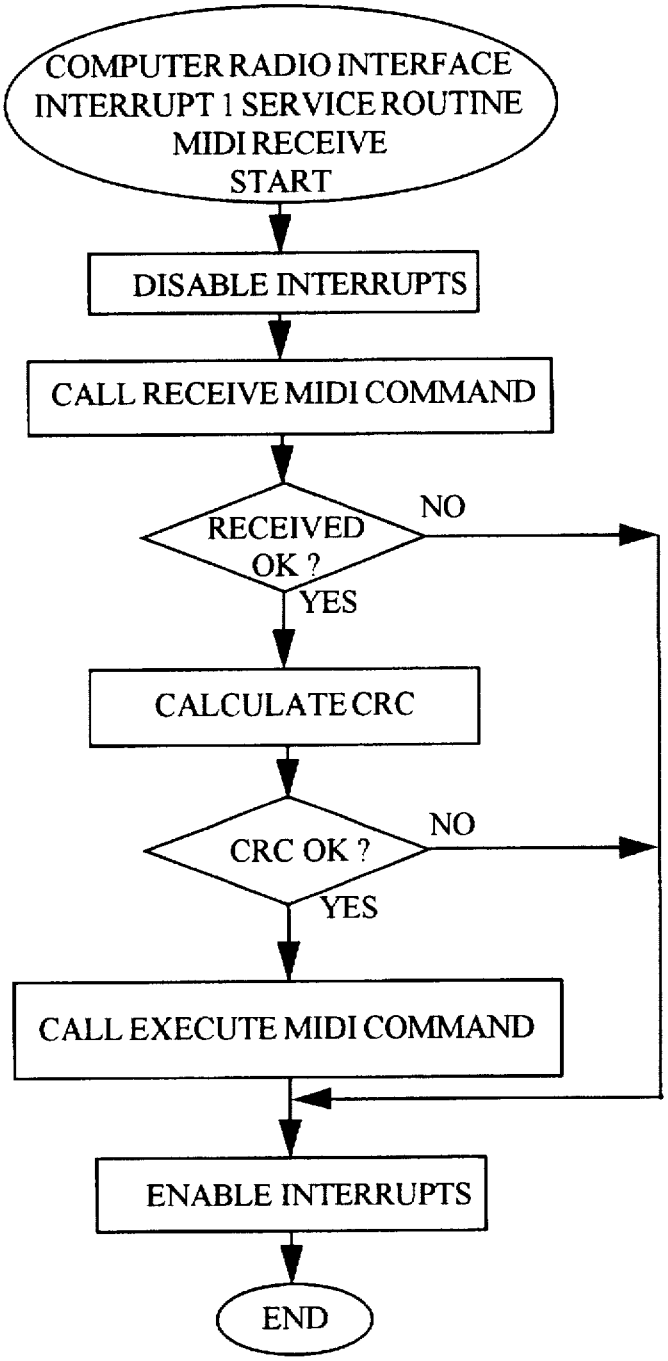
Figure 9E:
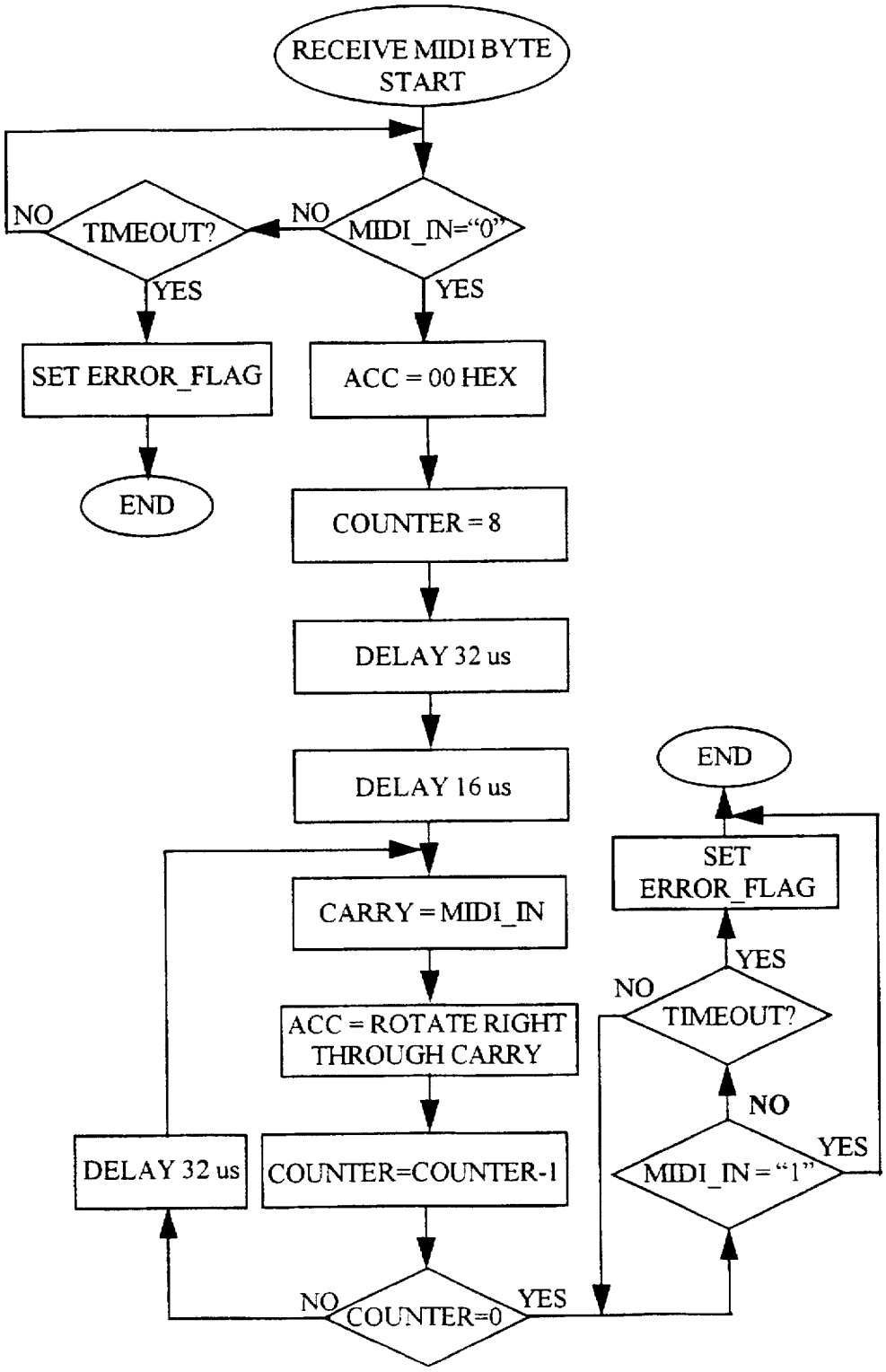
Figure 9F:
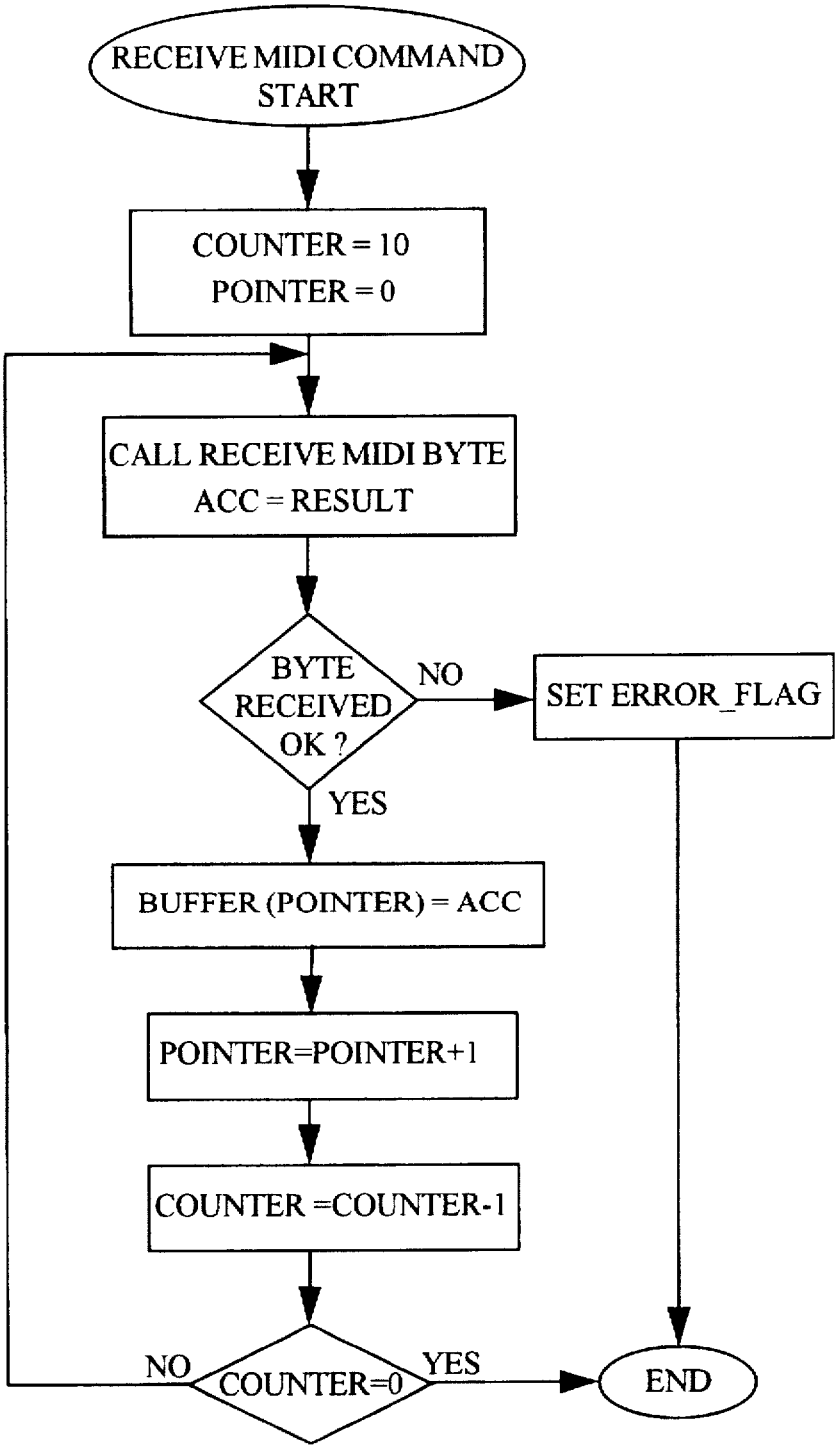
Figure 9G:
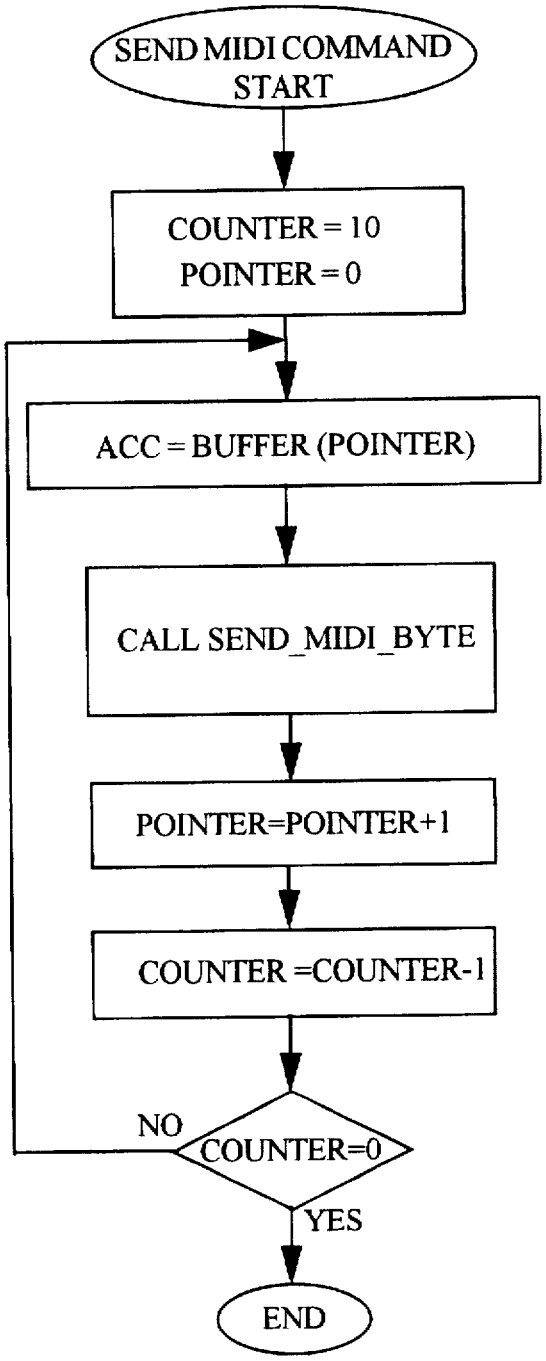
Figure 9H:
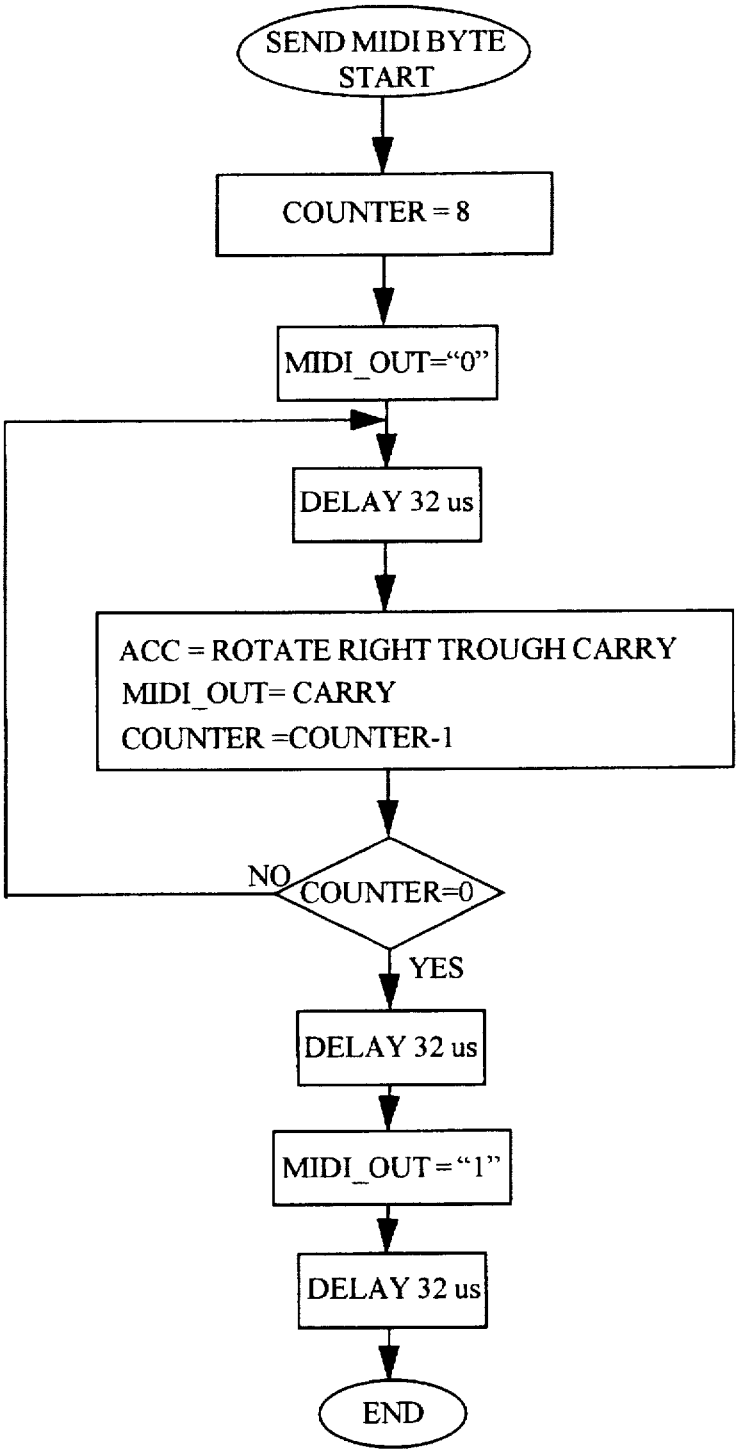
Figure 9I:
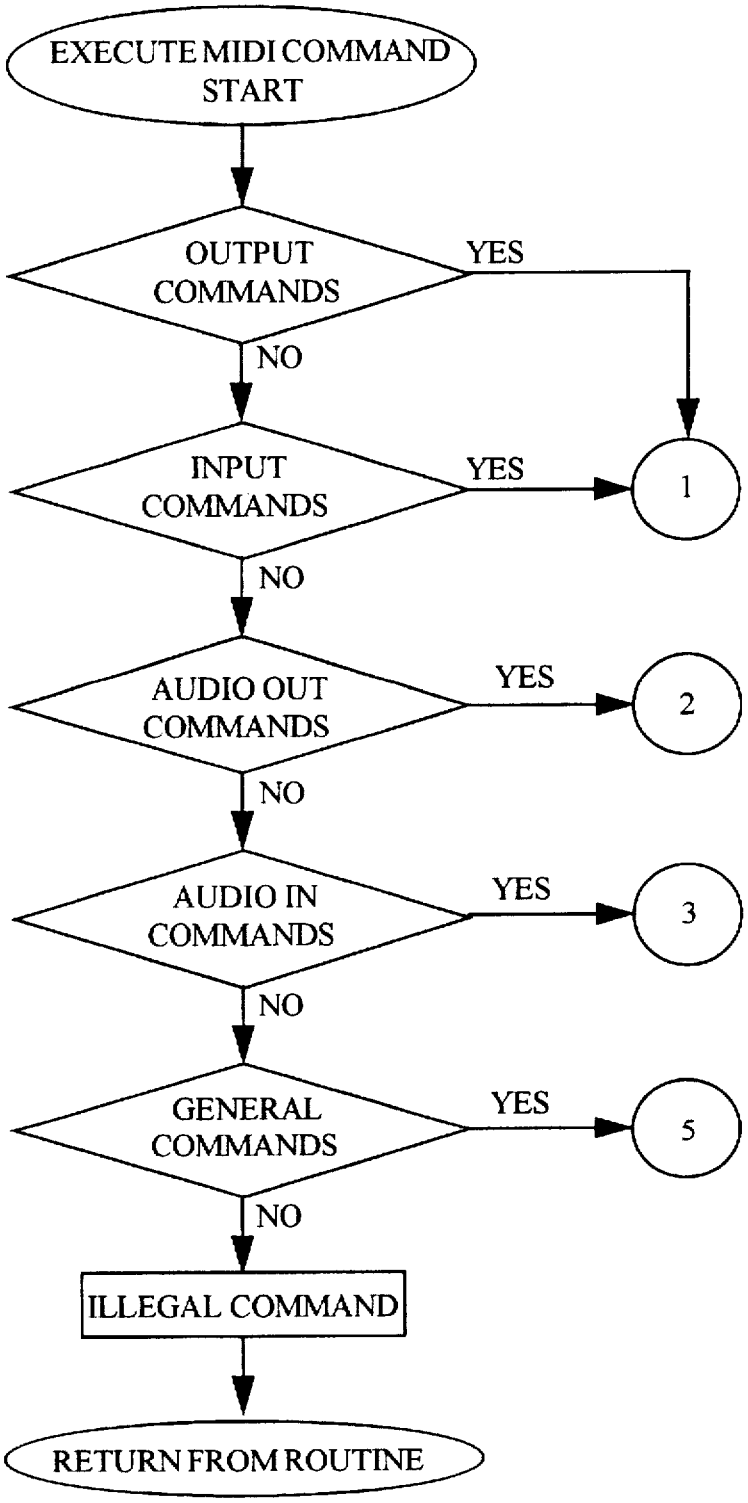
Figure 9J:
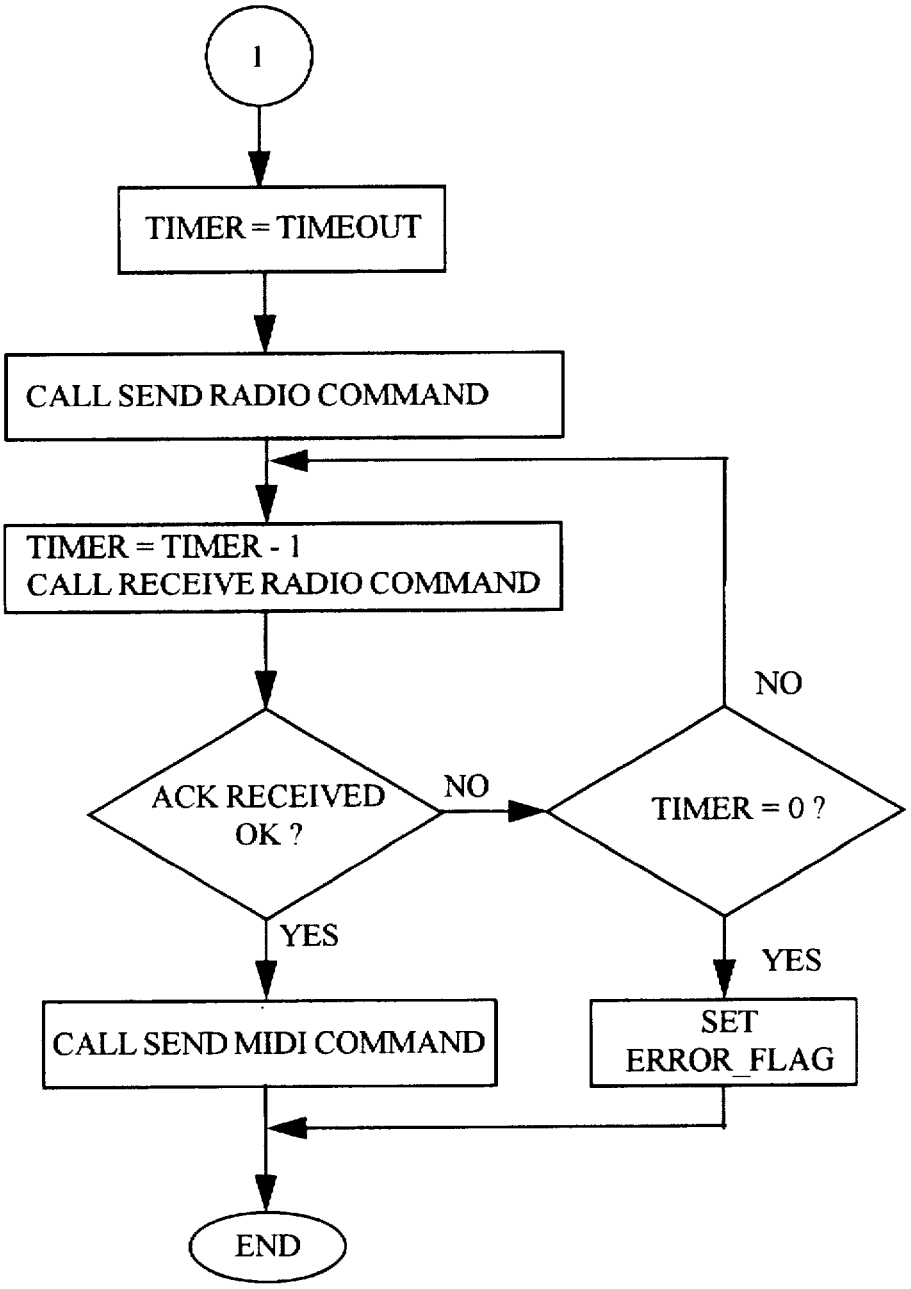
Figure 9K:
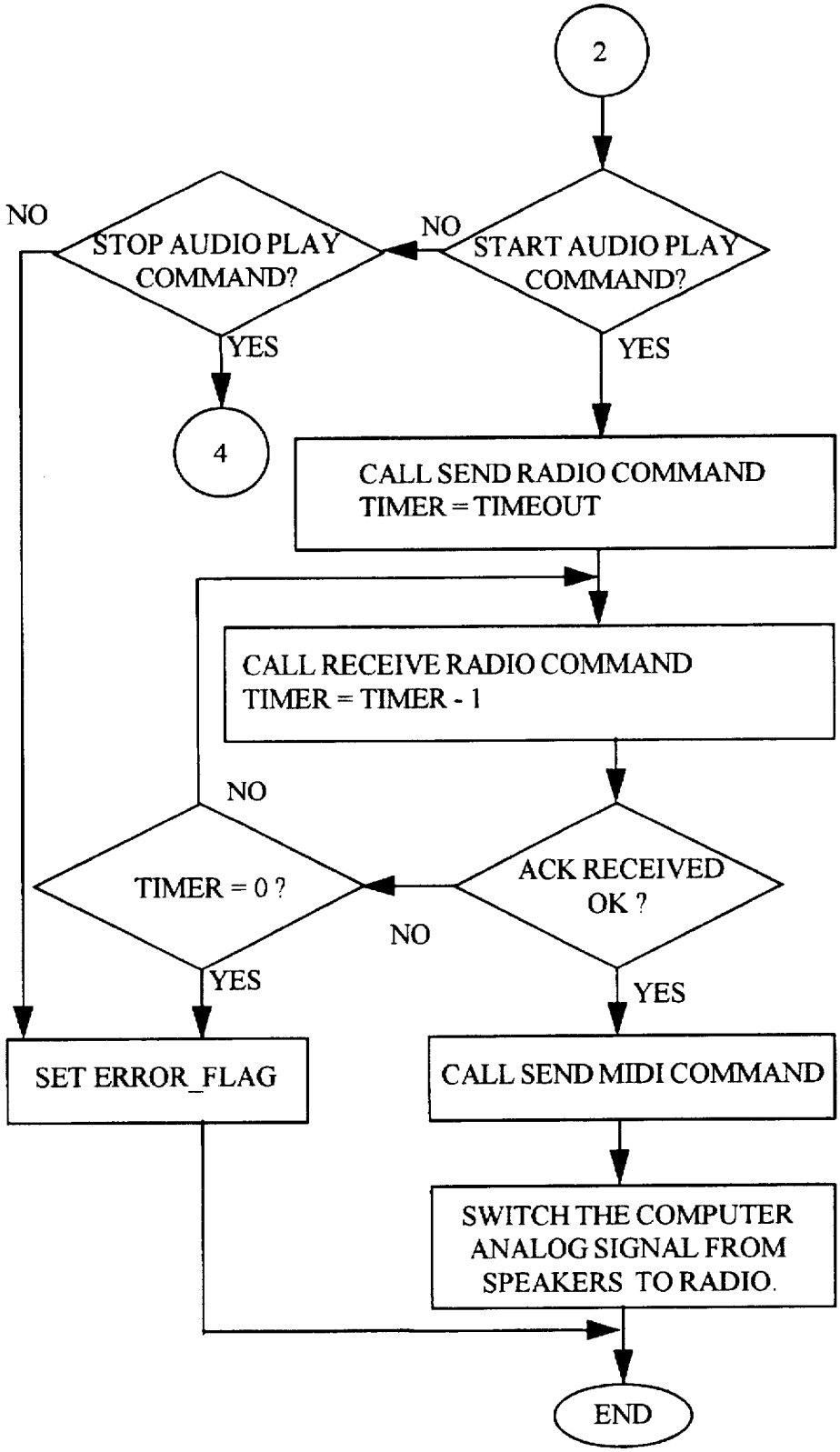
Figure 9L:
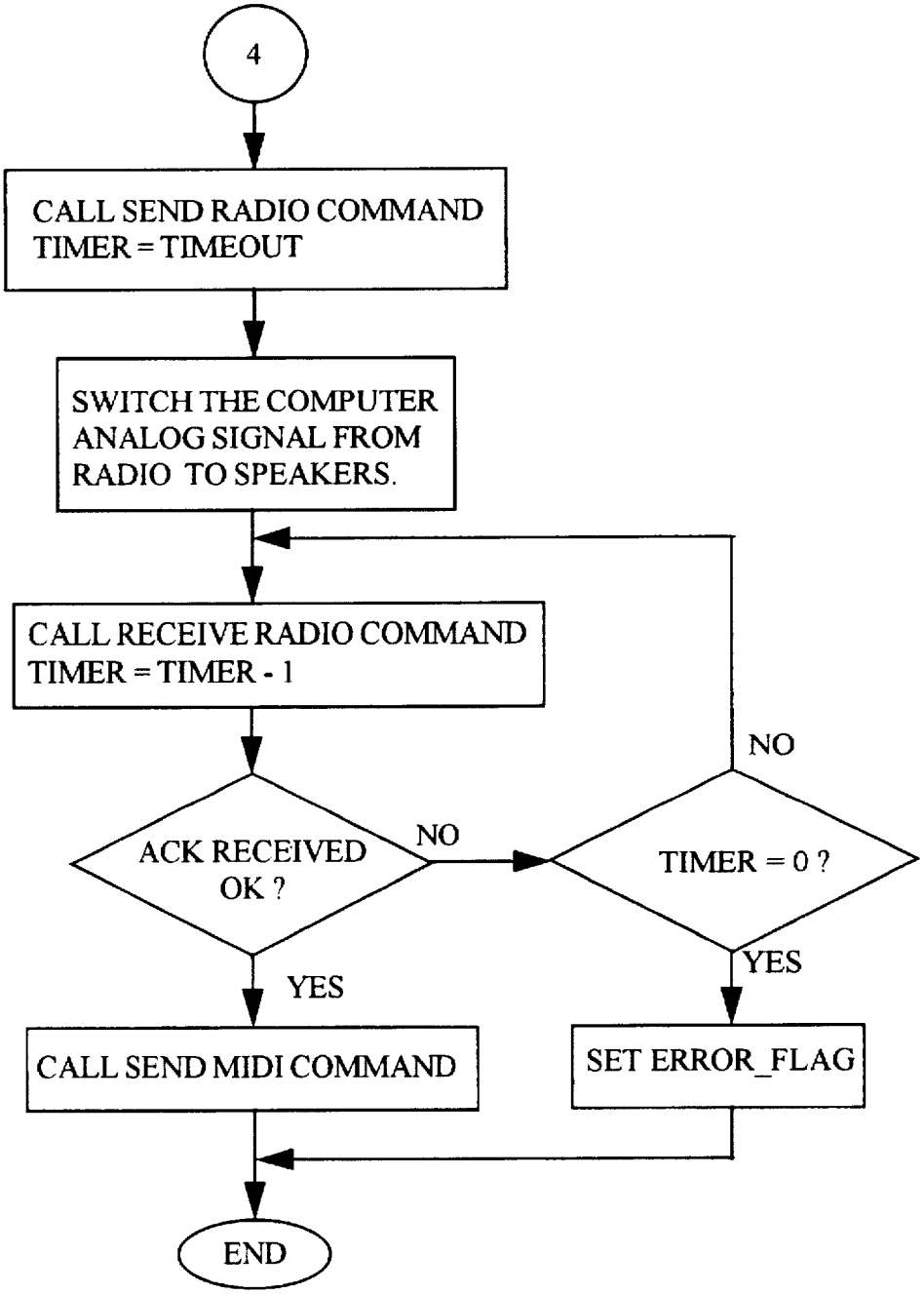
Figure 9M:
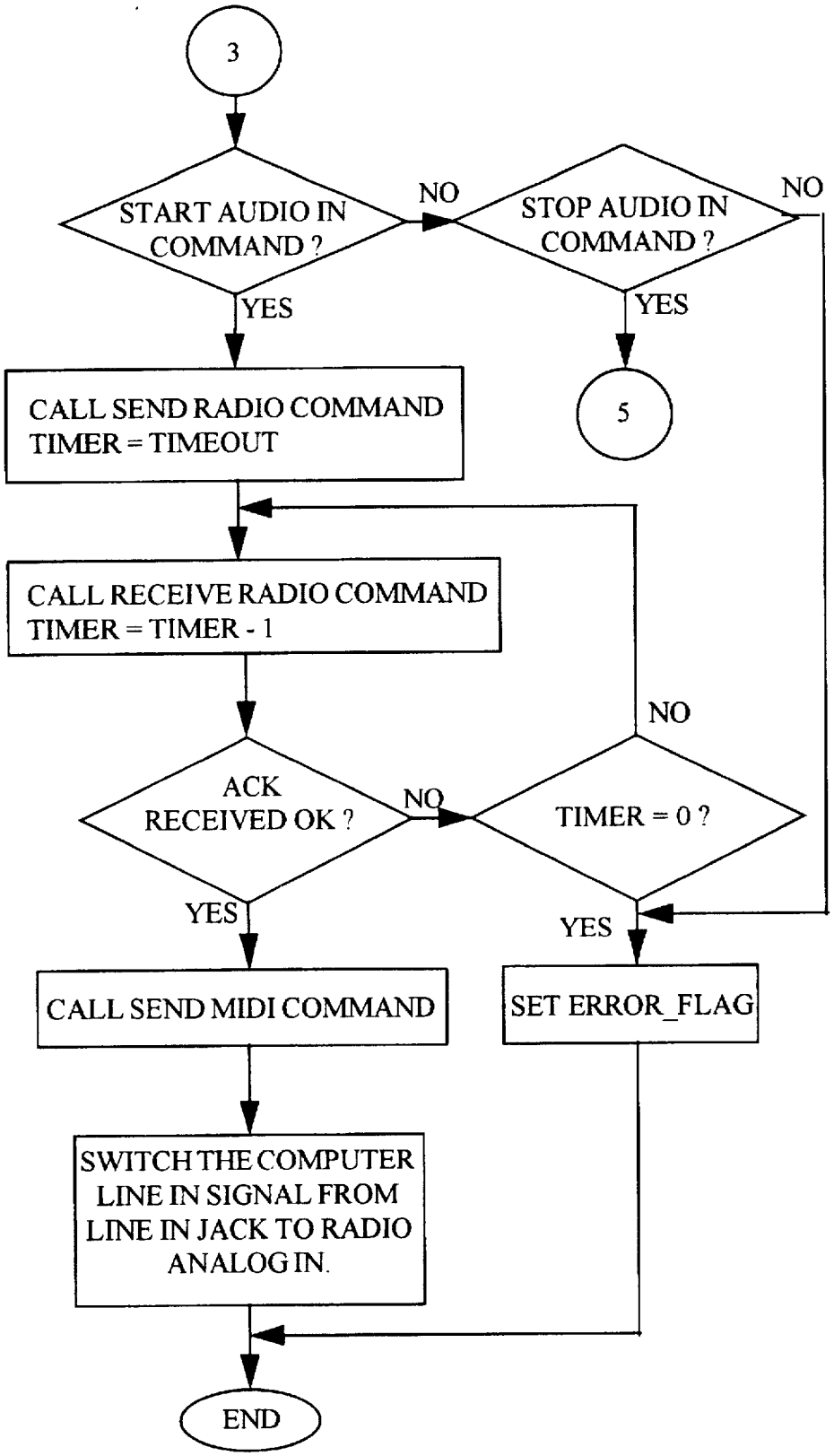
Figure 9N:
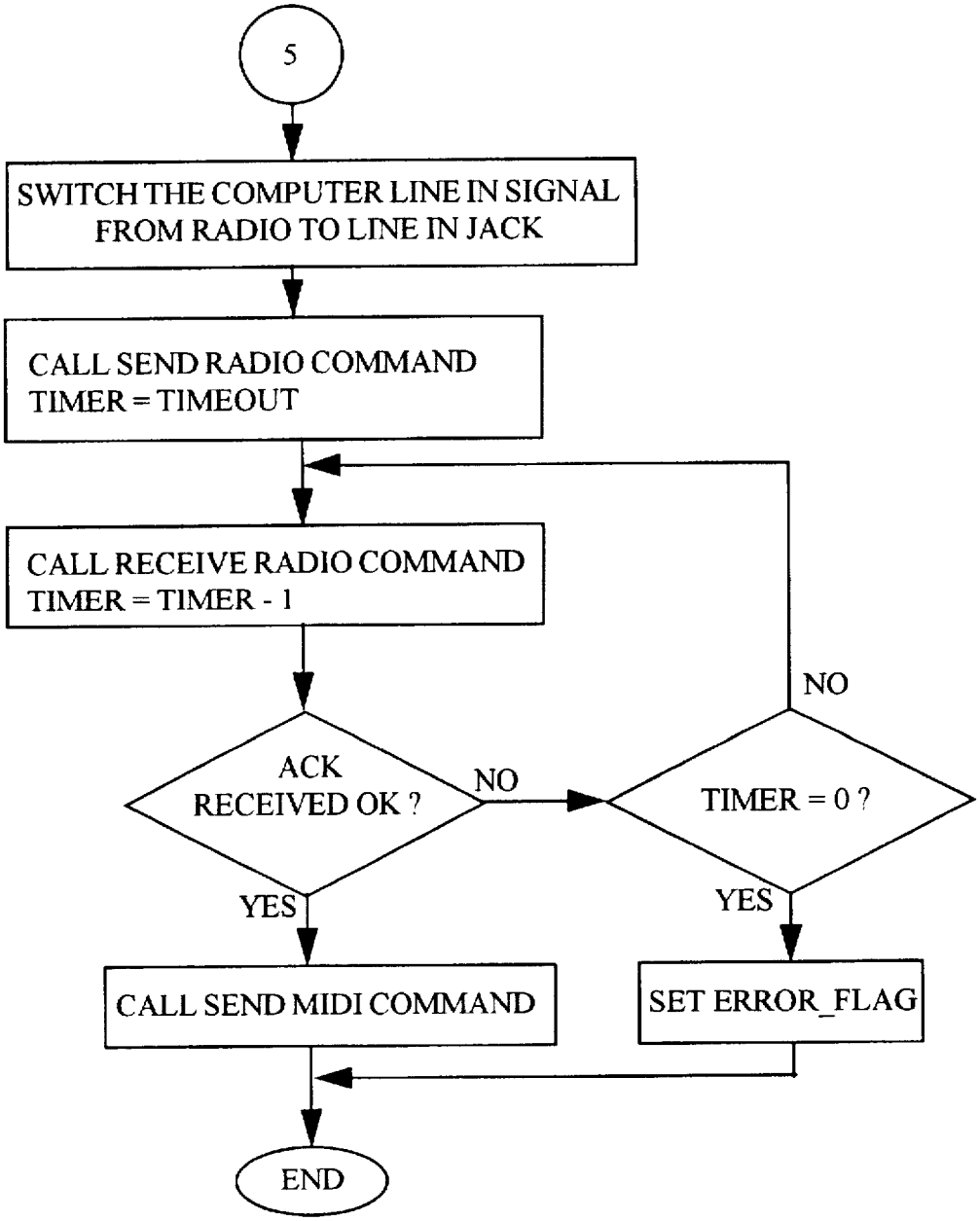

Attached herewith are the following appendices which aid in the understanding and appreciation of one preferred embodiment of the invention shown and described herein:

Appendix A is a computer listing of a preferred software implementation of the method of FIGS. 8A–8T;

Appendix B is a computer listing of a preferred software implementation of the method of FIGS. 9A–9N, together with the method of FIGS. 8D–8M;

Appendix C is a computer listing of a preferred software implementation of an example of a computer game for use in the computer 100 of FIG. 1;

Appendix D is a computer listing of a preferred software implementation of the method of FIGS. 11 and FIGS. 12A–12C.

DETAILED DESCRIPTION OF PREFERRED EMBODIMENTS

Figure 1A:
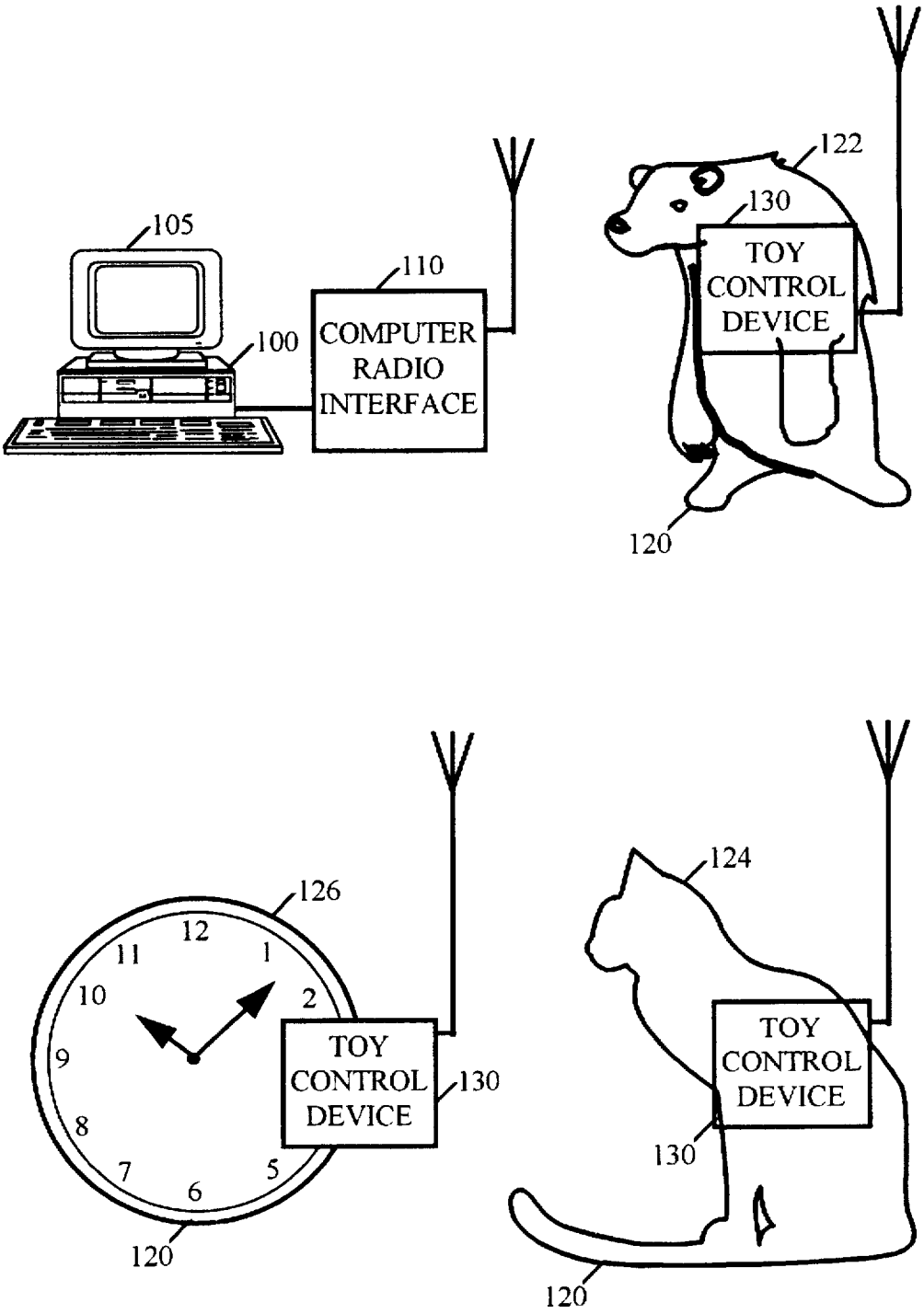
FIG. 1A is a partly pictorial, partly block diagram illustration of a computer control system including a toy, constructed and operative in accordance with a preferred embodiment of the present invention.

Reference is now made to FIG. 1A which is a partly pictorial, partly block diagram illustration of a computer control system including a toy, constructed and operative in accordance with a preferred embodiment of the present invention. The system of FIG. 1A comprises a computer 100, which may be any suitable computer such as, for example, an IBM-compatible personal computer. The computer 100 is equipped with a screen 105. The computer 100 is preferably equipped with a sound card such as, for example, a Sound Blaster Pro card commercially available from Creative Labs, Inc., 1901 McCarthy Boulevard, Milpitas, Calif. 95035 or from Creative Technology Ltd., 67

Ayer Rajah Crescent #03-18, Singapore, 0513; a hard disk; and, optionally, a CD-ROM drive.

The computer 100 is equipped with a computer radio interface 110 operative to transmit signals via wireless transmission based on commands received from the computer 100 and, in a preferred embodiment of the present invention, also to receive signals transmitted elsewhere via wireless transmission and to deliver the signals to the computer 100. Typically, commands transmitted from the computer 100 to the computer radio interface 110 are transmitted via both analog signals and digital signals, with the digital signals typically being transmitted by way of a MIDI port. Transmission of the analog and digital signals is described below with reference to FIG. 3.

The transmitted signal may be an analog signal or a digital signal. The received signal may also be an analog signal or a digital signal. Each signal typically comprises a message. A preferred implementation of the computer radio interface 110 is described below with reference to FIG. 3.

The system of FIG. 1A also comprises one or more toys 120. The system of FIG. 1A comprises a plurality of toys, namely three toys 122, 124, and 126 but it is appreciated that, alternatively, either one toy only or a large plurality of toys may be used.

Figure 1B:
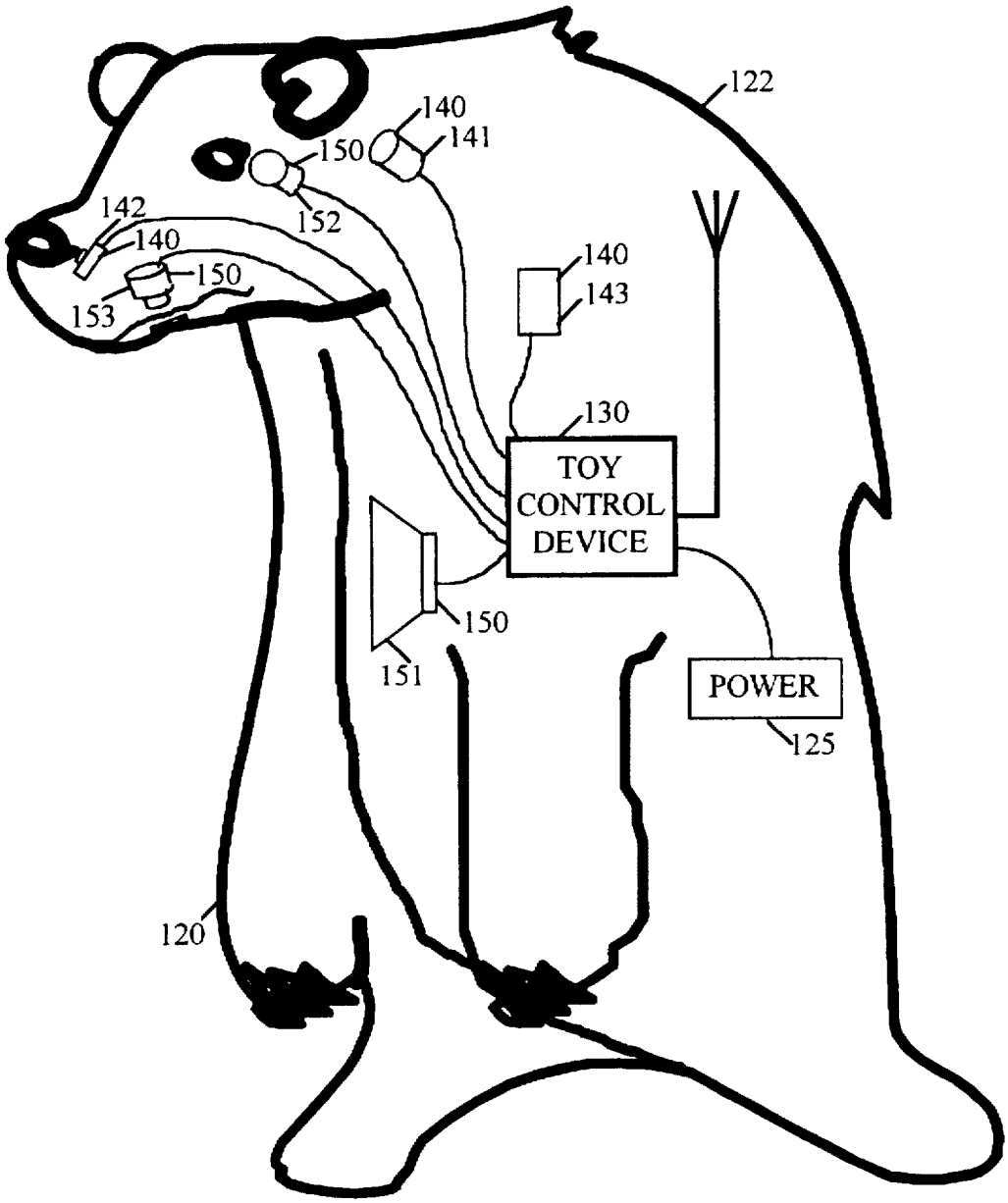
FIG. 1B is a partly pictorial, partly block diagram illustration a preferred implementation of the toy 122 of FIG. 1A.

Reference is now additionally made to FIG. 1B, which is a partly pictorial, partly block diagram illustration of the toy 122 of FIG. 1A.

Each toy 120 comprises a power source 125, such as a battery or a connection to line power. Each toy 120 also comprises a toy control device 130, operative to receive a wireless signal transmitted by the computer 100 and to cause each toy 120 to perform an action based on the received signal. The received signal may be, as explained above, an analog signal or a digital signal. A preferred implementation of the toy control device 130 is described below with reference to FIG. 6.

Each toy 120 preferably comprises a plurality of input devices 140 and output devices 150, as seen in FIG. 1B. The input devices 140 may comprise, for example on or more of the following: a microphone 141; a microswitch sensor 142; a touch sensor (not shown in FIG. 1B); a light sensor (not shown in FIG. 1B); a movement sensor 143, which may be, for example, a tilt sensor or an acceleration sensor. Appropriate commercially available input devices include the following: position sensors available from Hamlin Inc., 612 East Lake Street, Lake Mills, Wis. 53551, U.S.A.; motion and vibration sensors available from Comus International, 263 Hillside Avenue, Nutley, N.J. 07110, U.S.A.; temperature, shock, and magnetic sensors available from Murata Electronics Ltd., Hampshire, England; and switches available from C & K Components Inc., 15 Riverdale Avenue, Newton, Mass. 02058-1082, U.S.A. or from Micro Switch Inc., a division of Honeywell, U.S.A. The output devices 150 may comprise, for example, one or more of the following: a speaker 151; a light 152; a solenoid 153 which may be operative to move a portion of the toy; a motor, such as a stepping motor, operative to move a portion of the toy or all of the toy (not shown in FIG. 1B). Appropriate commercially available output devices include the following: DC motors available from Alkatel (dunkermotoren), Postfach 1240, D-7823, Bonndorf/Schwarzald, Germany; stepping motors and miniature motors available from Haydon Switch and Instruments, Inc. (HSI), 1500 Meriden Road, Waterbury, Conn., U.S.A.; and DC solenoids available from Communications Instruments, Inc., P.0 Box 520, Fairview, N.C. 28730, U.S.A.

Examples of actions which the toy may perform include the following: move a portion of the toy; move the entire toy; or produce a sound, which may comprise one or more of the following: a recorded sound, a synthesized sound, music including recorded music or synthesized music, speech including recorded speech or synthesized speech.

The received signal may comprise a condition governing the action as, for example, the duration of the action, or the number of repetitions of the action.

Typically, the portion of the received signal comprising a message comprising a command to perform a specific action as, for example, to produce a sound with a given duration, comprises a digital signal. The portion of the received signal comprising a sound, for example, typically comprises an analog signal. Alternatively, in a preferred embodiment of the present invention, the portion of the received signal comprising a sound, including music, may comprise a digital signal, typically a signal comprising MIDI data.

The action the toy may perform also includes reacting to signals transmitted by another toy, such as, for example, playing sound that the other toy is monitoring and transmitting.

In a preferred embodiment of the present invention, the toy control device 130 is also operative to transmit a signal intended for the computer 100, to be received by the computer radio interface 110. In this embodiment, the computer radio interface 110 is preferably also operative to poll the toy control device 130, that is, transmit a signal comprising a request that the toy control device 130 transmit a signal to the computer radio interface 110. It is appreciated that polling is particularly preferred in the case where there are a plurality of toys having a plurality of toy control devices 130.

The signal transmitted by the toy control device 130 may comprise one or more of the following: sound, typically sound captured by a microphone input device 141; status of sensor input devices 140 as, for example, light sensors or micro switch; an indication of low power in the power source 125; or information identifying the toy.

It is appreciated that a sound signal transmitted by the device 130 may also include speech. The computer system is operative to perform a speech recognition operation on the speech signals. Appropriate commercially available software for speech recognition is available from companies such as: Stylus Innovation Inc., One Kendall Square, Building 300, Cambridge, Mass. 02139, U.S.A. and A&G Graphics Interface, U.S.A., Telephone No. (617)492-0120, Telefax No. (617)427-3625.

The signal from the radio control interface 110 may also comprise, for example, one or more of the following: a request to ignore input from one or more input devices 140; a request to activate one or more input devices 140 or to stop ignoring input from one or more input devices 140; a request to report the status of one or more input devices 140; a request to store data received from one or more input devices 140, typically by latching a transition in the state of one or more input devices 140, until a future time when another signal from the radio control interface 110 requests the toy control device 130 to transmit a signal comprising the stored data received from the one or more input devices 140; or a request to transmit analog data, typically comprising sound, typically for a specified period of time.

Typically, all signals transmitted in both directions between the computer radio interface 110 and the toy control device 130 include information identifying the toy.

Figure 1C:
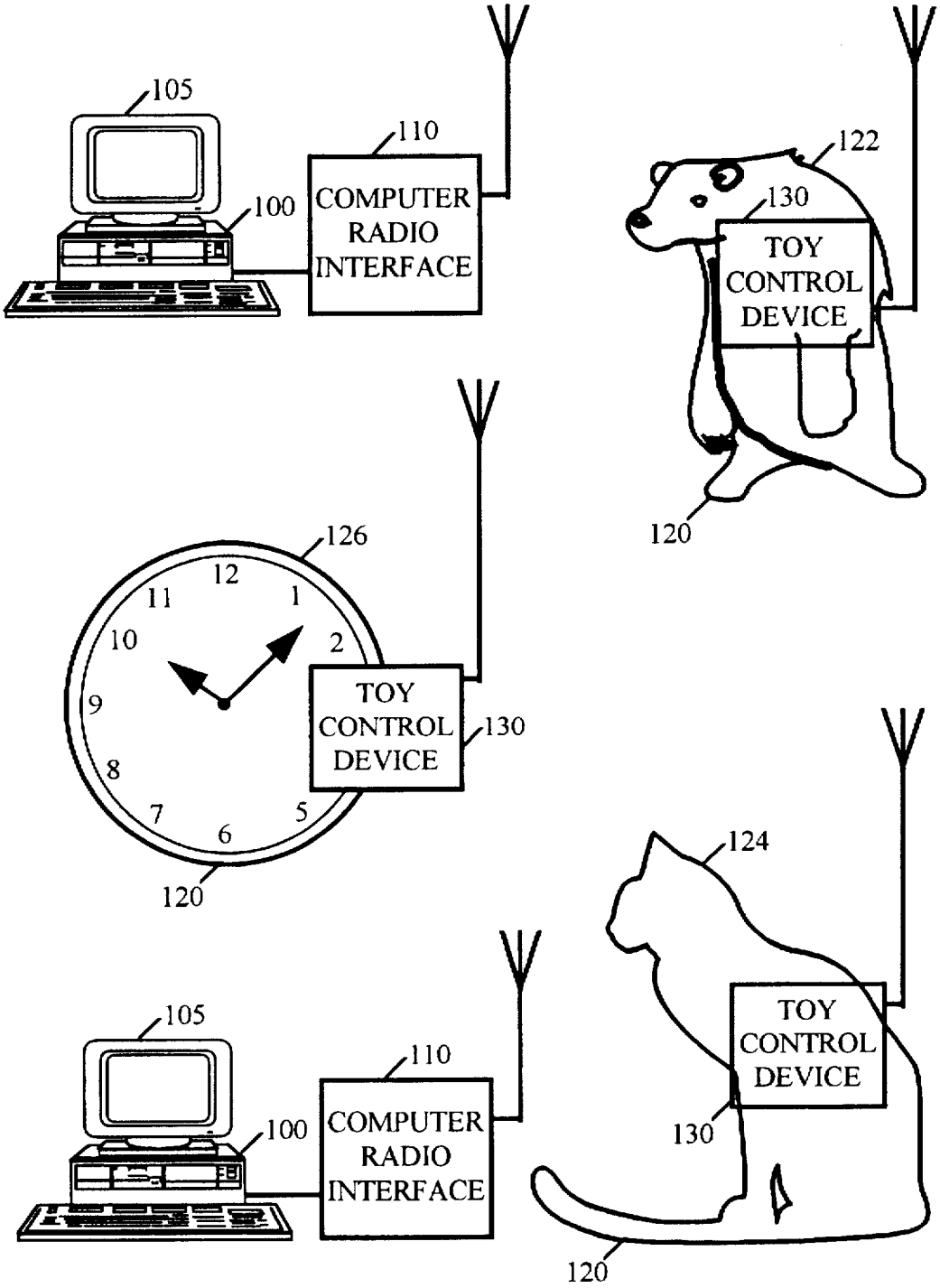
FIG. 1C is a partly pictorial, partly block diagram illustration of a computer control system including a toy, constructed and operative in accordance with an alternative preferred embodiment of the present invention.

Reference is now made to FIG. 1C, which is a partly pictorial, partly block diagram illustration of a computer control system including a toy, constructed and operative in accordance with an alternative preferred embodiment of the present invention. The system of FIG. 1C comprises two computers 100. It is appreciated that, in general, a plurality of computers 100 may be used. In the implementation of FIG. 1C, all signals transmitted in both directions between the computer radio interface 110 and the toy control device 130 typically include information identifying the computer.

The operation of the system of FIG. 1A is now briefly described. Typically, the computer 100 runs software comprising a computer game, typically a game including at least one animated character. Alternatively, the software may comprise educational software or any other interactive software including at least one animated object. As used herein, the term "animated object" includes any object which may be depicted on the computer screen 105 and which interacts with the user of the computer via input to and output from the computer. An animated object may be any object depicted on the screen such as, for example: a doll; an action figure; a toy, such as, for example, an activity toy, a vehicle, or a ride-on vehicle; a drawing board or sketch board; or a household object such as, for example, a clock, a lamp, a chamber pot, or an item of furniture.

Figure 2A:
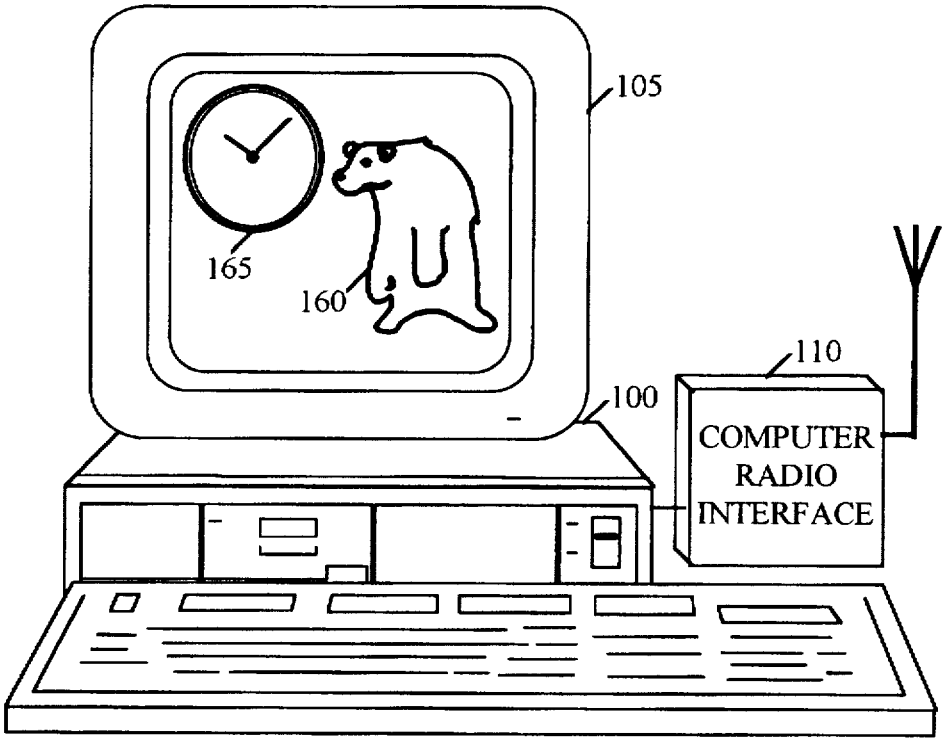
FIGS. 2A–2C are simplified pictorial illustrations of a portion of the system of FIG. 1A in use.
Figure 2B:
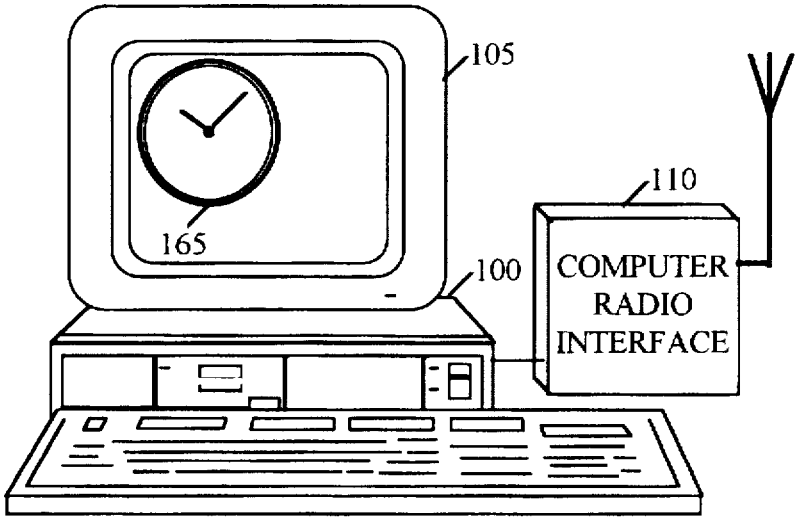
Figure 2B:
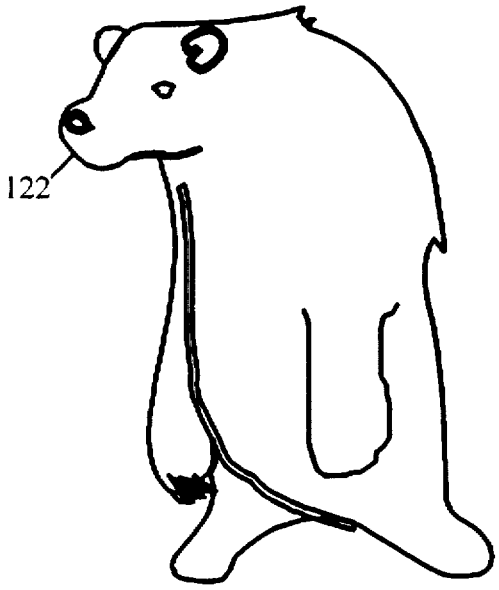
Figure 2C:
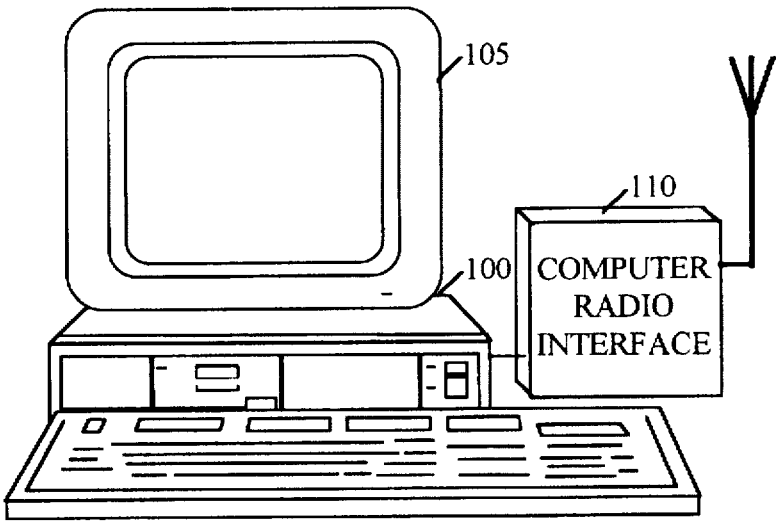
Figure 2C:
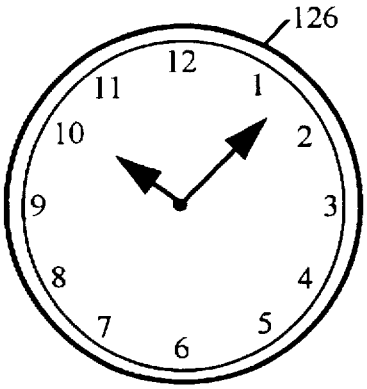
Figure 2C:
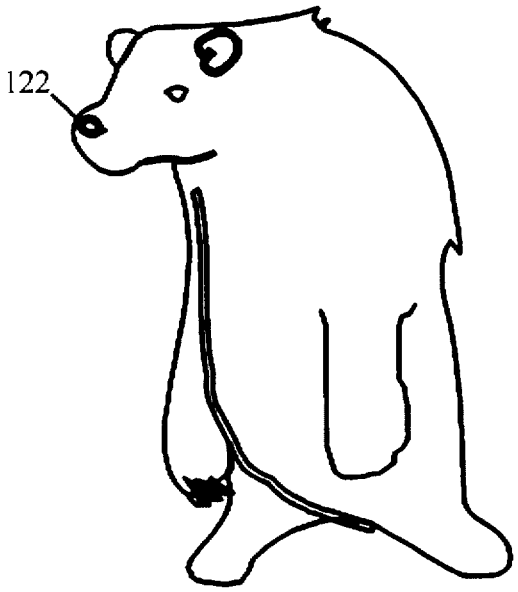

Reference is now additionally made to FIGS. 2A–2C, which depict a portion of the system of FIG. 1A in use. The apparatus of FIG. 2A comprises the computer screen 105 of FIG. 1A. On the computer screen are depicted animated objects 160 and 165.

FIG. 2B depicts the situation after the toy 122 has been brought into range of the computer radio interface 110 of FIG. 1A, typically into the same room therewith. Preferably, the toy 122 corresponds to the animated object 160. For example, in FIG. 2B the toy 122 and the animated object 160, shown in FIG. 2A, are both a teddy bear. The apparatus of FIG. 2B comprises the computer screen 105, on which is depicted the animated object 165. The apparatus of FIG. 2B also comprises the toy 122. The computer 100, having received a message via the computer radio interface 110, from the toy 122, no longer displays the animated object 160 corresponding to the toy 122. The functions of the animated object 160 are now performed through the toy 122, under control of the computer 100 through the computer radio interface 110 and the toy control device 130.

FIG. 2C depicts the situation after the toy 126 has also been brought into range of the computer radio interface 110 of FIG. 1A, typically into the same room therewith. Preferably, the toy 126 corresponds to the animated object 165. For example, in FIG. 2C the toy 126 and the animated object 165, shown in FIGS. 2A and 2B, are both a clock. The apparatus of FIG. 2C comprises the computer screen 105, on which no animated objects are depicted.

The apparatus of FIG. 2C also comprises the toy 126. The computer 100, having received a message via the computer radio interface 110 from the toy 126, no longer displays the animated object 165 corresponding to the toy 126. The functions of the animated object 165 are now performed through the toy 126, under control of the computer 100 through the computer radio interface 110 and the toy control device 130.

In FIG. 2A, the user interacts with the animated objects 160 and 165 on the computer screen, typically using conventional methods. In FIG. 2B the user also interacts with the toy 122, and in FIG. 2C typically with the toys 122 and 126, instead of interacting with the animated objects 160 and 165 respectively. It is appreciated that the user may interact with the toys 122 and 126 by moving the toys or parts of the toys; by speaking to the toys; by responding to movement of the toys which movement occurs in response to a signal received from the computer 100; by responding to a sound produced by the toys, which sound is produced in response to a signal received from the computer 100 and which may comprise music, speech, or another sound; or otherwise.

Figure 3:
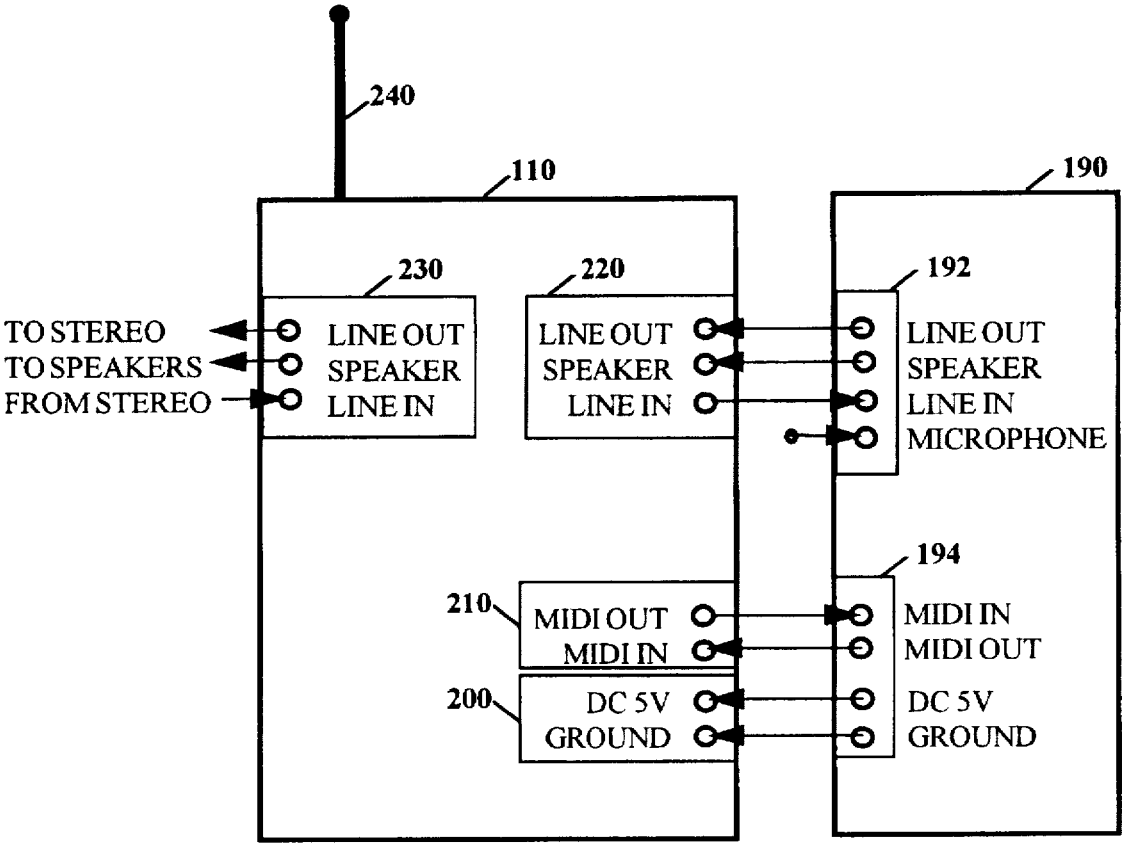
FIG. 3 is a simplified block diagram of a preferred implementation of the computer radio interface 110 of FIG. 1A.

Reference is now made to FIG. 3 which is a simplified block diagram of a preferred embodiment of the computer radio interface 110 of FIG. 1A. The apparatus of FIG. 3 comprises the computer radio interface 110. The apparatus of FIG. 3 also comprises a sound card 190, as described above with reference to FIG. 1A. In FIG. 3, the connections between the computer radio interface 110 and the sound card 190 are shown.

The computer radio interface 110 comprises a DC unit 200 which is fed with power through a MIDI interface 210 from a sound card MIDI interface 194, and the following interfaces: a MIDI interface 210 which connects to the sound card MIDI interface 194; an audio interface 220 which connects to an audio interface 192 of the sound card 190; and a secondary audio interface 230 which preferably connects to a stereo sound system for producing high quality sound under control of software running on the computer 100 (not shown).

The apparatus of FIG. 3 also comprises an antenna 240, which is operative to send and receive signals between the computer radio interface 110 and one or more toy control devices 130.

Figure 4:
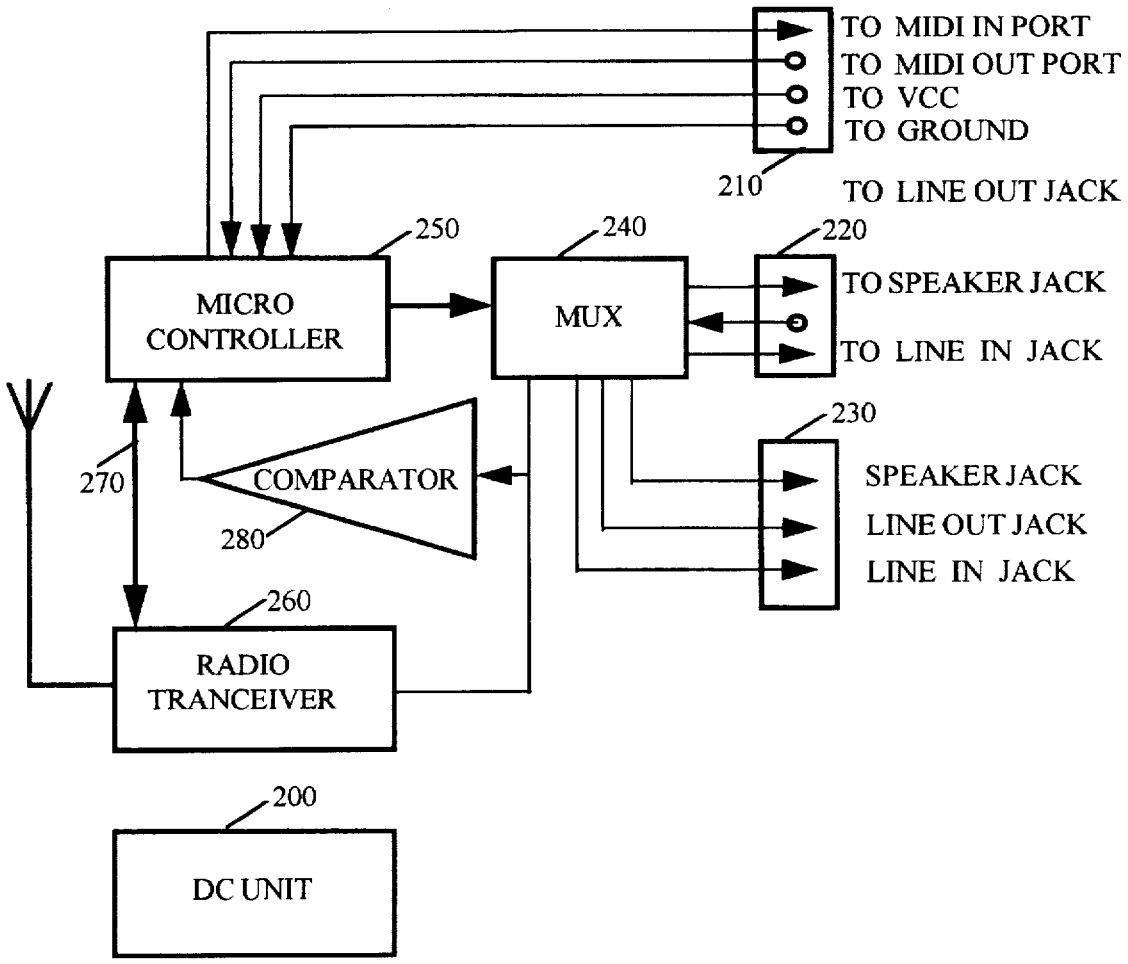
FIG. 4 is a more detailed block diagram of the computer radio interface 110 of FIG. 3.

FIG. 4 is a more detailed block diagram of the computer radio interface 110 of FIG. 3. The apparatus of FIG. 4 comprises the DC unit 200, the MIDI interface 210, the audio interface 220, and the secondary audio interface 230. The apparatus of FIG. 4 also comprises a multiplexer 240, a micro controller 250, a radio transceiver 260, a connection unit 270 connecting the radio transceiver 260 to the micro controller 250, and a comparator 280.

Reference is now made to FIGS. 5A–5D, which taken together comprise a schematic diagram of the apparatus of FIG. 4.

Figure 5A:
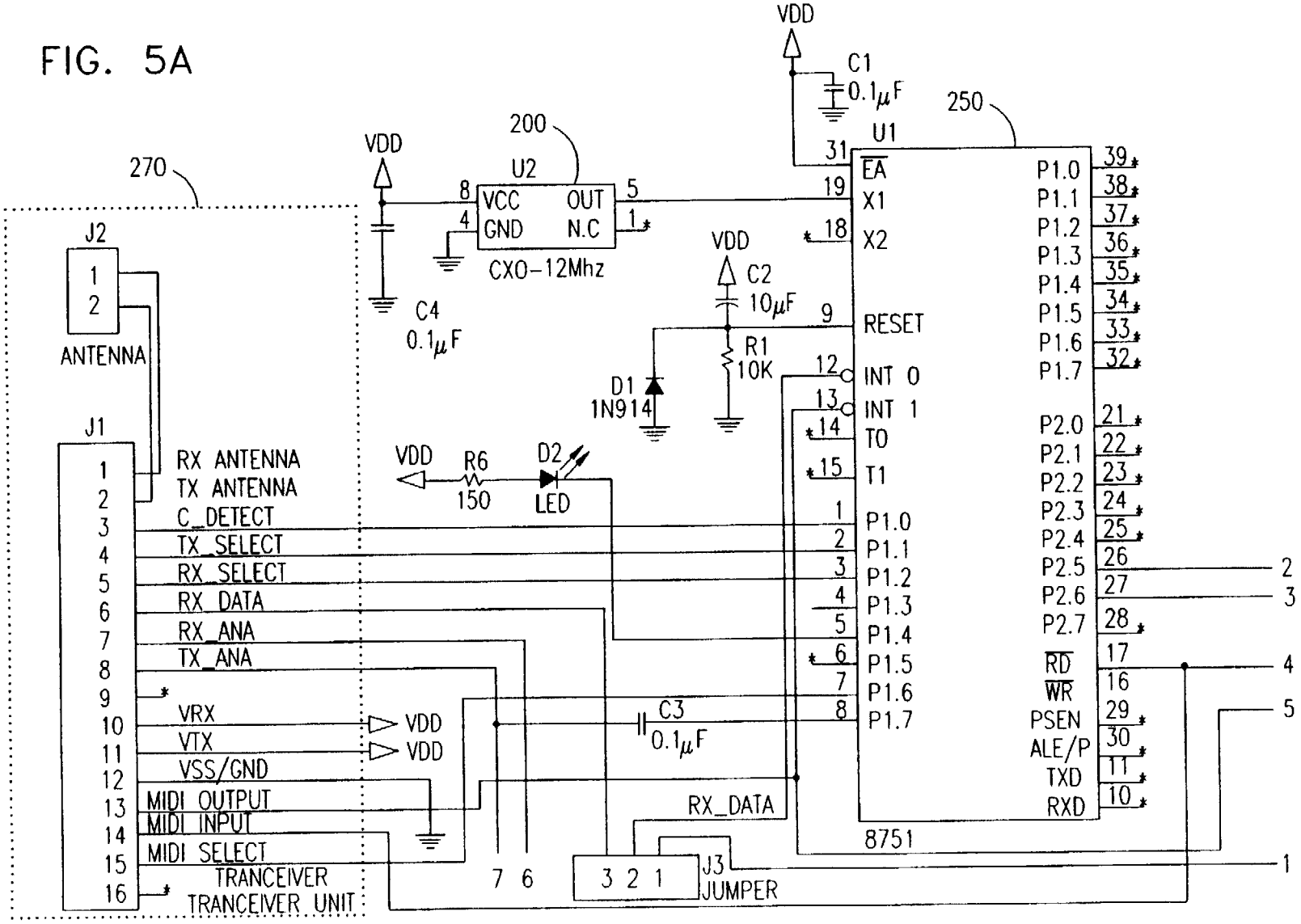
FIGS. 5A–5D taken together comprise a schematic diagram of the apparatus of FIG. 4.
Figure 5B:
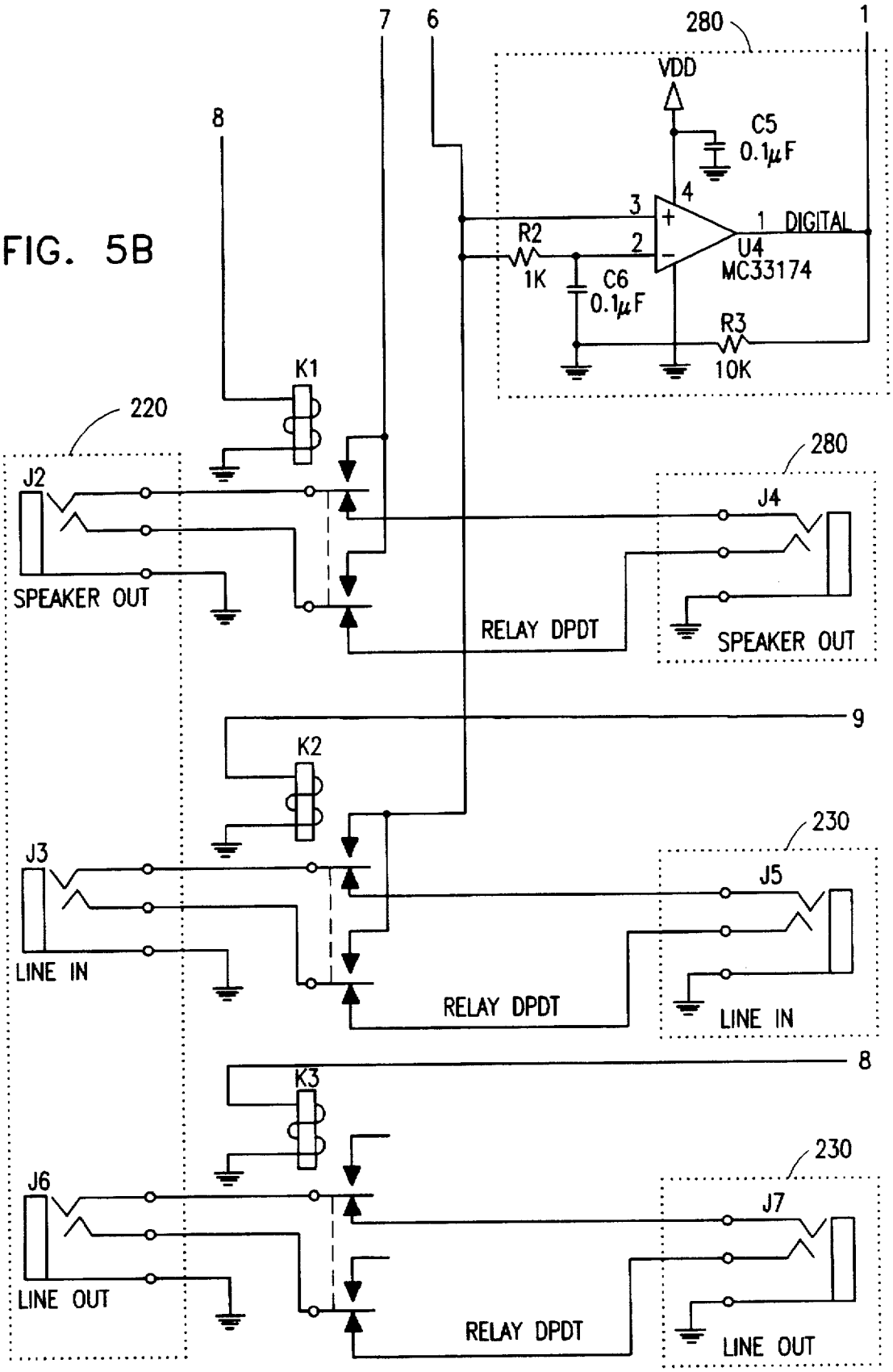
Figure 5C:
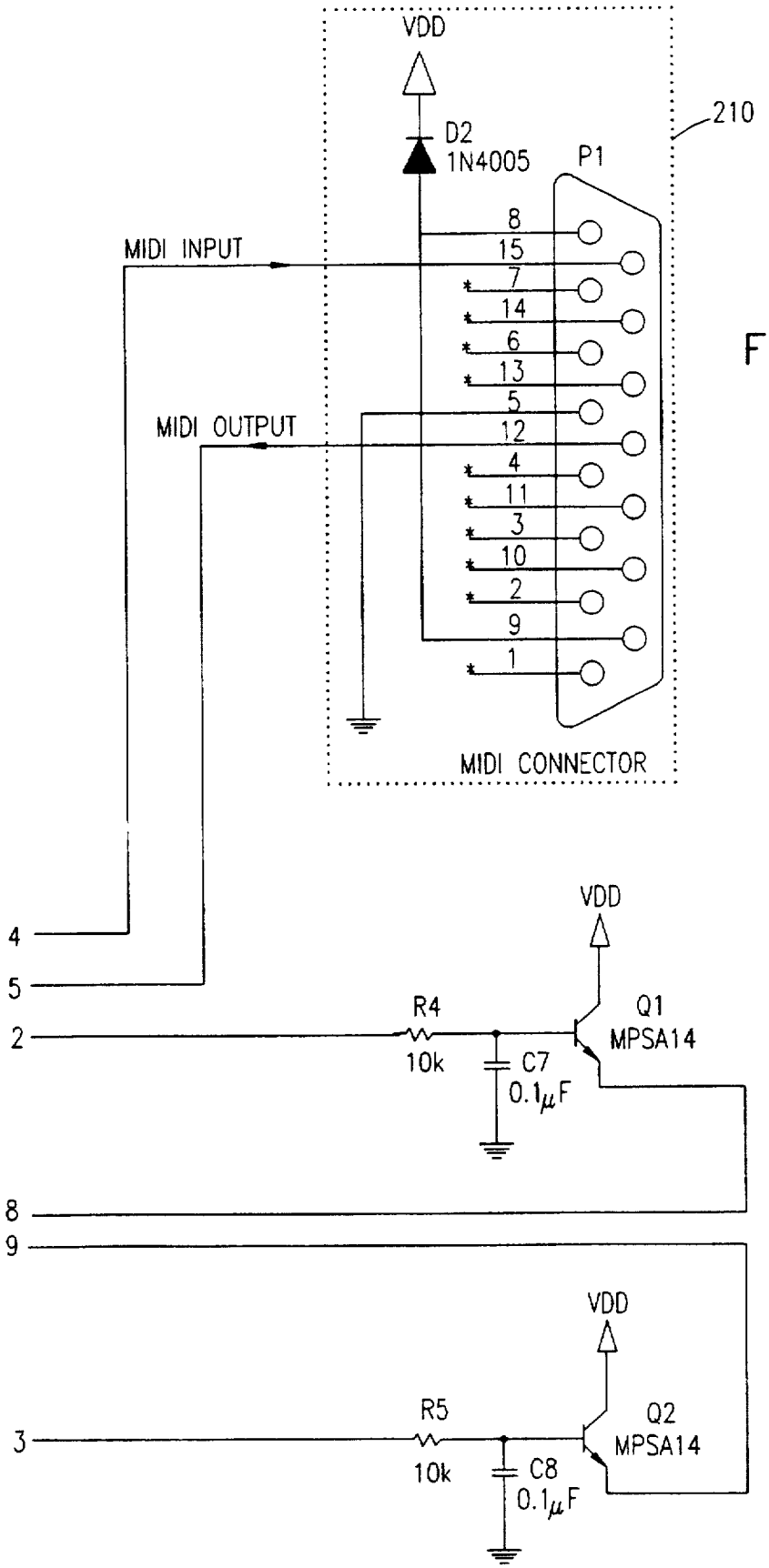

The following is a preferred parts list for the apparatus of FIGS. 5A–5C:

1. K1 Relay Dept, Idec, 1213 Elco Drive, Sunnyvale, Calif. 94089-2211, U.S.A.
2. U1 8751 microcontroller, Intel Corporation, San Tomas 4, 2700 Sun Tomas Expressway, 2nd Floor, Santa Clara, Calif., 95051, U.S.A.
3. U2 CXO—12 MHZ (crystal oscillator), Raltron, 2315 N.W. 107th Avenue, Miami, Fla. 33172, U.S.A.
4. U4 MC33174, Motorola, Phoenix, Ariz. U.S.A., Tel. No. (602)897-5056.
5. Diodes 1N914, Motorola, Phoenix, Ariz., U.S.A. Tel. No. (602)897-5056.
6. Transistors 2N2222 and MPSA14, Motorola, Phoenix, Ariz., U.S.A. Tel. No. (602)897-5056.

Figure 5D:
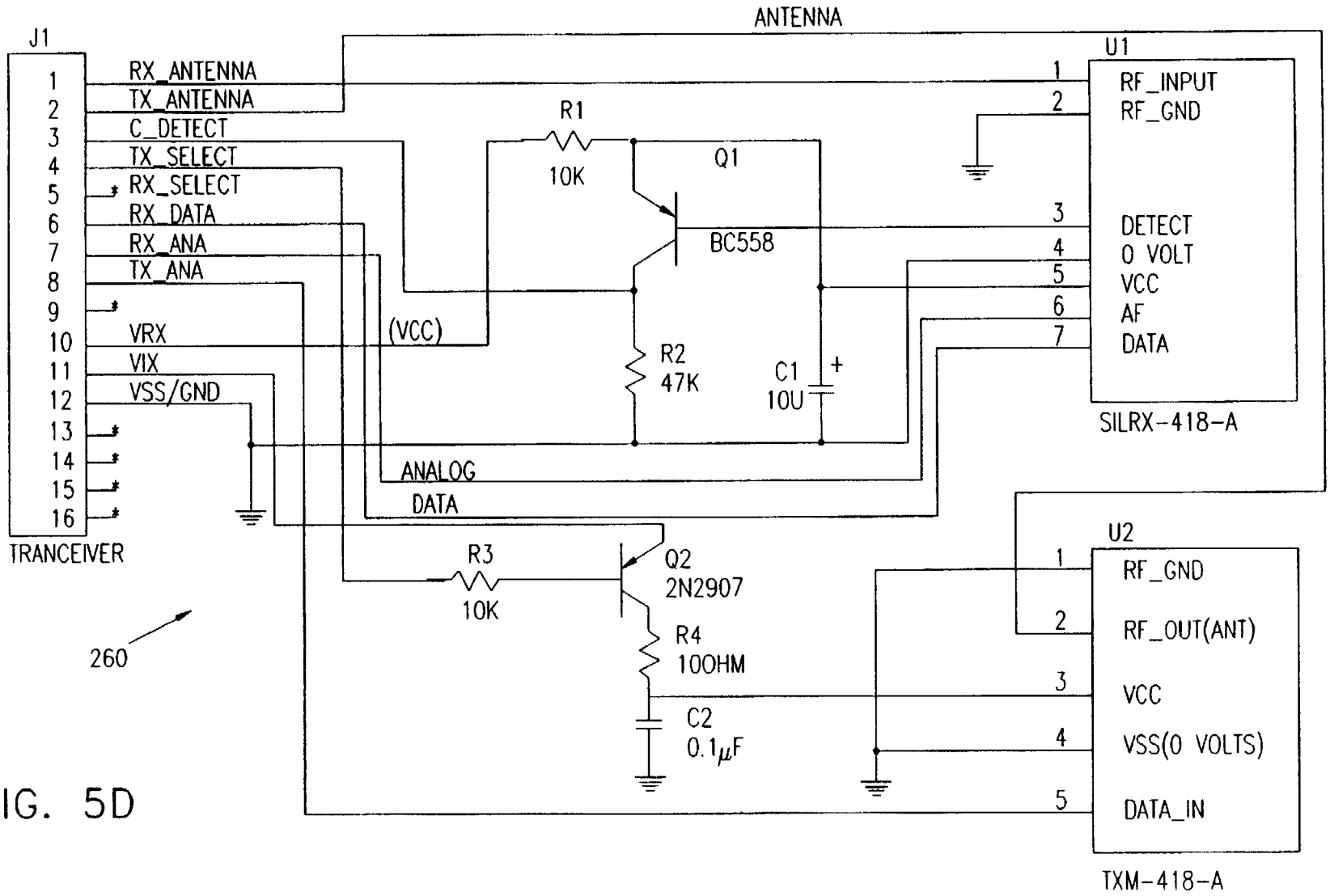

The following is a preferred parts list for the apparatus of FIG. 5D:

1. U1 SILRAX-418-A UFH radio telemetry receive module, Ginsburg Electronic GmbH, Am Moosfeld 85, D-81829, Munchen, Germany.
2. U2 TXM-418-A low power UHF radio telemetry transmit module, Ginsburg Electronic GmbH, Am Moosfeld 85, D-81829, Munchen, Germany.

Figure 5E:
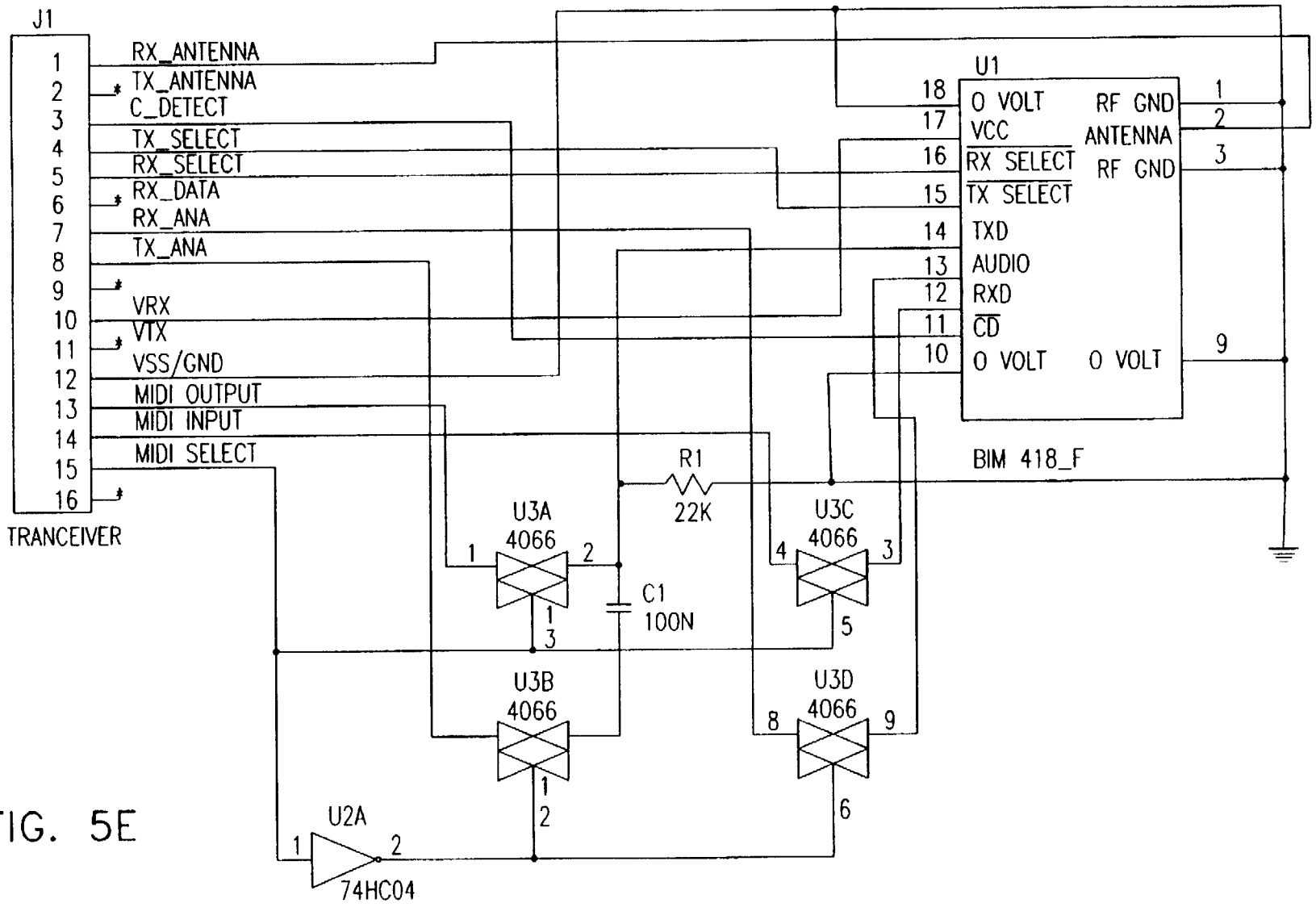
FIG. 5E is an schematic diagram of an alternative implementation of the apparatus of FIG. 5D.

Reference is now additionally made to FIG. 5E, which is a schematic diagram of an alternative implementation of the apparatus of FIG. 5D. The following is a preferred parts list for the apparatus of FIG. 5E:

1. U1 BIM-418-F low power UHF data transceiver module, Ginsburg Electronic GmbH, Am Moosfeld 85, D-81829, Munchen, Germany.

Alternate 1. U1 S20043 spread spectrum full duplex transceiver, AMI Semiconductors-American Microsystems, Inc., Idaho, U.S.A.

Alternate 1. U1 SDT-300 synthesized transceiver, Circuit Design, Inc., Japan.

In the parts list for FIG. 5E, one of item 1 or either of the alternate items 1 may be used for U1.

It is appreciated that the appropriate changes will have to be made to the circuit boards for alternate embodiments of the apparatus.

The apparatus of FIG. 5E has similar functionality to the apparatus of FIG. 5D, but has higher bit rate transmission and reception capacity and is, for example, preferred when MIDI data is transmitted and received.

FIGS. 5A–5E are self-explanatory with regard to the above parts lists.

Figure 6:
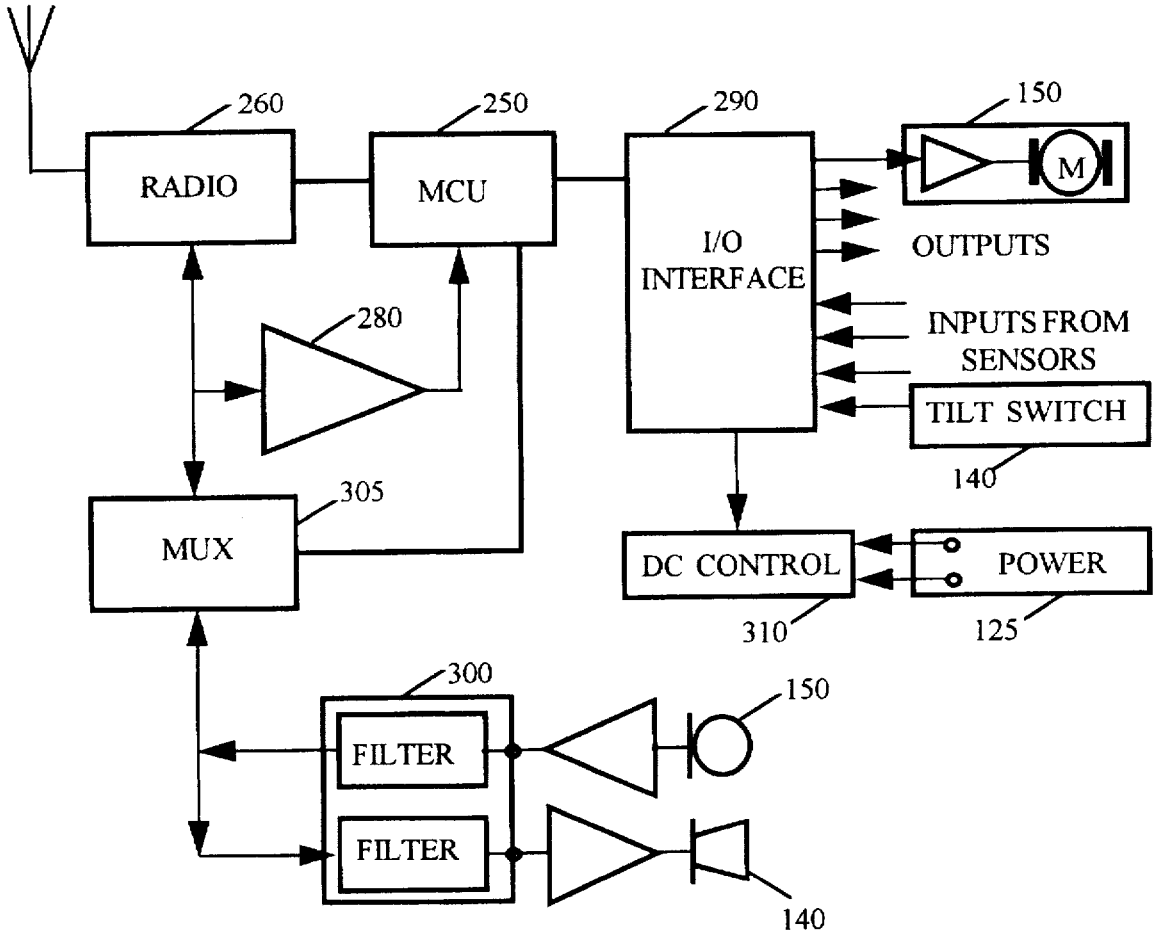
FIG. 6 is a simplified block diagram of a preferred implementation of the toy control device 130 of FIG. 1A.
Figure 7A:
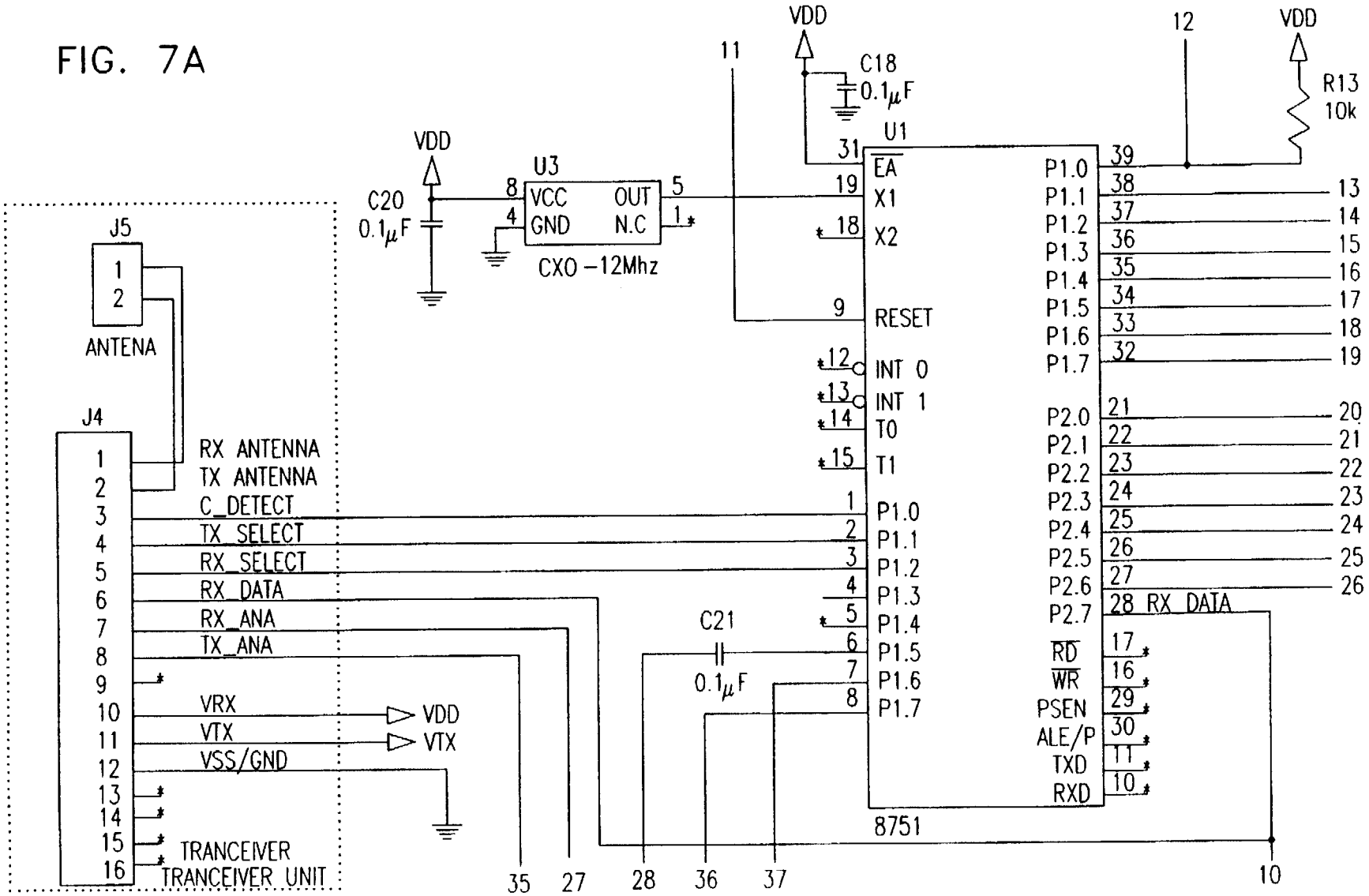
FIGS. 7A–7F, taken together with either FIG. 5D or FIG. 5E, comprise a schematic diagram of the apparatus of FIG. 6.
Figure 7B:
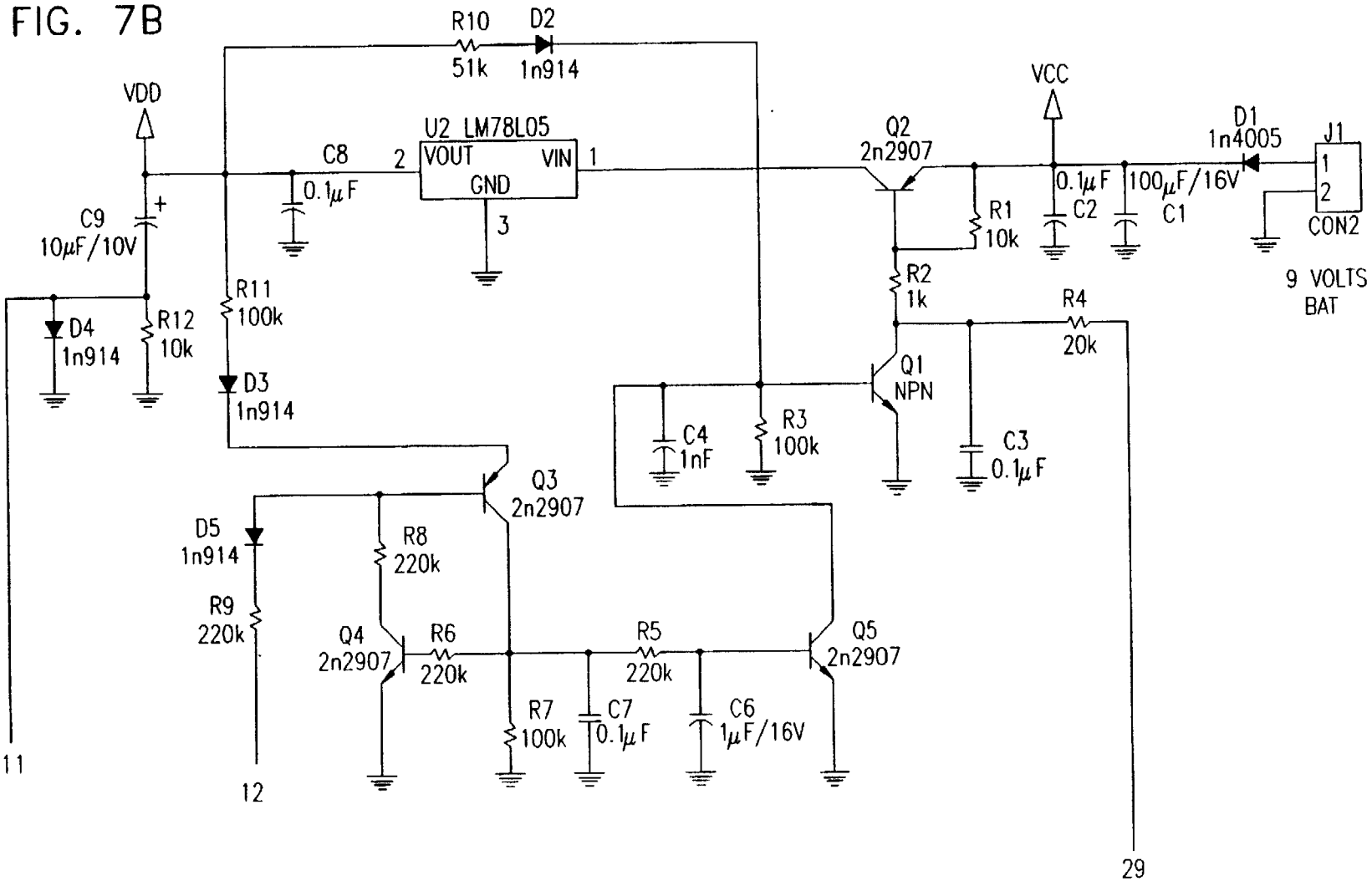
Figure 7C:
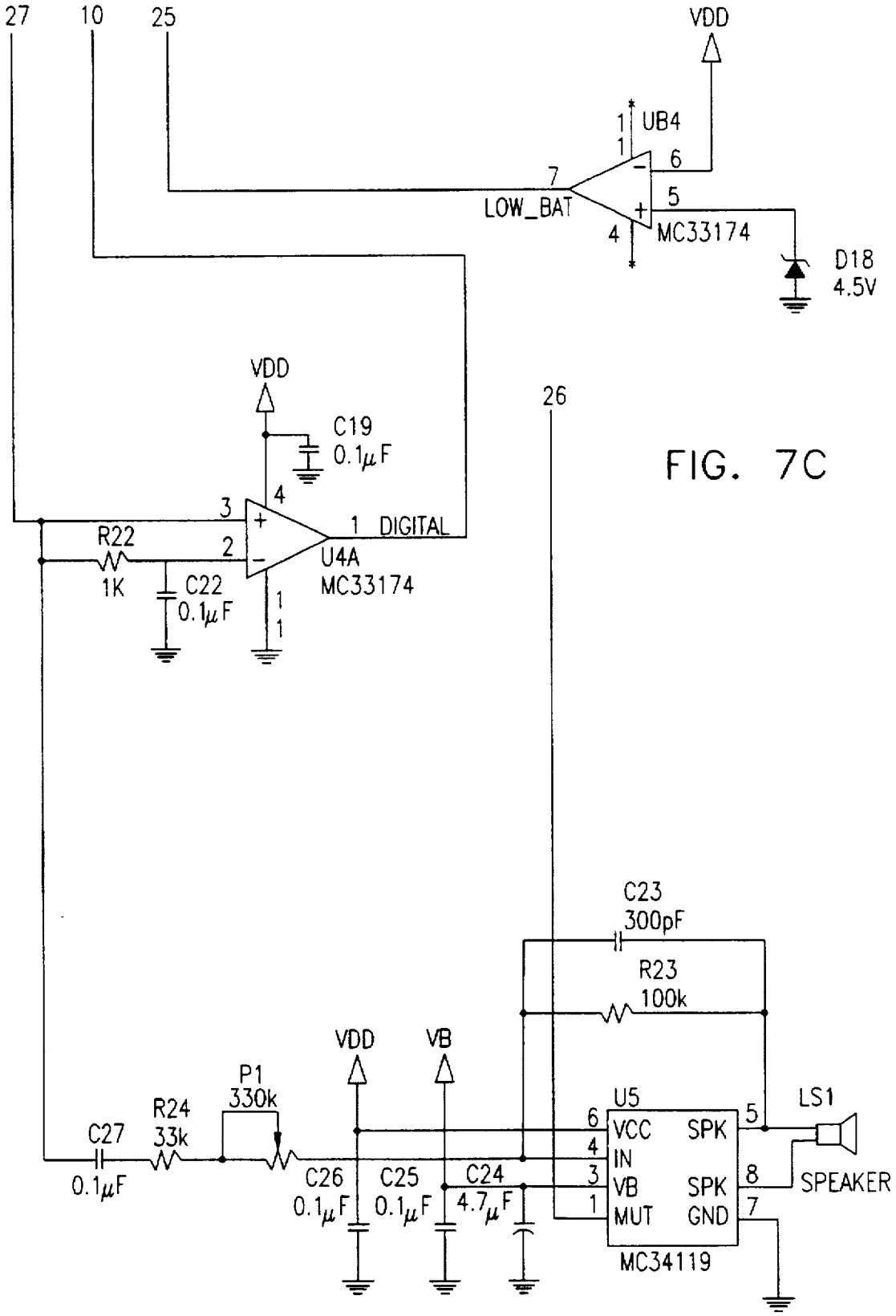
Figure 7D:
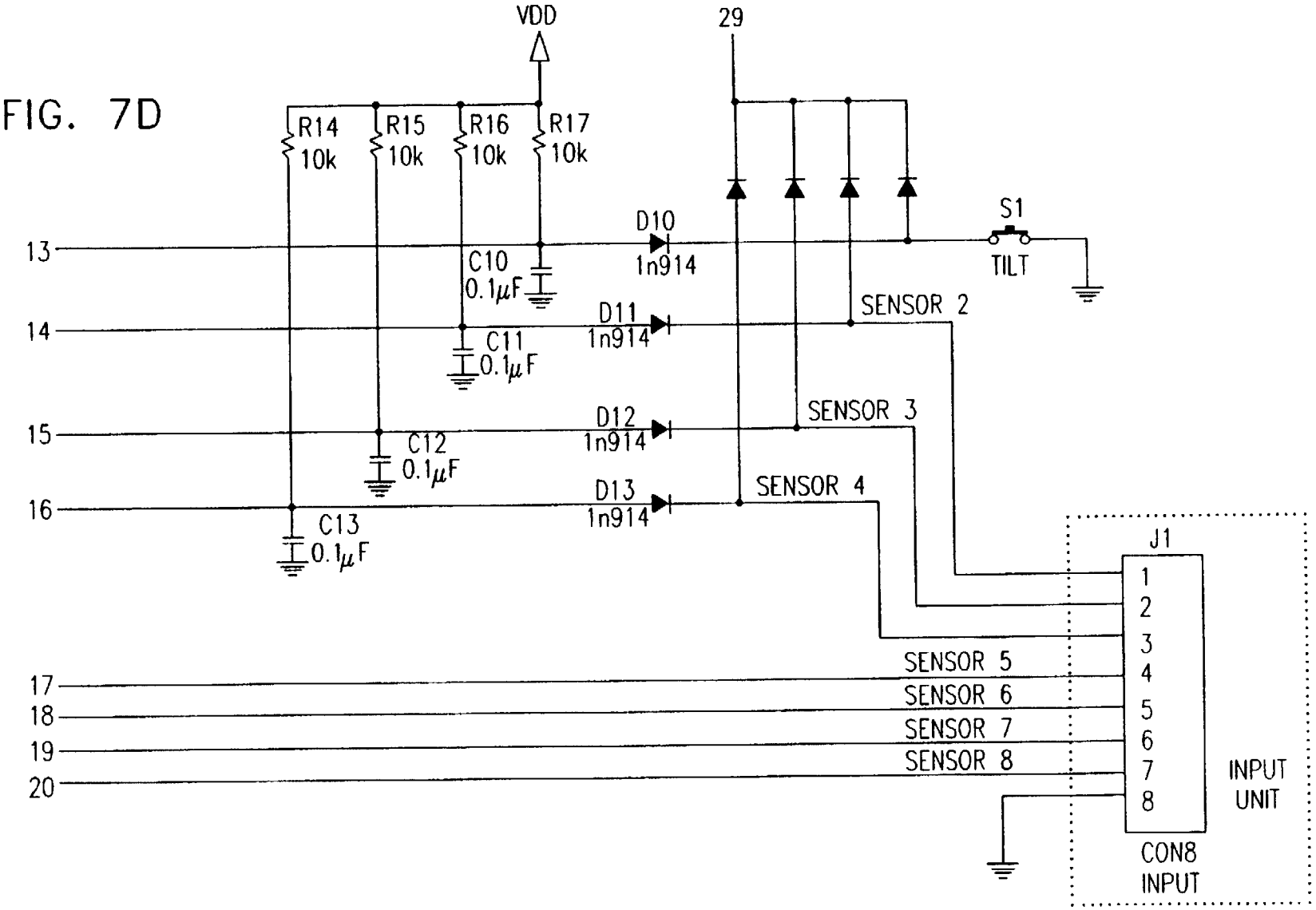
Figure 7E:
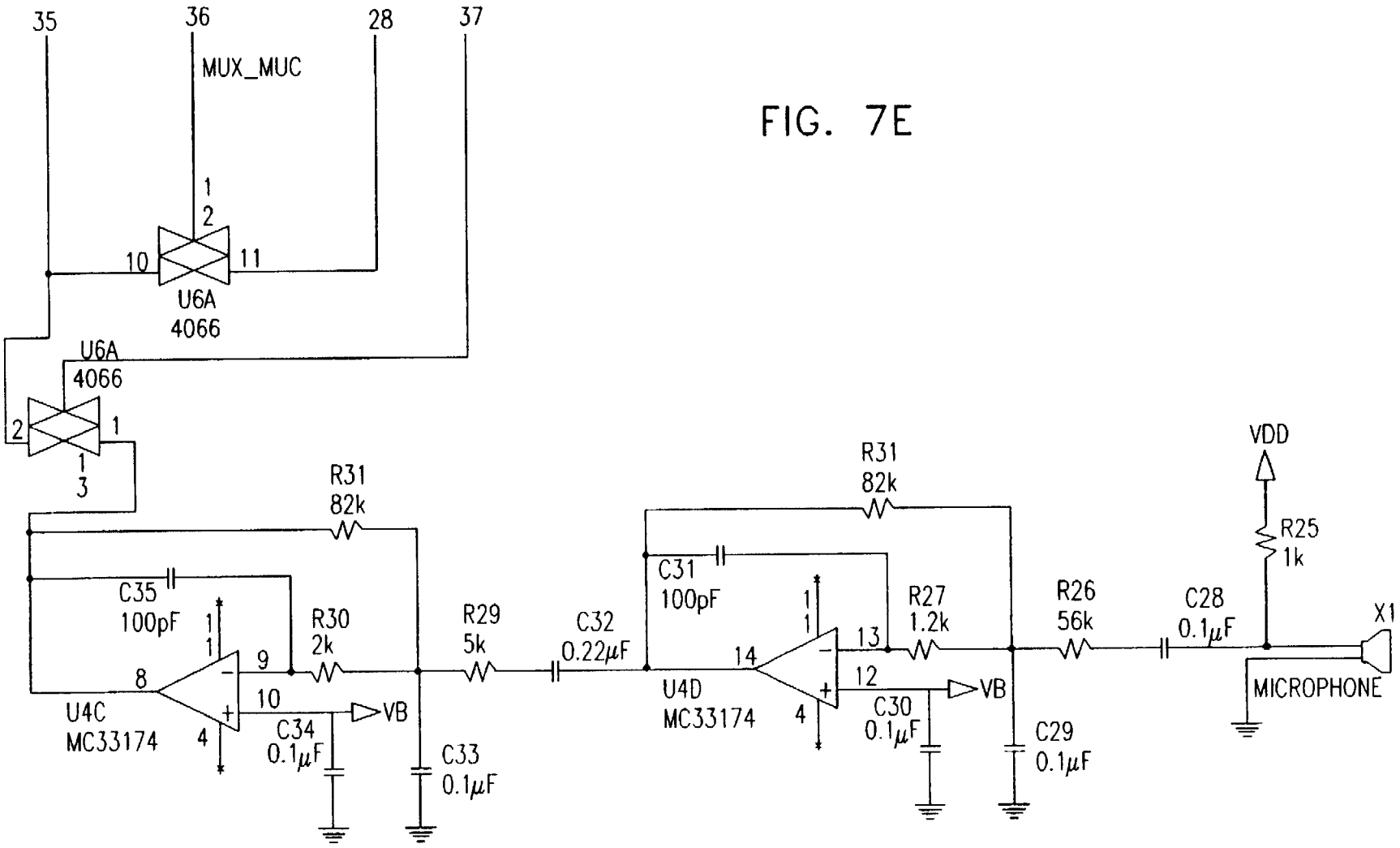
Figure 7F:
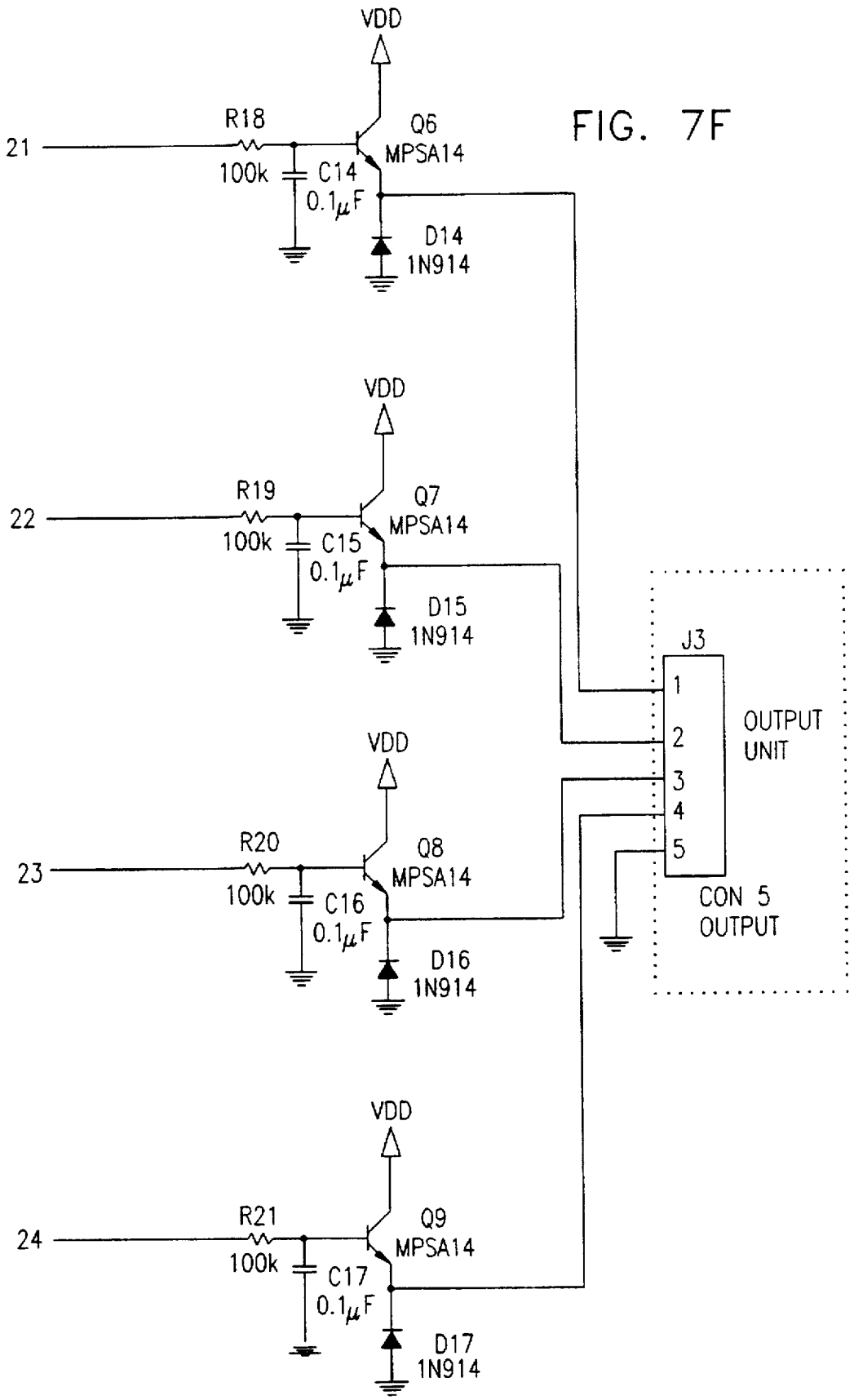

Reference is now made to FIG. 6 which is a simplified block diagram of a preferred embodiment of the toy control device 130 of FIG. 1A. The apparatus of FIG. 6 comprises a radio transceiver 260, similar to the radio transceiver 260 of FIG. 4. The apparatus of FIG. 6 also comprises a microcontroller 250 similar to the microcontroller 250 of FIG. 4.

The apparatus of FIG. 6 also comprises a digital input/output interface (digital I/O interface) 290, which is operative to provide an interface between the microcontroller 250 and a plurality of input and output devices which may be connected thereto such as, for example, four input device and four output devices. A preferred implementation of the digital I/O interface 290 is described in more detail below with reference to FIG. 7A–7F.

The apparatus of FIG. 6 also comprises an analog input/output interface (analog I/O interface) 300 operatively connected to the radio transceiver 260, and operative to receive signals therefrom and to send signals thereto.

The apparatus of FIG. 6 also comprises a multiplexer 305 which is operative, in response to a signal from the microcontroller 250, to provide output to the analog I/O interface 300 only when analog signals are being transmitted by the radio transceiver 260, and to pass input from the analog I/O interface 300 only when such input is desired.

The apparatus of FIG. 6 also comprises input devices 140 and output devices 150. In FIG. 6, the input devices 140 comprise, by way of example, a tilt switch operatively connected to the digital I/O interface 290, and a microphone operatively connected to the analog I/O interface 300. It is appreciated that a wide variety of input devices 140 may be used.

In FIG. 6, the output devices 150 comprise, by way of example, a DC motor operatively connected to the digital I/O interface 290, and a speaker operatively connected to the analog I/O interface 300. It is appreciated that a wide variety of output devices 150 may be used.

The apparatus of FIG. 6 also comprises a DC control 310, a preferred implementation of which is described in more detail below with reference to FIGS. 7A–7F.

The apparatus of FIG. 6 also comprises a comparator 280, similar to the comparator 280 of FIG. 4.

The apparatus of FIG. 6 also comprises a power source 125, shown in FIG. 6 by way of example as batteries, operative to provide electrical power to the apparatus of FIG. 6 via the DC control 310.

Reference is now made to FIGS. 7A–7F which, taken together with either FIG. 5D or 5E, comprise a schematic diagram of the apparatus of FIG. 6. The following is a preferred parts list for the apparatus of FIGS. 7A–7F:

1. U1 8751 microcontroller, Intel Corporation, San Tomas 4, 2700 Sun Tomas Expressway, 2nd Floor, Santa Clara, Calif. 95051, U.S.A.
2. U2 LM78L05, National Semiconductor, 2900 Semiconductor Drive, Santa Clara, Calif. 95052, U.S.A.
3. U3 CXO—12 MHz (crystal oscillator), Raltron, 2315 N.W. 107th Avenue, Miami, Fla. 33172, U.S.A.
4. U4 MC33174, Motorola, Phoenix, Ariz. U.S.A. Tel. No. (602)897-5056.
5. U5 MC34119, Motorola, Phoenix, Ariz. U.S.A. Tel. No. (602)897-5056.
6. U6 4066, Motorola, Phoenix, Ariz., U.S.A. Tel. No. (602)897-5056.
7. Diode 1N914, Motorola, Phoenix, Ariz. U.S.A. Tel. No. (602)897-5056.
8. Transistor 2N2222, Motorola, Phoenix, Ariz. U.S.A. Tel. No. (602)897-5056.
7. Transistors 2N2907 and MPSA14, Motorola, Phoenix, Ariz. U.S.A. Tel. No. (602)897-5056.

FIGS. 7A–7F are self-explanatory with reference to the above parts list.

As stated above with reference to FIG. 1A, the signals transmitted between the computer radio interface 110 and the toy control device 130 may be either analog signals or digital signals. It the case of digital signals, the digital signals preferably comprise a plurality of predefined messages, known to both the computer 100 and to the toy control device 130.

Each message sent by the computer radio interface 110 to the toy control device 130 comprises an indication of the intended recipient of the message. Each message sent by the toy control device 130 to the computer radio interface 110 comprises an indication of the sender of the message.

In the embodiment of FIG. 1C described above, messages also comprise the following:

each message sent by the computer radio interface 110 to the toy control device 130 comprises an indication of the sender of the message; and each message sent by the toy control device 130 to the computer radio interface 110 comprises an indication of the intended recipient of the message.

A preferred set of predefined messages is as follows:

COMMAND STRUCTURE

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |

Unit address- 24 bits:

8 bits - Computer Radio Interface address (PC address)
16 bits - Toy interface address (Doll address)

COMMANDS LIST

A. OUTPUT COMMANDS

SET_IO

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0001 Hex | 0000 | IO | 0000 | D | | | |

Set an output pin to a digital level D.
A: unit address
IO: i/o number - 0000–0111
T1,T2: time - 0000,0000–1111,1111
D: Data- 0000–0001
SET_IO_IF_SENSOR

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0002 Hex | IO | IO_D | S | SD | | | |

Set output pin to a digital level D, if detect a sensors in SD ("1" or "0")
A: unit address
IO: i/o number - 0000–0111
IO_D: i/o data- 0000–0001
S: sensor number- 0000–0111 / 1111=if one of the sensors
SD: Sensor Data- 0–1
SET_IO_IF_SENSOR_FOR_TIME

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0003 Hex | IO | IO_D | S | S_D | T | | |

Set output pin to a digital level D for a period of time, if detect SD in a sensor.
A: unit address -
IO: i/o number - 000–111
IO_D: Data- 0–1
S: sensor number 0000–0111
S_D: sensor data 0000–0001
T: time - 0000–1111
CLK_IO

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0004 Hex | IO | T | DC | 0000 | | | |

clk the i/o pin for a time T in duty cycle DC
A: unit address
IO: i/o number - 0000–0111
T: time T - 0000–1111 (sec)
DC: duty cycle 0000–1111 (× 250 ms)

E. TELEMETRY

Information sent by the TOY, as an ack to the command received.
OK_ACK

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0060 Hex | C1 | | C2 | | P1 | | |

Send back an ACK about the command that was received ok.
A: unit address

-continued

C1,C2: Received command. 16 bit
P1: Extra parameter passed. 0000–1111
TEST_RESULT_ACK

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0061 Hex | TYPE | BAT | P1 | P2 | | | |

Send back a test result after performing a self test.
A: unit address -
Type: each different TOY can have different type 0000–1111
BAT: Send back the remaining power of the batteries. 0000–1111 (<1000 = low bat)
P1: Extra parameter passed. 0000–1111
P2: Extra parameter passed. 0000–1111
TOY_STATUS

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0062 Hex | OUT | IN | P1 | P2 | | | |

Send back the status of the TOY, as requested.
A: unit address
OUT: Outputs status 0000–1111 (output #1 – output #4)
IN: Inputs status 0000–1111 (input #1 – input #4)
P1: Extra parameter passed. 0000–1111
P2: Extra parameter passed. 0000–1111
E. REQUESTS Requests sent by the TOY, beqause of an event.
TOY_AWAKE_REQ

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0070 Hex | OUT | IN | P1 | 0000 | | | |

Send req to the PC if the TOY goes from sleep mode to awake mode, beqause of chnge in one of the sensors or the tilt swich (that responds to movement).
A: unit address
OUT: Outputs status 0000–1111 (output #1 – output #4)
IN: Inputs status 0000–1111 (input #1 – input #4)
P1: Extra parameter passed. 0000–1111
TOY_LOW_BAT_REQ

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0071 Hex | OUT | IN | P1 | 0000 | | | |

Send req to the PC if the batteries of the TOY are week.
A: unit address
P1: Extra parameter passed. 0000–1111
TOY_REQ

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0072 Hex | OUT | IN | P1 | P2 | | | |

If detecting a change in one of the sensors, sending back the status of all Inputs & Outputs.
A: unit address
OUT: Outputs status 0000–1111 (output #1 – output #4)
IN: Inputs status 0000–1111 (input #1 – input #4)
P1: Extra parameter passed. 0000–1111
P2: Extra parameter passed. 0000–1111
B. INPUT COMMANDS

SEND_STATUS_OF_SENSORS

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0010 Hex | 0000 | 0000 | 0000 | 0000 | | | |

-continued send the status of all inputs/sensors of the toy back to the computer.
A: unit address
WAIT_FOR_CHANGE_IN_SENSORS_AND_SEND_NEW_STATUS

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0011 Hex | S | T | 0000 | 0000 | | | |

send the status of all sensors when there is a change in the status of one sensor.
A: unit address
S: sensor number 0000–1111 (1111 = one of the sensors)
T: max time to wait. (sec) 0001–1111

C. AUDIO OUT COMMANDS

START_AUDIO_PLAY_TILL_EOF_OR_TIMEOUT

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0020 Hex | SPK | 0000 | T | 0000 | | | |

Start playing an audio in a speaker.
A: unit address -
SPK: speaker number 0001–0010
T: TIME 0000–1111 (SEC) (0000=NO TIMEOUT)
STOP_AUDIO_PLAY (EOF)

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0021 Hex | SPK | 0000 | 0000 | 0000 | | | |

Stop playing audio in a speaker.
A: unit address
SPK: speaker number 0001–0010
START_AUDIO_PLAY_TILL_EOF_OR_SENSOR

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0022 Hex | SPK | 0000 | S | SD | | | |

Start playing an audio in a speaker till EOF or till detecting a SD level in a sensor.
A: unit address
SPK: speaker number 0001–0010
S: sensor number 0000–0111 (1111 = one of the sensors)
SD: sensor data 0000–0001 (1111 = wait till change)

D. AUDIO IN COMMANDS

TRANSMIT_MIC_FOR_TIME

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0030 Hex | T | 0000 | 0000 | 0000 | | | |

Transmit mic audio for time T.
A: unit address
T: TIME 0000–1111 (SEC)
STOP_MIC_TRANSMITIION

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0031 Hex | T | CH | 0000 | 0000 | | | |

Transmit mic audio for time T.
A: unit address

E. GENERAL COMMANDS

GOTO_AWAKE_MODE

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0040 Hex | P1 | 0000 | 0000 | 0000 | | | |

-continued

Tells the TOY to awake from power save mode & to send back an ack.
A: unit address
P1: Extra parameter passed. 0000–1111
GOTO_SLEEP_MODE

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0041 Hex | P1 | 0000 | 0000 | 0000 | | | |

Tells the TOY to go into power save mode (sleep) & to send back an ack.
A: unit address
P1: Extra parameter passed. 0000–1111
PERFORM_SELF_TEST

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0042 Hex | P1 | 0000 | 0000 | 0000 | | | |

Tells the TOY to perfom a self test & to send back an ack when ready.
A: unit address
P1: Extra parameter passed. 0000–1111
IDENTIFY_ALL_DOLLS

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | 00 | 0043 Hex | 0000 | 0000 | 0000 | 0000 | | | |

Command to tell each doll to send a status message so that the computer can know if it exists
(each doll will send the the staus message after a time set by its unit address).
USE_NEW_RF_CHANNEL

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0044 Hex | P1 | 0000 | 0000 | 0000 | | | |

Tells the TOY to switch into a new RF channel.
A: unit address
CH: New RF channel selected 0000–0011 (0–3)
P1: Extra parameter passed. 0000–1111
Note: This command is available only with enhanced radio modules (alternate U1 of FIG. 5E).

F. TELEMETRY

Information Sent by the TOY, as an ack to the command received.
OK_ACK

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0060 Hex | C1 | | C2 | | P1 | | |

Send back an ACK about the command that was received ok.
A: unit address
C1,C2: Received command 16 bit
P1: Extra parameter passed. 0000–1111
TEST_RESULT_ACK

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0061 Hex | TYPE | BAT | P1 | P2 | | | |

Send back a test result after performing a self test.
A: unit address -
Type: each different TOY can have different type 0000–1111
BAT: Send back the remaining power of the batteries. 0000–1111 (<1000 = low bat)
P1: Extra parameter passed. 0000–1111
P2: Extra parameter passed. 0000–1111

G. REQUESTS

Requests sent by the TOY, as a result of an event.
TOY_AWAKE_REQ

-continued

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0070 Hex | OUT | IN | P1 | 0000 | | | |

Send req to the PC if the TOY goes from sleep mode to awake mode, beqause of chnge in one of the sensors or the tilt swich (that responds to movement).

A: unit address
OUT: Outputs status 0000–1111 (output #1 – output #4)
IN: Inputs status 0000–1111 (input #1 – input #4)
P1: Extra parameter passed. 0000–1111

TOY_LOW_BAT_REQ

| Header | Starbit | Unit Address | Command | - 16 bits - | | | | - 8 bits - | | CRC |
|---|---|---|---|---|---|---|---|---|---|---|
| | | | | Dat1 | Dat2 | Dat3 | Dat4 | Dat5 | Dat6 | |
| 7 bit | 1 bit | 24 bits | 16 bits | | | | | | | 8 bits |
| 00 | 1 | A | 0071 Hex | OUT | IN | P1 | 0000 | | | |

Send req to the PC if the batteries of the TOY are week.

A: unit address
P1: Extra parameter passed. 0000–1111

Reference is now made to FIG. 8A, which is a simplified flowchart illustration of a preferred method for receiving radio signals, executing commands comprised therein, and sending radio signals, within the toy control device 130 of FIG. 1A. Typically, each message as described above comprises a command, which may include a command to process information also comprised in the message. The method of FIG. 8A preferably comprises the following steps:

A synchronization signal or preamble is detected (step 400). A header is detected (step 403).

A command contained in the signal is received (step 405).

The command contained in the signal is executed (step 410). Executing the command may be as described above with reference to FIG. 1A.

A signal comprising a command intended for the computer radio interface 110 is sent (step 420).

Reference is now made to FIGS. 8B–8T which, taken together, comprise a simplified flowchart illustration of a preferred implementation of the method of FIG. 8A. The method of FIGS. 8B–8T is self-explanatory.

Reference is now made to FIG. 9A, which is a simplified flowchart illustration of a preferred method for receiving MIDI signals, receiving radio signals, executing commands comprised therein, sending radio signals, and sending MIDI signals, within the computer radio interface 110 of FIG. 1A. Some of the steps of FIG. 9A are identical to steps of FIG. 8A, described above. FIG. 9A also preferably comprises the following steps:

A MIDI command is received from the computer 100 (step 430). The MIDI command may comprise a command intended to be transmitted to the toy control device 130, may comprise an audio in or audio out command, or may comprise a general command.

A MIDI command is sent to the computer 100 (step 440). The MIDI command may comprise a signal received from the toy control device 130, may comprise a response to a MIDI command previously received by the computer radio interface 110 from the computer 100, or may comprise a general command.

The command contained in the MIDI command or in the received signal is executed (step 450). Executing the command may comprise, in the case of a received signal, reporting the command to the computer 100, whereupon the computer 100 may typically carry out any appropriate action under program control as, for example, changing a screen display or taking any other appropriate action in response to the received command. In the case of a MIDI command received from the computer 100, executing the command may comprise transmitting the command to the toy control device 130. Executing a MIDI command may also comprise switching audio output of the computer control device 110 between the secondary audio interface 230 and the radio transceiver 260. Normally the secondary audio interface 230 is directly connected to the audio interface 220 preserving the connection between the computer sound board and the peripheral audio devices such as speakers, microphone and stereo system.

Reference is now made to FIGS. 9B–9N, and additionally reference is made back to FIGS. 8D–8M, all of which, taken together, comprise a simplified flowchart illustration of a preferred implementation of the method of FIG. 9A. The method of FIGS. 9B–9M, taken together with FIGS. 8D–8M, is self-explanatory.

Figure 10A:
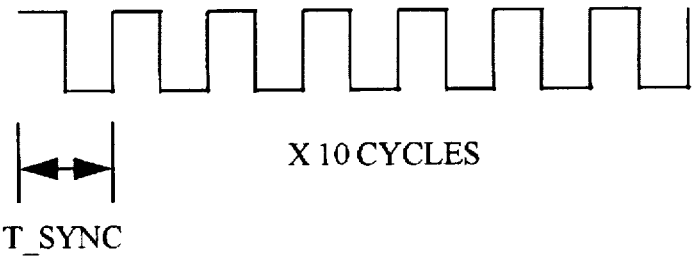
FIGS. 10A–10C are simplified pictorial illustrations of a signal transmitted between the computer radio interface 110 and the toy control device 130 of FIG. 1A.
Figure 10B:
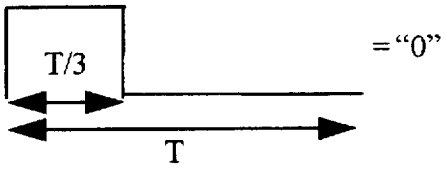
Figure 10C:
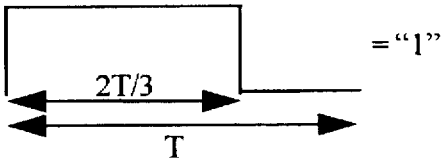

Reference is now additionally made to FIGS. 10A–10C, which are simplified pictorial illustrations of a signal transmitted between the computer radio interface 110 and the toy control device 130 of FIG. 1A. FIG. 10A comprises a synchronization preamble. The duration T_SYNC of the synchronization preamble is preferably 0.500 millisecond, being preferably substantially equally divided into on and off components.

FIG. 10B comprises a signal representing a bit with value 0, while FIG. 10C comprises a signal representing a bit with value 1.

It is appreciated that FIGS. 10B and 10C refer to the case where the apparatus of FIG. 5D is used. In the case of the apparatus of FIG. 5E, functionality corresponding to that depicted in FIGS. 10B and 10C is provided within the apparatus of FIG. 5E.

Preferably, each bit is assigned a predetermined duration T, which is the same for every bit. A frequency modulated carrier is transmitted, using the method of frequency modulation keying as is well known in the art. An "off" signal (typically less than 0.7 Volts) presented at termination 5 of U2 in FIG. 5D causes a transmission at a frequency below the median channel frequency. An "on" signal (typically over 2.3 Volts) presented at pin 5 of U2 in FIG. 5D causes a transmission at a frequency above the median frequency. These signals are received by the corresponding receiver U1. Output signal from pin 6 of U1 is fed to the comparator 280 of FIGS. 4 and 6 that is operative to determine whether the received signal is "off" or "on", respectively.

It is also possible to use the comparator that is contained within U1 by connecting pin 7 of U1 of FIG. 5D, through pin 6 of the connector J1 of FIG. 5D, pin 6 of connector J1 of FIG. 5A, through the jumper to pin 12 of U1 of FIG. 5A.

Preferably, receipt of an on signal or spike of duration less than 0.01 * T is ignored. Receipt of an on signal as shown in FIG. 10B, of duration between 0.01 * T and 0.40 * T is preferably taken to be a bit with value 0. Receipt of an on signal as shown in FIG. 10C, of duration greater than 0.40 * T is preferably taken to be a bit with value 1. Typically, T has a value of 1.0 millisecond.

Furthermore, after receipt of an on signal, the duration of the subsequent off signal is measured. The sum of the durations of the on signal and the off signal must be between 0.90 T and 1.10 T for the bit to be considered valid. Otherwise, the bit is considered invalid and is ignored.

Figure 11:
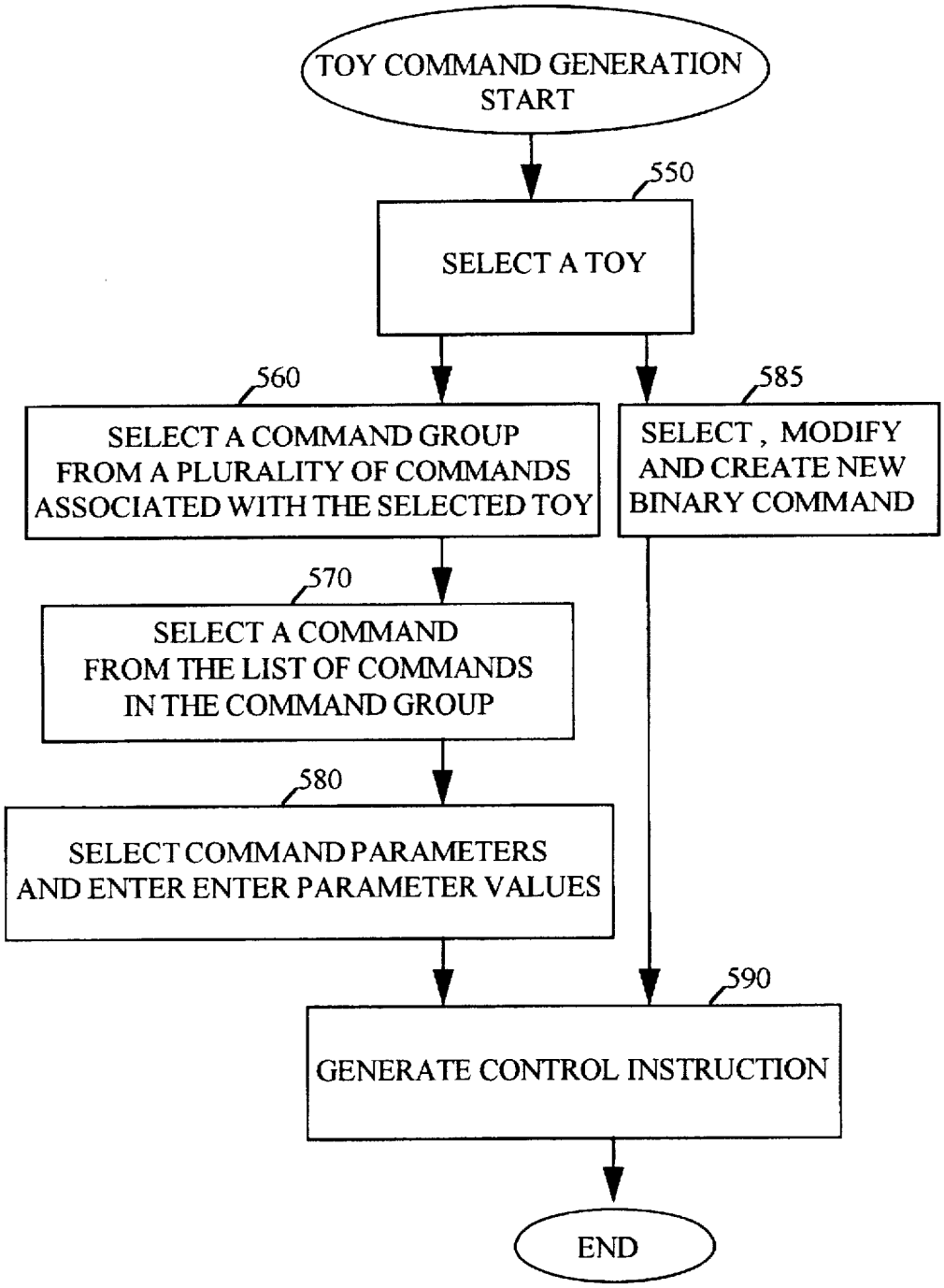
FIG. 11 is a simplified flowchart illustration of a preferred method for generating control instructions for the apparatus of FIG. 1A.

Reference is now made to FIG. 11, which is a simplified flowchart illustration of a method for generating control instructions for the apparatus of FIG. 1A. The method of FIG. 11 preferably includes the following steps:

A toy is selected (step 550). At least one command is selected, preferably from a plurality of commands associated with the selected toy (steps 560–580). Alternatively, a command may be entered by selecting, modifying, and creating a new binary command (step 585).

Typically, selecting a command in steps 560–580 may include choosing a command and specifying one or more control parameters associated with the command. A control parameter may include, for example, a condition depending on a result of a previous command, the previous command being associated either with the selected toy or with another toy. A control parameter may also include an execution condition governing execution of a command such as, for example: a condition stating that a specified output is to occur based on a status of the toy, that is, if and only if a specified input is received; a condition stating that the command is to be performed at a specified time; a condition stating that performance of the command is to cease at a specified time; a condition comprising a command modifier modifying execution of the command, such as, for example, to terminate execution of the command in a case where execution of the command continues over a period of time; a condition dependent on the occurrence of a future event; or another condition.

The command may comprise a command to cancel a previous command.

The output of the method of FIG. 11 typically comprises one or more control instructions implementing the specified command, generated in step 590. Typically, the one or more control instructions are comprised in a command file. Typically, the command file is called from a driver program which typically determines which command is to be executed at a given point in time and then calls the command file associated with the given command.

Figure 12A:
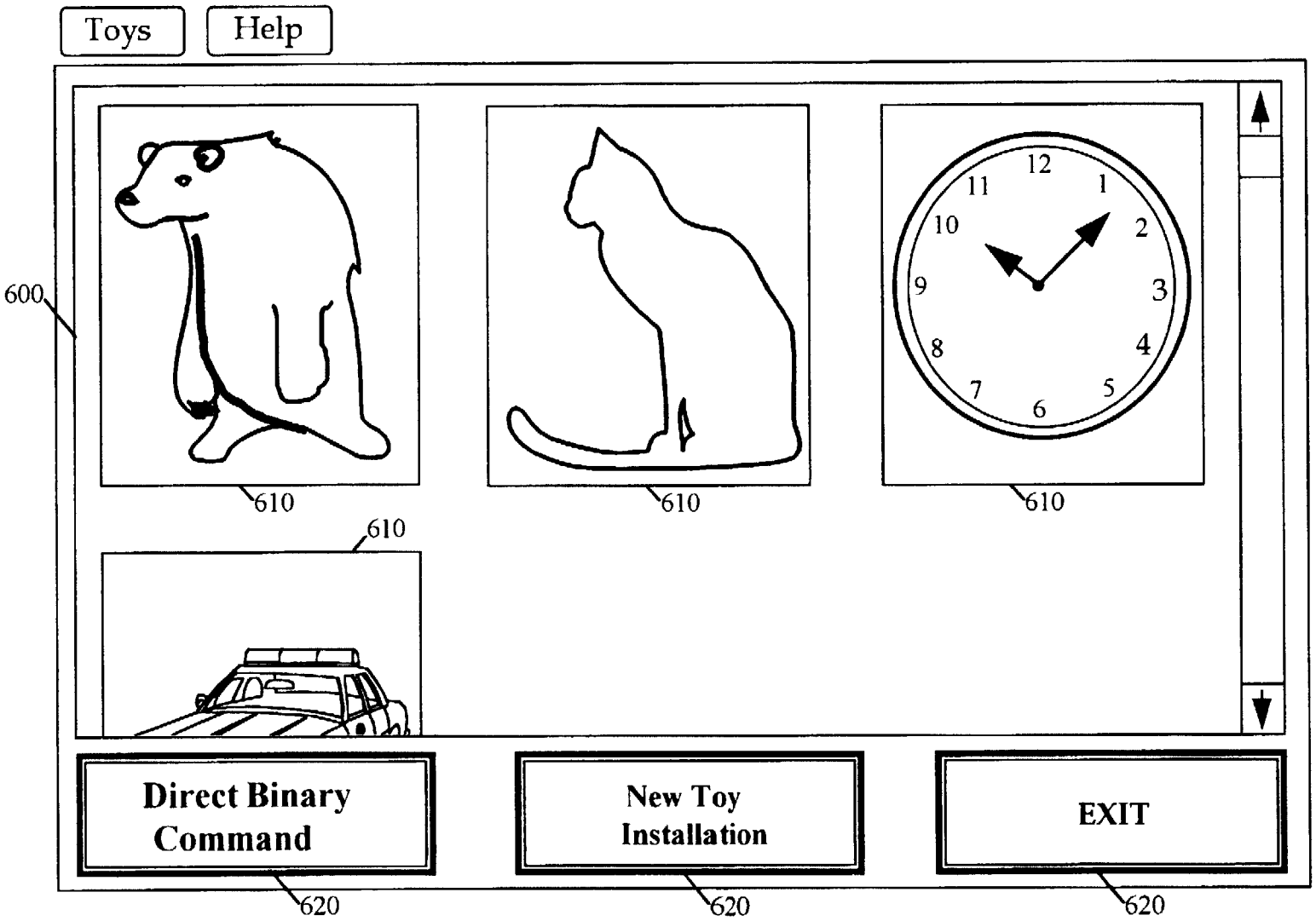
FIGS. 12A–12C are pictorial illustrations of a preferred implementation of a graphical user interface implementation of the method of FIG. 11.
Figure 12B:
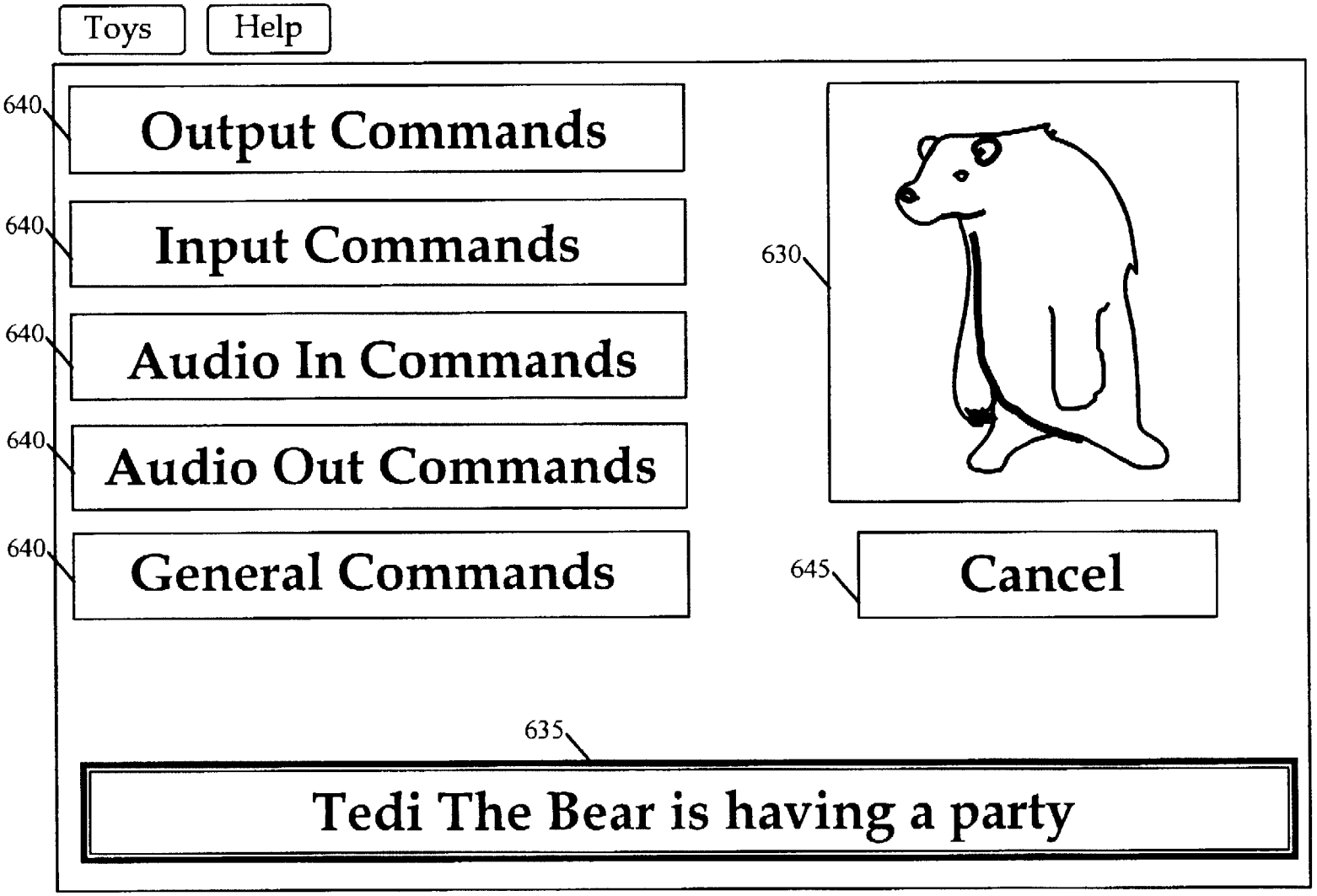
Figure 12C:
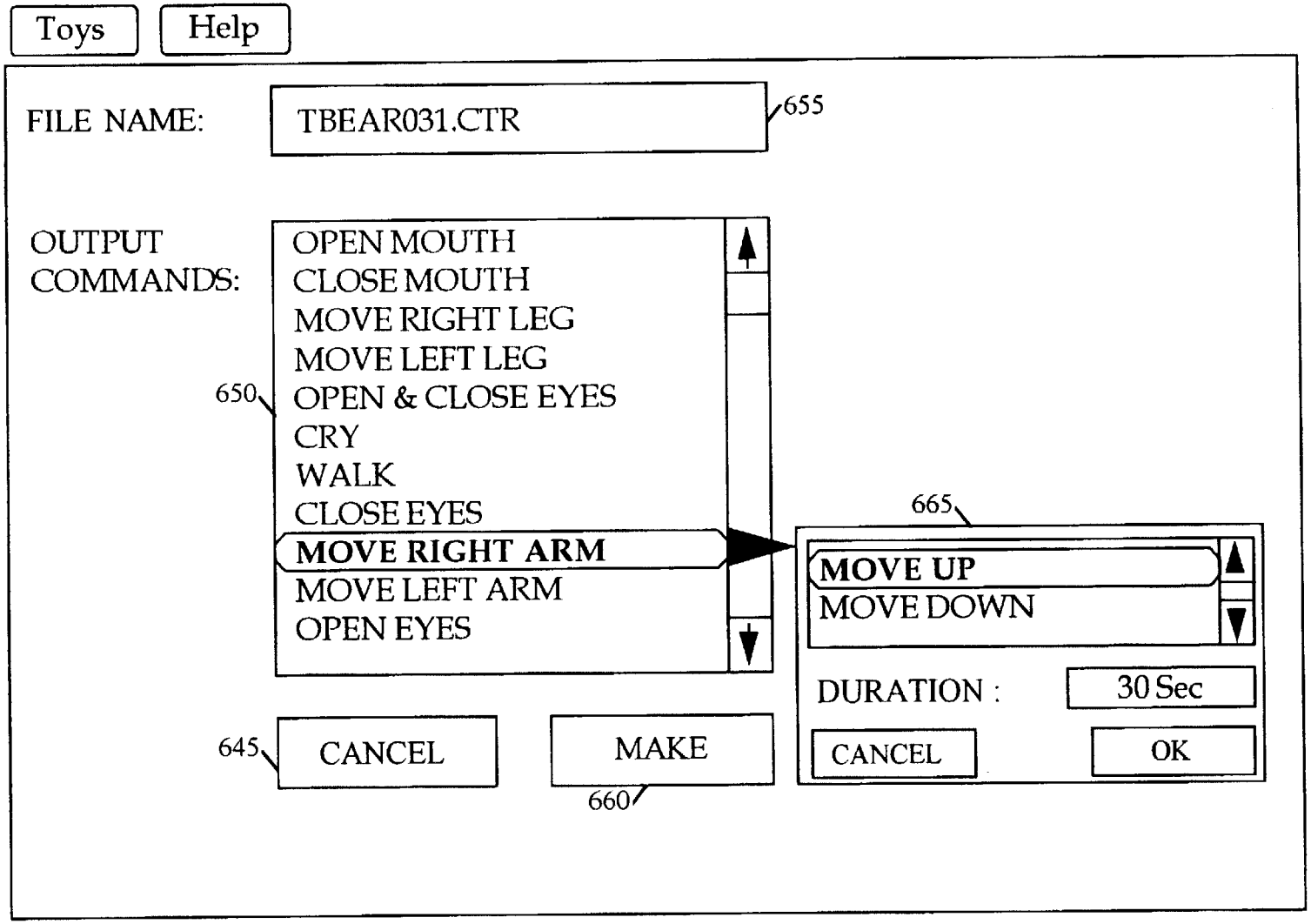

Preferably, a user of the method of FIG. 11 performs steps 550 and 560 using a computer having a graphical user interface. Reference is now made to FIGS. 12A–12C, which are pictorial illustrations of a preferred embodiment of a graphical user interface implementation of the method of FIG. 11.

FIG. 12A comprises a toy selection area 600, comprising a plurality of toy selection icons 610, each depicting a toy. The user of the graphical user interface of FIGS. 12A–12C typically selects one of the toy selection icons 610, indicating that a command is to be specified for the selected toy.

FIG. 12A also typically comprises action buttons 620, typically comprising one or more of the following:

a button allowing the user, typically an expert user, to enter a direct binary command implementing an advanced or particularly complex command not otherwise available through the graphical user interface of FIGS. 12A–12C;

a button allowing the user to install a new toy, thus adding a new toy selection icon 610; and a button allowing the user to exit the graphical user interface of FIGS. 12A–12C.

FIG. 12B depicts a command generator screen typically displayed after the user has selected one of the toy selection icons 610 of FIG. 12A. FIG. 12B comprises an animation area 630, preferably comprising a depiction of the selected toy selection icon 610, and a text area 635 comprising text describing the selected toy.

FIG. 12B also comprises a plurality of command category buttons 640, each of which allow the user to select a category of commands such as, for example: output commands; input commands; audio in commands; audio out commands; and general commands.

FIG. 12B also comprises a cancel button 645 to cancel command selection and return to the screen of FIG. 12A.

FIG. 12C comprises a command selection area 650, allowing the user to specify a specific command. A wide variety of commands may be specified, and the commands shown in FIG. 12C are shown by way of example only.

FIG. 12C also comprises a file name area 655, in which the user may specify the name of the file which is to receive the generated control instructions. FIG. 12C also comprises a cancel button 645, similar to the cancel button 645 of FIG. 12B. FIG. 12C also comprises a make button 660. When the user actuates the make button 660, the control instruction generator of FIG. 11 generates control instructions implementing the chosen command for the chosen toy, and writes the control instructions to the specified file.

FIG. 12C also comprises a parameter selection area 665, in which the user may specify a parameter associated with the chosen command.

Reference is now made to Appendix A, which is a computer listing of a preferred software implementation of the method of FIGS. 8A–8T.

Appendix A is an INTEL hex format file. The data bytes start from character number 9 in each line. Each byte is represented by 2 characters. The last byte (2 characters) in each line, should be ignored.

For example, for a sample line:

| | | |
|---|---|---|
| The original line reads- :07000000020100020320329F | | |
| The data bytes- | 02010002032032 | (02,01,00,02,03, 20,32) |
| Starting address of the data bytes- | 0000 | (00,00) |

Appendix A may be programmed into the memory of microcontroller 250 of FIG. 6.

Appendix B is a computer listing of a preferred software implementation of the method of FIGS. 9A–9N, together with the method of FIGS. 8D–8M.

Appendix B is an INTEL hex format file. The data bytes start from character number 9 in each line. Each byte is represented by 2 characters. The last byte (2 characters) in each line, should be ignored.

For example, for a sample line:

| | |
|---|---|
| The original line reads- :07000000020100020 5A73216 | |
| The data bytes- | 0201000205A732 (02,01,00,02,05, A7,32) |
| Starting address of the data bytes- | |
| 0000 | (00,00) |

Appendix B may be programmed into the memory of microcontroller 250 of FIG. 4.

Appendix C is a computer listing of a preferred software implementation of an example of a computer game for use in the computer 100 of FIG. 1.

Appendix D is a computer listing of a preferred software implementation of the method of FIG. 11 and FIGS. 12A–12C.

For Appendices C and D, these programs were developed using VISUAL BASIC. To run the programs you need to install the VISUAL BASIC environment first. The application needs a Visual Basic custom control for performing MIDI I/O similar to the one called MIDIVBX.VBX. VISUAL BASIC is manufactured by Microsoft Corporation, One Microsoft Way, Redmond, Wash. 98052-6399, U.S.A. MIDIVBX.VBX is available from Wayne Radinsky, electronic mail address a-wayner@microsoft.com.

The steps for programming the microcontrollers of the present invention include the use of a universal programmer, such as the Universal Programmer, type EXPRO 60/80, manufactured by Sunshine Electronics Co. Ltd., Taipei, Japan.

The method for programming the microcontrollers with the data of Appendices A and B, includes the following steps:

1. Run the program EXPRO.EXE, which is provided with the EXPRO 60/80".
2. Choose from the main menu the EDIT/VIEW option.
3. Choose the EDIT BUFFER option.
4. Enter the string E 0000.
5. Enter the relevant data (given in Appendices A or B), byte after byte, starting from the address 0000. In each line there is a new starting address for each data byte which appears in this line.
6. Press ESC.
7. Enter the letter Q.
8. Choose from the main menu the DEVICE option.
9. Choose the MPU/MCU option.
10. Choose the INTEL option.
11. Choose the 87C51.
11. Choose from the main menu the RUNFUNC option.
12. Choose the PROGRAM option.
13. Place the 87C51 chip in the programmer's socket.
14. Enter Y and wait until the OK message.
15. The chip is now ready to be installed in the board.

The method for creating the relevant files for the computer 100, with the data of Appendices C and D, includes using a HEX EDITOR which is able to edit DOS formatted files. A typical HEX and ASCII editor is manufactured by Martin Doppelbauer, Am Spoerkel 17, 44227 Dortmund, Germany, UET401 at electronic mail address hrz.unidozr.uni-dortmund.de.

The steps necessary for creating the files by means of a HEX editor, such as by the Martin Doppelbauer editor include the following:

1. Copy any DOS file to a new file with the desired name and with the extension .EXE. (For example, write COPY AUTOEXEC.BAT TOY1.EXE).
2. Run the program ME.EXE.
3. From the main menu press the letter L(load file).
4. Write the main menu of the new file (for example TOY1.EXE).
5. From the main menu, press the letter (insert).
6. Enter the relevant data (written in Appendices C or D), byte after byte, starting from the address 0000.
7. Press ESC.
8. From the main menu, enter the letter W(write file).
9. Press the RETURN key and exit from the editor by pressing the letter Q.

It is appreciated that the software components of the present invention may, if desired, be implemented in ROM (read-only memory) form. The software components may, generally, be implemented in hardware, if desired, using conventional techniques.

It is appreciated that the particular embodiment described in the Appendices is intended only to provide an extremely detailed disclosure of the present invention and is not intended to be limiting.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

U 010524-0
08/561316

Appendix A

```
:0700000002010002032 0329F
:01000B0032C2
:040013001205793227
:01001B0032B2
:0100230032AA
:01005300327A
:1001000000C2AFC2A8C2AAC28CC28E758125758EEC
:1001100001120831C22574AB120545000012031B01
:10012000120571C2211203660012014F12016D20E7
:1001300093081207290012083100302106001 2012D
:100140008A80D930250280B880E5D2A5C2A722C214
:10015000A5D2A72220A707D2A7740A1208AC223082
:10016000A707C2A7740A1208AC22D2A622C2A622EE
:10017000C2AFC2A8C2AAC2A9C2AB22D2AFD2A8D271
:10018000AAD2A9D2ABD28CD28E22C000C001C002AA
:10019000C2A020212512057612031B120366D2B8D5
:1001A000C2A1C221C22078FF79FF7A0A20210BD890
:1001B000FBD9F9DAF71203958017C22100120395D3
:1001C000001202E330200A1206110012074000D28A
:1001D0002000D2A0D2A1C2B8D002D001D00022C04B
:1001E00000C001C002D22020901B78FF79FF7A0264
:1001F00020900AD8FBD9F9DAF7C2208008740112DE
:1002000008AC3090EBD002D001D00022C000C00179
:10021000C002D22030901978FF79FF7A1430900A0A
:10022000D8FBD9F9DAF7C2208006120857209 0EDE2
:10023000D002D001D00022C000C00131DF30202E1A
:1002400031541203167402 1208AC1202741202B274
:1002500074021208AC781A790AE61202907402123B
:1002600008AC08D9F4001208691203 1B315F00D0F2
:1002700001D00022C000781ED297120857120857EA
:10028000120857C297120857120857D8EBD000220D
:10029000C0E0C0001202CC78081350051202B580ED
:1002A000031202CCD8F31202B500D000D0E022D263
:1002B0009722C29722C000D2977808120857D8FB1D
:1002C000C2977804120857D8FBD00022C000D297FA
:1002D0007804120857D8FBC2977808120857D8FB41
:1002E000D00022001203A730201778107401F608FE
:1002F000790912043A00302008F608D9F5D2208096
:1003000001000022003170C297002200C297003124
:100310007B1203660022C297C29122C297D2912219
:10032000209042C0D0C0E0C083C082C28C858C08BF
:10033000858A09758C00758A00D28C90019012050F
:100340002C3023139002581205 2C20230AD50F0DB0
:10035000750F06D2218006750F06C22100D082D00B
:1003600083D0E0D0D032750A00750B00750C007593
:100370000D00758911C2A9C2AB758C00758A00D2B7
```

```
:100380008C758D00758B00D28ED288D2A8D2AF2208
:10039000D288D2A822C2A822D2A030B2FD220071F7
:1003A00098001203A70022C0007195C2A0C2207558
:1003B0000EFF7832750E00C222C2A2C2A11204FD45
:1003C00030206FD2A2C28C758C00758A00D28C123C
:1003D00004CE30205D85080C85090DC2A21204FDF3
:1003E00030204FC28C758C00758A00D28CD2A290BE
:1003F00003E812052C30233590051412052C202318
:100400002C00850C08850D0990022612052C30233E
:1004100004D2228002C222A22292A1E50E13F50E7E
:10042000B4010D1204CE302009D2208007750EFFD2
:10043000D89DC220D2A000D00022C000C2A0C220FD
:10044000750E007809750E00C222C2A2C2A1120464
:10045000FD302072D2A2C28C758C00758A00D28CBD
:100460001204CE30206085080C85090DC2A212044A
:10047000FD302052C28C758C00758A00D28CD2A2BD
:100480009003E812052C30233D90051412052C2012
:10049000233400850C08850D0990022612052C30A6
:1004A0002304D2228002C222A22292A1E50E13F5D9
:1004B0000EE8B4090320220ED8A61204CE3020067E
:1004C000E50ED2208002C220D2A000D00022C000BF
:1004D000C001C002C220790A78FF30B206D8FBD929
:1004E000F98013C28C858C08858A09D28C7A0A20FF
:1004F000B2E8DAFBD220D002D001D00022C000C086
:1005000001C002C220790A78FF20B206D8FBD9F9CF
:100510008013C28C858C08858A09D28C7A0A30B205
:10052000E8DAFBD220D002D001D00022C223E508B5
:10053000B583028004400D8009E509B5820280027E
:100540004002D22322C000C001C002FA790A74001E
:10055000781AF608D9FC781A7401F608EAF608F653
:1005600008F61208940012074000D002D001D00013
:1005700022D2AAD2AF22C2AA22C0E0C0D0C2A1D247
:10058000A0C29412079030200D001205A100743211
:100590001208AC71900000D294B17100D0D0D0E0BC
:1005A00022C0001205F7007810E6B401467814E680
:1005B000B400090051370031 8A008037B4010900C6
:1005C000513700318A00802BB402070012062B003D
:1005D0008021B40307001206A4008017B4040900A8
:1005E000513700318A00800BB40C07001206CB0093
:1005F00080010000D00022C000C001C00278107944
:100600001A7A0AE6F70809DAFA00D002D001D00017
:1006100022C000C001C0027810791A7A0AE6F708F1
:1006200009DAFA00D002D001D00022C0007815E625
:10063000B400110051370031 8A30206400314A0083
:1006400071168 05CB4011900711B00314F316D745B
:10065000641208AC0051370031 8A302043008040DA
:10066000B402110051370031 8A30203400314A0081
:1006700071168 02CB4031900711B00314F316D7459
:10068000641208AC0051370031 8A3020130080100A
```

```
:10069000B4040C00513700318A302004008001007E
:1006A00000D00022C0007815E6B4001A00513700CF
:1006B000318A30201200316A7816E61208CD0031F6
:1006C0006D314F0080010000D00022C0007815E697
:1006D000B4000B314A0074ACB14571168026B401E8
:1006E0000B711B0074ACB145314F8018B40204315A
:1006F000548011B40304315F800AB40F02D2257410
:10070000ABB1450000D00022C000C0017808C2B7DC
:10071000790ED9FE1392B7790DD9FED8F7D2B779F1
:100720000ED9FE00D001D00022781A90090D790A66
:10073000740093F608A3D9F812074000513700223D
:10074000C000C001781A790AE654F003030303F1EC
:1007500008E6540FF10808D9EF007400F10800D042
:1007600001D00022C000C001740078087907D9FECA
:1007700000A2B313B2A0D8028006790CD9FE80F192
:10078000D220791420B304D9FBC220D001D000229A
:10079000C000C001C002C22078107914F16430207A
:1007A00020F608D907D2201207CC8018B2A17AFF10
:1007B00030B304DAFB800A20B3FD007A08DAFE8049
:1007C000DBC2200000D002D001D00022C000C00156
:1007D000C002C003781079107A0AE61207F82323C2
:1007E0002323FB08E61207F84BF70809DAEC00D0E0
:1007F00003D002D001D00022B441004005C3943799
:100800008003C394300022C0D0C0E0D0E0D0D0320A
:10081000C0E0C0F0C0E075F0086A13EA5002641846
:1008200013FAD0E003C0E0D5F0EFD0E0D0F0D0E094
:1008300022C000C001C00278FF79FF7A08D8FED933
:10084000FCDAFAD002D001D0002200000022C00061
:100850007814D8FED00022C000782DD8FED0002217
:10086000C000785ED8FED00022C00078FAD8FED052
:100870000022C000C00178FF7902D8FED9FCD00167
:10088000D00022C000C00178FF7914D8FED9FCD076
:1008900001D00022C000C00178FF79C8D8FED9FC81
:1008A000D001D00022D582FDD583FA22C0E0C0005D
:1008B000F81172D8FCD000D0E022C0E0C000B40033
:1008C000028005F81194D8FCD000D0E022C0E0C02E
:1008D00000B400028005F81131D8FCD000D0E0222D
:1008E000C0E0C000C0F075F014A4F8D8FED0F0D07D
:1008F00000D0E022C000C001C00278FF79FF7A0476
:10090000D8FED9FCDAFAD002D001D0002201AABB6D
:07091000CCDDEEFF0F10111A
:00000001FF
```

U 010524-0

Appendix B

```
:0700000000201000205A73216
:01000B0032C2
:0100130032BA
:01001B0032B2
:0100230032AA
:01005300327A
:1001000000C2AFC2A8C2AAC28CC28ED2B875812862
:10011000120169120192120180120 5A2C238C2397D
:10012000D2B1C23778031208DEC2311205ED1201D6
:100130007912018074CA1201E90030310FC2310016
:1001400012061C00120221001206170000303814 9B
:10015000E580B4FF02800D1201AF2039051204358D
:100160008002C23820379980D1C2A1C2A2C2A3C2E4
:10017000A422D296C295C2B122C296D295D2B12201
:10018000D2A622C2A622120495303002C2A622C2F2
:10019000A722D2A722C2AFC2A8C2AAC2A9C2AB22BA
:1001A000D2AFD2A8D2AAD2A9D2ABD28CD28E22C040
:1001B00000C0017401781AF6087406F608F608748F
:1001C00005F608740AF6087400F6087914E7F608CC
:1001D00009E7F608E580F6087400F60012086500E5
:1001E0001204C000D001D00022C000C001C002FA39
:1001F0007401781AF6087406F608F6087405F6080D
:10020000740AF6087400F608EAF608F608F67400B0
:1002100008F6120865001204C000D002D001D00018
:1002200022C000A2A6923600120568A23692A6301D
:10023000304D007813E6B405477814E6B4000D009D
:1002400031AF0012028930303600803 2B40107002D
:1002500012030E008028B4020A0031AF00120342DC
:1002600000801BB4030A0031AF001203ED00800EC2
:10027000B4040A0031AF0012041100800100000034
:1002800078011208DE00D00022C000C2307815E6E6
:10029000B401137817E61392347816E6540F12025D
:1002A000D530302D802BB40227007817E613923416
:1002B0007816E6540F1202D5303016007818E61280
:1002C000088B007816E6A23592341202D500800120
:1002D0000000D00022D230B4000AA2A19235A2348C
:1002E00092A18029B4010AA2A29235A23492A280DE
:1002F0001CB4020AA2A39235A23492A3800FB403C5
:100300000AA2A49235A23492A48002C23022C00074
:100310007815E6B400060031AF008022B401083140
:10032000AFD238C2398017B4020831AFD238D239CF
:10033000800CB4030831AFC238C23980010000D04C
:100340000022C000C001C0027815E6B400070031E9
:1003500083000203E5B4010700318000 0203E5B425
:1003600002100031830078 18E6540FD23451D500C2
:100370008073B4031000318000 7818E6540FC23443
```

E 3 3 9 9 7 4 1 3

```
:1003800051D5008060B4045C31807817E612088B88
:100390007816E6540FF9E603030303540FFA318687
:1003A0003030427818E6540FB40F02802FD2345107
:1003B000D500EA1207F6303012E912089EC234E680
:1003C00051D5EA9912089E3180801A12089E318018
:1003D000E99A12089EC234E651D58009EA12089EB5
:1003E00031808001000D002D001D00022C000780E
:1003F00015E6B4000E0031727816E612089E3179C7
:1004000000800AB40106003179008001000D000AC
:1004100022C0007815E6B4000600319200801 2B4C4
:1004200001060031 8F008009B40F0500D23780012A
:100430000000D00022C000C001C002D23078FF7995
:10044000FF7A1420311BE580B4FF02800AD8F4D96A
:10045000F2DAF0C230800A746412087DE580B4FFDD
:10046000E2D002D001D00022C000C001C002D230D0
:1004700020B31B78FF79FF7A0220B30AD8FBD9F9A1
:10048000DAF7C23080087401 2087D30B3EBD00275
:10049000D001D00022C000C001C002D23030B31958
:1004A00078FF79FF7A2830B30AD8FBD9F9DAF7C296
:1004B000308006120828 20B3EDD002D001D00022EF
:1004C000C000C001916830302A12059D74021208E4
:1004D0007D1204F9120537740212087D781A790A20
:1004E000E6120515740212087D08D9F40012083AC4
:1004F0001205A200D001D00022C000781ED29712AF
:1005000008281208281208 28C2971208281208285A
:10051000D8EBD00022C0E0C0001205517808 13507B
:100520000512053A8003120551D8F312053A00D09E
:1005300000D0E022D29722C29722C000D29778083A
:10054000120828D8FBC2977804120828D8FBD000DC
:1005500022C000D2977804120828D8FBC2977808E6
:10056000120828D8FBD000220012062E303019D2F3
:10057000A678107401F60879091206C10030300817
:10058000F608D9F5D2308001000022003195C297DB
:10059000002200C2970031A01205ED0022C297C2CE
:1005A0009122C297D2912220B342C0D0C0E0C08332
:1005B000C082C28C858C08858A09758C00758A007A
:1005C000D28C9001901207B3303313900258120767
:1005D000B320330AD50F0D750F06D2318006750F83
:1005E00006C23100D082D083D0E0D0D032750A006C
:1005F000750B00750C00750D00758911C2A9C2AB91
:10060000758C00758A00D28C758D00758B00D28E2A
:10061000D288D2A8D2AF22D288D2A822C2A822D20F
:10062000B030B2FD2200D11F0012062E0022C00001
:10063000D11CC2B0C230750EFF7832750E00C232C6
:10064000C2B6C2B112078430306FD2B6C28C758C7C
:1006500000758A00D28C12075530305D85080C85F4
:10066000090DC2B612078430304FC28C758C0075EC
:100670008A00D28CD2B69003E81207B3303335909B
:1006800005141207B320332C00850C08850D099042
```

08/561316

```
:1006900002261207B3303304D2328002C232A232B1
:1006A00092B1E50E13F50EB4010D12075530300965
:1006B000D2308007750EFFD89DC230D2B000D00076
:1006C00022C000C2B0C230750E007809750E00C29B
:1006D00032C2B6C2B1120784303072D2B6C28C7543
:1006E0008C00758A00D28C1207553030 6085080C5A
:1006F00085090DC2B6120784303052C28C758C0049
:10070000758A00D28CD2B69003E81207B330333D1D
:10071000900514 1207B320333400850C08850D09A9
:10072000900226 1207B3303304D2328002C232A2C2
:100730003292B1E50E13F50EE8B4090320320ED85B
:10074000A6120755303006E50ED2308002C230D2F4
:10075000B000D00022C000C001C002C230790A78C7
:10076000FF30B206D8FBD9F98013C28C858C08857E
:100770008A09D28C7A0A20B2E8DAFBD230D002D0D1
:1007800001D00022C000C001C002C230790A78FF47
:1007900020B206D8FBD9F98013C28C858C08858AD3
:1007A00009D28C7A0A30B2E8DAFBD230D002D0011A
:1007B000D00022C233E508B583028004400D8009D1
:1007C000E509B5820280024002D23322C0D0C0E0E7
:1007D000D0E0D0D032C0E0C0F0C0E075F0086A13BD
:1007E000EA500264 1813FAD0E003C0E0D5F0EFD06D
:1007F000E0D0F0D0E022C230B5010280044002D245
:100800003022C000C001C00278FF79FF7A08D8FE0C
:10081000D9FCDAFAD002D001D0002200000022C0B8
:10082000007814D8FED00022C000782DD8FED00069
:1008300022C000785ED8FED00022C00078FAD8FE30
:10084000D00022C000C00178FF7902D8FED9FCD0C8
:1008500001D00022C000C00178FF7914D8FED9FC75
:10086000D001D00022C000C00178FF79C8D8FED9DD
:10087000FCD001D00022D582FDD583FA22C0E0C091
:1008800000F81143D8FCD000D0E022C0E0C000B492
:1008900000028005F81165D8FCD000D0E022C0E04D
:1008A000C000B400028005F81102D8FCD000D0E0EE
:1008B00022C0E0C000C0F075F014A4F8D8FED0F05B
:1008C000D000D0E022C000C001C00278FF79FF7ADA
:1008D00004D8FED9FCDAFAD002D001D0002200C040
:1008E000E0C000C2B47450117DD2B47450117DD8F0
:0608F000F2D000D0E0226E
:00000001FF
```

U 010524-0

Appendix C 4D 5A 80 01 05 00 00 00 20 00 00 00 FF FF 00 00 00 00 00 00
00 00 00 00 40 00 00 00 01 00 00 00 00 00 00 00 00 00 00 00
00 00 00 00 00 00 00 00 00 00 00 00 00 00 00 00 00 00 00 00
00 06 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 8C D8 33 DB 8E D0 8B E3
53 50 B8 0F 01 50 CB B1 20 B8 01 00 D3 D8 83 F8 01 74 0D BA
1E 03 B4 09 CD 21 B0 01 B4 4C CD 21 B4 30 CD 21 3C 03 73 05
BA 1E 03 EB E9 8E 06 2C 00 33 C0 8B F8 B9 FF FF 26 81 3D 50
41 75 16 26 81 7D 02 54 48 75 0E 26 80 7D 04 3D 75 07 8D 75
05 89 36 9B 03 26 81 3D 77 69 75 1C 26 81 7D 02 6E 64 75 14
26 81 7D 04 69 72 75 0C 26 80 7D 06 3D 75 05 BA 49 03 EB 9E
F2 AE 26 38 05 75 B9 8D 7D 03 89 3E 9D 03 B4 19 CD 21 04 41
BE D8 02 88 04 46 C6 04 3A 46 C6 04 5C 46 B4 47 B2 00 CD 21
8C D8 8E C0 BF D8 02 32 C0 B9 46 00 F2 AE 4F 80 7D FF 5C 74
04 C6 05 5C 47 BE D0 02 8B 0E CE 02 F3 A4 BA D8 02 B8 00 3D
CD 21 72 0F A3 9F 03 EB 48 8C D0 8E D8 BA 1E 03 E9 3B FF 8B
36 9B 03 83 FE FF 74 ED 8E 1E 2C 00 8B FE 80 3C 00 74 E2 AC
3C 3B 74 04 0A C0 75 F7 8B CE 2B CF 83 F9 01 74 E7 8B F7 BF
D8 02 F3 A4 4F 8C D0 8E D8 89 36 9B 03 EB 9C BA 76 03 E9 FD
FE 8E 06 2C 00 8B 3E 9D 03 32 C0 B9 FF FF F2 AE F7 D1 8B D9
8B D1 8C D8 8E C0 BE 81 00 26 8A 4C FF 8A C1 02 C3 3C 7E 77
D2 26 88 44 FF 32 ED 03 F1 8D 38 41 FD F3 A4 FC BF 81 00 26
C6 05 20 47 8B 36 9D 03 8E 1E 2C 00 8B CB 49 F3 A4 BF D8 02
32 C0 B9 FF FF F2 AE F7 D1 8C D8 8E C0 8C D0 8E D8 A1 9D 03
03 C2 2B D1 73 08 24 0F 04 F1 38 C2 72 89 8B 3E 9D 03 BE D8
02 F3 A4 8C D8 8E C0 8B 1E 9F 03 BE 5C 00 C7 04 BC FE C7 44

02 FF CD C7 44 04 21 B4 C7 44 06 3E CD C7 44 08 21 E9 C7 44
0A 98 00 B4 3F B9 FF FF BA 00 01 1E 56 CB 08 00 77 69 6E 2E
63 6F 6D 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 54 68 69 73 20 70
72 6F 67 72 61 6D 20 72 65 71 75 69 72 65 73 20 4D 69 63 72
6F 73 6F 66 74 20 57 69 6E 64 6F 77 73 2E 0D 0A 24 59 6F 75
20 61 72 65 20 61 6C 72 65 61 64 79 20 72 75 6E 6E 69 6E 67
20 4D 69 63 72 6F 73 6F 66 74 20 57 69 6E 64 6F 77 73 2E 0D
0A 24 55 6E 61 62 6C 65 20 74 6F 20 73 74 61 72 74 20 4D 69
63 72 6F 73 6F 66 74 20 57 69 6E 64 6F 77 73 2E 0D 0A 24 FF
FF 00 00 00 00 00 00 00 00 00 00 00 00 00 00 00 00 00 00 00
00

00 00 20 00 2C 00 28 00 A3 31 64 98 CA F5 1C 10 8B 7B 9A F8
C4 8E 68 E6 00 00 00 00 41 4E 49 4D 31 00 00 00 00 00 00 00
00 00 00 00 03 00 A2 31 64 98 CA F5 1C 10 8B 7B 9A F8 C4 8E
68 E6 FF FF FF FF 28 00 30 01 5A 00 00 00 00 00 00 00 00 00
00 00 00 00 00 00 00 00 00 00 00 00 00 00 00 00 00 00 00 00
3C 00 6A 00 52 00 D6 00 68 00 DA 00 04 00 9C 00 B6 00 10 00
DE 00 00 00 00 00 00 00 00 00 00 00 00 00 00 00 7A 00 A2 31
64 98 CA F5 1C 10 8B 7B 9A F8 C4 8E 68 E6 95 31 64 98 CA F5
1C 10 8B 7B 9A F8 C4 8E 68 E6 01 00 68 00 6C 00 A1 31 64 98
CA F5 1C 10 8B 7B 9A F8 C4 8E 68 E6 03 00 20 16 89 E9 DA 45
1B 10 B1 76 08 00 2B 33 6F 60 01 00 03 00 3C 00 40 00 E4 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 97 31 64 98 CA F5 1C 10 8B 7B 9A F8 C4 8E 68 E6 FF FF
FF FF 70 00 00 00 00 00 00 00 00 00 00 00 00 00 00 00 00 00
00 00 00 00 00 00 00 00 00 00 00 00 00 00 00 00 00 00 00 00
00 00 00 00 4E 00 E8 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
FF CC 2D 00 02 43 01 00 00 59 00 00 00 00 05 00 46 6F 72 6D
31 00 0D 05 D0 05 00 00 D8 06 00 00 98 13 00 00 24 03 00 00
FF 00 0D 00 43 52 45 41 54 4F 52 20 20 44 45 4D 4F 00 19 01
00 42 00 23 FF FF FF FF 24 05 00 46 6F 72 6D 31 00 35 D0 05
00 00 36 D8 06 00 00 37 98 13 00 00 38 24 03 00 00 FF 01 93
00 00 00 02 05 00 4D 69 64 69 31 00 FF 08 00 56 42 58 2E 4D
49 44 49 00 02 C8 0A 08 07 50 01 50 01 FF 06 00 0B 02 00 0C
02 00 0D 29 00 56 6F 79 65 74 72 61 20 53 75 70 65 72 20 53
61 70 69 20 46 4D 20 44 72 69 76 65 72 7C 53 42 31 36 20 4D
49 44 49 20 49 6E 00 0E 2A 00 56 6F 79 65 74 72 61 20 53 75
70 65 72 20 53 61 70 69 20 46 4D 20 44 72 69 76 65 72 7C 53
42 31 36 20 4D 49 44 49 20 4F 75 74 00 0F 02 00 10 02 00 11
00 00 12 07 00 FF 03 4F 00 00 00 01 06 00 4C 61 62 65 6C 31
00 01 05 E0 04 F0 00 CC 09 20 01 FF 00 11 00 50 4C 45 41 53
45 20 20 54 4F 55 43 48 20 20 4D 45 00 12 00 00 14 02 18 FF
25 01 01 00 04 BC 02 E0 A5 01 00 0D 4D 53 20 53 61 6E 73 20
53 65 72 69 66 FF 02 04 04 00 02 00 2A 00 04 00 00 00 03 01
09 00 01 00 64 00 02 00 0F 00 03 00 00 00 02 00 02 00 02 00
00 00 00 00 95 31 64 98 CA F5 1C 10 8B 7B 9A F8 C4 8E 68 E6
00 00 00 00 00 00 00 00 00 00 00 00 00 00 00 00 00 00 00 00
00 00 00 00 00 00 00 00 00 00 00 00 00 00 00 00 14 00 48 01
00 00 00 00 14 02 64 00 DE 05 56 42 34 45 4E 31 36 2E 44 4C
4C 00 00 00 7E 00 00 00 00 00 00 00 00 00 00 00 00 00 00 00
00 00 14 00 82 00 08 00 08 00 01 00 06 00 01 00 01 00 00 00
00 00 7A 00 9C 00 FF FF 00 00 76 00 6C 00 FF FF 50 41 54 45
4E 54 31 00 50 41 54 45 4E 54 31 00 00 41 4E 49 4D 31 00 00
6C 31 64 98 CA F5 1C 10 8B 7B 9A F8 C4 8E 68 E6 6D 31 64 98
CA F5 1C 10 8B 7B 9A F8 C4 8E 68 E6 6E 31 64 98 CA F5 1C 10

8B 7B 9A F8 C4 8E 68 E6 6F 31 64 98 CA F5 1C 10 8B 7B 9A F8
C4 8E 68 E6 70 31 64 98 CA F5 1C 10 8B 7B 9A F8 C4 8E 68 E6
00 00 09 00 0C 00 56 42 58 2E 4D 49 44 49 00 4D 49 44 49 56
42 58 2E 56 42 58 00 00 02 00 02 00 7E 00 03 00 00 00 02 00
3E 00 02 00 00 00 00 00 00 00 00 00 A1 31 64 98 CA F5 1C 10
8B 7B 9A F8 C4 8E 68 E6 28 00 62 00 01 00 01 00 40 00 05 00
FF FF 02 00 01 00 12 08 10 00 00 00 00 00 00 00 00 00 00 00
15 00 00 00 00 00 00 00 B9 00 40 3D 33 C9 B8 B6 06 BA 0E 02
EA 71 00 71 00 00 00 00 00 00 B9 72 00 3D 33 C9 B8 C0 00 BA
FF FF EA FF FF FF FF 00 00 00 00 00 B9 6A 00 3D 33 C9 B8 58
02 BA 58 00 EA 5B 00 5B 00 00 00 00 00 00 00 00 D7 35 59 3C
06 00 58 00 BC 36 1C 00 90 FF 14 00 00 00 30 31 30 30 30 30
30 35 30 31 30 31 30 30 30 30 30 30 30 30 00 00 7B 41 7C 42
06 00 6C 30 A0 FF 02 00 03 00 06 00 A6 31 11 00 01 00 A5 25
A0 FF A7 14 04 00 20 00 44 00 14 00 00 00 00 00 08 00 00 00
00 00 00 00 0C 00 00 00 01 00 00 00 A0 FF 02 00 70 2D 0E 00
51 1E 7E FF CD 1E 3F 24 8E FF C0 2C 6E FF 70 2D 0E 00 51 1E
4E FF CD 1E 3F 24 5E FF C0 2C 3E FF 37 2D 2E FF 70 2D 0E 00
51 1E 0E FF CD 1E 3F 24 1E FF C0 2C FE FE 37 2D EE FE 70 2D
0E 00 51 1E CE FE CD 1E 3F 24 DE FE C0 2C BE FE 37 2D AE FE
70 2D 0E 00 51 1E 8E FE CD 1E 3F 24 9E FE C0 2C 7E FE 37 2D
6E FE 85 18 34 00 70 2D 0E 00 51 1E 8E FE CD 1E 3F 24 5E FF
C0 2C 6E FE 3F 24 5E FE E0 36 CE FE 00 00 CD 1E C0 2C 7E FE
32 2D AE FE 85 18 0A 00 3F 24 8E FF D5 1B D1 2D 0E 00 A6 3B
06 00 58 00 68 24 5C FE EB 23 5C FE C7 35 14 00 FD 49 4F 18
84 00 70 2D 16 00 51 1E 8E FE A6 3B 06 00 58 00 DF 1B 2C 3C
06 00 40 00 7C 48 D7 35 3F 24 9E FF C7 35 14 00 CC 26 58 FE
40 00 F5 23 54 FE 6F 1E 8E FE EB 23 9E FF DF 1B 2C 3C 06 00
40 00 96 15 EA 3C 6E FE 2E 19 FF FF FF FF 3F 24 6E FE 9D 4C
7E FE D2 1D AB 43 54 FE AE 25 04 00 6E FE 7E FE 3F 24 9E FF
E7 26 58 FE C0 FF 3F 24 54 FE DB 19 08 00 1C 00 00 00 6E 00
D7 35 59 3C 06 00 58 00 A7 14 38 18 28 00 EB 23 5C FE D7 35
C7 35 13 00 C7 4B 4F 18 18 00 70 2D 16 00 51 1E 8E FE A6 3B
06 00 58 00 DF 1B 2C 3C 06 00 40 00 7C 48 A6 3B 06 00 58 00
D7 35 FB 38 59 3C 06 00 58 00 A7 14 18 00 5C 01 78 01 34 00
00 00 00 00 28 00 00 00 08 00 00 00 8E FF 02 00 54 FE 01 00
A0 FF 02 00 DE FE 02 00 1E FF 02 00 5E FF 02 00 5E FE 02 00
9E FE 02 00 2C 00 00 00 09 00 00 00 6E FE 02 00 7E FE 02 00
AE FE 02 00 BE FE 02 00 EE FE 02 00 FE FE 02 00 2E FF 02 00
3E FF 02 00 6E FF 02 00 7D 2D 0A 00 1F 43 AC FF F5 23 AC FF
7C 36 30 00 2B 00 00 00 20 30 20 31 20 30 20 36 20 30 20 36
20 30 20 35 20 30 20 31 30 20 30 20 30 20 30 20 31 20 30 20
31 20 31 35 20 31 31 20 30 20 30 00 DB 49 4F 18 44 00 BC 36
22 00 8C FF 1A 00 00 00 59 4F 55 20 54 4F 55 43 48 20 20 4D
59 20 20 52 49 47 48 54 20 20 48 41 4E 44 00 00 7B 41 7C 42
06 00 6C 30 9C FF 01 00 03 00 06 00 A6 31 00 00 01 00 A5 25
9C FF 38 18 6E 03 F5 23 AC FF 7C 36 30 00 2A 00 00 00 20 30
20 31 20 30 20 36 20 30 20 36 20 30 20 35 20 30 20 31 30 20
30 20 30 20 30 20 31 20 30 20 31 20 31 35 20 37 20 30 20 30

00 00 DB 49 4F 18 42 00 BC 36 20 00 8C FF 19 00 00 00 59 4F
55 20 54 4F 55 43 48 20 20 4D 59 20 20 4C 45 46 54 20 20 48
41 4E 44 00 7B 41 7C 42 06 00 6C 30 9C FF 01 00 03 00 06 00
A6 31 00 00 01 00 A5 25 9C FF 38 18 EE 02 F5 23 AC FF 7C 36
30 00 2B 00 00 00 20 30 20 31 20 30 20 36 20 30 20 36 20 30
20 35 20 30 20 31 30 20 30 20 30 20 30 20 31 20 30 20 31 20
31 35 20 31 34 20 30 20 30 00 DB 49 4F 18 42 00 BC 36 20 00
8C FF 19 00 00 00 59 4F 55 20 54 4F 55 43 48 20 20 4D 59 20
20 52 49 47 48 54 20 20 4C 45 47 00 7B 41 7C 42 06 00 6C 30
9C FF 01 00 03 00 06 00 A6 31 00 00 01 00 A5 25 9C FF 38 18
6E 02 F5 23 AC FF 7C 36 30 00 2B 00 00 00 20 30 20 31 20 30
20 36 20 30 20 36 20 30 20 35 20 30 20 31 30 20 30 20 30 20
30 20 31 20 30 20 31 20 31 35 20 31 33 20 30 20 30 00 DB 49
4F 18 40 00 BC 36 1E 00 8C FF 17 00 00 00 59 4F 55 20 54 4F
55 43 48 20 20 4D 59 20 4C 45 46 54 20 20 4C 45 47 00 7B 41
7C 42 06 00 6C 30 9C FF 01 00 03 00 06 00 A6 31 00 00 01 00
A5 25 9C FF 38 18 F0 01 F5 23 AC FF 7C 36 30 00 2B 00 00 00
20 30 20 31 20 30 20 36 20 30 20 36 20 30 20 35 20 30 20 31
30 20 30 20 30 20 30 20 31 20 30 20 31 20 31 33 20 31 35 20
30 20 30 00 DB 49 4F 18 42 00 BC 36 20 00 8C FF 19 00 00 00
59 4F 55 20 54 4F 55 43 48 20 20 4D 59 20 20 52 49 47 48 54
20 20 45 41 52 00 7B 41 7C 42 06 00 6C 30 9C FF 01 00 03 00
06 00 A6 31 00 00 01 00 A5 25 9C FF 38 18 70 01 F5 23 AC FF
7C 36 30 00 2B 00 00 00 20 30 20 31 20 30 20 36 20 30 20 36
20 30 20 35 20 30 20 31 30 20 30 20 30 20 30 20 31 20 30 20
31 20 31 34 20 31 35 20 30 20 30 00 DB 49 4F 18 40 00 BC 36
1E 00 8C FF 17 00 00 00 59 4F 55 20 54 4F 55 43 48 20 20 4D
59 20 4C 45 46 54 20 20 45 41 52 00 7B 41 7C 42 06 00 6C 30
9C FF 01 00 03 00 06 00 A6 31 00 00 01 00 A5 25 9C FF 38 18
F2 00 F5 23 AC FF 7C 36 30 00 2A 00 00 00 20 30 20 31 20 30
20 36 20 30 20 36 20 30 20 35 20 30 20 31 30 20 30 20 30 20
30 20 31 20 30 20 31 20 37 20 31 35 20 30 20 30 00 00 DB 49
4F 18 3C 00 BC 36 1A 00 8C FF 13 00 00 00 59 4F 55 20 54 4F
55 43 48 20 20 4D 59 20 4D 4F 55 54 48 00 7B 41 7C 42 06 00
6C 30 9C FF 01 00 03 00 06 00 A6 31 00 00 01 00 A5 25 9C FF
38 18 78 00 F5 23 AC FF 7C 36 30 00 2B 00 00 00 20 30 20 31
20 30 20 36 20 30 20 36 20 30 20 35 20 30 20 31 30 20 30 20
30 20 30 20 31 20 30 20 31 20 31 31 20 31 35 20 30 20 30 00
DB 49 4F 18 3A 00 BC 36 1C 00 8C FF 15 00 00 00 59 4F 55 20
54 4F 55 43 48 20 20 4D 59 20 46 4F 52 48 45 41 44 00 7B 41
7C 42 06 00 6C 30 9C FF 01 00 03 00 06 00 A6 31 00 00 01 00
A5 25 9C FF CB 25 AC FF A7 14 08 00 24 00 FE 03 18 00 00 00
00 00 0C 00 00 00 01 00 00 00 AC FF 01 00 0C 00 00 00 01 00
00 00 9C FF 02 00 00 00 03 00 03 01 DE 01 01 00 65 02 02 00
42 00 04 00 00 00 03 01 45 00 01 00 C7 00 00 00 00 00 00 00
00 00 00 00 30 01 34 00 56 53 5F 56 45 52 53 49 4F 4E 5F 49
4E 46 4F 00 BD 04 EF FE 00 00 01 00 00 00 01 00 00 00 00 00
00 00 01 00 00 00 00 00 00 00 00 00 00 00 00 00 01 00 01 00
01 00 00 00 00 00 00 00 00 00 00 00 00 00 00 24 00 00 00

56 61 72 46 69 6C 65 49 6E 66 6F 00 14 00 04 00 54 72 61 6E
73 6C 61 74 69 6F 6E 00 09 08 E4 04 C4 00 00 00 53 74 72 69
6E 67 46 69 6C 65 49 6E 66 6F 00 00 B0 00 00 00 30 38 30 39
30 34 45 34 00 00 00 00 14 00 02 00 43 6F 6D 70 61 6E 79 4E
61 6D 65 00 20 00 00 00 18 00 08 00 50 72 6F 64 75 63 74 4E
61 6D 65 00 50 41 54 45 4E 54 31 00 18 00 05 00 46 69 6C 65
56 65 72 73 69 6F 6E 00 31 2E 30 30 00 00 00 00 1C 00 05 00
50 72 6F 64 75 63 74 56 65 72 73 69 6F 6E 00 00 31 2E 30 30
00 00 00 00 1C 00 08 00 49 6E 74 65 72 6E 61 6C 4E 61 6D 65
00 00 00 00 50 41 54 45 4E 54 31 00 24 00 0C 00 4F 72 69 67
69 6E 61 6C 46 69 6C 65 6E 61 6D 65 00 00 00 00 50 41 54 45
4E 54 31 2E 45 58 45 00 00 00 01 00 02 00 20 20 02 00 01 00
01 00 30 01 00 00 31 75 20 20 10 00 01 00 04 00 E8 02 00 00
32 75 00 00 00 00 00 00 00 00 00 00 00 00 00 00 28 00 00 00
20 00 00 00 40 00 00 00 01 00 04 00 00 00 00 00 80 02 00 00
00 00 00 00 00 00 00 00 00 00 00 00 00 00 00 00 00 00 00 00
00 00 80 00 00 80 00 00 00 80 80 00 80 00 00 00 80 00 80 00
80 80 00 00 80 80 80 00 C0 C0 C0 00 00 00 FF 00 00 FF 00 00
00 FF FF 00 FF 00 00 00 FF 00 FF 00 FF FF 00 00 FF FF FF 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 8F FF 07 70 00 00 00 00 00 00 00 00 00 00 8F
FF FF FF 07 77 70 00 00 00 00 00 00 08 FF FF FF FF FF FF 07
77 77 70 00 00 00 00 FF FF FF FF FF FF FF FF 07 77 70 00 00
00 00 00 FF FF FF FF FF FF FF FF 07 70 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF FF FF 00
00 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF 88 88 00
00 00 00 00 00 00 00 FF FF FF FF 88 88 00 00 00 00 00 00 00
00 00 00 FF FF 88 88 00 00 EE EE 00 00 00 00 00 00 00 00 88
88 00 00 EE EE 00 00 00 00 00 00 00 00 00 00 00 00 EE EE 00
00 00 00 00 00 00 00 00 00 00 00 EE EE 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 FF FF FF FF FF FF FF FF
FF FF FF FF FF FF FF FF FF FF FF FF FF FF C1 FF FF FC 00 7F
FF 80 00 1F F8 00 00 07 F8 00 00 1F F8 00 00 7F F8 00 01 FF
F8 00 01 FF F8 00 01 FF F8 00 01 FF F8 00 01 FF F8 00 01 FF
F8 00 01 FF F8 00 01 FF F8 00 01 FF F8 00 01 FF F8 00 01 FF

F8 00 3F FF F8 03 FF FF F8 3F FF FF FB FF FF FF FF FF FF FF
FF FF FF FF FF FF FF FF FF FF FF FF FF FF FF FF FF FF FF FF
00 00 00 00 00 00 00 00 28 00 00 00 20 00 00 00 40 00 00 00
01 00 01 00 00 00 00 00 00 01 00 00 00 00 00 00 00 00 00 00
00 00 00 00 00 00 00 00 00 00 00 00 FF FF FF 00 FF FF FF FF
FF FF FF FF FF FF FF FF FF FF FF FF FF FF FF FF FF FF FF C1 FF
FF FC 3C 7F FF C3 FC 1F F8 3F FC 07 FB FF FC 1F FB FF FC 7F
FB FF FD FF FB FF FD FF FB FF FD FF FB FF FD FF FB FF FD FF
FB FF FD FF FB FF FD FF FB FF FD FF FB FF C1 FF FB FC 3D FF
FB C3 C1 FF F8 3C 3F FF FB C3 FF FF F8 3F FF FF FB FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF C1 FF FF FC 00 7F FF C0 00 1F F8 00 00 07
F8 00 00 1F F8 00 00 7F F8 00 01 FF F8 00 01 FF F8 00 01 FF
F8 00 01 FF F8 00 01 FF F8 00 01 FF F8 00 01 FF F8 00 01 FF
F8 00 01 FF F8 00 01 FF F8 00 01 FF F8 00 3F FF F8 03 FF FF
F8 3F FF FF FB FF FF FF FF FF FF FF FF FF FF FF FF FF FF FF
FF FF FF FF FF FF FF FF FF FF FF FF 10 00 00 00 A1 31 64 98
CA F5 1C 10 8B 7B 9A F8 C4 8E 68 E6 00 00 00 00 00 00 00 00
00 00 00 00 53 4C 54 47 03 00 09 00 18 00 01 00 FF 04 02 00
00 00 00 00 C0 00 00 00 00 00 00 46 34 00 00 00 00 00 FF FF
DD 00 00 00 0D 00 02 00 36 04 00 00 09 00 00 00 01 43 6F 6D
70 4F 62 6A 00 64 69 72 00 31 31 62 34 34 32 61 63 37 33 00
00 00 00 00 00 00 00 00 00 01 05 22 00 00 00 FF FF FF FF 84
00 00 00 FF FF FF FF 01 00 00 00 00 00 FC FF 82 00 02 03 28
00 00 00 DF 00 FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF 08 00 00 00 01 00 02 80 FF
FF 0A 00 FF FF 01 00 00 00 00 08 00 2A 5C 52 61 38 2A 23 34
DF 05 00 FF FF 01 1A 00 00 00 4A 00 FF FF FF FF 00 80 12 00
00 00 02 40 FE FF FF FF 1D 00 00 00 FF FF FF FF 00 00 00 00
01 00 00 00 FF FF FF FF 00 00 FF FF FF FF 00 00 FF FF FF FF
00 00 00 00 01 00 00 00 04 00 01 00 00 00 00 00 1C 00 FF FF
FF FF FF FF FF FF 01 00 16 00 CC 51 04 00 00 00 FF FF FF FF
FF FF 00 00 00 00 00 00 09 04 00 00 01 00 00 00 01 00 00 00
00 00 00 00 00 00 00 00 00 00 00 00 00 00 00 FF FF FF FF
FF FF FF FF FF FF FF FF FF FF FF FF FF FF FF FF FF FF FF FF
FF FF FF FF FF FF FF FF FF FF FF FF 00 00 FF FF FF FF FF FF
FF FF FF FF FF FF FF FF FF FF FF FF FF FF FF FF FF FF FF FF
01 00 0A 00 31 31 62 34 34 32 61 63 37 33 0A 00 31 30 62 34
34 32 61 63 37 33 FF FF 0E 00 00 00 FF FF 00 00 00 00 FF FF
A1 31 64 98 CA F5 1C 10 8B 7B 9A F8 C4 8E 68 E6 04 00 B2 00
00 00 00 00 00 00 00 00 00 02 01 20 02 00 00 FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF A8
00 FF FF FF FF FF FF FF FF FF FF FF FF FF FF FF FF FF FF FF

08/561316

FF FF FF FF FF FF FF FF FF FF FF FF FF FF FF FF FF FF FF FF FF
FF FF FF FF FF FF FF FF FF 00 00 FF FF FF FF FF FF FF FF FF
FF FF FF FF FF FF FF FF FF FF FF FF FF FF FF FF FF FF FF FF FF
FF FF FF FF FF FF FF FF FF 60 00 FF FF FF FF FF FF FF FF FF
FF FF FF FF FF FF FF FF FF FF FF FF FF FF FF 1C 00 FF FF FF
FF 36 00 FF FF FF FF FF FF FF FF FF FF FF FF FF FF 98 00 FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF 0E 00 FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF 88 00 FF
FF FF FF FF FF FF FF FF FF FF FF FF FF FF FF 70 00 FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF 4A 00 FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF 20 00 FF FF 05 00 00 00 05 07 A7 3D 05
00 00 00 05 07 A4 3D 05 00 00 00 05 07 9E 3D 05 00 00 00 00
00 FF FF 01 0C 01 00 00 43 4C FF FF FF FF C0 FF 41 4E 49 4D
31 00 86 1B FF FF FF FF E2 FF 46 6F 72 6D 31 00 64 6D FF FF
FF FF 20 00 47 65 74 54 79 70 65 49 6E 66 6F 43 6F 75 6E 74
00 00 67 50 FF FF FF FF 20 00 47 65 74 54 79 70 65 49 6E 66
6F 00 D5 11 FF FF FF FF 20 00 47 65 74 49 44 73 4F 66 4E 61
6D 65 73 00 57 F8 FF FF FF FF 20 00 49 6E 76 6F 6B 65 00 07
BE 8E FF FF FF FF 20 00 51 75 65 72 79 49 6E 74 65 72 66 61
63 65 00 0A B5 B8 FF FF FF FF 20 00 41 64 64 52 65 66 00 FF
6F 61 FF FF FF FF 20 00 52 65 6C 65 61 73 65 00 2A 60 FF FF
FF FF C0 FF 2A 5C 47 7B 30 30 30 32 30 34 33 30 2D 30 30 30
30 2D 30 30 30 30 2D 43 30 30 30 2D 30 30 30 30 30 30 30 30
30 30 34 36 7D 23 31 2E 30 23 30 23 43 3A 5C 57 49 4E 44 4F
57 53 5C 53 59 53 54 45 4D 5C 73 74 64 6F 6C 65 2E 74 6C 62
23 4F 4C 45 20 41 75 74 6F 6D 61 74 69 6F 6E 00 01 0C 00 01
20 00 00 00 0F 00 00 00 FF FF FF FF FF FF FF FF 14 00 FF FF
05 07 94 40 05 00 00 00 05 07 8D 40 05 00 00 00 01 00 FF FF
02 00 00 00 01 00 12 00 00 00 00 00 00 00 00 00 20 40 00 00
A0 00 90 80 00 00 01 00 01 00 FE FF 03 0A 00 00 FF FF FF FF
FF 04 02 00 00 00 00 00 C0 00 00 00 00 00 00 00 46 08 00 00 00
54 59 50 45 4C 49 42 00 FF FF FF FF 00 02 00 00 00 00 00 00
00 00 00 00

U 010524-0

Appendix D 4D 5A 80 01 05 00 00 00 20 00 00 00 FF FF 00 00 00 00 00 00
00 00 00 00 40 00 00 00 01 00 00 00 00 00 00 00 00 00 00 00
00 00 00 00 00 00 00 00 00 00 00 00 00 00 00 00 00 00 00 00
00 06 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 8C D8 33 DB 8E D0 8B E3
53 50 B8 0F 01 50 CB B1 20 B8 01 00 D3 D8 83 F8 01 74 0D BA
1E 03 B4 09 CD 21 B0 01 B4 4C CD 21 B4 30 CD 21 3C 03 73 05
BA 1E 03 EB E9 8E 06 2C 00 33 C0 8B F8 B9 FF FF 26 81 3D 50
41 75 16 26 81 7D 02 54 48 75 0E 26 80 7D 04 3D 75 07 8D 75
05 89 36 9B 03 26 81 3D 77 69 75 1C 26 81 7D 02 6E 64 75 14
26 81 7D 04 69 72 75 0C 26 80 7D 06 3D 75 05 BA 49 03 EB 9E
F2 AE 26 38 05 75 B9 8D 7D 03 89 3E 9D 03 B4 19 CD 21 04 41
BE D8 02 88 04 46 C6 04 3A 46 C6 04 5C 46 B4 47 B2 00 CD 21
8C D8 8E C0 BF D8 02 32 C0 B9 46 00 F2 AE 4F 80 7D FF 5C 74
04 C6 05 5C 47 BE D0 02 8B 0E CE 02 F3 A4 BA D8 02 B8 00 3D
CD 21 72 0F A3 9F 03 EB 48 8C D0 8E D8 BA 1E 03 E9 3B FF 8B
36 9B 03 83 FE FF 74 ED 8E 1E 2C 00 8B FE 80 3C 00 74 E2 AC
3C 3B 74 04 0A C0 75 F7 8B CE 2B CF 83 F9 01 74 E7 8B F7 BF
D8 02 F3 A4 4F 8C D0 8E D8 89 36 9B 03 EB 9C BA 76 03 E9 FD
FE 8E 06 2C 00 8B 3E 9D 03 32 C0 B9 FF FF F2 AE F7 D1 8B D9
8B D1 8C D8 8E C0 BE 81 00 26 8A 4C FF 8A C1 02 C3 3C 7E 77
D2 26 88 44 FF 32 ED 03 F1 8D 38 41 FD F3 A4 FC BF 81 00 26
C6 05 20 47 8B 36 9D 03 8E 1E 2C 00 8B CB 49 F3 A4 BF D8 02
32 C0 B9 FF FF F2 AE F7 D1 8C D8 8E C0 8C D0 8E D8 A1 9D 03
03 C2 2B D1 73 08 24 0F 04 F1 38 C2 72 89 8B 3E 9D 03 BE D8

EE 389 77 83 13

02 F3 A4 8C D8 8E C0 8B 1E 9F 03 BE 5C 00 C7 04 BC FE C7 44
02 FF CD C7 44 04 21 B4 C7 44 06 3E CD C7 44 08 21 E9 C7 44
0A 98 00 B4 3F B9 FF FF BA 00 01 1E 56 CB 08 00 77 69 6E 2E
63 6F 6D 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 54 68 69 73 20 70
72 6F 67 72 61 6D 20 72 65 71 75 69 72 65 73 20 4D 69 63 72
6F 73 6F 66 74 20 57 69 6E 64 6F 77 73 2E 0D 0A 24 59 6F 75
20 61 72 65 20 61 6C 72 65 61 64 79 20 72 75 6E 6E 69 6E 67
20 4D 69 63 72 6F 73 6F 66 74 20 57 69 6E 64 6F 77 73 2E 0D
0A 24 55 6E 61 62 6C 65 20 74 6F 20 73 74 61 72 74 20 4D 69
63 72 6F 73 6F 66 74 20 57 69 6E 64 6F 77 73 2E 0D 0A 24 FF
FF 00 00 00 00 00 00 00 00 00 00 00 00 00 00 00 00 00 00 00
00

00 00 00 00 09 04 00 00 0E 00 00 00 01 00 02 00 00 00 42 00
0C 00 4A 00 10 00 FF FF 04 00 0E 00 02 00 00 00 00 00 00 00
00 00 00 00 01 00 95 4D 03 00 E4 CA 75 1A A3 F5 1C 10 8B 7B
9A F8 C4 8E 68 E6 0C 00 03 00 10 00 84 08 3E 00 00 00 00 00
00 00 00 00 00 00 00 00 12 03 46 00 00 00 01 00 00 00 20 00
2C 00 28 00 69 CB 75 1A A3 F5 1C 10 8B 7B 9A F8 C4 8E 68 E6
00 00 00 00 42 49 4E 31 00 00 00 00 00 00 00 00 00 00 00 00
1A 00 BC 07 76 00 A4 00 86 00 00 00 00 00 00 00 00 00 06 00
00 00 00 00 42 01 66 CB 75 1A A3 F5 1C 10 8B 7B 9A F8 C4 8E
68 E6 5F CB 75 1A A3 F5 1C 10 8B 7B 9A F8 C4 8E 68 E6 01 00
68 00 6C 00 65 CB 75 1A A3 F5 1C 10 8B 7B 9A F8 C4 8E 68 E6
03 00 68 CB 75 1A A3 F5 1C 10 8B 7B 9A F8 C4 8E 68 E6 FF FF
FF FF 34 00 A0 03 BC 00 00 00 00 00 00 00 00 00 00 00 00 00
00 00 00 00 00 00 00 00 00 00 00 00 00 00 00 00 94 01 C0 00
AA 01 42 01 C0 01 46 01 D6 01 4A 01 EC 01 4E 01 02 02 52 01
07 00 08 01 22 01 00 00 56 01 00 00 00 00 00 00 00 00 0A 00
00 00 04 00 64 00 68 CB 75 1A A3 F5 1C 10 8B 7B 9A F8 C4 8E
68 E6 62 CB 75 1A A3 F5 1C 10 8B 7B 9A F8 C4 8E 68 E6 01 00
68 00 6C 00 67 CB 75 1A A3 F5 1C 10 8B 7B 9A F8 C4 8E 68 E6
03 00 2F 16 89 E9 DA 45 1B 10 B1 76 08 00 2B 33 6F 60 0E 00
03 00 38 00 A4 04 5C 01 00 00 00 00 00 00 00 00 00 00 00 00
28 03 60 01 00 00 00 00 00 00 00 00 00 00 00 00 00 00 00 00
00 00 00 00 00 00 00 00 00 00 00 00 00 00 00 00 00 00 00 00
00 00 00 00 03 00 2F 16 89 E9 DA 45 1B 10 B1 76 08 00 2B 33
6F 60 0D 00 03 00 38 00 A8 01 C2 01 00 00 00 00 00 00 00 00
00 00 00 00 A4 02 D2 01 00 00 00 00 00 00 00 00 00 00 00 00
00 00 00 00 00 00 00 00 00 00 00 00 00 00 00 00 00 00 00 00
00 00 00 00 00 00 00 00 03 00 2F 16 89 E9 DA 45 1B 10 B1 76
08 00 2B 33 6F 60 03 00 03 00 38 00 FC 0C 16 02 00 00 00 00
00 00 00 00 00 00 00 00 90 01 26 02 00 00 00 00 00 00 00 00
00 00 00 00 00 00 00 00 00 00 00 00 00 00 00 00 00 00 00 00
00 00 00 00 00 00 00 00 00 00 00 00 03 00 2F 16 89 E9 DA 45
1B 10 B1 76 08 00 2B 33 6F 60 02 00 03 00 38 00 FC 01 6A 02
00 00 00 00 00 00 00 00 00 00 00 00 BA 02 7A 02 00 00 00 00
00 00 00 00 00 00 00 00 00 00 00 00 00 00 00 00 00 00 00 00
00 00 00 00 00 00 00 00 00 00 00 00 00 00 00 00 03 00 2F 16
89 E9 DA 45 1B 10 B1 76 08 00 2B 33 6F 60 01 00 03 00 38 00
A4 02 BE 02 00 00 00 00 00 00 00 00 00 00 00 00 D0 02 CE 02
00 00 00 00 00 00 00 00 00 00 00 00 00 00 00 00 00 00 00 00
00 00 00 00 00 00 00 00 00 00 00 00 00 00 00 00 00 00 00 00
03 00 2F 16 89 E9 DA 45 1B 10 B1 76 08 00 2B 33 6F 60 02 00
03 00 38 00 50 02 12 03 00 00 00 00 00 00 00 00 00 00 00 00
A6 01 22 03 00 00 00 00 00 00 00 00 00 00 00 00 00 00 00 00
00 00 00 00 00 00 00 00 00 00 00 00 00 00 00 00 00 00 00 00
00 00 00 00 03 00 2F 16 89 E9 DA 45 1B 10 B1 76 08 00 2B 33
6F 60 01 00 03 00 38 00 4C 03 66 03 00 00 00 00 00 00 00 00
00 00 00 00 BC 01 76 03 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76

08 00 2B 33 6F 60 11 00 03 00 3C 00 4C 04 BA 03 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 03 00 20 16
89 E9 DA 45 1B 10 B1 76 08 00 2B 33 6F 60 0F 00 03 00 3C 00
F8 02 0E 04 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 20 16 89 E9 DA 45 1B 10 B1 76 08 00 2B 33
6F 60 16 00 03 00 3C 00 64 07 66 04 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 43 16 89 E9 DA 45
1B 10 B1 76 08 00 2B 33 6F 60 04 00 03 00 3C 00 E4 0B BE 04
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 20 16 89 E9 DA 45 1B 10 B1 76 08 00 2B 33 6F 60 15 00
03 00 3C 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76
08 00 2B 33 6F 60 14 00 03 00 3C 00 54 05 16 05 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 03 00 20 16
89 E9 DA 45 1B 10 B1 76 08 00 2B 33 6F 60 13 00 03 00 3C 00
AC 05 C6 05 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 20 16 89 E9 DA 45 1B 10 B1 76 08 00 2B 33
6F 60 12 00 03 00 3C 00 04 06 1E 06 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 20 16 89 E9 DA 45
1B 10 B1 76 08 00 2B 33 6F 60 10 00 03 00 3C 00 5C 06 76 06
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 20 16 89 E9 DA 45 1B 10 B1 76 08 00 2B 33 6F 60 18 00
03 00 3C 00 B4 06 CE 06 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 20 16 89 E9 DA 45 1B 10 B1 76
08 00 2B 33 6F 60 17 00 03 00 3C 00 0C 07 26 07 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 03 00 66 CB
75 1A A3 F5 1C 10 8B 7B 9A F8 C4 8E 68 E6 FF FF FF FF 40 00

70 0C 7E 07 00 00 00 00 00 00 00 00 00 00 00 00 00 00 00 00 00
00 00 00 00 00 00 00 00 00 00 00 00 42 03 CA 03 58 03 F6 07
A8 02 FA 07 BE 02 FE 07 D4 02 02 08 EA 02 06 08 00 03 0A 08
16 03 0E 08 2C 03 12 08 03 00 25 16 89 E9 DA 45 1B 10 B1 76
08 00 2B 33 6F 60 0A 00 03 00 50 00 C8 09 D6 07 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 03 00 25 16
89 E9 DA 45 1B 10 B1 76 08 00 2B 33 6F 60 08 00 03 00 50 00
18 08 32 08 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 25 16 89 E9 DA 45 1B 10 B1 76 08 00 2B 33
6F 60 0B 00 03 00 50 00 5C 00 9E 08 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 25 16 89 E9 DA 45
1B 10 B1 76 08 00 2B 33 6F 60 07 00 03 00 50 00 34 0A 0A 09
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 25 16 89 E9 DA 45 1B 10 B1 76 08 00 2B 33 6F 60 09 00
03 00 50 00 5C 09 76 09 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 03 00 25 16 89 E9 DA 45 1B 10 B1 76
08 00 2B 33 6F 60 06 00 03 00 50 00 78 0B E2 09 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 03 00 25 16
89 E9 DA 45 1B 10 B1 76 08 00 2B 33 6F 60 03 00 03 00 50 00
F4 03 4E 0A 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 03 00 25 16 89 E9 DA 45 1B 10 B1 76 08 00 2B 33
6F 60 04 00 03 00 50 00 A0 0A BA 0A 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 03 00 25 16 89 E9 DA 45
1B 10 B1 76 08 00 2B 33 6F 60 05 00 03 00 50 00 0C 0B 26 0B
00 00 00 00 00 00 00 00 00 00 00 00 00 00 00 00 00 00 00 00

08/561216

00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 64 CB 75 1A A3 F5 1C 10 8B 7B 9A F8 C4 8E 68 E6 FF FF
FF FF 70 00 00 00 00 00 00 00 00 00 00 00 00 00 00 00 00 00
00 00 00 00 00 00 00 00 00 00 00 00 00 00 00 00 00 00 00 00
00 00 00 00 D2 01 16 08 00 00 00 00 E8 01 26 0C 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 61 CB 75 1A A3 F5 1C 10 8B 7B 9A F8 C4 8E 68 E6 FF FF
FF FF 70 00 F0 08 92 0B 00 00 00 00 00 00 00 00 00 00 00 00
00 00 00 00 00 00 00 00 00 00 00 00 00 00 00 00 00 00 00 00
00 00 00 00 E6 02 2E 0C 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
03 00 5D CB 75 1A A3 F5 1C 10 8B 7B 9A F8 C4 8E 68 E6 05 00
03 00 C4 00 FC 04 8A 0C 00 00 00 00 00 00 00 00 00 00 00 00
00 00 00 00 00 00 00 00 00 00 00 00 00 00 00 00 00 00 00 00
00 00 00 00 00 00 00 00 00 00 00 00 FE 01 B2 0C 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 FF CC 2D 00 18 24 05 00 00 7C 00 00 00 00 05 00
46 6F 72 6D 31 00 0D 05 14 01 00 00 54 06 00 00 C8 0D 00 00
1C 14 00 00 FF 00 12 00 43 52 45 41 54 4F 52 20 20 20 20 20
20 20 20 4C 41 42 00 03 C0 C0 C0 00 19 01 00 42 00 23 FF FF
FF FF 24 05 00 46 6F 72 6D 31 00 35 14 01 00 00 36 54 06 00
00 37 C8 0D 00 00 38 1C 14 00 00 40 01 01 00 00 BC 02 B0 30
01 00 0D 4D 53 20 53 61 6E 73 20 53 65 72 69 66 FF 01 2A 00
00 00 01 08 00 43 6F 6D 6D 61 6E 64 33 00 04 04 28 05 68 10
CC 03 74 01 FF 00 07 00 6C 69 62 72 61 72 79 00 11 16 00 FF
03 27 00 00 00 02 08 00 43 6F 6D 6D 61 6E 64 32 00 04 04 78
00 68 10 CC 03 74 01 FF 00 04 00 63 61 6C 63 00 11 15 00 FF
03 2C 00 00 00 03 05 00 54 65 78 74 39 00 02 04 B0 04 60 09
74 01 74 01 FF 02 C0 C0 C0 00 0B 02 00 30 30 00 12 10 00 25
02 00 00 00 FF 03 2C 00 00 00 04 05 00 54 65 78 74 38 00 02
04 B0 04 80 07 74 01 74 01 FF 02 C0 C0 C0 00 0B 02 00 30 30
00 12 0F 00 25 02 00 00 00 FF 03 2C 00 00 00 05 05 00 54 65
78 74 37 00 02 04 B0 04 A0 05 74 01 74 01 FF 02 C0 C0 C0 00
0B 02 00 30 30 00 12 0E 00 25 02 00 00 00 FF 03 2C 00 00 00
06 05 00 54 65 78 74 36 00 02 04 90 06 C0 03 74 01 74 01 FF
02 C0 C0 C0 00 0B 02 00 30 30 00 12 0A 00 25 02 00 00 00 FF
03 2C 00 00 00 07 05 00 54 65 78 74 35 00 02 04 B0 04 C0 03

74 01 74 01 FF 02 C0 C0 C0 00 0B 02 00 30 30 00 12 09 00 25
02 00 00 00 FF 03 2C 00 00 00 08 05 00 54 65 78 74 34 00 02
04 70 08 E0 01 74 01 74 01 FF 02 C0 C0 C0 00 0B 02 00 30 30
00 12 08 00 25 02 00 00 00 FF 03 2C 00 00 00 09 05 00 54 65
78 74 33 00 02 04 90 06 E0 01 74 01 74 01 FF 02 C0 C0 C0 00
0B 02 00 30 30 00 12 07 00 25 02 00 00 00 FF 03 2C 00 00 00
0A 05 00 54 65 78 74 32 00 02 04 B0 04 E0 01 74 01 74 01 FF
02 C0 C0 C0 00 0B 02 00 30 30 00 12 05 00 25 02 00 00 00 FF
03 2C 00 00 00 0B 05 00 54 65 78 74 31 00 02 04 B0 04 00 00
74 01 74 01 FF 02 C0 C0 C0 00 0B 02 00 30 30 00 12 03 00 25
02 00 00 00 FF 03 93 00 00 00 0C 05 00 4D 69 64 69 31 00 FF
08 00 56 42 58 2E 4D 49 44 49 00 02 30 0C 68 10 50 01 50 01
FF 06 00 0B 02 00 0C 02 00 0D 29 00 56 6F 79 65 74 72 61 20
53 75 70 65 72 20 53 61 70 69 20 46 4D 20 44 72 69 76 65 72
7C 53 42 31 36 20 4D 49 44 49 20 49 6E 00 0E 2A 00 56 6F 79
65 74 72 61 20 53 75 70 65 72 20 53 61 70 69 20 46 4D 20 44
72 69 76 65 72 7C 53 42 31 36 20 4D 49 44 49 20 4F 75 74 00
0F 02 00 10 02 00 11 00 00 12 07 00 FF 03 27 00 00 00 0D 08
00 43 6F 6D 6D 61 6E 64 31 00 04 04 60 09 48 12 44 04 74 01
FF 00 04 00 45 78 69 74 00 11 01 00 FF 03 23 00 00 00 0E 04
00 73 65 6E 64 00 04 04 78 00 48 12 7C 08 74 01 FF 00 04 00
73 65 6E 64 00 11 00 00 FF 03 25 00 00 00 0F 07 00 4C 61 62
65 6C 31 30 00 01 05 80 07 88 0E 74 01 74 01 FF 03 C0 C0 C0
00 12 14 00 13 01 FF 03 39 00 00 00 10 06 00 4C 61 62 65 6C
39 00 01 05 78 00 88 0E 24 06 74 01 FF 00 13 00 54 48 45 20
20 43 52 43 20 20 20 20 49 53 20 20 20 20 3A 00 03 C0 C0 C0
00 12 13 00 FF 03 24 00 00 00 11 06 00 4C 61 62 65 6C 38 00
01 05 78 00 30 0C 7C 08 74 01 FF 03 C0 C0 C0 00 12 12 00 13
01 FF 03 3A 00 00 00 12 06 00 4C 61 62 65 6C 37 00 01 05 78
00 40 0B 8C 07 74 01 FF 00 14 00 54 48 45 20 20 43 4F 4D 4D
41 4E 44 20 20 20 49 53 20 20 3A 00 03 C0 C0 C0 00 12 11 00
FF 03 2C 00 00 00 13 06 00 4C 61 62 65 6C 36 00 01 05 78 00
D8 09 CC 03 74 01 FF 00 06 00 44 41 54 33 20 3A 00 03 C0 C0
C0 00 12 0D 00 FF 03 2C 00 00 00 14 06 00 4C 61 62 65 6C 35
00 01 05 78 00 F8 07 CC 03 74 01 FF 00 06 00 44 41 54 32 20
3A 00 03 C0 C0 C0 00 12 0C 00 FF 03 2C 00 00 00 15 06 00 4C
61 62 65 6C 34 00 01 05 78 00 18 06 CC 03 74 01 FF 00 06 00
44 41 54 31 20 3A 00 03 C0 C0 C0 00 12 0B 00 FF 03 30 00 00
00 16 06 00 4C 61 62 65 6C 33 00 01 05 78 00 38 04 44 04 74
01 FF 00 0A 00 43 4F 4D 4D 41 4E 44 20 20 3A 00 03 C0 C0 C0
00 12 06 00 FF 03 30 00 00 00 17 06 00 4C 61 62 65 6C 32 00
01 05 78 00 58 02 44 04 74 01 FF 00 0A 00 41 44 44 52 45 53
53 20 20 3A 00 03 C0 C0 C0 00 12 04 00 FF 03 30 00 00 00 18
06 00 4C 61 62 65 6C 31 00 01 05 78 00 78 00 CC 03 74 01 FF
00 0A 00 48 45 41 44 45 52 20 20 20 3A 00 03 C0 C0 C0 00 12
02 00 FF 02 04 00 00 00 04 00 02 00 22 00 05 00 00 00 03 01
15 00 01 00 64 00 02 00 1B 00 03 00 00 00 02 00 02 00 02 00
00 00 00 00 00 00 00 00 DE 05 56 42 34 45 4E 31 36 2E 44 4C
4C 00 00 00 7E 00 00 00 00 00 00 00 00 00 00 00 00 00 00 00

00 00 30 00 FF FF 06 00 05 00 01 00 05 00 02 00 01 00 01 00
C4 00 3A 00 58 00 FF FF 44 01 36 00 88 00 02 01 4F 5A 42 49
4E 00 42 49 4E 31 00 00 42 49 4E 31 00 00 00 00 E1 CA 75 1A
A3 F5 1C 10 8B 7B 9A F8 C4 8E 68 E6 E2 CA 75 1A A3 F5 1C 10
8B 7B 9A F8 C4 8E 68 E6 E3 CA 75 1A A3 F5 1C 10 8B 7B 9A F8
C4 8E 68 E6 E4 CA 75 1A A3 F5 1C 10 8B 7B 9A F8 C4 8E 68 E6
E5 CA 75 1A A3 F5 1C 10 8B 7B 9A F8 C4 8E 68 E6 00 00 09 00
0C 00 56 42 58 2E 4D 49 44 49 00 4D 49 44 49 56 42 58 2E 56
42 58 00 00 5F CB 75 1A A3 F5 1C 10 8B 7B 9A F8 C4 8E 68 E6
00 00 00 00 00 00 00 00 00 00 00 00 00 00 00 00 00 00 00 00
00 00 00 00 00 00 00 00 00 00 00 00 00 00 00 00 C4 00 29 05
00 00 00 00 DC 0D 24 00 62 CB 75 1A A3 F5 1C 10 8B 7B 9A F8
C4 8E 68 E6 00 00 00 00 00 00 00 00 00 00 00 00 00 00 00 00
00 00 00 00 00 00 00 00 00 00 00 00 00 00 00 00 01 00 00 00
28 00 BD 01 00 00 00 00 00 00 FF FF 25 AF A8 C1 57 12 1B 10
8F B0 00 20 AF 03 9C A3 A6 8B 2B 09 0A 00 0A 00 0E 00 00 00
24 00 00 00 00 00 0A 00 98 00 00 00 00 00 26 00 27 AF A8 C1
57 12 1B 10 8F B0 00 20 AF 03 9C A3 26 AF A8 C1 57 12 1B 10
8F B0 00 20 AF 03 9C A3 5A CB 75 1A A3 F5 1C 10 8B 7B 9A F8
C4 8E 68 E6 5B CB 75 1A A3 F5 1C 10 8B 7B 9A F8 C4 8E 68 E6
5C CB 75 1A A3 F5 1C 10 8B 7B 9A F8 C4 8E 68 E6 5D CB 75 1A
A3 F5 1C 10 8B 7B 9A F8 C4 8E 68 E6 5E CB 75 1A A3 F5 1C 10
8B 7B 9A F8 C4 8E 68 E6 69 0A 4D 43 49 31 36 2E 4F 43 58 00
4D 43 49 2E 4D 4D 43 6F 6E 74 72 6F 6C 00 6D 67 6B 67 74 67
6E 6E 6D 6E 6D 6E 69 6E 69 67 74 68 6B 67 6F 67 67 67 76 6D
6B 68 69 6E 6A 67 67 6E 76 6D 00 00 00 00 00 00 00 00 00 00
26 00 00 00 01 00 00 00 02 00 00 00 03 00 00 00 04 00 00 00
05 00 00 00 06 00 00 00 07 00 00 00 08 00 00 00 09 00 00 00
0A 00 00 00 0B 00 00 00 0C 00 00 00 0D 00 00 00 0E 00 00 00
0F 00 00 00 10 00 00 00 11 00 00 00 12 00 00 00 13 00 00 00
14 00 00 00 15 00 00 00 16 00 00 00 17 00 00 00 18 00 00 00
19 00 00 00 1A 00 00 00 1B 00 00 00 1C 00 00 00 1D 00 00 00
1E 00 00 00 1F 00 00 00 20 00 00 00 21 00 00 00 22 00 00 00
23 00 00 00 24 00 00 00 25 00 00 00 4D 4D 43 6F 6E 74 72 6F
6C 00 00 00 03 00 02 00 42 01 04 00 00 00 02 00 3E 00 03 00
00 00 02 00 42 00 02 00 00 00 00 00 00 00 00 00 00 00 00 00
FF CC 2D 00 05 B8 01 00 00 7A 00 00 00 00 05 00 46 6F 72 6D
32 00 0D 05 3C 0F 00 00 60 06 00 00 BC 13 00 00 10 14 00 00
FF 00 10 00 4C 49 53 54 20 4F 46 20 43 4F 4D 4D 41 4E 44 53
00 03 C0 C0 C0 00 19 01 00 42 00 23 FF FF FF FF 24 05 00 46
6F 72 6D 32 00 35 3C 0F 00 00 36 60 06 00 00 37 BC 13 00 00
38 10 14 00 00 40 01 01 00 00 BC 02 B0 30 01 00 0D 4D 53 20
53 61 6E 73 20 53 65 72 69 66 FF 01 2C 00 00 00 01 08 00 43
6F 6D 6D 61 6E 64 33 00 04 04 88 0E 48 12 BC 04 74 01 FF 00
09 00 50 20 20 41 4E 44 20 20 50 00 11 04 00 FF 03 29 00 00
00 02 08 00 43 6F 6D 6D 61 6E 64 32 00 04 04 18 06 48 12 34
05 74 01 FF 00 06 00 43 61 6E 63 65 6C 00 11 02 00 FF 03 26
00 00 00 03 08 00 43 6F 6D 6D 61 6E 64 31 00 04 04 00 00 48
12 34 05 74 01 FF 00 03 00 53 65 74 00 11 01 00 FF 03 21 00

08/561816

00 00 04 05 00 4C 69 73 74 31 00 08 04 00 00 78 00 44 13 98
10 FF 02 C0 C0 C0 00 11 00 00 FF 03 97 00 00 00 05 0A 00 4D
4D 43 6F 6E 74 72 6F 6C 31 00 FF 0D 00 4D 43 49 2E 4D 4D 43
6F 6E 74 72 6F 6C 00 03 28 05 B0 04 10 0B 74 01 FF 07 00 0F
03 00 2D 18 00 4B 00 00 00 86 E7 78 6A 82 A7 BA 01 86 E7 78
6A 82 A7 BA 01 01 00 25 AF A8 C1 57 12 1B 10 8F B0 00 20 AF
03 9C A3 00 00 01 00 01 00 00 01 00 00 00 00 00 00 01 01 01
01 01 01 01 01 01 00 00 00 00 00 00 01 00 00 00 00 00 00 00
00 00 E8 03 00 00 FF 01 83 13 00 00 90 02 00 00 20 00 00 00
01 00 FF 02 04 00 00 00 08 00 34 00 00 00 00 00 08 00 06 00
00 00 00 00 65 CB 75 1A A3 F5 1C 10 8B 7B 9A F8 C4 8E 68 E6
B5 14 A7 14 04 00 00 00 04 00 14 00 00 00 00 00 08 00 00 00
00 00 00 00 08 00 00 00 00 00 00 00 7C 42 06 00 C9 30 05 00
02 00 00 00 A7 14 04 00 00 00 0E 00 14 00 00 00 00 00 08 00
00 00 00 00 00 00 08 00 00 00 00 00 00 00 00 00 C5 42 0A 00
00 00 11 3B 00 00 94 3E 01 00 00 00 C9 30 04 00 02 00 00 00
A7 14 04 00 00 00 1A 00 14 00 00 00 00 00 08 00 00 00 00 00
00 00 08 00 00 00 00 00 00 00 00 00 48 00 7A 00 02 00 02 00
40 00 05 00 00 00 02 00 01 00 12 08 10 00 00 00 00 00 00 00
00 00 00 00 15 00 00 00 00 00 00 00 58 00 05 00 17 33 02 00
01 00 12 08 10 00 00 00 00 00 00 00 00 00 00 00 15 00 00 00
00 00 00 00 BC 36 0C 00 90 FF 05 00 00 00 43 6C 6F 73 65 00
7B 41 7C 42 06 00 6C 30 A0 FF 05 00 03 00 06 00 A6 31 17 00
00 00 A5 25 A0 FF A7 14 08 00 20 00 2C 00 14 00 00 00 00 00
08 00 00 00 00 00 00 00 0C 00 00 00 01 00 00 00 A0 FF 02 00
BC 36 0C 00 90 FF 04 00 00 00 53 74 6F 70 00 00 7B 41 C5 42
0A 00 00 00 11 3B 00 00 94 3E 01 00 00 00 0C 31 A0 FF 05 00
03 00 1D 25 A6 31 17 00 00 00 A5 25 A0 FF A7 14 04 00 20 00
38 00 14 00 00 00 00 00 08 00 00 00 00 00 00 00 0C 00 00 00
01 00 00 00 A0 FF 02 00 B9 44 00 3D 33 C9 B8 EA 27 BA FF FF
EA 61 03 61 03 00 00 00 00 00 B9 3C 00 3D 33 C9 B8 4E 00 BA
EE 0A EA FF FF FF FF 00 00 00 00 00 B9 34 00 3D 33 C9 B8 C4
20 BA FF FF EA B3 01 B3 01 00 00 00 00 00 B9 5C 00 3D 33 C9
B8 52 04 BA C6 01 EA C9 01 C9 01 00 00 00 00 00 00 B9 5C 00 3D
33 C9 B8 18 01 BA DC 01 EA DF 01 DF 01 00 00 00 00 00 00 B9 4C
00 3D 33 C9 B8 C0 18 BA F2 01 EA F5 01 F5 01 00 00 00 00 00
BC 36 0C 00 90 FF 04 00 00 00 50 6C 61 79 00 00 7B 41 C5 42
0A 00 00 00 11 3B 00 00 94 3E 01 00 00 00 0C 31 A0 FF 05 00
03 00 1D 25 A6 31 17 00 00 00 A5 25 A0 FF BC 36 0C 00 90 FF
04 00 00 00 50 72 65 76 00 00 7B 41 C5 42 0A 00 00 00 11 3B
00 00 94 3E 01 00 00 00 0C 31 A0 FF 05 00 03 00 1D 25 A6 31
17 00 00 00 A5 25 A0 FF A7 14 04 00 20 00 6E 00 14 00 00 00
00 00 08 00 00 00 00 00 00 00 0C 00 00 00 01 00 00 00 A0 FF
02 00 00 00 B9 F2 00 3D 33 C9 B8 24 00 BA 08 02 EA 0B 02 0B
02 00 00 00 00 00 B9 EA 00 3D 33 C9 B8 54 37 BA AE 02 EA B1
02 B1 02 00 00 00 00 00 B9 E2 00 3D 33 C9 B8 86 00 BA C4 02
EA C7 02 C7 02 00 00 00 00 00 B9 7A 00 3D 33 C9 B8 EC 11 BA
DA 02 EA DD 02 DD 02 00 00 00 00 00 B9 00 40 3D 33 C9 B8 F6
06 BA F0 02 EA F3 02 F3 02 00 00 00 00 00 B9 8A 00 3D 33 C9

B8 38 0B BA 06 03 EA 09 03 09 03 00 00 00 00 00 B9 FA 00 3D
33 C9 B8 D0 2B BA 1C 03 EA 1F 03 1F 03 00 00 00 00 00 B9 00
40 3D 33 C9 B8 82 02 BA 32 03 EA 35 03 35 03 00 00 00 00 00
B9 00 40 3D 33 C9 B8 70 01 BA 48 03 EA 4B 03 4B 03 00 00 00
00 00 00 00 9D 36 A0 FF 7B 41 7C 42 06 00 6C 30 90 FF 05 00
03 00 06 00 A6 31 18 00 00 00 A5 25 90 FF 99 36 A0 FF 7B 41
7C 42 06 00 6C 30 90 FF 05 00 03 00 06 00 A6 31 19 00 00 00
A5 25 90 FF 9D 36 A0 FF 7B 41 7C 42 06 00 6C 30 90 FF 05 00
03 00 06 00 A6 31 1A 00 00 00 A5 25 90 FF BC 36 10 00 A0 FF
09 00 00 00 57 61 76 65 41 75 64 69 6F 00 7B 41 7C 42 06 00
6C 30 90 FF 05 00 03 00 06 00 A6 31 15 00 00 00 A5 25 90 FF
BC 36 14 00 A0 FF 0C 00 00 00 43 3A 5C 41 4E 47 45 4C 2E 57
41 56 00 00 7B 41 7C 42 06 00 6C 30 90 FF 05 00 03 00 06 00
A6 31 16 00 00 00 A5 25 90 FF BC 36 0C 00 A0 FF 04 00 00 00
4F 70 65 6E 00 00 7B 41 7C 42 06 00 6C 30 90 FF 05 00 03 00
06 00 A6 31 17 00 00 00 A5 25 90 FF A7 14 04 00 20 00 E6 00
14 00 00 00 00 00 08 00 00 00 00 00 00 00 0C 00 00 00 01 00
00 00 90 FF 02 00 00 00 7D 2D 0A 00 1F 43 AC FF F5 23 AC FF
7C 36 24 00 1E 00 00 00 30 31 7C 30 36 7C 30 36 7C 30 35 7C
30 41 7C 30 30 7C 30 32 7C 30 32 7C 46 46 7C 30 30 7C 00 00
DB 49 4F 18 5A 00 BC 36 14 00 9C FF 0D 00 00 00 53 54 41 52
54 20 50 4C 41 59 49 4E 47 00 19 47 8C FF 3F 24 8C FF AA 36
7C FF AA 36 6C FF AA 36 5C FF AA 36 4C FF 46 19 6C 05 6C 05
51 1E 2C FF 4F 47 3C FF AE 25 0A 00 8C FF 7C FF 6C FF 5C FF
4C FF DB 19 04 00 1C 00 10 00 8E 05 38 18 E8 01 F5 23 AC FF
7C 36 24 00 1E 00 00 00 30 31 7C 30 36 7C 30 36 7C 30 35 7C
30 41 7C 30 30 7C 30 32 7C 30 32 7C 46 46 7C 30 30 7C 00 00
DB 49 4F 18 5A 00 BC 36 14 00 2C FF 0D 00 00 00 53 54 4F 50
20 20 50 4C 41 59 49 4E 47 00 19 47 4C FF 3F 24 4C FF AA 36
5C FF AA 36 6C FF AA 36 7C FF AA 36 8C FF 46 19 EA 05 EA 05
51 1E 9C FF 4F 47 3C FF AE 25 0A 00 4C FF 5C FF 6C FF 7C FF
8C FF DB 19 04 00 20 00 10 00 5E 03 38 18 5C 01 F5 23 AC FF
7C 36 1E 00 19 00 00 00 33 20 31 31 20 31 32 20 31 33 20 31
34 20 31 35 20 37 20 38 20 39 20 31 30 00 DB 49 4F 18 48 00
BC 36 0C 00 2C FF 05 00 00 00 33 33 33 33 33 00 19 47 4C FF
3F 24 4C FF AA 36 5C FF AA 36 6C FF AA 36 7C FF AA 36 8C FF
46 19 60 06 60 06 51 1E 9C FF 4F 47 3C FF AE 25 0A 00 4C FF
5C FF 6C FF 7C FF 8C FF 38 18 E8 00 F5 23 AC FF 7C 36 20 00
1A 00 00 00 20 34 20 31 31 20 31 32 20 31 33 20 31 34 20 31
35 20 37 20 38 20 39 20 31 30 00 00 DB 49 4F 18 48 00 BC 36
0C 00 2C FF 05 00 00 00 34 34 34 34 34 00 19 47 4C FF 3F 24
4C FF AA 36 5C FF AA 36 6C FF AA 36 7C FF AA 36 8C FF 46 19
FF FF FF FF 51 1E 9C FF 4F 47 3C FF AE 25 0A 00 4C FF 5C FF
6C FF 7C FF 8C FF 38 18 72 00 F5 23 AC FF 7C 36 20 00 1A 00
00 00 20 35 20 31 31 20 31 32 20 31 33 20 31 34 20 31 35 20
37 20 38 20 39 20 31 30 00 00 DB 49 4F 18 44 00 BC 36 0C 00
2C FF 05 00 00 00 35 35 35 35 35 00 19 47 4C FF 3F 24 4C FF
AA 36 5C FF AA 36 6C FF AA 36 7C FF AA 36 8C FF 46 19 42 2F
42 2F 51 1E 9C FF 4F 47 3C FF AE 25 0A 00 4C FF 5C FF 6C FF

08/561056

7C FF 8C FF CB 25 AC FF A7 14 08 00 84 00 82 02 1C 00 00 00
00 00 10 00 00 00 02 00 00 00 AC FF 01 00 3C FF 02 00 1C 00
00 00 05 00 00 00 4C FF 02 00 5C FF 02 00 6C FF 02 00 7C FF
02 00 8C FF 02 00 00 00 70 2D 0E 00 51 1E 7E FF CD 1E 3F 24
8E FF C0 2C 6E FF 70 2D 0E 00 51 1E 4E FF CD 1E 3F 24 5E FF
C0 2C 3E FF 37 2D 2E FF 70 2D 0E 00 51 1E 0E FF CD 1E 3F 24
1E FF C0 2C FE FE 37 2D EE FE 70 2D 0E 00 51 1E CE FE CD 1E
3F 24 DE FE C0 2C BE FE 37 2D AE FE 70 2D 0E 00 51 1E 8E FE
CD 1E 3F 24 9E FE C0 2C 7E FE 37 2D 6E FE 85 18 30 00 70 2D
0E 00 51 1E 8E FE CD 1E 3F 24 5E FF C0 2C 6E FE 70 2D 16 00
CF 35 FD 49 83 1E CE FE 32 2D 7E FE 85 18 0A 00 3F 24 8E FF
D5 1B D1 2D 0E 00 A6 3B 06 00 70 00 68 24 6C FE EB 23 6C FE
C7 35 14 00 FD 49 4F 18 18 03 70 2D 16 00 51 1E 8E FE A6 3B
06 00 70 00 DF 1B 2C 3C 06 00 40 00 7C 48 D7 35 3F 24 9E FF
C7 35 14 00 CC 26 68 FE D4 02 EB 23 9E FF DF 1B 2C 3C 06 00
40 00 65 16 19 47 58 FE 3F 24 58 FE E0 36 8E FE 00 00 CD 1E
C0 2C CE FE 85 18 12 00 7C 36 06 00 01 00 00 00 30 00 1F 43
54 FE 38 18 48 02 3F 24 58 FE E0 36 8E FE 01 00 CD 1E C0 2C
CE FE 85 18 12 00 7C 36 06 00 01 00 00 00 31 00 1F 43 54 FE
38 18 22 02 3F 24 58 FE E0 36 8E FE 02 00 CD 1E C0 2C CE FE
85 18 12 00 7C 36 06 00 01 00 00 00 32 00 1F 43 54 FE 38 18
FC 01 3F 24 58 FE E0 36 8E FE 03 00 CD 1E C0 2C CE FE 85 18
12 00 7C 36 06 00 01 00 00 00 33 00 1F 43 54 FE 38 18 D6 01
3F 24 58 FE E0 36 8E FE 04 00 CD 1E C0 2C CE FE 85 18 12 00
7C 36 06 00 01 00 00 00 34 00 1F 43 54 FE 38 18 B0 01 3F 24
58 FE E0 36 8E FE 05 00 CD 1E C0 2C CE FE 85 18 12 00 7C 36
06 00 01 00 00 00 35 00 1F 43 54 FE 38 18 8A 01 3F 24 58 FE
E0 36 8E FE 06 00 CD 1E C0 2C CE FE 85 18 12 00 7C 36 06 00
01 00 00 00 36 00 1F 43 54 FE 38 18 64 01 3F 24 58 FE E0 36
8E FE 07 00 CD 1E C0 2C CE FE 85 18 12 00 7C 36 06 00 01 00
00 00 37 00 1F 43 54 FE 38 18 3E 01 3F 24 58 FE E0 36 8E FE
08 00 CD 1E C0 2C CE FE 85 18 12 00 7C 36 06 00 01 00 00 00
38 00 1F 43 54 FE 38 18 18 01 3F 24 58 FE E0 36 8E FE 09 00
CD 1E C0 2C CE FE 85 18 12 00 7C 36 06 00 01 00 00 00 39 00
1F 43 54 FE 38 18 F2 00 3F 24 58 FE E0 36 8E FE 0A 00 CD 1E
C0 2C CE FE 85 18 12 00 7C 36 06 00 01 00 00 00 41 00 1F 43
54 FE 38 18 CC 00 3F 24 58 FE E0 36 8E FE 0B 00 CD 1E C0 2C
CE FE 85 18 12 00 7C 36 06 00 01 00 00 00 42 00 1F 43 54 FE
38 18 A6 00 3F 24 58 FE E0 36 8E FE 0C 00 CD 1E C0 2C CE FE
85 18 12 00 7C 36 06 00 01 00 00 00 43 00 1F 43 54 FE 38 18
80 00 3F 24 58 FE E0 36 8E FE 0D 00 CD 1E C0 2C CE FE 85 18
12 00 7C 36 06 00 01 00 00 00 44 00 1F 43 54 FE 38 18 5A 00
3F 24 58 FE E0 36 8E FE 0E 00 CD 1E C0 2C CE FE 85 18 12 00
7C 36 06 00 01 00 00 00 45 00 1F 43 54 FE 38 18 34 00 3F 24
58 FE E0 36 8E FE 0F 00 CD 1E C0 2C CE FE 85 18 12 00 7C 36
06 00 01 00 00 00 46 00 1F 43 54 FE 38 18 0E 00 7C 36 06 00
01 00 00 00 3F 00 1F 43 54 FE A5 25 58 FE F5 23 50 FE F5 23
54 FE 8D 4C AB 43 50 FE EB 23 9E FF 15 1C DF 35 15 1C 6D 3A
E4 38 F6 1C EB 23 9E FF 15 1C DF 35 15 1C 6D 3A F6 1C E9 49

08/561316

4F 18 14 00 F5 23 50 FE 7C 36 06 00 01 00 00 00 7C 00 8D 4C
AB 43 50 FE 3F 24 9E FF E7 26 68 FE 2C FD 3F 24 50 FE DB 19
08 00 34 00 10 00 02 05 D7 35 59 3C 06 00 70 00 A7 14 38 18
28 00 EB 23 6C FE D7 35 C7 35 13 00 C7 4B 4F 18 18 00 70 2D
16 00 51 1E 8E FE A6 3B 06 00 70 00 DF 1B 2C 3C 06 00 40 00
7C 48 A6 3B 06 00 70 00 D7 35 FB 38 59 3C 06 00 70 00 A7 14
18 00 60 01 08 04 38 00 00 00 00 00 2C 00 00 00 09 00 00 00
58 FE 02 00 8E FF 02 00 54 FE 01 00 50 FE 01 00 A0 FF 02 00
DE FE 02 00 1E FF 02 00 5E FF 02 00 9E FE 02 00 2C 00 00 00
09 00 00 00 6E FE 02 00 7E FE 02 00 AE FE 02 00 BE FE 02 00
EE FE 02 00 FE FE 02 00 2E FF 02 00 3E FF 02 00 6E FF 02 00
BC 36 16 00 90 FF 0F 00 00 00 53 45 54 20 49 2F 4F 20 23 34
20 74 6F 20 31 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF BC 36 16 00 90 FF 0F 00 00 00 53 45 54 20
49 2F 4F 20 23 34 20 74 6F 20 30 00 7B 41 C5 42 0A 00 00 00
11 3B 00 00 94 3E 01 00 00 00 0C 31 A0 FF 04 00 03 00 1D 25
C9 30 01 00 02 00 01 00 A5 25 A0 FF BC 36 2C 00 90 FF 25 00
00 00 53 45 54 20 49 2F 4F 20 23 34 20 74 6F 20 31 20 66 6F
72 20 61 20 54 49 4D 45 20 6F 66 20 32 30 48 20 73 65 63 00
7B 41 C5 42 0A 00 00 00 11 3B 00 00 94 3E 01 00 00 00 0C 31
A0 FF 04 00 03 00 1D 25 C9 30 01 00 02 00 01 00 A5 25 A0 FF
BC 36 1C 00 90 FF 15 00 00 00 47 45 54 20 53 54 41 54 55 53
20 4F 46 20 53 45 4E 53 4F 52 53 00 7B 41 C5 42 0A 00 00 00
11 3B 00 00 94 3E 01 00 00 00 0C 31 A0 FF 04 00 03 00 1D 25
C9 30 01 00 02 00 01 00 A5 25 A0 FF BC 36 1C 00 90 FF 14 00
00 00 53 45 4E 53 4F 52 53 20 53 43 41 4E 20 4D 4F 44 45 20
4F 4E 00 00 7B 41 C5 42 0A 00 00 00 11 3B 00 00 94 3E 01 00
00 00 0C 31 A0 FF 04 00 03 00 1D 25 C9 30 01 00 02 00 01 00
A5 25 A0 FF BC 36 22 00 90 FF 1A 00 00 00 53 45 4E 53 4F 52
53 20 53 43 41 4E 20 4D 4F 44 45 20 4F 4E 20 6F 6E 63 65 21
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 1C 00 90 FF 15 00 00 00 53 45 4E 53 4F 52 53 20
53 43 41 4E 20 4D 4F 44 45 20 4F 46 46 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 12 00 90 FF
0B 00 00 00 41 55 44 49 4F 20 50 4C 41 59 20 00 7B 41 C5 42
0A 00 00 00 11 3B 00 00 94 3E 01 00 00 00 0C 31 A0 FF 04 00
03 00 1D 25 C9 30 01 00 02 00 01 00 A5 25 A0 FF BC 36 16 00
90 FF 0F 00 00 00 41 55 44 49 4F 20 53 54 4F 50 20 50 4C 41
59 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 26 00 90 FF 1E 00 00 00 41 55 44 49 4F 20 50 4C
41 59 20 61 6E 64 20 53 45 54 20 49 2F 4F 20 23 34 20 74 6F
20 31 00 00 7B 41 C5 42 0A 00 00 00 11 3B 00 00 94 3E 01 00
00 00 0C 31 A0 FF 04 00 03 00 1D 25 C9 30 01 00 02 00 01 00
A5 25 A0 FF BC 36 2A 00 90 FF 23 00 00 00 41 55 44 49 4F 20
53 54 4F 50 20 50 4C 41 59 20 61 6E 64 20 53 45 54 20 49 2F 4F 20 23 34 20 74 6F 20 30 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 36 00 90 FF 2E 00 00 00
50 52 45 50 41 52 45 20 46 4F 52 20 41 55 44 49 4F 28 4C 45
4E 47 54 48 20 35 73 29 2C 20 43 4D 44 20 44 45 4C 41 59 28
32 30 30 6D 73 29 00 00 7B 41 C5 42 0A 00 00 00 11 3B 00 00
94 3E 01 00 00 00 0C 31 A0 FF 04 00 03 00 1D 25 C9 30 01 00
02 00 01 00 A5 25 A0 FF BC 36 3A 00 90 FF 32 00 00 00 50 52
45 50 41 52 45 20 46 4F 52 20 41 55 44 49 4F 28 35 73 29 2C
49 2F 4F 20 23 34 28 38 73 29 2C 20 43 4D 44 20 44 45 4C 41
59 28 32 30 30 6D 73 29 00 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 22 00 90 FF 1A 00 00 00
54 52 41 4E 53 4D 49 54 20 4D 49 43 20 46 4F 52 20 54 49 4D
45 20 28 35 73 29 00 00 7B 41 C5 42 0A 00 00 00 11 3B 00 00
94 3E 01 00 00 00 0C 31 A0 FF 04 00 03 00 1D 25 C9 30 01 00
02 00 01 00 A5 25 A0 FF BC 36 16 00 90 FF 0F 00 00 00 47 4F
54 4F 20 53 4C 45 45 50 20 4D 4F 44 45 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 10 00 90 FF
09 00 00 00 54 4F 59 20 52 45 53 45 54 00 7B 41 C5 42 0A 00
00 00 11 3B 00 00 94 3E 01 00 00 00 0C 31 A0 FF 04 00 03 00
1D 25 C9 30 01 00 02 00 01 00 A5 25 A0 FF BC 36 30 00 90 FF
28 00 00 00 43 2E 52 2E 49 2E 20 53 57 49 54 43 48 20 41 55
44 49 4F 20 54 4F 20 52 41 44 49 4F 20 26 20 54 52 41 4E 53
4D 49 54 54 00 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF BC 36 34 00 90 FF 2C 00 00 00 43 2E 52 2E
49 2E 20 53 57 49 54 43 48 20 41 55 44 49 4F 20 54 4F 20 4A
41 43 4B 20 26 20 53 54 4F 50 20 54 52 41 4E 53 4D 49 54 54
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 18 00 90 FF 11 00 00 00 43 2E 52 2E 49 2E 20 4D
55 54 45 20 52 41 44 49 4F 00 7B 41 C5 42 0A 00 00 00 11 3B
00 00 94 3E 01 00 00 00 0C 31 A0 FF 04 00 03 00 1D 25 C9 30
01 00 02 00 01 00 A5 25 A0 FF BC 36 1C 00 90 FF 14 00 00 00
43 2E 52 2E 49 2E 20 55 4E 2D 4D 55 54 45 20 52 41 44 49 4F
00 00 7B 41 C5 42 0A 00 00 00 11 3B 00 00 94 3E 01 00 00 00
0C 31 A0 FF 04 00 03 00 1D 25 C9 30 01 00 02 00 01 00 A5 25
A0 FF BC 36 14 00 90 FF 0C 00 00 00 43 2E 52 2E 49 2E 20 52
45 53 45 54 00 00 7B 41 C5 42 0A 00 00 00 11 3B 00 00 94 3E
01 00 00 00 0C 31 A0 FF 04 00 03 00 1D 25 C9 30 01 00 02 00
01 00 A5 25 A0 FF D7 35 59 3C 06 00 70 00 A7 14 04 00 20 00
50 06 14 00 00 00 00 00 08 00 00 00 00 00 00 00 0C 00 00 00
01 00 00 00 A0 FF 02 00 7C 42 06 00 6C 30 A0 FF 05 00 03 00
06 00 0C 31 90 FF 20 00 00 00 A5 25 A0 FF 85 18 94 06 BC 36
0A 00 80 FF 02 00 00 00 30 31 00 00 7B 41 C5 42 06 00 00 00
11 3B 00 00 94 3E 00 00 00 00 0C 31 90 FF 0B 00 03 00 1D 25
A6 31 0B 00 01 00 A5 25 90 FF BC 36 0A 00 80 FF 02 00 00 00

30 30 00 00 7B 41 C5 42 06 00 00 00 11 3B 00 00 94 3E 00 00
00 00 0C 31 90 FF 0A 00 03 00 1D 25 A6 31 0B 00 01 00 A5 25
90 FF BC 36 0A 00 80 FF 02 00 00 00 30 30 00 00 7B 41 C5 42
06 00 00 00 11 3B 00 00 94 3E 00 00 00 00 0C 31 90 FF 09 00
03 00 1D 25 A6 31 0B 00 01 00 A5 25 90 FF BC 36 0A 00 80 FF
02 00 00 00 30 35 00 00 7B 41 C5 42 06 00 00 00 11 3B 00 00
94 3E 00 00 00 00 0C 31 90 FF 08 00 03 00 1D 25 A6 31 0B 00
01 00 A5 25 90 FF BC 36 0A 00 80 FF 02 00 00 00 30 32 00 00
7B 41 C5 42 06 00 00 00 11 3B 00 00 94 3E 00 00 00 00 0C 31
90 FF 07 00 03 00 1D 25 A6 31 0B 00 01 00 A5 25 90 FF BC 36
0A 00 80 FF 02 00 00 00 30 33 00 00 7B 41 C5 42 06 00 00 00
11 3B 00 00 94 3E 00 00 00 00 0C 31 90 FF 06 00 03 00 1D 25
A6 31 0B 00 01 00 A5 25 90 FF BC 36 0A 00 80 FF 02 00 00 00
30 30 00 00 7B 41 C5 42 06 00 00 00 11 3B 00 00 94 3E 00 00
00 00 0C 31 90 FF 05 00 03 00 1D 25 A6 31 0B 00 01 00 A5 25
90 FF BC 36 0A 00 80 FF 02 00 00 00 30 30 00 00 7B 41 C5 42
06 00 00 00 11 3B 00 00 94 3E 00 00 00 00 0C 31 90 FF 04 00
03 00 1D 25 A6 31 0B 00 01 00 A5 25 90 FF BC 36 0A 00 80 FF
02 00 00 00 30 33 00 00 7B 41 C5 42 06 00 00 00 11 3B 00 00
94 3E 00 00 00 00 0C 31 90 FF 03 00 03 00 1D 25 A6 31 0B 00
01 00 A5 25 90 FF C5 42 06 00 00 00 11 3B 00 00 94 3E 00 00
00 00 0C 31 90 FF 0B 00 03 00 1D 25 0C 31 A0 FF 0B 00 01 00
D2 1D A2 43 7C FF 46 19 56 14 56 14 C5 42 06 00 00 00 11 3B
00 00 94 3E 00 00 00 00 0C 31 6C FF 0A 00 03 00 1D 25 0C 31
5C FF 0B 00 01 00 D2 1D A2 43 58 FF 46 19 86 14 86 14 C0 37
C5 42 06 00 00 00 11 3B 00 00 94 3E 00 00 00 00 0C 31 48 FF
09 00 03 00 1D 25 0C 31 38 FF 0B 00 01 00 D2 1D A2 43 34 FF
46 19 B6 14 B6 14 C0 37 C5 42 06 00 00 00 11 3B 00 00 94 3E
00 00 00 00 0C 31 24 FF 08 00 03 00 1D 25 0C 31 14 FF 0B 00
01 00 D2 1D A2 43 10 FF 46 19 E6 14 E6 14 C0 37 C5 42 06 00
00 00 11 3B 00 00 94 3E 00 00 00 00 0C 31 00 FF 07 00 03 00
1D 25 0C 31 F0 FE 0B 00 01 00 D2 1D A2 43 EC FE 46 19 16 15
16 15 C0 37 C5 42 06 00 00 00 11 3B 00 00 94 3E 00 00 00 00
0C 31 DC FE 06 00 03 00 1D 25 0C 31 CC FE 0B 00 01 00 D2 1D
A2 43 C8 FE 46 19 46 15 46 15 C0 37 C5 42 06 00 00 00 11 3B
00 00 94 3E 00 00 00 00 0C 31 B8 FE 05 00 03 00 1D 25 0C 31
A8 FE 0B 00 01 00 D2 1D A2 43 A4 FE 46 19 76 15 76 15 C0 37
C5 42 06 00 00 00 11 3B 00 00 94 3E 00 00 00 00 0C 31 94 FE
04 00 03 00 1D 25 0C 31 84 FE 0B 00 01 00 D2 1D A2 43 80 FE
46 19 FF FF FF FF C0 37 C5 42 06 00 00 00 11 3B 00 00 94 3E
00 00 00 00 0C 31 70 FE 03 00 03 00 1D 25 0C 31 60 FE 0B 00
01 00 D2 1D A2 43 5C FE 46 19 96 31 96 31 C0 37 51 1E 80 FF
4F 47 4C FE C2 25 12 00 7C FF 58 FF 34 FF 10 FF EC FE C8 FE
A4 FE 80 FE 5C FE AE 25 24 00 90 FF A0 FF 6C FF 5C FF 48 FF
38 FF 24 FF 14 FF 00 FF F0 FE DC FE CC FE B8 FE A8 FE 94 FE
84 FE 70 FE 60 FE C5 42 06 00 00 00 11 3B 00 00 94 3E 00 00
00 00 0C 31 60 FE 0B 00 03 00 1D 25 0C 31 70 FE 0B 00 01 00
D2 1D A2 43 5C FE C5 42 06 00 00 00 11 3B 00 00 94 3E 00 00
00 00 0C 31 84 FE 0A 00 03 00 1D 25 0C 31 94 FE 0B 00 01 00

D2 1D A2 43 80 FE 8D 4C A2 43 A4 FE C5 42 06 00 00 00 11 3B
00 00 94 3E 00 00 00 00 0C 31 A8 FE 09 00 03 00 1D 25 0C 31
B8 FE 0B 00 01 00 D2 1D A2 43 C8 FE 8D 4C A2 43 EC FE C5 42
06 00 00 00 11 3B 00 00 94 3E 00 00 00 00 0C 31 CC FE 08 00
03 00 1D 25 0C 31 DC FE 0B 00 01 00 D2 1D A2 43 10 FF 8D 4C
A2 43 34 FF C5 42 06 00 00 00 11 3B 00 00 94 3E 00 00 00 00
0C 31 F0 FE 07 00 03 00 1D 25 0C 31 00 FF 0B 00 01 00 D2 1D
A2 43 58 FF 8D 4C A2 43 7C FF C5 42 06 00 00 00 11 3B 00 00
94 3E 00 00 00 00 0C 31 14 FF 06 00 03 00 1D 25 0C 31 24 FF
0B 00 01 00 D2 1D A2 43 48 FE 8D 4C A2 43 44 FE C5 42 06 00
00 00 11 3B 00 00 94 3E 00 00 00 00 0C 31 38 FF 05 00 03 00
1D 25 0C 31 48 FF 0B 00 01 00 D2 1D A2 43 40 FE 8D 4C A2 43
3C FE C5 42 06 00 00 00 11 3B 00 00 94 3E 00 00 00 00 0C 31
5C FF 04 00 03 00 1D 25 0C 31 6C FF 0B 00 01 00 D2 1D A2 43
38 FE 8D 4C A2 43 34 FE C5 42 06 00 00 00 11 3B 00 00 94 3E
00 00 00 00 0C 31 90 FF 03 00 03 00 1D 25 0C 31 A0 FF 0B 00
01 00 D2 1D A2 43 30 FE 8D 4C A2 43 2C FE 3F 24 4C FE 0A 1C
4B 19 FF FF FF FF A2 43 28 FE 8D 4C A2 43 24 FE F7 35 F0 1E
A2 43 20 FE 8D 4C 6F 1E 00 FE 4F 47 10 FE C2 25 28 00 5C FE
80 FE A4 FE C8 FE EC FE 10 FF 34 FF 58 FF 7C FF 48 FE 44 FE
40 FE 3C FE 38 FE 34 FE 30 FE 2C FE 28 FE 24 FE 20 FE AE 25
24 00 60 FE 70 FE 84 FE 94 FE A8 FE B8 FE CC FE DC FE F0 FE
00 FF 14 FF 24 FF 38 FF 48 FF 5C FF 6C FF 90 FF A0 FF 3F 24
10 FE BE 1D 6F 1E 60 FE 7B 41 C5 42 06 00 00 00 11 3B 00 00
94 3E 00 00 00 00 0C 31 00 FE 11 00 03 00 1D 25 A6 31 00 00
01 00 AE 25 04 00 00 FE 60 FE 3F 24 4C FE 0A 1C 4B 19 56 36
56 36 A2 43 20 FE F7 35 F0 1E A2 43 24 FE 8D 4C 6F 1E 60 FE
7B 41 C5 42 06 00 00 00 11 3B 00 00 94 3E 00 00 00 00 0C 31
00 FE 0F 00 03 00 1D 25 A6 31 00 00 01 00 C2 25 04 00 20 FE
24 FE AE 25 04 00 00 FE 60 FE 3F 24 10 FE BE 1D 6F 1E 60 FE
7B 41 C5 42 06 00 00 00 11 3B 00 00 94 3E 00 00 00 00 0C 31
00 FE 0C 00 03 00 1D 25 A6 31 11 00 01 00 AE 25 04 00 00 FE
60 FE A7 14 08 00 B0 01 B4 06 1C 00 00 00 00 00 10 00 00 00
02 00 00 00 10 FE 02 00 4C FE 02 00 A4 00 00 00 27 00 00 00
20 FE 01 00 24 FE 01 00 28 FE 01 00 2C FE 01 00 30 FE 01 00
34 FE 01 00 38 FE 01 00 3C FE 01 00 40 FE 01 00 44 FE 01 00
48 FE 01 00 5C FE 01 00 80 FE 01 00 A4 FE 01 00 C8 FE 01 00
EC FE 01 00 10 FF 01 00 34 FF 01 00 58 FF 01 00 7C FF 01 00
00 FE 02 00 60 FE 02 00 70 FE 02 00 84 FE 02 00 94 FE 02 00
A8 FE 02 00 B8 FE 02 00 CC FE 02 00 DC FE 02 00 F0 FE 02 00
00 FF 02 00 14 FF 02 00 24 FF 02 00 38 FF 02 00 48 FF 02 00
5C FF 02 00 6C FF 02 00 90 FF 02 00 A0 FF 02 00 BC 36 22 00
A0 FF 1B 00 00 00 49 4E 50 55 54 20 20 50 41 54 48 20 20 4F
46 20 20 57 41 56 20 20 46 49 4C 45 20 00 19 47 90 FF 3F 24
90 FF AA 36 80 FF AA 36 70 FF AA 36 60 FF AA 36 50 FF AA 36
40 FF AA 36 30 FF 4B 19 FF FF FF FF AB 43 2C FF AE 25 0E 00
90 FF 80 FF 70 FF 60 FF 50 FF 40 FF 30 FF F5 23 2C FF 6F 1E
A0 FF 7B 41 7C 42 06 00 6C 30 30 FF 05 00 03 00 06 00 A6 31
16 00 00 00 A5 25 30 FF BC 36 0C 00 A0 FF 04 00 00 00 4F 70

65 6E 00 00 7B 41 7C 42 06 00 6C 30 30 FF 05 00 03 00 06 00
A6 31 17 00 00 00 A5 25 30 FF BC 36 0A 00 A0 FF 02 00 00 00
30 31 00 00 7B 41 C5 42 06 00 00 00 11 3B 00 00 94 3E 00 00
00 00 0C 31 30 FF 0B 00 03 00 1D 25 A6 31 0B 00 01 00 A5 25
30 FF BC 36 0A 00 A0 FF 02 00 00 00 30 30 00 00 7B 41 C5 42
06 00 00 00 11 3B 00 00 94 3E 00 00 00 00 0C 31 30 FF 0A 00
03 00 1D 25 A6 31 0B 00 01 00 A5 25 30 FF BC 36 0A 00 A0 FF
02 00 00 00 30 30 00 00 7B 41 C5 42 06 00 00 00 11 3B 00 00
94 3E 00 00 00 00 0C 31 30 FF 09 00 03 00 1D 25 A6 31 0B 00
01 00 A5 25 30 FF BC 36 0A 00 A0 FF 02 00 00 00 30 35 00 00
7B 41 C5 42 06 00 00 00 11 3B 00 00 94 3E 00 00 00 00 0C 31
30 FF 08 00 03 00 1D 25 A6 31 0B 00 01 00 A5 25 30 FF BC 36
0A 00 A0 FF 02 00 00 00 30 32 00 00 7B 41 C5 42 06 00 00 00
11 3B 00 00 94 3E 00 00 00 00 0C 31 30 FF 07 00 03 00 1D 25
A6 31 0B 00 01 00 A5 25 30 FF BC 36 0A 00 A0 FF 02 00 00 00
30 32 00 00 7B 41 C5 42 06 00 00 00 11 3B 00 00 94 3E 00 00
00 00 0C 31 30 FF 06 00 03 00 1D 25 A6 31 0B 00 01 00 A5 25
30 FF BC 36 0A 00 A0 FF 02 00 00 00 30 30 00 00 7B 41 C5 42
06 00 00 00 11 3B 00 00 94 3E 00 00 00 00 0C 31 30 FF 05 00
03 00 1D 25 A6 31 0B 00 01 00 A5 25 30 FF BC 36 0A 00 A0 FF
02 00 00 00 30 30 00 00 7B 41 C5 42 06 00 00 00 11 3B 00 00
94 3E 00 00 00 00 0C 31 30 FF 04 00 03 00 1D 25 A6 31 0B 00
01 00 A5 25 30 FF BC 36 0A 00 A0 FF 02 00 00 00 30 33 00 00
7B 41 C5 42 06 00 00 00 11 3B 00 00 94 3E 00 00 00 00 0C 31
30 FF 03 00 03 00 1D 25 A6 31 0B 00 01 00 A5 25 30 FF C5 42
06 00 00 00 11 3B 00 00 94 3E 00 00 00 00 0C 31 30 FF 0B 00
03 00 1D 25 0C 31 40 FF 0B 00 01 00 D2 1D A2 43 28 FF 46 19
5A 1C 5A 1C C5 42 06 00 00 00 11 3B 00 00 94 3E 00 00 00 00
0C 31 50 FF 0A 00 03 00 1D 25 0C 31 60 FF 0B 00 01 00 D2 1D
A2 43 24 FF 46 19 8A 1C 8A 1C C0 37 C5 42 06 00 00 00 11 3B
00 00 94 3E 00 00 00 00 0C 31 70 FF 09 00 03 00 1D 25 0C 31
80 FF 0B 00 01 00 D2 1D A2 43 20 FF 46 19 BA 1C BA 1C C0 37
C5 42 06 00 00 00 11 3B 00 00 94 3E 00 00 00 00 0C 31 90 FF
08 00 03 00 1D 25 0C 31 10 FF 0B 00 01 00 D2 1D A2 43 0C FF
46 19 EA 1C EA 1C C0 37 C5 42 06 00 00 00 11 3B 00 00 94 3E
00 00 00 00 0C 31 FC FE 07 00 03 00 1D 25 0C 31 EC FE 0B 00
01 00 D2 1D A2 43 E8 FE 46 19 1A 1D 1A 1D C0 37 C5 42 06 00
00 00 11 3B 00 00 94 3E 00 00 00 00 0C 31 D8 FE 06 00 03 00
1D 25 0C 31 C8 FE 0B 00 01 00 D2 1D A2 43 C4 FE 46 19 4A 1D
4A 1D C0 37 C5 42 06 00 00 00 11 3B 00 00 94 3E 00 00 00 00
0C 31 B4 FE 05 00 03 00 1D 25 0C 31 A4 FE 0B 00 01 00 D2 1D
A2 43 A0 FE 46 19 7A 1D 7A 1D C0 37 C5 42 06 00 00 00 11 3B
00 00 94 3E 00 00 00 00 0C 31 90 FE 04 00 03 00 1D 25 0C 31
80 FE 0B 00 01 00 D2 1D A2 43 7C FE 46 19 AA 1D AA 1D C0 37
C5 42 06 00 00 00 11 3B 00 00 94 3E 00 00 00 00 0C 31 6C FE
03 00 03 00 1D 25 0C 31 5C FE 0B 00 01 00 D2 1D A2 43 58 FE
46 19 28 14 28 14 C0 37 51 1E A0 FF 4F 47 48 FE C2 25 12 00
28 FF 24 FF 20 FF 0C FF E8 FE C4 FE A0 FE 7C FE 58 FE AE 25
24 00 30 FF 40 FF 50 FF 60 FF 70 FF 80 FF 90 FF 10 FF FC FE

EC FE D8 FE C8 FE B4 FE A4 FE 90 FE 80 FE 6C FE 5C FE C5 42
06 00 00 00 11 3B 00 00 94 3E 00 00 00 00 0C 31 5C FE 0B 00
03 00 1D 25 0C 31 6C FE 0B 00 01 00 D2 1D A2 43 58 FE C5 42
06 00 00 00 11 3B 00 00 94 3E 00 00 00 00 0C 31 80 FE 0A 00
03 00 1D 25 0C 31 90 FE 0B 00 01 00 D2 1D A2 43 7C FE 8D 4C
A2 43 A0 FE C5 42 06 00 00 00 11 3B 00 00 94 3E 00 00 00 00
0C 31 A4 FE 09 00 03 00 1D 25 0C 31 B4 FE 0B 00 01 00 D2 1D
A2 43 C4 FE 8D 4C A2 43 E8 FE C5 42 06 00 00 00 11 3B 00 00
94 3E 00 00 00 00 0C 31 C8 FE 08 00 03 00 1D 25 0C 31 D8 FE
0B 00 01 00 D2 1D A2 43 0C FF 8D 4C A2 43 20 FF C5 42 06 00
00 00 11 3B 00 00 94 3E 00 00 00 00 0C 31 EC FE 07 00 03 00
1D 25 0C 31 FC FE 0B 00 01 00 D2 1D A2 43 24 FF 8D 4C A2 43
28 FF C5 42 06 00 00 00 11 3B 00 00 94 3E 00 00 00 00 0C 31
10 FF 06 00 03 00 1D 25 0C 31 30 FF 0B 00 01 00 D2 1D A2 43
44 FE 8D 4C A2 43 40 FE C5 42 06 00 00 00 11 3B 00 00 94 3E
00 00 00 00 0C 31 40 FF 05 00 03 00 1D 25 0C 31 50 FF 0B 00
01 00 D2 1D A2 43 3C FE 8D 4C A2 43 38 FE C5 42 06 00 00 00
11 3B 00 00 94 3E 00 00 00 00 0C 31 60 FF 04 00 03 00 1D 25
0C 31 70 FF 0B 00 01 00 D2 1D A2 43 34 FE 8D 4C A2 43 30 FE
C5 42 06 00 00 00 11 3B 00 00 94 3E 00 00 00 00 0C 31 80 FF
03 00 03 00 1D 25 0C 31 90 FF 0B 00 01 00 D2 1D A2 43 2C FE
8D 4C A2 43 28 FE 3F 24 48 FE 0A 1C 4B 19 46 20 46 20 A2 43
24 FE 8D 4C A2 43 20 FE F7 35 F0 1E A2 43 1C FE 8D 4C 6F 1E
FC FD 4F 47 0C FE C2 25 28 00 58 FE 7C FE A0 FE C4 FE E8 FE
0C FF 20 FF 24 FF 28 FF 44 FE 40 FE 3C FE 38 FE 34 FE 30 FE
2C FE 28 FE 24 FE 20 FE 1C FE AE 25 24 00 5C FE 6C FE 80 FE
90 FE A4 FE B4 FE C8 FE D8 FE EC FE FC FE 10 FF 30 FF 40 FF
50 FF 60 FF 70 FF 80 FF 90 FF 3F 24 0C FE BE 1D 6F 1E 5C FE
7B 41 C5 42 06 00 00 00 11 3B 00 00 94 3E 00 00 00 00 0C 31
FC FD 11 00 03 00 1D 25 A6 31 00 00 01 00 AE 25 04 00 FC FD
5C FE 3F 24 48 FE 0A 1C 4B 19 92 17 92 17 A2 43 1C FE F7 35
F0 1E A2 43 20 FE 8D 4C 6F 1E 5C FE 7B 41 C5 42 06 00 00 00
11 3B 00 00 94 3E 00 00 00 00 0C 31 FC FD 0F 00 03 00 1D 25
A6 31 00 00 01 00 C2 25 04 00 1C FE 20 FE AE 25 04 00 FC FD
5C FE 3F 24 0C FE BE 1D 6F 1E 5C FE 7B 41 C5 42 06 00 00 00
11 3B 00 00 94 3E 00 00 00 00 0C 31 FC FD 0C 00 03 00 1D 25
A6 31 11 00 01 00 AE 25 04 00 FC FD 5C FE A7 14 04 00 B4 01
44 07 20 00 00 00 00 00 14 00 00 00 03 00 00 00 2C FF 01 00
0C FE 02 00 48 FE 02 00 A4 00 00 00 27 00 00 00 1C FE 01 00
20 FE 01 00 24 FE 01 00 28 FE 01 00 2C FE 01 00 30 FE 01 00
34 FE 01 00 38 FE 01 00 3C FE 01 00 40 FE 01 00 44 FE 01 00
58 FE 01 00 7C FE 01 00 A0 FE 01 00 C4 FE 01 00 E8 FE 01 00
0C FF 01 00 20 FF 01 00 24 FF 01 00 28 FF 01 00 FC FD 02 00
5C FE 02 00 6C FE 02 00 80 FE 02 00 90 FE 02 00 A4 FE 02 00
B4 FE 02 00 C8 FE 02 00 D8 FE 02 00 EC FE 02 00 FC FE 02 00
10 FF 02 00 30 FF 02 00 40 FF 02 00 50 FF 02 00 60 FF 02 00
70 FF 02 00 80 FF 02 00 90 FF 02 00 7C 42 06 00 6C 30 A0 FF
0B 00 03 00 06 00 0C 31 90 FF 0B 00 01 00 D2 1D 6F 1E 70 FF
CD 1E 89 36 80 FF C0 2C 60 FF 7C 42 06 00 6C 30 50 FF 0A 00

03 00 06 00 0C 31 40 FF 0B 00 01 00 D2 1D 6F 1E 20 FF CD 1E
89 36 30 FF C0 2C 10 FF 37 2D 00 FF 7C 42 06 00 6C 30 F0 FE
09 00 03 00 06 00 0C 31 E0 FE 0B 00 01 00 D2 1D 6F 1E C0 FE
CD 1E 89 36 D0 FE C0 2C B0 FE 37 2D A0 FE 7C 42 06 00 6C 30
90 FE 08 00 03 00 06 00 0C 31 80 FE 0B 00 01 00 D2 1D 6F 1E
60 FE CD 1E 89 36 70 FE C0 2C 50 FE 37 2D 40 FE 7C 42 06 00
6C 30 30 FE 07 00 03 00 06 00 0C 31 20 FE 0B 00 01 00 D2 1D
6F 1E 00 FE CD 1E 89 36 10 FE C0 2C F0 FD 37 2D E0 FD 7C 42
06 00 6C 30 D0 FD 06 00 03 00 06 00 0C 31 C0 FD 0B 00 01 00
D2 1D 6F 1E A0 FD CD 1E 89 36 B0 FD C0 2C 90 FD 37 2D 80 FD
7C 42 06 00 6C 30 70 FD 05 00 03 00 06 00 0C 31 60 FD 0B 00
01 00 D2 1D 6F 1E 40 FD CD 1E 89 36 50 FD C0 2C 30 FD 37 2D
20 FD 7C 42 06 00 6C 30 10 FD 04 00 03 00 06 00 0C 31 00 FD
0B 00 01 00 D2 1D 6F 1E E0 FC CD 1E 89 36 F0 FC C0 2C D0 FC
37 2D C0 FC 7C 42 06 00 6C 30 B0 FC 03 00 03 00 06 00 0C 31
A0 FC 0B 00 01 00 D2 1D 6F 1E 80 FC CD 1E 89 36 90 FC C0 2C
70 FC 37 2D 60 FC AE 25 36 00 A0 FF 90 FF 70 FF 50 FF 40 FF
20 FF F0 FE E0 FE C0 FE 90 FE 80 FE 60 FE 30 FE 20 FE 00 FE
D0 FD C0 FD A0 FD 70 FD 60 FD 40 FD 10 FD 00 FD E0 FC B0 FC
A0 FC 80 FC 85 18 64 00 BC 36 26 00 90 FC 1F 00 00 00 20 20
59 4F 55 20 44 49 44 4E 27 54 20 50 55 54 20 41 4C 4C 20 54
48 45 20 56 41 4C 55 45 53 00 19 47 60 FC 3F 24 60 FC E0 36
F0 FC 30 00 AA 36 70 FC AA 36 80 FC AA 36 A0 FC 46 19 9A 25
9A 25 51 1E 50 FD 4F 47 50 FC AE 25 08 00 60 FC 70 FC 80 FC
A0 FC A7 14 38 18 3A 04 7C 42 06 00 6C 30 60 FC 0B 00 03 00
06 00 0C 31 70 FC 0B 00 01 00 D2 1D A2 43 4C FC 09 4D 37 36
02 00 00 00 64 4A 7C 42 06 00 6C 30 80 FC 0A 00 03 00 06 00
0C 31 A0 FC 0B 00 01 00 D2 1D A2 43 48 FC 09 4D 37 36 02 00
00 00 64 4A 81 37 7C 42 06 00 6C 30 B0 FC 09 00 03 00 06 00
0C 31 C0 FC 0B 00 01 00 D2 1D A2 43 44 FC 09 4D 37 36 02 00
00 00 64 4A 81 37 7C 42 06 00 6C 30 D0 FC 08 00 03 00 06 00
0C 31 E0 FC 0B 00 01 00 D2 1D A2 43 40 FC 09 4D 37 36 02 00
00 00 64 4A 81 37 7C 42 06 00 6C 30 00 FD 07 00 03 00 06 00
0C 31 10 FD 0B 00 01 00 D2 1D A2 43 3C FC 09 4D 37 36 02 00
00 00 64 4A 81 37 7C 42 06 00 6C 30 20 FD 06 00 03 00 06 00
0C 31 30 FD 0B 00 01 00 D2 1D A2 43 38 FC 09 4D 37 36 02 00
00 00 64 4A 81 37 7C 42 06 00 6C 30 40 FD 05 00 03 00 06 00
0C 31 60 FD 0B 00 01 00 D2 1D A2 43 34 FC 09 4D 37 36 02 00
00 00 64 4A 81 37 7C 42 06 00 6C 30 70 FD 04 00 03 00 06 00
0C 31 80 FD 0B 00 01 00 D2 1D A2 43 30 FC 09 4D 37 36 02 00
00 00 64 4A 81 37 7C 42 06 00 6C 30 90 FD 03 00 03 00 06 00
0C 31 A0 FD 0B 00 01 00 D2 1D A2 43 2C FC 09 4D 37 36 02 00
00 00 64 4A 81 37 C2 25 12 00 4C FC 48 FC 44 FC 40 FC 3C FC
38 FC 34 FC 30 FC 2C FC AE 25 24 00 60 FC 70 FC 80 FC A0 FC
B0 FC C0 FC D0 FC E0 FC 00 FD 10 FD 20 FD 30 FD 40 FD 60 FD
70 FD 80 FD 90 FD A0 FD 4F 18 70 00 BC 36 32 00 90 FC 2A 00
00 00 20 20 59 4F 55 20 44 49 44 4E 27 54 20 50 55 54 20 32
20 43 48 41 52 20 49 4E 20 41 4C 4C 20 54 48 45 20 50 4C 41
43 45 53 20 00 00 19 47 60 FC 3F 24 60 FC E0 36 F0 FC 30 00

AA 36 70 FC AA 36 80 FC AA 36 A0 FC 46 19 C0 27 C0 27 51 1E
50 FD 4F 47 50 FC AE 25 08 00 60 FC 70 FC 80 FC A0 FC A7 14
38 18 22 02 7C 42 06 00 6C 30 60 FC 0B 00 03 00 06 00 0C 31
70 FC 0B 00 01 00 D2 1D A2 43 2C FC 46 19 FE 25 FE 25 C7 35
46 00 36 4B 7C 42 06 00 6C 30 80 FC 0A 00 03 00 06 00 0C 31
A0 FC 0B 00 01 00 D2 1D A2 43 30 FC 46 19 28 26 28 26 C7 35
46 00 36 4B 81 37 7C 42 06 00 6C 30 B0 FC 09 00 03 00 06 00
0C 31 C0 FC 0B 00 01 00 D2 1D A2 43 34 FC 46 19 52 26 52 26
C7 35 46 00 36 4B 81 37 7C 42 06 00 6C 30 D0 FC 08 00 03 00
06 00 0C 31 E0 FC 0B 00 01 00 D2 1D A2 43 38 FC 46 19 7C 26
7C 26 C7 35 46 00 36 4B 81 37 7C 42 06 00 6C 30 00 FD 07 00
03 00 06 00 0C 31 10 FD 0B 00 01 00 D2 1D A2 43 3C FC 46 19
A6 26 A6 26 C7 35 46 00 36 4B 81 37 7C 42 06 00 6C 30 20 FD
06 00 03 00 06 00 0C 31 30 FD 0B 00 01 00 D2 1D A2 43 40 FC
46 19 D0 26 D0 26 C7 35 46 00 36 4B 81 37 7C 42 06 00 6C 30
40 FD 05 00 03 00 06 00 0C 31 60 FD 0B 00 01 00 D2 1D A2 43
44 FC 46 19 FA 26 FA 26 C7 35 46 00 36 4B 81 37 7C 42 06 00
6C 30 70 FD 04 00 03 00 06 00 0C 31 80 FD 0B 00 01 00 D2 1D
A2 43 48 FC 46 19 24 27 24 27 C7 35 46 00 36 4B 81 37 7C 42
06 00 6C 30 90 FD 03 00 03 00 06 00 0C 31 A0 FD 0B 00 01 00
D2 1D A2 43 4C FC 46 19 F8 27 F8 27 C7 35 46 00 36 4B 81 37
C2 25 12 00 2C FC 30 FC 34 FC 38 FC 3C FC 40 FC 44 FC 48 FC
4C FC AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD
A0 FD 4F 18 68 00 BC 36 2E 00 90 FC 27 00 00 00 20 20 4E 4F
54 20 41 20 56 41 4C 49 44 20 20 56 41 4C 55 45 20 28 30 20
2D 20 39 20 20 4F 52 20 20 41 20 2D 20 46 29 00 19 47 60 FC
3F 24 60 FC E0 36 F0 FC 30 00 AA 36 70 FC AA 36 80 FC AA 36
A0 FC 46 19 E0 04 E0 04 51 1E 50 FD 4F 47 50 FC AE 25 08 00
60 FC 70 FC 80 FC A0 FC A7 14 7C 42 06 00 6C 30 60 FC 0B 00
03 00 06 00 0C 31 70 FC 0B 00 01 00 D2 1D A2 43 2C FC 46 19
1A 28 1A 28 7C 42 06 00 6C 30 80 FC 0A 00 03 00 06 00 0C 31
A0 FC 0B 00 01 00 D2 1D A2 43 30 FC 46 19 3E 28 3E 28 C0 37
7C 42 06 00 6C 30 B0 FC 09 00 03 00 06 00 0C 31 C0 FC 0B 00
01 00 D2 1D A2 43 34 FC 46 19 62 28 62 28 C0 37 7C 42 06 00
6C 30 D0 FC 08 00 03 00 06 00 0C 31 E0 FC 0B 00 01 00 D2 1D
A2 43 38 FC 46 19 86 28 86 28 C0 37 7C 42 06 00 6C 30 00 FD
07 00 03 00 06 00 0C 31 10 FD 0B 00 01 00 D2 1D A2 43 3C FC
46 19 AA 28 AA 28 C0 37 7C 42 06 00 6C 30 20 FD 06 00 03 00
06 00 0C 31 30 FD 0B 00 01 00 D2 1D A2 43 40 FC 46 19 CE 28
CE 28 C0 37 7C 42 06 00 6C 30 40 FD 05 00 03 00 06 00 0C 31
60 FD 0B 00 01 00 D2 1D A2 43 44 FC 46 19 F2 28 F2 28 C0 37
7C 42 06 00 6C 30 70 FD 04 00 03 00 06 00 0C 31 80 FD 0B 00
01 00 D2 1D A2 43 48 FC 46 19 16 29 16 29 C0 37 7C 42 06 00
6C 30 90 FD 03 00 03 00 06 00 0C 31 A0 FD 0B 00 01 00 D2 1D
A2 43 4C FC 46 19 2C 1C 2C 1C C0 37 51 1E 90 FC 4F 47 1C FC
C2 25 12 00 2C FC 30 FC 34 FC 38 FC 3C FC 40 FC 44 FC 48 FC
4C FC AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD

A0 FD 7C 42 06 00 6C 30 60 FC 0B 00 03 00 06 00 0C 31 70 FC
0B 00 01 00 D2 1D A2 43 2C FC 7C 42 06 00 6C 30 80 FC 0A 00
03 00 06 00 0C 31 A0 FC 0B 00 01 00 D2 1D A2 43 30 FC 8D 4C
A2 43 34 FC 7C 42 06 00 6C 30 B0 FC 09 00 03 00 06 00 0C 31
C0 FC 0B 00 01 00 D2 1D A2 43 38 FC 8D 4C A2 43 3C FC 7C 42
06 00 6C 30 D0 FC 08 00 03 00 06 00 0C 31 E0 FC 0B 00 01 00
D2 1D A2 43 40 FC 8D 4C A2 43 44 FC 7C 42 06 00 6C 30 00 FD
07 00 03 00 06 00 0C 31 10 FD 0B 00 01 00 D2 1D A2 43 48 FC
8D 4C A2 43 4C FC 7C 42 06 00 6C 30 20 FD 06 00 03 00 06 00
0C 31 30 FD 0B 00 01 00 D2 1D A2 43 18 FC 8D 4C A2 43 14 FC
7C 42 06 00 6C 30 40 FD 05 00 03 00 06 00 0C 31 60 FD 0B 00
01 00 D2 1D A2 43 10 FC 8D 4C A2 43 0C FC 7C 42 06 00 6C 30
70 FD 04 00 03 00 06 00 0C 31 80 FD 0B 00 01 00 D2 1D A2 43
08 FC 8D 4C A2 43 04 FC 7C 42 06 00 6C 30 90 FD 03 00 03 00
06 00 0C 31 A0 FD 0B 00 01 00 D2 1D A2 43 00 FC 8D 4C A2 43
FC FB 3F 24 1C FC 0A 1C 4B 19 56 2B 56 2B A2 43 F8 FB 8D 4C
A2 43 F4 FB F7 35 F0 1E A2 43 F0 FB 8D 4C A2 43 EC FB 2C 3C
06 00 2C 00 CB 3D 14 00 C2 25 2A 00 2C FC 30 FC 34 FC 38 FC
3C FC 40 FC 44 FC 48 FC 4C FC 18 FC 14 FC 10 FC 0C FC 08 FC
04 FC 00 FC FC FB F8 FB F4 FB F0 FB EC FB AE 25 24 00 60 FC
70 FC 80 FC A0 FC B0 FC C0 FC D0 FC E0 FC 00 FD 10 FD 20 FD
30 FD 40 FD 60 FD 70 FD 80 FD 90 FD A0 FD 2C 3C 06 00 2C 00
9F 3D 14 00 36 3D EC FB 4A 20 08 40 7C 42 06 00 6C 30 60 FC
11 00 03 00 06 00 A6 31 00 00 01 00 F5 23 EC FB 2C 3C 06 00
2C 00 CB 3D 14 00 CB 25 EC FB A5 25 60 FC 3F 24 1C FC 0A 1C
4B 19 96 1F 96 1F A2 43 EC FB F7 35 F0 1E A2 43 F0 FB 8D 4C
6F 1E 70 FC 7B 41 7C 42 06 00 6C 30 60 FC 0F 00 03 00 06 00
A6 31 00 00 01 00 C2 25 04 00 EC FB F0 FB AE 25 04 00 60 FC
70 FC 2C 3C 06 00 2C 00 9F 3D 14 00 36 3D EC FB 4A 20 08 40
7C 42 06 00 6C 30 60 FC 0C 00 03 00 06 00 A6 31 11 00 01 00
F5 23 EC FB 2C 3C 06 00 2C 00 CB 3D 14 00 CB 25 EC FB A5 25
60 FC A7 14 04 00 C4 03 48 0A 1C 00 00 00 00 00 10 00 00 00
02 00 00 00 50 FC 02 00 1C FC 02 00 0C 01 00 00 41 00 00 00
EC FB 01 00 F0 FB 01 00 F4 FB 01 00 F8 FB 01 00 FC FB 01 00
00 FC 01 00 04 FC 01 00 08 FC 01 00 0C FC 01 00 10 FC 01 00
14 FC 01 00 18 FC 01 00 2C FC 01 00 30 FC 01 00 34 FC 01 00
38 FC 01 00 3C FC 01 00 40 FC 01 00 44 FC 01 00 48 FC 01 00
4C FC 01 00 60 FC 02 00 70 FC 02 00 80 FC 02 00 A0 FC 02 00
B0 FC 02 00 C0 FC 02 00 D0 FC 02 00 E0 FC 02 00 00 FD 02 00
10 FD 02 00 20 FD 02 00 30 FD 02 00 40 FD 02 00 60 FD 02 00
70 FD 02 00 80 FD 02 00 90 FD 02 00 A0 FD 02 00 C0 FD 02 00
D0 FD 02 00 E0 FD 02 00 F0 FD 02 00 00 FE 02 00 20 FE 02 00
30 FE 02 00 40 FE 02 00 50 FE 02 00 60 FE 02 00 80 FE 02 00
90 FE 02 00 A0 FE 02 00 B0 FE 02 00 C0 FE 02 00 E0 FE 02 00
F0 FE 02 00 00 FF 02 00 10 FF 02 00 20 FF 02 00 40 FF 02 00
50 FF 02 00 60 FF 02 00 70 FF 02 00 90 FF 02 00 A0 FF 02 00
BC 36 0A 00 90 FF 02 00 00 00 30 31 00 00 7B 41 7C 42 06 00
6C 30 A0 FF 0B 00 03 00 06 00 A6 31 0B 00 01 00 A5 25 A0 FF
BC 36 0A 00 90 FF 02 00 00 00 30 35 00 00 7B 41 7C 42 06 00

6C 30 A0 FF 08 00 03 00 06 00 A6 31 0B 00 01 00 A5 25 A0 FF
7C 42 06 00 6C 30 A0 FF 0B 00 03 00 06 00 0C 31 80 FF 0B 00
01 00 D2 1D 6F 1E 70 FF CD 1E 89 36 90 FF C0 2C 60 FF 7C 42
06 00 6C 30 50 FF 0A 00 03 00 06 00 0C 31 40 FF 0B 00 01 00
D2 1D 6F 1E 20 FF CD 1E 89 36 30 FF C0 2C 10 FF 37 2D 00 FF
7C 42 06 00 6C 30 F0 FE 09 00 03 00 06 00 0C 31 E0 FE 0B 00
01 00 D2 1D 6F 1E C0 FE CD 1E 89 36 D0 FE C0 2C B0 FE 37 2D
A0 FE 7C 42 06 00 6C 30 90 FE 08 00 03 00 06 00 0C 31 80 FE
0B 00 01 00 D2 1D 6F 1E 60 FE CD 1E 89 36 70 FE C0 2C 50 FE
37 2D 40 FE 7C 42 06 00 6C 30 30 FE 07 00 03 00 06 00 0C 31
20 FE 0B 00 01 00 D2 1D 6F 1E 00 FE CD 1E 89 36 10 FE C0 2C
F0 FD 37 2D E0 FD 7C 42 06 00 6C 30 D0 FD 06 00 03 00 06 00
0C 31 C0 FD 0B 00 01 00 D2 1D 6F 1E A0 FD CD 1E 89 36 B0 FD
C0 2C 90 FD 37 2D 80 FD 7C 42 06 00 6C 30 70 FD 05 00 03 00
06 00 0C 31 60 FD 0B 00 01 00 D2 1D 6F 1E 40 FD CD 1E 89 36
50 FD C0 2C 30 FD 37 2D 20 FD 7C 42 06 00 6C 30 10 FD 04 00
03 00 06 00 0C 31 00 FD 0B 00 01 00 D2 1D 6F 1E E0 FC CD 1E
89 36 F0 FC C0 2C D0 FC 37 2D C0 FC 7C 42 06 00 6C 30 B0 FC
03 00 03 00 06 00 0C 31 A0 FC 0B 00 01 00 D2 1D 6F 1E 80 FC
CD 1E 89 36 90 FC C0 2C 70 FC 37 2D 60 FC AE 25 36 00 A0 FF
80 FF 70 FF 50 FF 40 FF 20 FF F0 FE E0 FE C0 FE 90 FE 80 FE
60 FE 30 FE 20 FE 00 FE D0 FD C0 FD A0 FD 70 FD 60 FD 40 FD
10 FD 00 FD E0 FC B0 FC A0 FC 80 FC 85 18 64 00 BC 36 26 00
90 FC 1F 00 00 00 20 20 59 4F 55 20 44 49 44 4E 27 54 20 50
55 54 20 41 4C 4C 20 54 48 45 20 56 41 4C 55 45 53 00 19 47
60 FC 3F 24 60 FC E0 36 F0 FC 30 00 AA 36 70 FC AA 36 80 FC
AA 36 A0 FC 46 19 5A 31 5A 31 51 1E 50 FD 4F 47 50 FC AE 25
08 00 60 FC 70 FC 80 FC A0 FC A7 14 38 18 3A 04 7C 42 06 00
6C 30 60 FC 0B 00 03 00 06 00 0C 31 70 FC 0B 00 01 00 D2 1D
A2 43 4C FC 09 4D 37 36 02 00 00 00 64 4A 7C 42 06 00 6C 30
80 FC 0A 00 03 00 06 00 0C 31 A0 FC 0B 00 01 00 D2 1D A2 43
48 FC 09 4D 37 36 02 00 00 00 64 4A 81 37 7C 42 06 00 6C 30
B0 FC 09 00 03 00 06 00 0C 31 C0 FC 0B 00 01 00 D2 1D A2 43
44 FC 09 4D 37 36 02 00 00 00 64 4A 81 37 7C 42 06 00 6C 30
D0 FC 08 00 03 00 06 00 0C 31 E0 FC 0B 00 01 00 D2 1D A2 43
40 FC 09 4D 37 36 02 00 00 00 64 4A 81 37 7C 42 06 00 6C 30
00 FD 07 00 03 00 06 00 0C 31 10 FD 0B 00 01 00 D2 1D A2 43
3C FC 09 4D 37 36 02 00 00 00 64 4A 81 37 7C 42 06 00 6C 30
20 FD 06 00 03 00 06 00 0C 31 30 FD 0B 00 01 00 D2 1D A2 43
38 FC 09 4D 37 36 02 00 00 00 64 4A 81 37 7C 42 06 00 6C 30
40 FD 05 00 03 00 06 00 0C 31 60 FD 0B 00 01 00 D2 1D A2 43
34 FC 09 4D 37 36 02 00 00 00 64 4A 81 37 7C 42 06 00 6C 30
70 FD 04 00 03 00 06 00 0C 31 80 FD 0B 00 01 00 D2 1D A2 43
30 FC 09 4D 37 36 02 00 00 00 64 4A 81 37 7C 42 06 00 6C 30
90 FD 03 00 03 00 06 00 0C 31 A0 FD 0B 00 01 00 D2 1D A2 43
2C FC 09 4D 37 36 02 00 00 00 64 4A 81 37 C2 25 12 00 4C FC
48 FC 44 FC 40 FC 3C FC 38 FC 34 FC 30 FC 2C FC AE 25 24 00
60 FC 70 FC 80 FC A0 FC B0 FC C0 FC D0 FC E0 FC 00 FD 10 FD
20 FD 30 FD 40 FD 60 FD 70 FD 80 FD 90 FD A0 FD 4F 18 70 00

08/561316

BC 36 32 00 90 FC 2A 00 00 00 20 20 59 4F 55 20 44 49 44 4E
27 54 20 50 55 54 20 32 20 43 48 41 52 20 49 4E 20 41 4C 4C
20 54 48 45 20 50 4C 41 43 45 53 20 00 00 19 47 60 FC 3F 24
60 FC E0 36 F0 FC 30 00 AA 36 70 FC AA 36 80 FC AA 36 A0 FC
46 19 80 33 80 33 51 1E 50 FD 4F 47 50 FC AE 25 08 00 60 FC
70 FC 80 FC A0 FC A7 14 38 18 22 02 7C 42 06 00 6C 30 60 FC
0B 00 03 00 06 00 0C 31 70 FC 0B 00 01 00 D2 1D A2 43 2C FC
46 19 BE 31 BE 31 C7 35 46 00 36 4B 7C 42 06 00 6C 30 80 FC
0A 00 03 00 06 00 0C 31 A0 FC 0B 00 01 00 D2 1D A2 43 30 FC
46 19 E8 31 E8 31 C7 35 46 00 36 4B 81 37 7C 42 06 00 6C 30
B0 FC 09 00 03 00 06 00 0C 31 C0 FC 0B 00 01 00 D2 1D A2 43
34 FC 46 19 12 32 12 32 C7 35 46 00 36 4B 81 37 7C 42 06 00
6C 30 D0 FC 08 00 03 00 06 00 0C 31 E0 FC 0B 00 01 00 D2 1D
A2 43 38 FC 46 19 3C 32 3C 32 C7 35 46 00 36 4B 81 37 7C 42
06 00 6C 30 00 FD 07 00 03 00 06 00 0C 31 10 FD 0B 00 01 00
D2 1D A2 43 3C FC 46 19 66 32 66 32 C7 35 46 00 36 4B 81 37
7C 42 06 00 6C 30 20 FD 06 00 03 00 06 00 0C 31 30 FD 0B 00
01 00 D2 1D A2 43 40 FC 46 19 90 32 90 32 C7 35 46 00 36 4B
81 37 7C 42 06 00 6C 30 40 FD 05 00 03 00 06 00 0C 31 60 FD
0B 00 01 00 D2 1D A2 43 44 FC 46 19 BA 32 BA 32 C7 35 46 00
36 4B 81 37 7C 42 06 00 6C 30 70 FD 04 00 03 00 06 00 0C 31
80 FD 0B 00 01 00 D2 1D A2 43 48 FC 46 19 E4 32 E4 32 C7 35
46 00 36 4B 81 37 7C 42 06 00 6C 30 90 FD 03 00 03 00 06 00
0C 31 A0 FD 0B 00 01 00 D2 1D A2 43 4C FC 46 19 B8 33 B8 33
C7 35 46 00 36 4B 81 37 C2 25 12 00 2C FC 30 FC 34 FC 38 FC
3C FC 40 FC 44 FC 48 FC 4C FC AE 25 24 00 60 FC 70 FC 80 FC
A0 FC B0 FC C0 FC D0 FC E0 FC 00 FD 10 FD 20 FD 30 FD 40 FD
60 FD 70 FD 80 FD 90 FD A0 FD 4F 18 68 00 BC 36 2E 00 90 FC
27 00 00 00 20 20 4E 4F 54 20 41 20 56 41 4C 49 44 20 20 56
41 4C 55 45 20 28 30 20 2D 20 39 20 20 4F 52 20 20 41 20 2D
20 46 29 00 19 47 60 FC 3F 24 60 FC E0 36 F0 FC 30 00 AA 36
70 FC AA 36 80 FC AA 36 A0 FC 46 19 82 23 82 23 51 1E 50 FD
4F 47 50 FC AE 25 08 00 60 FC 70 FC 80 FC A0 FC A7 14 7C 42
06 00 6C 30 60 FC 0B 00 03 00 06 00 0C 31 70 FC 0B 00 01 00
D2 1D A2 43 2C FC 46 19 DA 33 DA 33 7C 42 06 00 6C 30 80 FC
0A 00 03 00 06 00 0C 31 A0 FC 0B 00 01 00 D2 1D A2 43 30 FC
46 19 FE 33 FE 33 C0 37 7C 42 06 00 6C 30 B0 FC 09 00 03 00
06 00 0C 31 C0 FC 0B 00 01 00 D2 1D A2 43 34 FC 46 19 22 34
22 34 C0 37 7C 42 06 00 6C 30 D0 FC 08 00 03 00 06 00 0C 31
E0 FC 0B 00 01 00 D2 1D A2 43 38 FC 46 19 46 34 46 34 C0 37
7C 42 06 00 6C 30 00 FD 07 00 03 00 06 00 0C 31 10 FD 0B 00
01 00 D2 1D A2 43 3C FC 46 19 6A 34 6A 34 C0 37 7C 42 06 00
6C 30 20 FD 06 00 03 00 06 00 0C 31 30 FD 0B 00 01 00 D2 1D
A2 43 40 FC 46 19 8E 34 8E 34 C0 37 7C 42 06 00 6C 30 40 FD
05 00 03 00 06 00 0C 31 60 FD 0B 00 01 00 D2 1D A2 43 44 FC
46 19 B2 34 B2 34 C0 37 7C 42 06 00 6C 30 70 FD 04 00 03 00
06 00 0C 31 80 FD 0B 00 01 00 D2 1D A2 43 48 FC 46 19 D6 34
D6 34 C0 37 7C 42 06 00 6C 30 90 FD 03 00 03 00 06 00 0C 31
A0 FD 0B 00 01 00 D2 1D A2 43 4C FC 46 19 D6 25 D6 25 C0 37

51 1E 90 FC 4F 47 1C FC C2 25 12 00 2C FC 30 FC 34 FC 38 FC
3C FC 40 FC 44 FC 48 FC 4C FC AE 25 24 00 60 FC 70 FC 80 FC
A0 FC B0 FC C0 FC D0 FC E0 FC 00 FD 10 FD 20 FD 30 FD 40 FD
60 FD 70 FD 80 FD 90 FD A0 FD 7C 42 06 00 6C 30 60 FC 0B 00
03 00 06 00 0C 31 70 FC 0B 00 01 00 D2 1D A2 43 2C FC 7C 42
06 00 6C 30 80 FC 0A 00 03 00 06 00 0C 31 A0 FC 0B 00 01 00
D2 1D A2 43 30 FC 8D 4C A2 43 34 FC 7C 42 06 00 6C 30 B0 FC
09 00 03 00 06 00 0C 31 C0 FC 0B 00 01 00 D2 1D A2 43 38 FC
8D 4C A2 43 3C FC 7C 42 06 00 6C 30 D0 FC 08 00 03 00 06 00
0C 31 E0 FC 0B 00 01 00 D2 1D A2 43 40 FC 8D 4C A2 43 44 FC
7C 42 06 00 6C 30 00 FD 07 00 03 00 06 00 0C 31 10 FD 0B 00
01 00 D2 1D A2 43 48 FC 8D 4C A2 43 4C FC 7C 42 06 00 6C 30
20 FD 06 00 03 00 06 00 0C 31 30 FD 0B 00 01 00 D2 1D A2 43
18 FC 8D 4C A2 43 14 FC 7C 42 06 00 6C 30 40 FD 05 00 03 00
06 00 0C 31 60 FD 0B 00 01 00 D2 1D A2 43 10 FC 8D 4C A2 43
0C FC 7C 42 06 00 6C 30 70 FD 04 00 03 00 06 00 0C 31 80 FD
0B 00 01 00 D2 1D A2 43 08 FC 8D 4C A2 43 04 FC 7C 42 06 00
6C 30 90 FD 03 00 03 00 06 00 0C 31 A0 FD 0B 00 01 00 D2 1D
A2 43 00 FC 8D 4C A2 43 FC FB 3F 24 1C FC 0A 1C 4B 19 16 37
16 37 A2 43 F8 FB 8D 4C A2 43 F4 FB F7 35 F0 1E A2 43 F0 FB
8D 4C A2 43 EC FB 2C 3C 06 00 2C 00 CB 3D 14 00 C2 25 2A 00
2C FC 30 FC 34 FC 38 FC 3C FC 40 FC 44 FC 48 FC 4C FC 18 FC
14 FC 10 FC 0C FC 08 FC 04 FC 00 FC FC FB F8 FB F4 FB F0 FB
EC FB AE 25 24 00 60 FC 70 FC 80 FC A0 FC B0 FC C0 FC D0 FC
E0 FC 00 FD 10 FD 20 FD 30 FD 40 FD 60 FD 70 FD 80 FD 90 FD
A0 FD 2C 3C 06 00 2C 00 9F 3D 14 00 36 3D EC FB 4A 20 08 40
7C 42 06 00 6C 30 60 FC 11 00 03 00 06 00 A6 31 00 00 01 00
F5 23 EC FB 2C 3C 06 00 2C 00 CB 3D 14 00 CB 25 EC FB A5 25
60 FC 3F 24 1C FC 0A 1C 4B 19 96 2A 96 2A A2 43 EC FB F7 35
F0 1E A2 43 F0 FB 8D 4C 6F 1E 70 FC 7B 41 7C 42 06 00 6C 30
60 FC 0F 00 03 00 06 00 A6 31 00 00 01 00 C2 25 04 00 EC FB
F0 FB AE 25 04 00 60 FC 70 FC A7 14 04 00 C4 03 5C 0A 1C 00
00 00 00 00 10 00 00 00 02 00 00 00 50 FC 02 00 1C FC 02 00
0C 01 00 00 41 00 00 00 EC FB 01 00 F0 FB 01 00 F4 FB 01 00
F8 FB 01 00 FC FB 01 00 00 FC 01 00 04 FC 01 00 08 FC 01 00
0C FC 01 00 10 FC 01 00 14 FC 01 00 18 FC 01 00 2C FC 01 00
30 FC 01 00 34 FC 01 00 38 FC 01 00 3C FC 01 00 40 FC 01 00
44 FC 01 00 48 FC 01 00 4C FC 01 00 60 FC 02 00 70 FC 02 00
80 FC 02 00 A0 FC 02 00 B0 FC 02 00 C0 FC 02 00 D0 FC 02 00
E0 FC 02 00 00 FD 02 00 10 FD 02 00 20 FD 02 00 30 FD 02 00
40 FD 02 00 60 FD 02 00 70 FD 02 00 80 FD 02 00 90 FD 02 00
A0 FD 02 00 C0 FD 02 00 D0 FD 02 00 E0 FD 02 00 F0 FD 02 00
00 FE 02 00 20 FE 02 00 30 FE 02 00 40 FE 02 00 50 FE 02 00
60 FE 02 00 80 FE 02 00 90 FE 02 00 A0 FE 02 00 B0 FE 02 00
C0 FE 02 00 E0 FE 02 00 F0 FE 02 00 00 FF 02 00 10 FF 02 00
20 FF 02 00 40 FF 02 00 50 FF 02 00 60 FF 02 00 70 FF 02 00
80 FF 02 00 A0 FF 02 00 07 00 03 01 C8 19 01 00 54 02 03 01
A6 15 01 00 04 02 03 01 42 18 01 00 19 02 03 01 D6 06 01 00
53 02 02 00 B0 01 05 00 00 00 02 00 9A 01 06 00 00 00 03 01

9D 01 01 00 C7 00 00 00 00 00 00 00 00 00 00 00 7C 42 06 00
6C 30 A0 FF 04 00 03 00 06 00 0C 31 90 FF 13 00 01 00 D5 1B
68 24 8E FF AE 25 04 00 A0 FF 90 FF EB 23 8E FF CF 35 FD 49
4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 31 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 33 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF 38 18 E0 25 EB 23 8E FF
D7 35 FD 49 4F 18 D8 01 BC 36 0A 00 7E FF 02 00 00 00 30 31
00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 33 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41

C5 42 06 00 00 00 11 3B 00 00 94 3E 00 00 00 00 0C 31 90 FF
03 00 03 00 1D 25 A6 31 0B 00 01 00 A5 25 90 FF 38 18 FC 23
EB 23 8E FF DF 35 FD 49 4F 18 D8 01 BC 36 0A 00 7E FF 02 00
00 00 30 31 00 00 7B 41 C5 42 06 00 00 00 11 3B 00 00 94 3E
00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 33 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 32 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF
38 18 18 22 EB 23 8E FF E7 35 FD 49 4F 18 D8 01 BC 36 0A 00
7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 31 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E 00 00 00 00 0C 31 90 FF 03 00 03 00 1D 25 A6 31 0B 00 01 00
A5 25 90 FF 38 18 34 20 EB 23 8E FF EF 35 FD 49 4F 18 D8 01
BC 36 0A 00 7E FF 02 00 00 00 30 31 00 00 7B 41 C5 42 06 00
00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 31 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 50 1E EB 23 8E FF F7 35 FD 49
4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 31 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00

08/561216

1D 25 A6 31 0B 00 01 00 A5 25 90 FF 38 18 6C 1C EB 23 8E FF
FF 35 FD 49 4F 18 D8 01 BC 36 0A 00 7E FF 02 00 00 00 30 31
00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 33
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
03 00 03 00 1D 25 A6 31 0B 00 01 00 A5 25 90 FF 38 18 88 1A
EB 23 8E FF 07 36 FD 49 4F 18 D8 01 BC 36 0A 00 7E FF 02 00
00 00 30 31 00 00 7B 41 C5 42 06 00 00 00 11 3B 00 00 94 3E
00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF 38 18 A4 18 EB 23 8E FF 0F 36 FD 49 4F 18 D8 01 BC 36 0A 00
7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 31 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 03 00 03 00 1D 25 A6 31 0B 00 01 00
A5 25 90 FF 38 18 C0 16 EB 23 8E FF 17 36 FD 49 4F 18 D8 01
BC 36 0A 00 7E FF 02 00 00 00 30 31 00 00 7B 41 C5 42 06 00
00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 32
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 33 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 DC 14 EB 23 8E FF 1F 36 FD 49

08/501015

4F 18 D8 01 BC 36 0A 00 7E FF 02 00 00 00 30 31 00 00 7B 41
C5 42 06 00 00 00 11 3B 00 00 94 3E 00 00 00 00 0C 31 90 FF
0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 33 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 33 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF 38 18 F8 12 EB 23 8E FF
C7 35 0B 00 FD 49 4F 18 D8 01 BC 36 0A 00 7E FF 02 00 00 00
30 31 00 00 7B 41 C5 42 06 00 00 00 11 3B 00 00 94 3E 00 00
00 00 0C 31 90 FF 0B 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 0A 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 09 00 03 00 1D 25 A6 31 0B 00
01 00 A5 25 90 FF BC 36 0A 00 7E FF 02 00 00 00 30 35 00 00
7B 41 C5 42 06 00 00 00 11 3B 00 00 94 3E 00 00 00 00 0C 31
90 FF 08 00 03 00 1D 25 A6 31 0B 00 01 00 A5 25 90 FF BC 36
0A 00 7E FF 02 00 00 00 30 32 00 00 7B 41 C5 42 06 00 00 00
11 3B 00 00 94 3E 00 00 00 00 0C 31 90 FF 07 00 03 00 1D 25
A6 31 0B 00 01 00 A5 25 90 FF BC 36 0A 00 7E FF 02 00 00 00
30 34 00 00 7B 41 C5 42 06 00 00 00 11 3B 00 00 94 3E 00 00
00 00 0C 31 90 FF 06 00 03 00 1D 25 A6 31 0B 00 01 00 A5 25
90 FF BC 36 0A 00 7E FF 02 00 00 00 35 30 00 00 7B 41 C5 42
06 00 00 00 11 3B 00 00 94 3E 00 00 00 00 0C 31 90 FF 05 00
03 00 1D 25 A6 31 0B 00 01 00 A5 25 90 FF BC 36 0A 00 7E FF
02 00 00 00 30 32 00 00 7B 41 C5 42 06 00 00 00 11 3B 00 00
94 3E 00 00 00 00 0C 31 90 FF 04 00 03 00 1D 25 A6 31 0B 00
01 00 A5 25 90 FF BC 36 0A 00 7E FF 02 00 00 00 30 46 00 00
7B 41 C5 42 06 00 00 00 11 3B 00 00 94 3E 00 00 00 00 0C 31
90 FF 03 00 03 00 1D 25 A6 31 0B 00 01 00 A5 25 90 FF 38 18
12 11 EB 23 8E FF C7 35 0C 00 FD 49 4F 18 D8 01 BC 36 0A 00

08/561316

7E FF 02 00 00 00 30 31 00 00 7B 41 C5 42 06 00 00 00 11 3B
00 00 94 3E 00 00 00 00 0C 31 90 FF 0B 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 0A 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 09 00 03 00
1D 25 A6 31 0B 00 01 00 A5 25 90 FF BC 36 0A 00 7E FF 02 00
00 00 30 35 00 00 7B 41 C5 42 06 00 00 00 11 3B 00 00 94 3E
00 00 00 00 0C 31 90 FF 08 00 03 00 1D 25 A6 31 0B 00 01 00
A5 25 90 FF BC 36 0A 00 7E FF 02 00 00 00 30 32 00 00 7B 41
C5 42 06 00 00 00 11 3B 00 00 94 3E 00 00 00 00 0C 31 90 FF
07 00 03 00 1D 25 A6 31 0B 00 01 00 A5 25 90 FF BC 36 0A 00
7E FF 02 00 00 00 30 34 00 00 7B 41 C5 42 06 00 00 00 11 3B
00 00 94 3E 00 00 00 00 0C 31 90 FF 06 00 03 00 1D 25 A6 31
0B 00 01 00 A5 25 90 FF BC 36 0A 00 7E FF 02 00 00 00 35 38
00 00 7B 41 C5 42 06 00 00 00 11 3B 00 00 94 3E 00 00 00 00
0C 31 90 FF 05 00 03 00 1D 25 A6 31 0B 00 01 00 A5 25 90 FF
BC 36 0A 00 7E FF 02 00 00 00 30 32 00 00 7B 41 C5 42 06 00
00 00 11 3B 00 00 94 3E 00 00 00 00 0C 31 90 FF 04 00 03 00
1D 25 A6 31 0B 00 01 00 A5 25 90 FF BC 36 0A 00 7E FF 02 00
00 00 30 33 00 00 7B 41 C5 42 06 00 00 00 11 3B 00 00 94 3E
00 00 00 00 0C 31 90 FF 03 00 03 00 1D 25 A6 31 0B 00 01 00
A5 25 90 FF 38 18 2C 0F EB 23 8E FF C7 35 0D 00 FD 49 4F 18
D8 01 BC 36 0A 00 7E FF 02 00 00 00 30 31 00 00 7B 41 C5 42
06 00 00 00 11 3B 00 00 94 3E 00 00 00 00 0C 31 90 FF 0B 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 0A 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 09 00 03 00 1D 25 A6 31 0B 00 01 00 A5 25 90 FF BC 36
0A 00 7E FF 02 00 00 00 30 35 00 00 7B 41 C5 42 06 00 00 00
11 3B 00 00 94 3E 00 00 00 00 0C 31 90 FF 08 00 03 00 1D 25
A6 31 0B 00 01 00 A5 25 90 FF BC 36 0A 00 7E FF 02 00 00 00
30 33 00 00 7B 41 C5 42 06 00 00 00 11 3B 00 00 94 3E 00 00
00 00 0C 31 90 FF 07 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 06 00
03 00 1D 25 A6 31 0B 00 01 00 A5 25 90 FF BC 36 0A 00 7E FF
02 00 00 00 30 35 00 00 7B 41 C5 42 06 00 00 00 11 3B 00 00
94 3E 00 00 00 00 0C 31 90 FF 05 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 04 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 03 00 03 00 1D 25
A6 31 0B 00 01 00 A5 25 90 FF 38 18 46 0D EB 23 8E FF C7 35
0E 00 FD 49 4F 18 D8 01 BC 36 0A 00 7E FF 02 00 00 00 30 31

00 00 7B 41 C5 42 06 00 00 00 11 3B 00 00 94 3E 00 00 00 00
0C 31 90 FF 0B 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 0A 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 09 00 03 00 1D 25 A6 31 0B 00 01 00
A5 25 90 FF BC 36 0A 00 7E FF 02 00 00 00 30 35 00 00 7B 41
C5 42 06 00 00 00 11 3B 00 00 94 3E 00 00 00 00 0C 31 90 FF
08 00 03 00 1D 25 A6 31 0B 00 01 00 A5 25 90 FF BC 36 0A 00
7E FF 02 00 00 00 30 34 00 00 7B 41 C5 42 06 00 00 00 11 3B
00 00 94 3E 00 00 00 00 0C 31 90 FF 07 00 03 00 1D 25 A6 31
0B 00 01 00 A5 25 90 FF BC 36 0A 00 7E FF 02 00 00 00 30 31
00 00 7B 41 C5 42 06 00 00 00 11 3B 00 00 94 3E 00 00 00 00
0C 31 90 FF 06 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 05 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 04 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
03 00 03 00 1D 25 A6 31 0B 00 01 00 A5 25 90 FF 38 18 60 0B
EB 23 8E FF C7 35 0F 00 FD 49 4F 18 D8 01 BC 36 0A 00 7E FF
02 00 00 00 30 31 00 00 7B 41 C5 42 06 00 00 00 11 3B 00 00
94 3E 00 00 00 00 0C 31 90 FF 0B 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 0A 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 09 00 03 00 1D 25
A6 31 0B 00 01 00 A5 25 90 FF BC 36 0A 00 7E FF 02 00 00 00
30 35 00 00 7B 41 C5 42 06 00 00 00 11 3B 00 00 94 3E 00 00
00 00 0C 31 90 FF 08 00 03 00 1D 25 A6 31 0B 00 01 00 A5 25
90 FF BC 36 0A 00 7E FF 02 00 00 00 30 34 00 00 7B 41 C5 42
06 00 00 00 11 3B 00 00 94 3E 00 00 00 00 0C 31 90 FF 07 00
03 00 1D 25 A6 31 0B 00 01 00 A5 25 90 FF BC 36 0A 00 7E FF
02 00 00 00 30 46 00 00 7B 41 C5 42 06 00 00 00 11 3B 00 00
94 3E 00 00 00 00 0C 31 90 FF 06 00 03 00 1D 25 A6 31 0B 00
01 00 A5 25 90 FF BC 36 0A 00 7E FF 02 00 00 00 30 30 00 00
7B 41 C5 42 06 00 00 00 11 3B 00 00 94 3E 00 00 00 00 0C 31
90 FF 05 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 04 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 03 00 03 00 1D 25 A6 31 0B 00 01 00 A5 25
90 FF 38 18 7A 09 EB 23 8E FF C7 35 10 00 FD 49 4F 18 D8 01
BC 36 0A 00 7E FF 02 00 00 00 30 31 00 00 7B 41 C5 42 06 00

09/501313

00 00 11 3B 00 00 94 3E 00 00 00 00 0C 31 90 FF 0B 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 0A 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
09 00 03 00 1D 25 A6 31 0B 00 01 00 A5 25 90 FF BC 36 0A 00
7E FF 02 00 00 00 30 35 00 00 7B 41 C5 42 06 00 00 00 11 3B
00 00 94 3E 00 00 00 00 0C 31 90 FF 08 00 03 00 1D 25 A6 31
0B 00 01 00 A5 25 90 FF BC 36 0A 00 7E FF 02 00 00 00 30 43
00 00 7B 41 C5 42 06 00 00 00 11 3B 00 00 94 3E 00 00 00 00
0C 31 90 FF 07 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 06 00 03 00
1D 25 A6 31 0B 00 01 00 A5 25 90 FF BC 36 0A 00 7E FF 02 00
00 00 30 30 00 00 7B 41 C5 42 06 00 00 00 11 3B 00 00 94 3E
00 00 00 00 0C 31 90 FF 05 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
04 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 03 00 03 00 1D 25 A6 31
0B 00 01 00 A5 25 90 FF 38 18 94 07 EB 23 8E FF C7 35 11 00
FD 49 4F 18 D8 01 BC 36 0A 00 7E FF 02 00 00 00 30 31 00 00
7B 41 C5 42 06 00 00 00 11 3B 00 00 94 3E 00 00 00 00 0C 31
90 FF 0B 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 0A 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 09 00 03 00 1D 25 A6 31 0B 00 01 00 A5 25
90 FF BC 36 0A 00 7E FF 02 00 00 00 30 35 00 00 7B 41 C5 42
06 00 00 00 11 3B 00 00 94 3E 00 00 00 00 0C 31 90 FF 08 00
03 00 1D 25 A6 31 0B 00 01 00 A5 25 90 FF BC 36 0A 00 7E FF
02 00 00 00 30 43 00 00 7B 41 C5 42 06 00 00 00 11 3B 00 00
94 3E 00 00 00 00 0C 31 90 FF 07 00 03 00 1D 25 A6 31 0B 00
01 00 A5 25 90 FF BC 36 0A 00 7E FF 02 00 00 00 30 31 00 00
7B 41 C5 42 06 00 00 00 11 3B 00 00 94 3E 00 00 00 00 0C 31
90 FF 06 00 03 00 1D 25 A6 31 0B 00 01 00 A5 25 90 FF BC 36
0A 00 7E FF 02 00 00 00 30 30 00 00 7B 41 C5 42 06 00 00 00
11 3B 00 00 94 3E 00 00 00 00 0C 31 90 FF 05 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 04 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 03 00
03 00 1D 25 A6 31 0B 00 01 00 A5 25 90 FF 38 18 AE 05 EB 23
8E FF C7 35 12 00 FD 49 4F 18 D8 01 BC 36 0A 00 7E FF 02 00
00 00 30 31 00 00 7B 41 C5 42 06 00 00 00 11 3B 00 00 94 3E 00 00 00 00 0C 31 90 FF 0B 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
0A 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 09 00 03 00 1D 25 A6 31
0B 00 01 00 A5 25 90 FF BC 36 0A 00 7E FF 02 00 00 00 30 35
00 00 7B 41 C5 42 06 00 00 00 11 3B 00 00 94 3E 00 00 00 00
0C 31 90 FF 08 00 03 00 1D 25 A6 31 0B 00 01 00 A5 25 90 FF
BC 36 0A 00 7E FF 02 00 00 00 30 43 00 00 7B 41 C5 42 06 00
00 00 11 3B 00 00 94 3E 00 00 00 00 0C 31 90 FF 07 00 03 00
1D 25 A6 31 0B 00 01 00 A5 25 90 FF BC 36 0A 00 7E FF 02 00
00 00 30 32 00 00 7B 41 C5 42 06 00 00 00 11 3B 00 00 94 3E
00 00 00 00 0C 31 90 FF 06 00 03 00 1D 25 A6 31 0B 00 01 00
A5 25 90 FF BC 36 0A 00 7E FF 02 00 00 00 30 30 00 00 7B 41
C5 42 06 00 00 00 11 3B 00 00 94 3E 00 00 00 00 0C 31 90 FF
05 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 04 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 03 00 03 00 1D 25 A6 31 0B 00 01 00 A5 25 90 FF
38 18 C8 03 EB 23 8E FF C7 35 13 00 FD 49 4F 18 D8 01 BC 36
0A 00 7E FF 02 00 00 00 30 31 00 00 7B 41 C5 42 06 00 00 00
11 3B 00 00 94 3E 00 00 00 00 0C 31 90 FF 0B 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 0A 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 09 00
03 00 1D 25 A6 31 0B 00 01 00 A5 25 90 FF BC 36 0A 00 7E FF
02 00 00 00 30 35 00 00 7B 41 C5 42 06 00 00 00 11 3B 00 00
94 3E 00 00 00 00 0C 31 90 FF 08 00 03 00 1D 25 A6 31 0B 00
01 00 A5 25 90 FF BC 36 0A 00 7E FF 02 00 00 00 30 43 00 00
7B 41 C5 42 06 00 00 00 11 3B 00 00 94 3E 00 00 00 00 0C 31
90 FF 07 00 03 00 1D 25 A6 31 0B 00 01 00 A5 25 90 FF BC 36
0A 00 7E FF 02 00 00 00 30 33 00 00 7B 41 C5 42 06 00 00 00
11 3B 00 00 94 3E 00 00 00 00 0C 31 90 FF 06 00 03 00 1D 25
A6 31 0B 00 01 00 A5 25 90 FF BC 36 0A 00 7E FF 02 00 00 00
30 30 00 00 7B 41 C5 42 06 00 00 00 11 3B 00 00 94 3E 00 00
00 00 0C 31 90 FF 05 00 03 00 1D 25 A6 31 0B 00 01 00 A5 25
90 FF BC 36 0A 00 7E FF 02 00 00 00 30 30 00 00 7B 41 C5 42
06 00 00 00 11 3B 00 00 94 3E 00 00 00 00 0C 31 90 FF 04 00
03 00 1D 25 A6 31 0B 00 01 00 A5 25 90 FF BC 36 0A 00 7E FF
02 00 00 00 30 30 00 00 7B 41 C5 42 06 00 00 00 11 3B 00 00
94 3E 00 00 00 00 0C 31 90 FF 03 00 03 00 1D 25 A6 31 0B 00
01 00 A5 25 90 FF 38 18 E2 01 EB 23 8E FF C7 35 14 00 FD 49
4F 18 D4 01 BC 36 0A 00 7E FF 02 00 00 00 30 31 00 00 7B 41
C5 42 06 00 00 00 11 3B 00 00 94 3E 00 00 00 00 0C 31 90 FF 0B 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 0A 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 09 00 03 00 1D 25 A6 31 0B 00 01 00 A5 25 90 FF
BC 36 0A 00 7E FF 02 00 00 00 30 35 00 00 7B 41 C5 42 06 00
00 00 11 3B 00 00 94 3E 00 00 00 00 0C 31 90 FF 08 00 03 00
1D 25 A6 31 0B 00 01 00 A5 25 90 FF BC 36 0A 00 7E FF 02 00
00 00 30 43 00 00 7B 41 C5 42 06 00 00 00 11 3B 00 00 94 3E
00 00 00 00 0C 31 90 FF 07 00 03 00 1D 25 A6 31 0B 00 01 00
A5 25 90 FF BC 36 0A 00 7E FF 02 00 00 00 30 46 00 00 7B 41
C5 42 06 00 00 00 11 3B 00 00 94 3E 00 00 00 00 0C 31 90 FF
06 00 03 00 1D 25 A6 31 0B 00 01 00 A5 25 90 FF BC 36 0A 00
7E FF 02 00 00 00 30 30 00 00 7B 41 C5 42 06 00 00 00 11 3B
00 00 94 3E 00 00 00 00 0C 31 90 FF 05 00 03 00 1D 25 A6 31
0B 00 01 00 A5 25 90 FF BC 36 0A 00 7E FF 02 00 00 00 30 30
00 00 7B 41 C5 42 06 00 00 00 11 3B 00 00 94 3E 00 00 00 00
0C 31 90 FF 04 00 03 00 1D 25 A6 31 0B 00 01 00 A5 25 90 FF
BC 36 0A 00 7E FF 02 00 00 00 30 30 00 00 7B 41 C5 42 06 00
00 00 11 3B 00 00 94 3E 00 00 00 00 0C 31 90 FF 03 00 03 00
1D 25 A6 31 0B 00 01 00 A5 25 90 FF A7 14 04 00 32 00 EA 27
14 00 00 00 00 00 08 00 00 00 00 00 00 00 10 00 00 00 02 00
00 00 90 FF 02 00 A0 FF 02 00 00 00 30 01 34 00 56 53 5F 56
45 52 53 49 4F 4E 5F 49 4E 46 4F 00 BD 04 EF FE 00 00 01 00
00 00 01 00 00 00 00 00 00 00 01 00 00 00 00 00 00 00 00 00
00 00 00 00 01 00 01 00 01 00 00 00 00 00 00 00 00 00 00 00
00 00 00 00 24 00 00 00 56 61 72 46 69 6C 65 49 6E 66 6F 00
14 00 04 00 54 72 61 6E 73 6C 61 74 69 6F 6E 00 09 08 E4 04
C4 00 00 00 53 74 72 69 6E 67 46 69 6C 65 49 6E 66 6F 00 00
B0 00 00 00 30 38 30 39 30 34 45 34 00 00 00 00 14 00 02 00
43 6F 6D 70 61 6E 79 4E 61 6D 65 00 20 00 00 00 18 00 05 00
50 72 6F 64 75 63 74 4E 61 6D 65 00 42 49 4E 31 00 00 00 00
18 00 05 00 46 69 6C 65 56 65 72 73 69 6F 6E 00 31 2E 30 30
00 00 00 00 1C 00 05 00 50 72 6F 64 75 63 74 56 65 72 73 69
6F 6E 00 00 31 2E 30 30 00 00 00 00 1C 00 06 00 49 6E 74 65
72 6E 61 6C 4E 61 6D 65 00 00 00 00 4F 5A 42 49 4E 00 00 00
24 00 0A 00 4F 72 69 67 69 6E 61 6C 46 69 6C 65 6E 61 6D 65
00 00 00 00 4F 5A 42 49 4E 2E 45 58 45 00 00 00 00 00 01 00
02 00 20 20 02 00 01 00 01 00 30 01 00 00 31 75 20 20 10 00
01 00 04 00 E8 02 00 00 32 75 00 00 00 00 00 00 00 00 00 00
00 00 00 00 28 00 00 00 20 00 00 00 40 00 00 00 01 00 04 00
00 00 00 00 80 02 00 00 00 00 00 00 00 00 00 00 00 00 00 00
00 00 00 00 00 00 00 00 00 00 80 00 00 80 00 00 00 80 80 00
80 00 00 00 80 00 80 00 80 80 00 00 80 80 80 00 C0 C0 C0 00
00 00 FF 00 00 FF 00 00 00 FF FF 00 FF 00 00 00 FF 00 FF 00
FF FF 00 00 FF FF FF 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00

08/561316

00 00 00 00 00 00 00 00 00 00 00 00 00 00 00 00 00 00 00 00 00
00 00 00 00 00 00 00 00 00 00 00 00 00 00 00 00 00 00 00 00 00
00 00 00 00 00 00 00 00 00 00 00 00 00 8F FF 07 70 00 00 00
00 00 00 00 00 00 00 8F FF FF FF 07 77 70 00 00 00 00 00 00
08 FF FF FF FF FF FF 07 77 77 70 00 00 00 00 FF FF FF FF FF
FF FF FF 07 77 70 00 00 00 00 00 FF FF FF FF FF FF FF FF 07
70 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF FF FF 00 00 00 00 00 00 00 00 FF FF FF FF FF
FF FF FF 00 00 00 00 00 00 00 00 FF FF FF FF FF FF FF FF 00
00 00 00 00 00 00 00 FF FF FF FF FF FF FF FF 00 00 00 00 00
00 00 00 FF FF FF FF FF FF FF FF 00 00 00 00 00 00 00 00 FF
FF FF FF FF FF 88 88 00 00 00 00 00 00 00 00 FF FF FF FF 88
88 00 00 00 00 00 00 00 00 00 00 FF FF 88 88 00 00 EE EE 00
00 00 00 00 00 00 00 88 88 00 00 EE EE 00 00 00 00 00 00 00
00 00 00 00 00 EE EE 00 00 00 00 00 00 00 00 00 00 00 EE
EE 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
00 00 00 00 00 00 00 00 00 00 00 00 00 00 00 00 00 00 00 00
FF FF FF FF FF FF FF FF FF FF FF FF FF FF FF FF FF FF FF FF
FF FF C1 FF FF FC 00 7F FF 80 00 1F F8 00 00 07 F8 00 00 1F
F8 00 00 7F F8 00 01 FF F8 00 01 FF F8 00 01 FF F8 00 01 FF
F8 00 01 FF F8 00 01 FF F8 00 01 FF F8 00 01 FF F8 00 01 FF
F8 00 01 FF F8 00 01 FF F8 00 3F FF F8 03 FF FF F8 3F FF FF
FB FF FF FF FF FF FF FF FF FF FF FF FF FF FF FF FF FF FF FF
FF FF FF FF FF FF FF FF 00 00 00 00 00 00 00 00 28 00 00 00
20 00 00 00 40 00 00 00 01 00 01 00 00 00 00 00 00 01 00 00
00 00 00 00 00 00 00 00 00 00 00 00 00 00 00 00 00 00 00 00
FF FF FF 00 FF FF FF FF FF FF FF FF FF FF FF FF FF FF FF FF
FF FF FF FF FF FF C1 FF FF FC 3C 7F FF C3 FC 1F F8 3F FC 07
FB FF FC 1F FB FF FC 7F FB FF FD FF FB FF FD FF FB FF FD FF
FB FF FD FF FB FF FD FF FB FF FD FF FB FF FD FF FB FF FD FF
FB FF C1 FF FB FC 3D FF FB C3 C1 FF F8 3C 3F FF FB C3 FF FF
F8 3F FF FF FB FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF C1 FF FF FC 00 7F
FF C0 00 1F F8 00 00 07 F8 00 00 1F F8 00 00 7F F8 00 01 FF
F8 00 01 FF F8 00 01 FF F8 00 01 FF F8 00 01 FF F8 00 01 FF
F8 00 01 FF F8 00 01 FF F8 00 01 FF F8 00 01 FF F8 00 01 FF
F8 00 3F FF F8 03 FF FF F8 3F FF FF FB FF FF FF FF FF FF FF
FF FF FF FF FF FF FF FF FF FF FF FF FF FF FF FF FF FF FF FF
10 00 00 00 67 CB 75 1A A3 F5 1C 10 8B 7B 9A F8 C4 8E 68 E6
00 00 00 00 00 00 00 00 00 00 00 00 10 00 00 00 65 CB 75 1A
A3 F5 1C 10 8B 7B 9A F8 C4 8E 68 E6 00 00 00 00 00 00 00 00
00 00 00 00 53 4C 54 47 04 00 09 00 23 00 01 00 FF 04 02 00

00 00 00 00 C0 00 00 00 00 00 00 46 34 00 00 00 00 00 FF FF
0D 01 00 00 18 00 02 00 DD 00 00 00 0D 00 03 00 BA 04 00 00
09 00 00 00 01 43 6F 6D 70 4F 62 6A 00 64 69 72 00 31 35 62
34 34 32 34 36 32 38 00 31 34 62 34 34 32 34 36 32 38 00 00
00 00 00 00 00 00 00 00 01 05 22 00 00 00 FF FF FF FF 84 00
00 00 FF FF FF FF 01 00 00 00 00 00 FC FF 82 00 02 03 28 00
00 00 DF 00 FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF 08 00 00 00 01 00 02 80 FF FF
00 00 FF FF 01 00 00 00 00 08 00 2A 5C 52 65 32 2A 23 34 DF
05 00 FF FF 01 4A 00 00 00 4A 00 FF FF FF FF 00 80 12 00 00
00 02 40 FE FF FF FF 1D 00 00 00 4C 12 2C 00 2A 00 9A 00 03
60 FE FF FF FF FF FF 01 80 19 00 1C 00 4C 12 FF FF 40 00 B0
00 03 60 FE FF FF FF FF FF 01 80 19 00 20 00 16 00 FF FF 2C
00 FF FF 02 00 00 00 01 00 00 00 16 00 FF FF 00 00 2C 00 FF
FF 00 00 FF FF FF FF 00 00 00 00 00 00 00 00 04 00 01 00 00
00 00 00 24 00 FF FF FF FF FF FF FF FF 04 00 42 00 01 05 22
00 00 00 FF FF FF FF 84 00 00 00 FF FF FF FF 01 00 00 00 00
00 FC FF 82 00 02 03 28 00 00 00 DF 00 FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF 08
00 00 00 01 00 02 80 FF FF 00 00 FF FF 01 00 00 00 00 08 00
2A 5C 52 65 32 2A 23 34 DF 05 00 FF FF 01 1A 00 00 00 4A 00
FF FF FF FF 00 80 12 00 00 00 02 40 FE FF FF FF 1D 00 00 00
FF FF FF FF 00 00 00 00 01 00 00 00 FF FF FF FF 00 00 FF FF
FF FF 00 00 FF FF FF FF 00 00 00 00 00 00 00 00 04 00 01 00
00 00 00 00 1C 00 FF FF FF FF FF FF FF FF 01 00 16 00 CC 51
04 00 00 00 FF FF FF FF FF FF 00 00 00 00 00 00 09 04 00 00
01 00 00 00 01 00 00 00 00 00 00 00 00 00 00 00 00 00 00 00
00 00 00 00 FF FF FF FF FF FF FF FF FF FF FF FF FF FF FF FF
00 00 FF FF 01 00 FF FF FF FF FF FF FF FF FF FF FF FF FF FF
FF FF FF FF FF FF FF FF FF FF FF FF FF FF FF FF FF FF FF FF
FF FF FF FF FF FF FF FF 02 00 0A 00 31 34 62 34 34 32 34 36
32 38 0A 00 31 31 62 34 34 32 34 36 32 37 FF FF 0E 00 00 00
FF FF 00 00 00 00 FF FF 65 CB 75 1A A3 F5 1C 10 8B 7B 9A F8
C4 8E 68 E6 04 00 0A 00 31 35 62 34 34 32 34 36 32 38 0A 00
31 33 62 34 34 32 34 36 32 37 FF FF 1C 00 00 00 FF FF 00 00
00 00 FF FF 67 CB 75 1A A3 F5 1C 10 8B 7B 9A F8 C4 8E 68 E6
04 00 EA 00 00 00 00 00 00 00 00 00 00 02 01 20 02 00 00 FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF FF FF FF FF FF FF FF FF FF FF FF FF FF FF FF FF FF
FF FF FF E2 00 FF FF FF FF FF FF FF FF FF FF FF FF FF FF FF
FF FF FF FF FF FF FF FF FF FF FF FF FF FF FF FF 40 00 FF FF FF
FF FF FF FF FF FF FF FF FF FF FF FF FF FF FF FF FF FF FF FF
FF FF FF FF FF FF FF FF FF FF FF FF FF FF FF FF FF FF FF FF

FF FF FF FF FF FF FF FF FF FF FF FF FF 9A 00 FF FF FF FF FF
FF FF FF FF FF FF FF FF FF FF FF FF FF FF FF FF FF FF FF FF 56
00 FF FF FF FF 70 00 FF FF FF FF FF FF FF FF FF FF FF FF FF FF FF
FF D2 00 FF FF FF FF FF FF FF FF FF FF FF FF FF FF FF FF FF FF FF
FF FF FF FF FF FF FF FF FF FF FF FF FF FF FF FF FF FF FF FF FF FF
FF FF FF 2A 00 FF FF 0E 00 1C 00 FF FF FF FF FF FF FF FF FF FF
FF FF FF FF FF FF FF FF FF FF FF FF FF FF FF FF FF FF FF FF FF FF
FF FF FF FF FF FF FF FF FF FF FF FF FF FF FF FF FF FF FF FF FF FF
FF FF FF FF FF FF FF 00 00 FF FF FF FF FF FF FF FF FF FF FF FF
FF FF FF FF FF FF FF FF FF FF FF FF FF FF FF FF FF FF FF FF FF FF
FF C2 00 FF FF FF FF FF FF FF FF FF FF FF FF FF FF FF FF FF AA
00 FF FF FF FF FF FF FF FF FF FF FF FF FF FF FF FF FF FF FF FF FF
FF FF FF FF FF FF FF FF FF FF FF FF FF FF FF FF FF FF FF FF FF FF
FF FF FF FF FF 84 00 FF FF FF FF FF FF FF FF FF FF FF FF FF FF
FF FF FF FF FF FF FF FF FF FF FF FF FF FF FF FF FF FF FF FF FF FF
FF FF FF FF FF FF FF FF FF FF FF FF FF FF FF FF FF FF FF FF FF FF
FF FF FF FF FF FF FF FF FF FF FF FF FF FF FF FF FF FF FF FF FF FF
FF FF FF FF FF FF FF FF FF FF FF FF 20 00 FF FF 67 3D 38 2F 67
3D 1A 24 67 3D 84 20 67 3D 90 21 67 3D 46 92 97 0A DE 94 97
0A 44 99 00 00 FF FF 01 46 01 00 00 A4 D9 FF FF FF FF C0 FF
42 49 4E 31 00 00 86 1B FF FF FF FF E2 FF 46 6F 72 6D 31 00
87 1B FF FF FF FF E2 FF 46 6F 72 6D 32 00 84 F5 FF FF FF FF
20 00 53 54 41 52 54 5F 50 4C 41 59 49 4E 47 00 3A 10 FF FF
FF FF 20 00 73 74 6F 70 5F 70 6C 61 79 69 6E 67 00 69 64 6D
FF FF FF FF 28 00 47 65 74 54 79 70 65 49 6E 66 6F 43 6F 75
6E 74 00 00 67 50 FF FF FF FF 28 00 47 65 74 54 79 70 65 49
6E 66 6F 00 D5 11 FF FF FF FF 28 00 47 65 74 49 44 73 4F 66
4E 61 6D 65 73 00 57 F8 FF FF FF FF 28 00 49 6E 76 6F 6B 65
00 00 BE 8E FF FF FF FF 28 00 51 75 65 72 79 49 6E 74 65 72
66 61 63 65 00 00 B5 B8 FF FF FF FF 28 00 41 64 64 52 65 66
00 00 6F 61 FF FF FF FF 28 00 52 65 6C 65 61 73 65 00 2A 60
FF FF FF FF C0 FF 2A 5C 47 7B 30 30 30 32 30 34 33 30 2D 30
30 30 30 2D 30 30 30 30 2D 43 30 30 30 2D 30 30 30 30 30 30
30 30 30 30 34 36 7D 23 31 2E 30 23 30 23 43 3A 5C 57 49 4E
44 4F 57 53 5C 53 59 53 54 45 4D 5C 73 74 64 6F 6C 65 2E 74
6C 62 23 4F 4C 45 20 41 75 74 6F 6D 61 74 69 6F 6E 00 01 18
00 01 20 00 00 00 FF FF FF FF FF FF FF FF FF FF FF FF 0F 00
00 00 FF FF 1D 00 01 00 FF FF 08 00 FF FF 1C D3 10 00 02 00
FF FF 04 00 00 00 01 00 24 00 00 00 10 00 00 00 00 00 20 44
00 00 A0 00 90 80 00 00 01 00 00 00 00 00 00 00 20 40 00 00
A0 00 90 80 00 00 01 00 01 00 FE FF 03 0A 00 00 FF FF FF FF
FF 04 02 00 00 00 00 00 C0 00 00 00 00 00 00 46 08 00 00 00
54 59 50 45 4C 49 42 00 FF FF FF FF 00 02 00 00 00 00 00 00

We claim:

1. Wireless computer controlled toy apparatus comprising:

a computer assembly including a first wireless transmitter and a first wireless receiver, said computer assembly being operative to command the at least one toy to perform an operation by transmitting a first transmission via the first wireless transmitter; and at least one toy comprising a second wireless receiver and a second wireless transmitter, said toy receiving said first transmission via said second wireless receiver and being operative to perform said operation and to provide said computer assembly with feedback pertaining to performance of the operation by transmitting a second transmission via the second wireless transmitter to the computer assembly's first wireless receiver, and wherein at least one subsequent transmission by the computer assembly to the at least one toy at least partly depends on said second transmission.

2. A system according to claim 1 wherein the computer assembly comprises computer game software.

3. A system according to claim 2 wherein the first transmission comprises a control command chosen from a plurality of available control commands based, at least in part, on a result of operation of the computer game.

4. Apparatus according to claim 1 wherein said first transmission includes voice information and toy control information and wherein said first transmission is transmitted from the computer assembly to the at least one toy via a first channel including a single wireless transmitter, and wherein said toy comprises a microcontroller operative to differentiate between said voice information and said toy control information.

5. Apparatus according to claim 1 wherein said computer assembly comprises a general purpose household computer.

6. A system according to claim 1 wherein said operation comprises movement of the toy.

7. A system according to claim 1 wherein said operation comprises movement of a part of the toy.

8. A system according to claim 1 wherein said operation comprises output of a sound.

9. A system according to claim 8 wherein the sound comprises music.

10. A system according to claim 8 wherein the sound comprises a pre-recorded sound.

11. A system according to claim 8 wherein the sound comprises speech.

12. A system according to claim 11 wherein the speech comprises recorded speech.

13. A system according to claim 11 wherein the speech comprises synthesized speech.

14. A system according to claim 8 wherein the sound is transmitted using a MIDI protocol.

15. A system according to claim 1 wherein the first transmission comprises a digital signal.

16. A system according to claim 15 wherein the computer assembly comprises a computer having a MIDI port and wherein the computer is operative to transmit the digital signal by way of the MIDI port.

17. A system according to claim 1 wherein the first transmission comprises an analog signal.

18. A system according to claim 17 wherein the analog signal comprises sound.

19. A system according to claim 1 wherein the at least one toy has a plurality of states comprising at least a sleep state and an awake state, and wherein the first transmission comprises a state transition command, and wherein the at least one action comprises transitioning between the sleep state and the awake state.

20. A system according to claim 1 wherein the at least one toy comprises a plurality of toys.

21. A system according to claim 1 wherein the second transmission comprises toy identification data, and wherein the computer system is operative to identify the at least one toy based, at least in part, on the toy identification data.

22. A system according to claim 21 wherein the computer system is operative to adapt a mode of operation thereof based, at least in part, on the toy identification data.

23. A system according to claim 21 wherein the first transmission comprises toy identification data.

24. A system according to claim 1 wherein said operation comprises a plurality of actions.

25. A system according to claim 1 wherein the at least one toy comprises sound input apparatus, wherein the second transmission comprises a sound signal which represents a sound input via the sound input apparatus.

26. A system according to claim 25 wherein the sound comprises speech, wherein the computer assembly is operative to perform a speech recognition operation on the speech.

27. A system according to claim 25 wherein the computer system is operative to record the sound signal.

28. A system according to claim 27 wherein the computer system is also operative to perform at least one of the following actions: manipulate the sound signal; and play the sound signal.

29. A system according to claim 1 wherein the computer assembly comprises a plurality of computers.

30. A method according to claim 29 wherein the first transmission comprises computer identification data.

31. A method according to claim 29 wherein the second transmission comprises computer identification data.

32. A system according to claim 1 and also comprising at least one input device and wherein said second transmission includes a status of said at least one input device.

33. A system according to claim 1 wherein the at least one toy comprises at least a first toy and a second toy, and wherein the first toy is operative to transmit a toy-to-toy transmission to the second toy via said second wireless transmitter, and wherein the second toy is operative to carry out at least one action based on said toy-to-toy transmission.

34. Apparatus according to claim 1 and wherein:

said first transmission comprises a toy identifier, a command and voice information;

said at least one toy comprises a plurality of toys each comprising a second wireless receiver, each toy receiving said first transmission via its second wireless receiver, each toy being operative to carry out at least one action based on said transmission if and only if the toy identifier specifies that toy;

at least one toy from among said plurality of toys also includes a second wireless transmitter operative to transmit a second transmission to said first wireless receiver; and transmissions sent by the computer assembly subsequent to said second transmission depend at least in part on said second transmission.

35. Apparatus according to claim 34 wherein said command comprises a command to the toy to transmit voice information to the computer assembly and wherein said first transmission also comprises an indication of a transmission cessation time at which transmission of voice information is to terminate and wherein each toy is operative to transmit voice information to the computer assembly until said transmission cessation time if and only if the toy identifier specifies that toy.

36. Apparatus according to claim 34 wherein said second transmission is at least partly determined by an interaction of a user with said at least one toy and wherein said second transmission also comprises a toy identifier.

37. Apparatus according to claim 34 wherein said first transmission is transmitted from the computer assembly to the at least one toy via a first channel including no wireless transmitters other than said first wireless transmitter, and wherein each toy comprises a microcontroller operative to differentiate between said voice information and said command.

* * * * *